US010681980B2

(12) United States Patent
Martin et al.

(10) Patent No.: US 10,681,980 B2
(45) **Date of Patent: *Jun. 16, 2020**

(54) FRAME TYPE WORKSTATION CONFIGURATIONS

(71) Applicant: Steelcase Inc., Grand Rapids, MI (US)

(72) Inventors: Kirt Martin, Ada, MI (US); David C. Eberlein, Hudsonville, MI (US); Fredric Biddle, Kalamazoo, MI (US)

(73) Assignee: STEELCASE INC., Grand Rapids, MI (US)

( * ) Notice: Subject to any disclaimer, the term of this patent is extended or adjusted under 35 U.S.C. 154(b) by 111 days.

This patent is subject to a terminal disclaimer.

(21) Appl. No.: 15/875,229

(22) Filed: Jan. 19, 2018

(65) Prior Publication Data

US 2018/0140091 A1 May 24, 2018

Related U.S. Application Data

(63) Continuation of application No. 14/816,658, filed on Aug. 3, 2015, now abandoned, which is a (Continued)

(51) Int. Cl.
*A47B 85/06* (2006.01)
*A47B 9/00* (2006.01)
(Continued)

(52) U.S. Cl.
CPC ..... *A47B 85/06* (2013.01); *A47B 9/00* (2013.01); *A47B 13/02* (2013.01); *A47B 13/081* (2013.01);
(Continued)

(58) Field of Classification Search
CPC ..... A47B 2021/06; A47B 2021/062; A47B 2021/064; A47B 2021/066; A47B 21/06;
(Continued)

(56) References Cited

U.S. PATENT DOCUMENTS 8,934 A 5/1852 Betts
99,246 A 1/1870 Shannon
(Continued)

FOREIGN PATENT DOCUMENTS

CA 2240373 A1 12/1999
CN 1170554 A 1/1998
(Continued)

OTHER PUBLICATIONS

PCT International Search Report, PCT/US2008/064457, dated Jan. 29, 2009.
(Continued)

*Primary Examiner* — Daniel J Troy
*Assistant Examiner* — Timothy M Ayres
(74) *Attorney, Agent, or Firm* — Quarles & Brady LLP

(57) ABSTRACT

A furniture assembly comprising a first frame structure having front and rear portions and including at least a first leg member and a substantially horizontal first rail member supported by the at least a first leg member where the first rail member has a first length dimension, a substantially horizontal second rail member supported by the at least a second leg member spaced apart from the first rail member wherein an assembly space includes the space between the first and second rail members, a front portion of the assembly space adjacent the front portion of the first frame structure and a rear portion of the assembly space adjacent the rear portion of the first frame structure, a first furniture sub-assembly having first and second ends, having a first depth dimension and supported within the assembly space by the first and second rail members and a second furniture sub-assembly having first and second ends, a second depth dimension and supported within the assembly space by the first rail member and a rail member of another frame
(Continued)

structure, wherein the combined first and second depth dimensions are less than the first length dimension.

20 Claims, 124 Drawing Sheets

Related U.S. Application Data continuation of application No. 13/481,194, filed on May 25, 2012, now Pat. No. 9,185,974, which is a continuation-in-part of application No. 13/092,703, filed on Apr. 22, 2011, now Pat. No. 8,667,908, and a continuation of application No. 14/934,426, filed on Nov. 6, 2015, now abandoned, which is a continuation of application No. 13/092,504, filed on Apr. 22, 2011, now Pat. No. 9,210,999.

(60) Provisional application No. 61/350,736, filed on Jun. 2, 2010.

(51) Int. Cl.

| | |
|---|---|
| ***A47B 13/02*** | (2006.01) |
| ***A47B 83/00*** | (2006.01) |
| ***A47B 83/04*** | (2006.01) |
| ***A47B 13/08*** | (2006.01) |
| ***A47B 13/16*** | (2006.01) |
| ***A47B 21/06*** | (2006.01) |
| *A47B 83/02* | (2006.01) |

(52) U.S. Cl.

CPC ..... *A47B 13/088* (2013.01); *A47B 13/16* (2013.01); *A47B 21/06* (2013.01); *A47B 83/001* (2013.01); *A47B 83/04* (2013.01); *A47B 2009/006* (2013.01); *A47B 2083/025* (2013.01)

(58) Field of Classification Search

CPC ..... A47B 13/003; A47B 13/021; A47B 13/08; A47B 13/081; A47B 83/001; A47B 83/04; A47B 87/002; A47B 2200/0016; A47B 2083/003; A47B 2083/005; A47B 2083/006; A47B 85/06; A47B 9/00; A47B 13/02; A47B 13/088; A47B 13/16; A47B 83/02; A47B 2009/006; A47B 2083/025; E04B 2/7401

USPC ..... 108/11, 12, 59–65, 50.02, 155, 152, 108/137–143; 312/194–203, 223.6; 248/451–453

See application file for complete search history.

(56) References Cited

U.S. PATENT DOCUMENTS

| | | | |
|---|---|---|---|
| 114,515 | A | 5/1871 | Beek |
| 285,995 | A | 10/1883 | Gesking |
| 327,413 | A | 9/1885 | Rohrbach |
| 418,084 | A | 12/1889 | Swinnerton |
| 443,108 | A | 12/1890 | Owen |
| 451,599 | A | 5/1891 | Meigs |
| 452,971 | A | 5/1891 | Kidder |
| 501,935 | A | 7/1893 | Harsha |
| 543,053 | A | 7/1895 | Ripking |
| 571,652 | A | 11/1896 | Dodd |
| 604,215 | A | 5/1898 | Quarry |
| 636,548 | A | 11/1899 | Owen |
| 654,922 | A | 7/1900 | Schipkowsky |
| 658,983 | A | 10/1900 | Francis |
| 659,987 | A | 10/1900 | Ray |
| 688,104 | A | 12/1901 | Lohrman |
| 698,558 | A | 4/1902 | Rosenbaum |
| 710,376 | A | 9/1902 | Smith |
| 794,809 | A | 7/1905 | Marsh |
| 795,957 | A | 8/1905 | Cartland |
| 859,987 | A | 7/1907 | Smith |
| 860,150 | A | 7/1907 | Plym |
| 907,507 | A | 12/1908 | Kerr |
| 978,299 | A | 12/1910 | Jacobs |
| 983,903 | A | 2/1911 | Horton |
| 1,014,848 | A | 1/1912 | Reinert |
| 1,050,409 | A | 1/1913 | Wadsworth et al. |
| 1,201,305 | A | 10/1916 | Jones |
| 1,251,719 | A | 2/1918 | Wege |
| 1,258,773 | A | 3/1918 | Hoffmann et al. |
| 1,277,550 | A | 9/1918 | Connell |
| 1,340,562 | A | 5/1920 | Sandmann |
| 1,386,469 | A | 8/1921 | Gomoll |
| 1,395,166 | A | 10/1921 | Tomlinson |
| 1,398,611 | A | 11/1921 | Van Alstyn |
| 1,411,260 | A | 4/1922 | Baker et al. |
| 1,421,929 | A | 7/1922 | Floreskul |
| 1,448,642 | A | 3/1923 | Tomlinson |
| 1,454,467 | A | 5/1923 | Crooks |
| 1,514,512 | A | 11/1924 | Fisher |
| 1,527,094 | A | 2/1925 | Tomlinson |
| 1,542,693 | A | 6/1925 | Gordon |
| 1,547,301 | A | 7/1925 | Cordes |
| 1,638,612 | A | 8/1927 | Baus |
| 1,643,101 | A | 9/1927 | Thompson |
| 1,656,868 | A | 1/1928 | Davis et al. |
| 1,696,456 | A | 12/1928 | Sebring |
| 1,706,388 | A | 3/1929 | Ashkenas |
| 1,766,077 | A | 6/1930 | Jensen |
| 1,770,167 | A | 9/1930 | Hoyer, Jr. et al. |
| 1,780,118 | A | 10/1930 | D'Humy |
| 1,785,463 | A | 12/1930 | Strongson |
| 1,786,823 | A | 12/1930 | Carrington et al. |
| 1,792,406 | A | 2/1931 | Tomlinson |
| 1,800,685 | A | 4/1931 | Griffis |
| 1,810,618 | A | 6/1931 | Nelson |
| 1,831,162 | A | 11/1931 | Crowell |
| 1,845,142 | A | 2/1932 | Friesner |
| 1,852,749 | A | 4/1932 | Hiner |
| 1,854,248 | A | 4/1932 | Cairney |
| 1,963,393 | A | 6/1934 | Woodall |
| 1,965,785 | A | 7/1934 | Vallone |
| 1,992,574 | A | 2/1935 | Jenkins |
| D95,588 | S | 5/1935 | Holsman |
| 2,002,128 | A | 5/1935 | Reidenbaugh |
| 2,005,593 | A | 6/1935 | Onions et al. |
| 2,017,844 | A | 10/1935 | Ferney |
| 2,018,250 | A | 10/1935 | Cohan |
| 2,031,848 | A | 2/1936 | Ogden |
| 2,056,356 | A | 10/1936 | Logan |
| 2,089,059 | A | 8/1937 | Harley |
| 2,110,466 | A | 3/1938 | Louis |
| 2,115,239 | A | 4/1938 | Strain |
| 2,118,099 | A | 5/1938 | Mirk |
| 2,119,319 | A | 5/1938 | D'Esopo |
| 2,156,633 | A | 5/1939 | La Ducer |
| 2,179,395 | A | 11/1939 | Yerrick |
| 2,182,703 | A | 12/1939 | Rainwater |
| 2,189,389 | A | 2/1940 | Baker |
| 2,191,701 | A | 2/1940 | Wood |
| 2,201,435 | A | 5/1940 | Guyton |
| 2,202,476 | A | 5/1940 | Baker |
| 2,202,684 | A | 5/1940 | Baker |
| 2,223,023 | A | 11/1940 | Weilemann |
| 2,240,484 | A | 5/1941 | Anderson |
| 2,276,635 | A | 3/1942 | Weber |
| 2,287,079 | A | 6/1942 | Anderson |
| 2,299,443 | A | 10/1942 | Walmsley |
| 2,345,913 | A | 4/1944 | Bishop |
| 2,359,109 | A | 9/1944 | Hormes |
| 2,362,567 | A | 11/1944 | La Rue |
| 2,380,379 | A | 7/1945 | Attwood |
| D150,242 | S | 7/1948 | McDonald |
| 2,479,416 | A | 8/1949 | Schnurer |
| 2,497,278 | A | 2/1950 | Soderlund |
| 2,506,844 | A | 5/1950 | Smith |

(56) References Cited

U.S. PATENT DOCUMENTS 2,511,949 A 6/1950 Simon
2,522,149 A 9/1950 Tunstall
2,530,474 A 11/1950 Lutes
2,557,766 A 6/1951 Ronfeldt
2,570,000 A 10/1951 Lowry
2,605,203 A 7/1952 Silver
2,620,024 A 12/1952 Rietman
2,640,644 A 6/1953 Hennessey et al.
2,664,331 A 12/1953 Glotfelter
2,675,863 A 4/1954 Lee
2,683,639 A 7/1954 Brenny
2,735,519 A 2/1956 Frischmann
D177,215 S 3/1956 Collins
2,793,926 A 5/1957 Deaton
2,821,450 A 1/1958 Knoll
2,825,614 A 3/1958 Card
2,834,478 A 5/1958 Macdonald
2,840,243 A 6/1958 Brinker
2,845,187 A 7/1958 Bianchi
2,900,085 A 8/1959 Levy
2,903,316 A 9/1959 Schmidt
2,905,114 A 9/1959 Olson
2,921,607 A 1/1960 Caveney
2,930,665 A 3/1960 Budai
2,937,765 A 5/1960 Shank
2,942,924 A 6/1960 Stangert
2,944,861 A 7/1960 Lessin
2,963,031 A 12/1960 Carroll
2,965,161 A 12/1960 Knoll
2,975,908 A 3/1961 Huet
2,976,097 A 3/1961 Devine
2,981,583 A 4/1961 Eisenberg
2,988,412 A 6/1961 Vannice
2,993,603 A 7/1961 Fohn
3,000,682 A 9/1961 Loew et al.
3,001,755 A 9/1961 Doyle
3,017,153 A 1/1962 Johnson
3,027,212 A 3/1962 Pearson
3,027,214 A 3/1962 Curatolo
3,031,244 A 4/1962 Stopek
3,036,864 A 5/1962 Arai
3,041,109 A 6/1962 Eames
3,045,961 A 7/1962 Cygan
3,059,825 A 10/1962 Thomas
3,083,007 A 3/1963 Campfield
3,098,239 A 7/1963 Nader
3,117,534 A 1/1964 Martland
3,127,216 A 3/1964 Clouse
3,167,352 A 1/1965 Johnson
3,170,742 A 2/1965 Berkowitz
3,172,711 A 3/1965 Gillotte
3,180,459 A 4/1965 Liskey, Jr.
3,181,923 A 5/1965 Guillon
3,189,140 A 6/1965 Luss
3,197,822 A 8/1965 Herrschaft
3,200,962 A 8/1965 Davelaar
3,213,580 A 10/1965 Mark
3,217,673 A 11/1965 Knoblock
3,233,942 A 2/1966 Creutz
3,235,218 A 2/1966 Graham
3,238,004 A 3/1966 Goebel
3,241,885 A 3/1966 Deaton
3,249,351 A 5/1966 Smith
3,252,469 A 5/1966 Peake
3,255,467 A 6/1966 Kowalski
3,284,974 A 11/1966 Stein
3,289,676 A 12/1966 Saunders
3,295,764 A 1/1967 Geary
3,298,743 A 1/1967 Albinson
3,301,597 A 1/1967 Bereday
3,321,253 A 5/1967 Everburg
3,326,147 A 6/1967 Toney
3,339,502 A 9/1967 Fyffe
3,364,882 A 1/1968 Merrick
3,367,290 A 2/1968 Barecki
3,370,389 A 2/1968 Macaluso
3,388,711 A 6/1968 Huddle
3,404,930 A 10/1968 Cafiero
3,406,645 A 10/1968 Monroe
3,413,053 A 11/1968 Featherston
3,425,108 A 2/1969 Cerutti et al.
3,428,108 A 2/1969 Singer
3,428,688 A 4/1969 Ferdinand et al.
3,437,737 A 4/1969 Wagner
3,438,687 A 4/1969 Wikey
3,441,146 A 4/1969 Summers
3,456,833 A 7/1969 Cornelius
3,464,372 A 9/1969 Fiterman et al.
3,475,769 A 11/1969 Fasanella
3,489,290 A 1/1970 Larson
3,490,824 A 1/1970 Bartlett et al.
3,497,081 A 2/1970 Field
3,497,279 A 2/1970 Chovanec
3,498,239 A 3/1970 Bartlett et al.
3,511,193 A 5/1970 Schild
3,514,170 A 5/1970 Shewchuk
3,517,822 A 6/1970 Wagner
3,517,963 A 6/1970 Woods et al.
3,521,579 A 7/1970 Stafford
3,528,559 A 9/1970 Miller
3,529,880 A 9/1970 Christen
3,552,579 A 1/1971 Simon et al.
3,556,586 A 1/1971 Beardmore
3,563,624 A 2/1971 Stice
3,565,152 A 2/1971 Cohn, Jr. et al.
3,566,566 A 3/1971 Janic
3,570,682 A 3/1971 Elliott
3,570,798 A 3/1971 Squibb
3,572,874 A 3/1971 Hassel
3,574,434 A 4/1971 Propst
3,575,465 A 4/1971 Dolby et al.
3,584,348 A 6/1971 Soltysik
3,584,417 A 6/1971 Gatton et al.
3,591,233 A 7/1971 Turcksin
3,596,297 A 8/1971 James
3,601,825 A 8/1971 Moorhead et al.
3,601,912 A 8/1971 Dubbs
3,605,650 A 9/1971 Hebel et al.
3,608,959 A 9/1971 Sarvas
3,612,289 A 10/1971 Zink
3,619,004 A 11/1971 McKernan et al.
3,620,376 A 11/1971 Gingher
3,626,647 A 12/1971 Guzelimian
3,635,174 A * 1/1972 Ball ..... A47B 21/06
108/150
3,636,661 A 1/1972 Strawsine
3,640,445 A 2/1972 Durham
3,643,608 A 2/1972 DeCesaris
3,654,382 A 4/1972 Rubright
3,655,065 A 4/1972 Yellin
3,655,253 A 4/1972 Deeds et al.
3,663,059 A 5/1972 Omlie
3,667,803 A 6/1972 Ford
3,674,068 A 7/1972 Lucci
3,680,942 A 8/1972 Davis
3,682,523 A 8/1972 Esposito
3,687,092 A 8/1972 Manning
3,688,707 A 9/1972 White
3,693,923 A 9/1972 Ayoub et al.
3,695,649 A 10/1972 Laverone
3,700,282 A 10/1972 Rowland
3,712,698 A 1/1973 Propst et al.
3,713,257 A 1/1973 Beavers
3,713,474 A 1/1973 Orlando
3,724,792 A 4/1973 Thalenfeld
3,730,601 A 5/1973 Misenheimer, III
3,736,035 A 5/1973 Brown et al.
3,736,602 A 6/1973 Miller
3,741,450 A 6/1973 Seastrom
3,741,852 A 6/1973 Keener
3,743,332 A 7/1973 Sonolet
3,745,936 A 7/1973 Bennett
3,748,006 A 7/1973 Levit et al.
3,749,299 A 7/1973 Ingle

(56) References Cited

U.S. PATENT DOCUMENTS 3,756,116 A 9/1973 Schuplin
3,758,182 A 9/1973 Barecki et al.
3,761,971 A 10/1973 Behnke
3,774,966 A 11/1973 Faulkner et al.
3,778,175 A 12/1973 Zimmer
3,786,765 A 1/1974 Burr
3,786,932 A 1/1974 Smith
3,790,241 A 2/1974 Messina
3,797,790 A 3/1974 Iseki
3,806,220 A 4/1974 Payne
3,808,607 A 5/1974 Harder
3,810,430 A 5/1974 Siegal
3,811,728 A 5/1974 Redemske
D231,880 S 6/1974 Weinstock
3,814,034 A 6/1974 Seiz
3,827,377 A 8/1974 Aughtry, Jr.
3,830,168 A 8/1974 Crete
3,831,533 A 8/1974 Kellogg
3,835,795 A 9/1974 Levenberg
3,838,902 A 10/1974 Tenani
3,841,725 A 10/1974 Dorner
3,845,985 A 11/1974 Behrend et al.
3,848,388 A 11/1974 Bretche
3,851,936 A 12/1974 Muller
3,851,981 A 12/1974 Corsi
3,852,916 A 12/1974 Laby
3,857,622 A 12/1974 Mohr et al.
3,865,429 A 2/1975 Barker
3,871,153 A 3/1975 Birum, Jr.
3,871,726 A 3/1975 Stegner
D234,988 S 4/1975 Lopez-Benitez
3,875,711 A 4/1975 Palmer
3,877,764 A 4/1975 Hillier, Jr.
3,881,428 A 5/1975 Klecki
3,883,196 A 5/1975 Mohr
3,883,202 A * 5/1975 Konig ..... A47B 17/00 312/223.6
3,890,495 A 6/1975 Bauer
3,892,189 A 7/1975 Killam
3,901,612 A 8/1975 Canin
3,910,659 A 10/1975 Peterson
3,913,498 A 10/1975 Hall
3,915,189 A 10/1975 Holbrook
3,916,972 A 11/1975 Breiner
3,922,045 A 11/1975 Meyer
3,927,481 A 12/1975 Safranek
3,944,283 A 3/1976 Molzon
3,945,742 A 3/1976 Condevaux
D239,424 S 4/1976 Offredi
3,964,401 A 6/1976 Gutmann, Jr. et al.
3,966,158 A 6/1976 Boundy
3,966,338 A 6/1976 Ghyczy
3,973,800 A 8/1976 Kogan
3,974,782 A 8/1976 Ruckriegel
3,974,917 A 8/1976 Waxmanski
3,978,554 A 9/1976 Miller, Jr.
3,984,884 A 10/1976 Spitz
3,990,741 A 11/1976 Snyder
4,009,796 A 3/1977 Schmidt
4,018,167 A 4/1977 Spangler
4,021,087 A 5/1977 Ferguson
4,022,136 A 5/1977 Schott
4,026,508 A 5/1977 Ziegler
4,029,024 A 6/1977 Klitzky
4,030,748 A 6/1977 Brock
4,032,188 A 6/1977 Jones
4,034,864 A 7/1977 Tyson
4,037,614 A 7/1977 Hines
4,040,588 A 8/1977 Papsco
4,046,417 A 9/1977 Beckley
4,049,230 A 9/1977 Minniear
4,049,331 A 9/1977 Gutmann, Jr.
4,050,752 A 9/1977 Dykstra
D245,950 S 10/1977 Mathur
4,053,192 A 10/1977 Spetner
4,053,701 A 10/1977 Ogilvie et al.
4,055,373 A 10/1977 Andresen et al.
4,056,196 A 11/1977 Brauning
4,059,248 A 11/1977 Kuntz
4,062,589 A 12/1977 Klein
RE29,522 E 1/1978 Barecki
4,066,305 A 1/1978 Gazarek
4,069,927 A 1/1978 Taylor
4,070,013 A 1/1978 Sickler
4,070,075 A 1/1978 Morgan
D247,595 S 3/1978 Corson et al.
4,077,335 A 3/1978 Luzzani
4,090,335 A 5/1978 Curatolo
4,094,256 A * 6/1978 Holper ..... A47B 21/06 108/33
4,094,561 A 6/1978 Wolff
4,106,736 A 8/1978 Becker, III
4,106,738 A 8/1978 Kostecky
4,108,086 A 8/1978 Yindra
4,109,328 A 8/1978 Mason
4,118,061 A 10/1978 Atkinson
4,118,084 A 10/1978 Sussman
4,118,903 A 10/1978 Coulthard
4,121,645 A 10/1978 Behr
4,125,787 A 11/1978 Ohhinata et al.
D250,922 S 1/1979 Adkinson
4,136,680 A 1/1979 Southworth
4,138,952 A 2/1979 Hodson
4,141,612 A 2/1979 Rowe
4,145,098 A 3/1979 Alexander
4,149,352 A 4/1979 Allen
4,156,515 A 5/1979 Mochly
4,158,936 A 6/1979 Fulton
D252,487 S 7/1979 Petersilie
4,161,254 A 7/1979 Taylor
4,162,113 A 7/1979 Pallavicini
4,163,572 A 8/1979 Benscoter
4,163,592 A 8/1979 Nelson
4,165,869 A 8/1979 Williams
4,165,902 A 8/1979 Ehrlich
4,166,195 A 8/1979 Schwab
4,185,430 A 1/1980 Gartung
4,186,533 A 2/1980 Jensen
4,186,666 A 2/1980 Honickman
4,188,066 A 2/1980 Terenzoni
4,192,562 A 3/1980 Bishoff
4,200,254 A 4/1980 Nelson
4,205,876 A 6/1980 Cetina
4,213,650 A 7/1980 Sroub
4,215,840 A 8/1980 Babberl
4,219,101 A 8/1980 Valsvik
D256,829 S 9/1980 Qui et al.
4,222,541 A 9/1980 Cillis
4,224,769 A 9/1980 Ball
4,227,758 A 10/1980 Clare
4,230,365 A 10/1980 Messinger
D257,603 S 12/1980 Cyplik
4,236,460 A 12/1980 Poupko
4,243,279 A 1/1981 Ackeret
4,258,856 A 3/1981 Marling
4,263,683 A 4/1981 Knoke
4,266,714 A 5/1981 Crane
4,272,136 A 6/1981 Sengua
4,281,602 A 8/1981 Lange
D260,826 S 9/1981 Steinberger
4,287,837 A 9/1981 Bayles
4,290,657 A 9/1981 Haas
4,291,999 A 9/1981 Vandelanoite
4,295,697 A * 10/1981 Grime ..... E04B 2/7425 439/215
4,296,981 A * 10/1981 Hildebrandt ..... A47B 21/06 312/194
4,297,952 A 11/1981 Zagaroli
4,298,291 A 11/1981 Ward, Jr.
4,311,101 A 1/1982 de Almagro
4,311,337 A 1/1982 Brunn
4,312,086 A 1/1982 Bianco
4,314,280 A 2/1982 Rose
4,318,353 A 3/1982 Schier

(56) References Cited

U.S. PATENT DOCUMENTS

| | | | |
|---|---|---|---|
| 4,320,935 | A | 3/1982 | Nagelkirk |
| D263,770 | S | 4/1982 | Melchior |
| 4,323,291 | A | 4/1982 | Ball |
| 4,324,076 | A | 4/1982 | Honickman |
| 4,325,597 | A | 4/1982 | Morrison |
| 4,334,483 | A | 6/1982 | Kellogg |
| 4,352,432 | A | 10/1982 | Smith |
| 4,353,661 | A | 10/1982 | Ruther |
| 4,372,629 | A | 2/1983 | Propst |
| 4,382,642 | A | 5/1983 | Burdick |
| 4,385,850 | A | 5/1983 | Bobath |
| D269,237 | S | 6/1983 | Burdick |
| 4,387,872 | A | 6/1983 | Hogue |
| 4,387,873 | A | 6/1983 | Pavlo |
| 4,393,915 | A | 7/1983 | Olson |
| 4,401,222 | A | 8/1983 | Kulikowski |
| 4,403,677 | A | 9/1983 | Messinger |
| 4,407,476 | A | 10/1983 | Bohannan |
| 4,418,967 | A | 12/1983 | Winkelman, Jr. et al. |
| 4,422,385 | A | 12/1983 | Rutsche |
| 4,423,913 | A | 1/1984 | Lee |
| 4,429,850 | A | 2/1984 | Weber |
| 4,429,934 | A | 2/1984 | VandenHoek |
| 4,437,278 | A | 3/1984 | Thomas, Jr. |
| 4,437,714 | A | 3/1984 | Struck |
| 4,450,775 | A | 5/1984 | Brendle |
| 4,455,102 | A | 6/1984 | Baroi et al. |
| 4,457,436 | A | 7/1984 | Kelley |
| 4,458,961 | A | 7/1984 | Browning |
| 4,463,057 | A | 7/1984 | Knurr |
| 4,471,586 | A | 9/1984 | Shuch |
| 4,472,009 | A | 9/1984 | Bell |
| 4,477,128 | A | 10/1984 | Hasbrouck |
| RE31,733 | E | 11/1984 | Haworth et al. |
| 4,482,195 | A | 11/1984 | Chapin |
| 4,490,064 | A | 12/1984 | Ducharme |
| 4,508,231 | A | 4/1985 | Honickman |
| 4,516,341 | A | 5/1985 | Jenkins |
| 4,516,509 | A | 5/1985 | Langenegger |
| 4,516,619 | A | 5/1985 | Hasbrouck |
| 4,516,620 | A | 5/1985 | Mulhern |
| 4,522,130 | A | 6/1985 | Worthington |
| 4,525,093 | A | 6/1985 | Moll |
| 4,526,250 | A | 7/1985 | Messinger |
| 4,535,577 | A | 8/1985 | Tenser et al. |
| 4,535,703 | A | 8/1985 | Henriott |
| 4,545,142 | A | 10/1985 | Whisnant |
| 4,559,738 | A | 12/1985 | Helfman |
| 4,561,229 | A | 12/1985 | Gartung |
| 4,570,408 | A | 2/1986 | Frascaroli |
| 4,572,694 | A | 2/1986 | Hoeksema |
| 4,580,854 | A | 4/1986 | Hedfeld |
| 4,582,002 | A | 4/1986 | Wright |
| D283,855 | S | 5/1986 | Kujawski |
| D283,872 | S | 5/1986 | Clendinen |
| 4,586,759 | A | 5/1986 | Wrobel |
| 4,588,227 | A | 5/1986 | Austin |
| 4,590,865 | A | 5/1986 | Rutsche |
| 4,591,289 | A | 5/1986 | Vickers |
| 4,601,247 | A | 7/1986 | Welch |
| 4,602,817 | A | 7/1986 | Raftery |
| 4,603,787 | A | 8/1986 | Essary |
| 4,610,560 | A | 9/1986 | Miller |
| 4,618,192 | A | 10/1986 | Kelley |
| 4,619,486 | A | 10/1986 | Hannah |
| 4,620,489 | A | 11/1986 | Albano |
| 4,621,381 | A | 11/1986 | Schramek |
| 4,621,865 | A | 11/1986 | Herrera |
| 4,623,088 | A | 11/1986 | Holden |
| 4,624,083 | A | 11/1986 | Diffrient |
| 4,625,483 | A | 12/1986 | Zacky |
| 4,632,040 | A | 12/1986 | Sheffer |
| 4,632,459 | A | 12/1986 | Herschlag |
| 4,633,789 | A | 1/1987 | Kortering |
| 4,637,666 | A | 1/1987 | Worrell |
| 4,639,049 | A | 1/1987 | Frascaroli |
| 4,645,161 | A | 2/1987 | Collins |
| D288,748 | S | 3/1987 | Klein |
| 4,646,655 | A | 3/1987 | Robolin |
| 4,653,652 | A | 3/1987 | Avati |
| 4,653,662 | A | 3/1987 | Wise et al. |
| 4,653,713 | A | 3/1987 | Hamilton |
| 4,654,756 | A | 3/1987 | Wilson |
| 4,662,092 | A | 5/1987 | Kim |
| 4,666,115 | A | 5/1987 | Schiro |
| 4,678,151 | A | 7/1987 | Radek |
| 4,679,510 | A | 7/1987 | Veyhl |
| 4,684,094 | A | 8/1987 | Everett |
| 4,685,647 | A | 8/1987 | Calhoun |
| 4,688,491 | A | 8/1987 | Herrera et al. |
| 4,688,869 | A | 8/1987 | Kelly |
| 4,698,936 | A | 10/1987 | Helfman |
| 4,699,067 | A | 10/1987 | Okopny |
| 4,700,993 | A | 10/1987 | Fu Long |
| 4,708,132 | A | 11/1987 | Silvestrini |
| 4,712,942 | A | 12/1987 | Brown |
| 4,713,949 | A | 12/1987 | Wilcox |
| 4,714,027 | A | 12/1987 | Stern |
| 4,714,373 | A | 12/1987 | Heekin |
| 4,717,358 | A | 1/1988 | Chaundy |
| 4,718,132 | A | 1/1988 | Wirland |
| 4,725,030 | A | 2/1988 | Miller |
| 4,730,802 | A | 3/1988 | Chatham |
| 4,732,088 | A | 3/1988 | Koechlin |
| 4,732,089 | A | 3/1988 | Mueller |
| 4,734,826 | A | 3/1988 | Wilson |
| 4,735,152 | A | 4/1988 | Bricker |
| 4,735,467 | A | 4/1988 | Wolters |
| D295,810 | S | 5/1988 | Saporiti |
| 4,744,492 | A | 5/1988 | Hackmann et al. |
| 4,747,248 | A | 5/1988 | Fahs |
| 4,748,913 | A | 6/1988 | Favaretto |
| 4,750,432 | A | 6/1988 | McNamara |
| 4,761,931 | A | 8/1988 | Schrunk |
| 4,762,072 | A | 8/1988 | Boundy |
| 4,763,581 | A | 8/1988 | Weese |
| 4,765,253 | A | 8/1988 | Schappach |
| 4,766,422 | A | 8/1988 | Wolters |
| 4,771,583 | A | 9/1988 | Ball |
| 4,773,337 | A | 9/1988 | Ball |
| 4,774,792 | A | 10/1988 | Balance |
| 4,778,487 | A | 10/1988 | Chenel |
| 4,779,940 | A | 10/1988 | Ralston |
| 4,781,127 | A | 11/1988 | Conley |
| 4,782,637 | A | 11/1988 | Eriksson et al. |
| 4,784,468 | A | 11/1988 | Tierney |
| 4,785,742 | A | 11/1988 | Esslinger |
| 4,786,119 | A | 11/1988 | Smuda |
| 4,792,881 | A | 12/1988 | Wilson et al. |
| 4,795,355 | A | 1/1989 | Dorn |
| 4,798,423 | A | 1/1989 | LaCour |
| 4,799,432 | A | 1/1989 | Rickner |
| 4,805,784 | A | 2/1989 | Solheim |
| 4,807,838 | A | 2/1989 | Anderson |
| 4,819,986 | A | 4/1989 | Markus |
| 4,821,477 | A | 4/1989 | Rydqvist |
| 4,827,849 | A | 5/1989 | Vignale |
| 4,831,791 | A | 5/1989 | Ball |
| 4,832,241 | A | 5/1989 | Radcliffe |
| 4,832,421 | A | 5/1989 | Shoffner |
| 4,834,450 | A | 5/1989 | Stickler |
| 4,838,175 | A | 6/1989 | Hauville |
| 4,838,177 | A | 6/1989 | Vander Park |
| 4,840,584 | A | 6/1989 | Cox |
| 4,846,430 | A | 7/1989 | Ke |
| 4,850,285 | A | 7/1989 | Suttles |
| 4,852,500 | A | 8/1989 | Ryburg |
| 4,856,242 | A | 8/1989 | Baloga |
| D303,327 | S | 9/1989 | Masarotti |
| 4,869,378 | A | 9/1989 | Miller |
| 4,875,418 | A | 10/1989 | Moeckl |
| 4,879,955 | A | 11/1989 | Moll |
| 4,882,885 | A | 11/1989 | Chatterson et al. |
| 4,884,513 | A | 12/1989 | Newhouse |

(56) References Cited

U.S. PATENT DOCUMENTS

| | | | |
|---|---|---|---|
| 4,884,702 | A | 12/1989 | Rekow |
| 4,891,922 | A | 1/1990 | Hozer |
| 4,905,428 | A | 3/1990 | Sykes |
| 4,914,873 | A | 4/1990 | Newhouse |
| 4,915,034 | A | 4/1990 | Grabe |
| 4,915,120 | A | 4/1990 | Ziolkowski |
| 4,224,769 | B1 | 5/1990 | Ball |
| 4,925,143 | A | 5/1990 | Sandmeyer |
| 4,934,765 | A | 6/1990 | Slifer, Sr. |
| 4,938,442 | A | 7/1990 | Mastrodicasa |
| 4,941,717 | A | 7/1990 | Beaulieu |
| 4,944,235 | A | 7/1990 | Jahnke |
| 4,945,584 | A | 8/1990 | LaMantia |
| 4,947,601 | A | 8/1990 | McGuire |
| 4,948,205 | A | 8/1990 | Kelley |
| 4,953,696 | A | 9/1990 | Huang |
| 4,957,262 | A | 9/1990 | Kemper |
| 4,957,333 | A | 9/1990 | Hsu |
| 4,966,181 | A | 10/1990 | Liberman et al. |
| 4,971,281 | A | 11/1990 | Steinbeck |
| 4,974,913 | A | 12/1990 | Vogt |
| 4,977,696 | A | 12/1990 | Johansson |
| 4,985,195 | A | 1/1991 | Wilson |
| 4,986,194 | A | 1/1991 | Bollman |
| 4,986,198 | A | 1/1991 | Naito |
| 4,986,330 | A | 1/1991 | McGonagle |
| 4,998,636 | A | 3/1991 | Hardigg |
| 5,004,192 | A | 4/1991 | Handler |
| 5,008,966 | A | 4/1991 | Lepow |
| 5,016,765 | A | 5/1991 | Leonardo |
| 5,018,323 | A | 5/1991 | Clausen |
| 5,022,621 | A | 6/1991 | Quest |
| 5,024,167 | A | 6/1991 | Hayward |
| 5,025,603 | A | 6/1991 | Johnson |
| 5,026,614 | A | 6/1991 | Itoh |
| 5,031,683 | A | 7/1991 | Marvy |
| 5,033,624 | A | 7/1991 | DeGelder |
| 5,035,389 | A | 7/1991 | Wang |
| D318,966 | S | 8/1991 | Schroff et al. |
| 5,038,539 | A | 8/1991 | Kelley |
| 5,040,681 | A | 8/1991 | Grusin |
| 5,041,002 | A | 8/1991 | Byrne |
| 5,041,770 | A | 8/1991 | Seiler |
| 5,048,698 | A | 9/1991 | Konrad |
| 5,050,267 | A | 9/1991 | Quest |
| 5,056,746 | A | 10/1991 | Parsons |
| D321,435 | S | 11/1991 | Scalisi et al. |
| 5,069,263 | A | 12/1991 | Edwards |
| 5,069,506 | A | 12/1991 | Wieland |
| 5,070,666 | A | 12/1991 | Looman |
| 5,071,204 | A | 12/1991 | Price |
| 5,074,422 | A | 12/1991 | Holtz |
| 5,078,055 | A | 1/1992 | Bellini |
| 5,080,238 | A | 1/1992 | Hochman |
| 5,080,438 | A | 1/1992 | Moyer |
| 5,082,120 | A | 1/1992 | Vega |
| 5,083,512 | A | 1/1992 | Newhouse |
| 5,085,153 | A | 2/1992 | McKee |
| 5,086,195 | A | 2/1992 | Claisse |
| 5,086,606 | A | 2/1992 | Finses |
| 5,086,958 | A | 2/1992 | Nagy |
| 5,092,253 | A | 3/1992 | Grund et al. |
| 5,094,174 | A | 3/1992 | Grund |
| 5,094,516 | A | 3/1992 | Hunter |
| 5,101,989 | A | 4/1992 | Jones |
| 5,103,741 | A | 4/1992 | Grund et al. |
| 5,104,080 | A | 4/1992 | Berger |
| 5,109,992 | A | 5/1992 | Miller |
| 5,121,974 | A | 6/1992 | Monson |
| 5,123,549 | A | 6/1992 | Finses |
| 5,125,518 | A | 6/1992 | Ward |
| 5,129,202 | A | 7/1992 | Payne |
| 5,130,494 | A | 7/1992 | Simonton |
| 5,131,620 | A | 7/1992 | Boundy |
| 5,134,826 | A | 8/1992 | La Roche |
| D329,875 | S | 9/1992 | Stern et al. |
| 5,144,888 | A | 9/1992 | Heine |
| 5,144,896 | A | 9/1992 | Fortsch |
| 5,148,646 | A | 9/1992 | Lutostanski |
| 5,154,126 | A | 10/1992 | Newhouse |
| 5,155,955 | A | 10/1992 | Ball |
| 5,158,472 | A | 10/1992 | Juhlin |
| 5,165,614 | A | 11/1992 | Fourche |
| 5,167,047 | A | 12/1992 | Plumley |
| 5,168,889 | A | 12/1992 | Diestel |
| 5,172,641 | A | 12/1992 | Auer |
| 5,173,001 | A | 12/1992 | Schunke |
| 5,174,225 | A | 12/1992 | Reise |
| 5,174,532 | A | 12/1992 | Huang |
| 5,177,899 | A | 1/1993 | Powell |
| 5,177,912 | A | 1/1993 | Ball |
| 5,183,319 | A | 2/1993 | Pearson |
| 5,184,441 | A | 2/1993 | Balfanz, Jr. |
| 5,185,972 | A | 2/1993 | Markiewicz |
| 5,186,425 | A | 2/1993 | Keusch |
| 5,187,641 | A | 2/1993 | Muskatello |
| 5,197,614 | A | 3/1993 | Dalton |
| 5,203,135 | A | 4/1993 | Bastian |
| 5,206,972 | A | 5/1993 | Nudelmont |
| 5,208,731 | A | 5/1993 | Blomquist |
| D336,185 | S | 6/1993 | Deinen et al. |
| 5,214,890 | A | 6/1993 | Levitan et al. |
| 5,215,108 | A | 6/1993 | Sprague |
| 5,217,124 | A | 6/1993 | Stone |
| 5,220,871 | A | 6/1993 | Grund |
| D337,219 | S | 7/1993 | Dokoupil et al. |
| D337,450 | S | 7/1993 | Dettinger |
| 5,224,610 | A | 7/1993 | Veazey |
| 5,226,179 | A | 7/1993 | Choi |
| 5,228,579 | A | 7/1993 | Kaufman |
| 5,230,492 | A | 7/1993 | Zwart |
| 5,230,552 | A | 7/1993 | Schipper et al. |
| 5,231,562 | A | 7/1993 | Pierce |
| D337,911 | S | 8/1993 | Gibson |
| 5,233,707 | A | 8/1993 | Perkins |
| 5,237,935 | A | 8/1993 | Newhouse |
| 5,241,717 | A | 9/1993 | Ward |
| 5,241,796 | A | 9/1993 | Hellwig |
| 5,241,914 | A | 9/1993 | Korb |
| 5,242,048 | A | 9/1993 | Ellingsworth |
| 5,252,086 | A | 10/1993 | Russell |
| 5,255,478 | A | 10/1993 | Baranowski |
| 5,255,966 | A | 10/1993 | Newhouse et al. |
| 5,257,701 | A | 11/1993 | Edelson |
| 5,261,736 | A | 11/1993 | Sisbarro |
| 5,263,772 | A | 11/1993 | Ritzow |
| 5,265,972 | A | 11/1993 | Bahr |
| 5,267,715 | A | 12/1993 | Owen |
| 5,272,988 | A | 12/1993 | Kelley |
| D342,837 | S | 1/1994 | Forcolini |
| 5,277,005 | A | 1/1994 | Hellwig et al. |
| 5,277,007 | A | 1/1994 | Hellwig |
| 5,277,132 | A | 1/1994 | Korb |
| 5,277,512 | A | 1/1994 | Dwillies |
| 5,285,900 | A | 2/1994 | Swingler |
| 5,287,666 | A | 2/1994 | Frascaroli |
| 5,287,909 | A | 2/1994 | King et al. |
| 5,295,594 | A | 3/1994 | Melzian |
| 5,297,486 | A | 3/1994 | Herrmann |
| 5,305,883 | A | 4/1994 | Gage |
| 5,308,031 | A | 5/1994 | Evenson |
| D347,622 | S | 6/1994 | Flasz |
| 5,317,977 | A | 6/1994 | Omessi |
| 5,321,579 | A | 6/1994 | Brown |
| 5,322,022 | A | 6/1994 | Burkholder |
| D348,432 | S | 7/1994 | Dubruco |
| 5,327,838 | A | 7/1994 | Beltman |
| 5,328,260 | A | 7/1994 | Beirise |
| 5,333,744 | A | 8/1994 | LoCicero |
| 5,339,576 | A | 8/1994 | Fussler |
| 5,339,747 | A | 8/1994 | Epps |
| 5,340,326 | A | 8/1994 | LeMaster |
| 5,341,615 | A | 8/1994 | Hodges |
| 5,341,749 | A | 8/1994 | Noakes |

(56) References Cited

U.S. PATENT DOCUMENTS 5,346,296 A 9/1994 Kelley
5,347,778 A 9/1994 Bray
5,349,135 A 9/1994 Mollenkopf et al.
5,353,566 A 10/1994 Boon et al.
5,354,025 A 10/1994 McCaffrey
5,354,027 A 10/1994 Cox
5,357,874 A 10/1994 Palmer
5,359,826 A 11/1994 Grearson
5,360,121 A 11/1994 Sothman
5,362,923 A 11/1994 Newhouse
5,378,077 A 1/1995 Paulsen
5,380,034 A 1/1995 Wilson
5,381,908 A 1/1995 Hepp
5,386,787 A 2/1995 Hall
5,392,934 A 2/1995 Fox
5,394,658 A 3/1995 Schreiner
5,394,809 A 3/1995 Feldpausch et al.
5,398,622 A 3/1995 Lubinskas et al.
5,400,719 A 3/1995 Santapa
5,402,988 A 4/1995 Eisele
5,403,082 A 4/1995 Kramer
5,406,894 A 4/1995 Herrmann
5,415,454 A 5/1995 Fu Tsung
5,415,461 A 5/1995 Sakamoto
D359,161 S 6/1995 Byrne
D359,631 S 6/1995 Bubb
5,423,151 A 6/1995 Caro et al.
D360,310 S 7/1995 Stamberg et al.
5,428,928 A 7/1995 Hellwig
5,429,431 A 7/1995 Olson
5,433,152 A 7/1995 Henry
5,437,235 A 8/1995 Randolph
5,437,426 A 8/1995 MacDonald
5,438,937 A 8/1995 Ball
5,441,151 A 8/1995 Billingham
5,441,338 A 8/1995 Kane
5,451,101 A 9/1995 Ellison
5,454,638 A 10/1995 Bird
5,466,058 A 11/1995 Chan
5,467,703 A 11/1995 Crinion
5,469,794 A 11/1995 Laderoute
5,472,164 A 12/1995 Contee, Jr.
5,473,994 A 12/1995 Foley
5,479,733 A 1/1996 Kusina
5,483,904 A 1/1996 Kelly
5,486,042 A 1/1996 Heisler
D366,978 S 2/1996 Mariol
D367,364 S 2/1996 Lewis
5,490,357 A 2/1996 Lin
D368,177 S 3/1996 Mourgue
D368,314 S 3/1996 Lin
5,499,868 A 3/1996 Schainholz
5,511,348 A 4/1996 Cornell
5,516,298 A 5/1996 Smith
5,522,324 A 6/1996 van Gelder
D371,703 S 7/1996 Muller-Deisig et al.
5,535,972 A 7/1996 Fallago
5,537,290 A 7/1996 Brown
5,542,553 A 8/1996 Penniman
5,544,593 A 8/1996 Canfield
5,546,873 A 8/1996 Conner
5,547,080 A 8/1996 Klimas
5,549,055 A 8/1996 Kusch
5,553,551 A 9/1996 Crombie
5,555,694 A 9/1996 Commins
5,556,067 A 9/1996 Konig
5,556,181 A 9/1996 Bertrand
5,560,302 A 10/1996 Diffrient
5,560,303 A 10/1996 Severin
5,564,784 A 10/1996 Felling
5,568,773 A 10/1996 Hung
D375,845 S 11/1996 Mourgue
5,572,751 A 11/1996 Brandt
5,573,320 A 11/1996 Shearer
5,586,593 A 12/1996 Schwartz
5,588,376 A 12/1996 Seidl
5,592,884 A 1/1997 Glick
5,595,494 A 1/1997 Wiebe
D378,028 S 2/1997 Schefcik
5,598,678 A 2/1997 Reynolds
5,603,405 A 2/1997 Smith
5,606,920 A 3/1997 Meyer
5,609,112 A 3/1997 Meyer
5,609,402 A 3/1997 Kemp
5,611,608 A 3/1997 Clausen
5,615,783 A 4/1997 Warnken
5,621,994 A 4/1997 Cobb et al.
5,622,197 A 4/1997 Valaire
5,623,880 A 4/1997 Kuntz
5,623,882 A 4/1997 Price
5,628,257 A 5/1997 Conner
5,628,759 A 5/1997 McCool
D379,987 S 6/1997 Scheid et al.
D380,095 S 6/1997 Diaz-Azcuy
5,634,300 A 6/1997 Huebner
5,638,759 A 6/1997 Klugkist
D381,216 S 7/1997 Paus
5,642,557 A 7/1997 Clews
5,644,995 A 7/1997 Gurwell
5,649,742 A 7/1997 Liu
D382,123 S 8/1997 Pimental et al.
D382,736 S 8/1997 Kopish
5,658,635 A 8/1997 Davis et al.
5,662,132 A 9/1997 Larsen
5,662,298 A 9/1997 Collins
5,666,713 A 9/1997 Kubota
5,669,498 A 9/1997 Fierek
5,673,632 A 10/1997 Sykes
5,678,491 A 10/1997 Price
5,678,792 A 10/1997 Arguin et al.
5,678,907 A 10/1997 Schainholz
5,680,820 A 10/1997 Randolph
5,683,154 A 11/1997 Chang
5,683,198 A 11/1997 Leutenegger
D387,583 S 12/1997 Shear
5,697,686 A 12/1997 Miller
5,698,759 A 12/1997 Fray
5,704,683 A 1/1998 Cooper
5,709,156 A 1/1998 Gevaert
5,711,121 A 1/1998 Garver
5,715,760 A 2/1998 Frascaroli et al.
5,715,761 A 2/1998 Frattini
5,718,179 A 2/1998 Johnson
5,718,492 A 2/1998 Ellison
5,720,547 A 2/1998 Baird
D392,470 S 3/1998 Smith
D392,775 S 3/1998 McMahon
5,724,778 A 3/1998 Cornell
5,730,414 A 3/1998 Wenger et al.
5,738,422 A 4/1998 Welborn, Jr. et al.
5,738,462 A 4/1998 Petersen
5,740,650 A 4/1998 Seiber et al.
5,740,743 A 4/1998 Schairbaum
5,746,488 A 5/1998 LaCour
5,752,449 A 5/1998 Simon
5,752,450 A 5/1998 Roesner
5,754,995 A 5/1998 Behrendt
5,755,321 A 5/1998 Wang
5,756,539 A 5/1998 Skrumsager
5,765,932 A 6/1998 Domina et al.
5,771,954 A 6/1998 Benner
5,775,778 A 7/1998 Riley
5,778,804 A 7/1998 Read
5,791,259 A 8/1998 Mansfield
5,791,265 A 8/1998 Ellsworth et al.
5,791,751 A 8/1998 Meyer et al.
5,794,545 A 8/1998 McDaniel
5,794,902 A 8/1998 Henry
5,795,028 A 8/1998 Dussia, Jr.
5,799,430 A 9/1998 Fremstad
5,802,672 A 9/1998 Rohder
5,802,778 A 9/1998 Thorp
5,802,789 A 9/1998 Goodman
5,803,561 A 9/1998 Puehlhorn

(56) References Cited

U.S. PATENT DOCUMENTS 5,806,258 A 9/1998 Miedema
5,809,708 A 9/1998 Greer
D399,661 S 10/1998 Smith
5,816,001 A 10/1998 Goodman
5,823,624 A 10/1998 Dahlbacka
5,826,955 A 10/1998 Sanders
5,831,211 A 11/1998 Gartung
5,833,065 A 11/1998 Burgess
5,833,332 A 11/1998 Marshall
5,836,112 A 11/1998 Lindale
5,839,240 A 11/1998 Elsholz
5,839,462 A 11/1998 Randall
5,853,236 A 12/1998 Rogers et al.
5,857,415 A 1/1999 Richard
5,860,713 A 1/1999 Richardson
D405,976 S 2/1999 Beall
D405,979 S 2/1999 Kramer et al.
5,865,409 A 2/1999 Nimer
5,867,955 A 2/1999 Russell
5,870,868 A 2/1999 Kita et al.
5,876,002 A 3/1999 White
5,881,500 A 3/1999 Latino
5,886,295 A 3/1999 Carino
5,890,325 A 4/1999 Corcorran
5,890,614 A 4/1999 Dancyger
5,890,782 A 4/1999 Alberts
5,893,606 A 4/1999 Chiang
5,894,614 A 4/1999 Stroud
5,896,817 A 4/1999 Hancock
5,896,995 A 4/1999 Murray
5,897,178 A 4/1999 Ohara
5,901,513 A 5/1999 Mollenkopf
5,904,104 A 5/1999 Yu
5,906,035 A 5/1999 Atkins
5,906,420 A 5/1999 Rozier, Jr.
D410,800 S 6/1999 Gomez
5,908,002 A 6/1999 Alexander
5,911,178 A 6/1999 Alexander
5,921,042 A 7/1999 Ashton
5,921,052 A 7/1999 Kemp
5,921,411 A 7/1999 Merl
5,927,311 A 7/1999 Jager
D413,306 S 8/1999 Scherer et al.
5,934,201 A 8/1999 Diffrient
5,934,203 A 8/1999 Glass
5,934,679 A 8/1999 Strain et al.
5,937,924 A 8/1999 Cooper
5,941,397 A 8/1999 Buchanan
5,943,834 A 8/1999 Jeffers
5,943,966 A 8/1999 Machado
5,947,307 A 9/1999 Battaglia
5,947,742 A 9/1999 Katayama
5,950,371 A 9/1999 Rives
5,950,649 A 9/1999 Gerig
5,954,409 A 9/1999 LaCour
5,957,556 A 9/1999 Singer
5,967,631 A 10/1999 Ko
5,970,662 A 10/1999 Corcorran
5,971,508 A 10/1999 Deimen
5,971,509 A 10/1999 Deimen
D415,901 S 11/1999 Arko et al.
5,974,985 A 11/1999 Flototto
5,975,657 A 11/1999 LaCour
5,976,663 A 11/1999 Davis
5,979,988 A 11/1999 Heidmann
5,983,420 A 11/1999 Tilley
5,986,212 A 11/1999 Lhota
5,988,076 A 11/1999 Vander Park
5,988,383 A 11/1999 Armstrong
5,988,755 A 11/1999 Fastelli
5,993,216 A 11/1999 Stogner
5,994,644 A 11/1999 Rindoks
5,996,145 A 12/1999 Taylor
6,000,179 A 12/1999 Musculus
6,000,343 A 12/1999 Laney
6,000,750 A 12/1999 Rossman
6,003,446 A 12/1999 Leibowitz
6,003,447 A 12/1999 Cox
6,004,065 A 12/1999 Higdon
D418,611 S 1/2000 Montague, III
6,012,690 A 1/2000 Cohen
6,015,124 A 1/2000 Loy
6,024,024 A 2/2000 Favaretto
6,024,599 A 2/2000 Stathis
6,029,580 A 2/2000 Alfonso
6,036,150 A 3/2000 Lehrman
6,036,516 A 3/2000 Byrne
6,037,538 A 3/2000 Brooks
6,039,420 A 3/2000 Besserer et al.
6,041,722 A 3/2000 Baker
6,047,508 A 4/2000 Goodman et al.
6,050,426 A 4/2000 Leurdijk
6,050,646 A 4/2000 Stenzel et al.
6,050,659 A 4/2000 LaCour
D423,808 S 5/2000 Natuzzi et al.
6,055,912 A 5/2000 Doud
6,059,109 A 5/2000 Stein
6,061,972 A 5/2000 Thorp
5,816,001 B1 6/2000 Goodman
6,070,956 A 6/2000 Yates
6,076,308 A 6/2000 Lyon
6,076,317 A 6/2000 Hellwig
6,076,474 A 6/2000 Grabowski
6,076,903 A 6/2000 Vander Park
6,079,803 A 6/2000 West
D427,783 S 7/2000 Luedke
6,082,838 A 7/2000 Bissu Palombo
6,082,840 A 7/2000 Chau
6,086,028 A 7/2000 Pfister
D429,081 S 8/2000 Gomez
6,098,349 A 8/2000 Zheng
6,098,821 A 8/2000 Dube
6,107,576 A 8/2000 Morton
6,109,280 A 8/2000 Custer
D430,543 S 9/2000 Rohder
6,119,317 A 9/2000 Pfister
6,119,878 A 9/2000 Zen
6,119,989 A 9/2000 Hollington
6,120,097 A 9/2000 Perry et al.
6,120,207 A 9/2000 Goto
D432,807 S 10/2000 Gollinucci
6,125,600 A 10/2000 Bastian
6,132,666 A 10/2000 Foley et al.
6,133,528 A 10/2000 Henriott et al.
6,134,852 A 10/2000 Shipman et al.
6,135,545 A 10/2000 Liao
6,135,583 A 10/2000 Simon
6,138,827 A 10/2000 Marshall
6,138,831 A 10/2000 Agostinelli
6,138,841 A 10/2000 Klein
5,802,789 B1 11/2000 Goodman
6,146,047 A 11/2000 Saito
6,148,958 A 11/2000 Ahl et al.
6,152,047 A 11/2000 MacNamara
6,152,048 A 11/2000 Vander Park
6,152,312 A 11/2000 Nava
6,158,178 A 12/2000 Jeffers et al.
6,161,486 A 12/2000 Boots
6,164,467 A 12/2000 DePottey
6,167,579 B1 1/2001 Kopish
6,167,676 B1 1/2001 Shipman
6,170,200 B1 1/2001 Cornell
6,170,410 B1 1/2001 Gioacchini
6,176,561 B1 1/2001 Roels
6,180,884 B1 1/2001 Tokunaga
6,182,579 B1 2/2001 Chang
6,182,580 B1 2/2001 Barrett
6,183,280 B1 2/2001 Laukhuf
6,189,268 B1 2/2001 Carr
D438,402 S 3/2001 Walsh
D439,624 S 3/2001 Webb
6,196,648 B1 3/2001 Henriott
6,199,321 B1 3/2001 Ginzel
6,202,567 B1 3/2001 Funk

(56) References Cited

U.S. PATENT DOCUMENTS

| | | | |
|---|---|---|---|
| 6,205,716 | B1 | 3/2001 | Peltz |
| 6,206,206 | B1 | 3/2001 | Saylor |
| D440,448 | S | 4/2001 | Horsten |
| 6,213,191 | B1 | 4/2001 | Nitzsche |
| 6,213,919 | B1 | 4/2001 | Wang |
| 6,216,397 | B1 | 4/2001 | Chang |
| 6,216,606 | B1 | 4/2001 | Kathardekar et al. |
| 6,220,186 | B1 | 4/2001 | Scharer |
| 5,836,112 | C1 | 5/2001 | Lindale |
| 6,224,029 | B1 | 5/2001 | Marble |
| 6,233,900 | B1 | 5/2001 | Gill |
| 6,234,385 | B1 | 5/2001 | Espinoza |
| D443,157 | S | 6/2001 | Linder |
| 6,240,587 | B1 | 6/2001 | Meichtry et al. |
| 6,240,687 | B1 | 6/2001 | Chong |
| 6,241,317 | B1 | 6/2001 | Wu |
| 6,250,020 | B1 | 6/2001 | Shipman |
| 6,253,509 | B1 | 7/2001 | Hellwig et al. |
| 6,254,206 | B1 | 7/2001 | Petrick |
| 6,254,427 | B1 | 7/2001 | Stathis |
| 6,267,064 | B1 | 7/2001 | Ostertag |
| 6,267,338 | B1 | 7/2001 | Saylor |
| D446,039 | S | 8/2001 | Gomez |
| 6,270,162 | B1 | 8/2001 | Jeny |
| 6,276,382 | B1 | 8/2001 | Bindschatel et al. |
| 6,282,854 | B1 | 9/2001 | Vos |
| 6,283,043 | B1 | 9/2001 | Stern |
| 6,283,564 | B1 | 9/2001 | Corson |
| 6,285,544 | B1 | 9/2001 | Chandramohan |
| 6,286,192 | B2 | 9/2001 | Pfister |
| 6,289,826 | B1 | 9/2001 | Waisbrod |
| 6,293,506 | B1 | 9/2001 | Gutgsell |
| D448,946 | S | 10/2001 | Goetz |
| 6,296,002 | B1 | 10/2001 | Tashchyan |
| 6,302,035 | B1 | 10/2001 | Frenkler |
| 6,302,053 | B1 | 10/2001 | Tomczak et al. |
| 6,302,366 | B1 | 10/2001 | Saylor |
| 6,308,641 | B1 | 10/2001 | Kingbury |
| D450,959 | S | 11/2001 | Birsel et al. |
| 6,318,276 | B1 | 11/2001 | Reinecke |
| 6,324,997 | B1 | 12/2001 | Baker |
| 6,327,983 | B1 | 12/2001 | Cronk |
| 6,329,960 | B1 | 12/2001 | Andrew |
| 6,330,773 | B1 | 12/2001 | MacDonald |
| 6,336,414 | B1 | 1/2002 | Stewart |
| 6,338,172 | B1 | 1/2002 | Taylor |
| 6,338,226 | B1 | 1/2002 | Gauthier |
| 6,340,145 | B1 | 1/2002 | Tagami |
| 6,341,666 | B1 | 1/2002 | Allen |
| 6,341,822 | B2 | 1/2002 | Apissomian |
| 6,347,591 | B1 | 2/2002 | Karpa |
| 6,347,592 | B1 | 2/2002 | Gessert |
| 6,349,507 | B1 | 2/2002 | Muellerleile |
| 6,354,043 | B1 | 3/2002 | Simon |
| 6,357,616 | B1 | 3/2002 | Harris |
| 6,362,420 | B1 | 3/2002 | Bacouelle et al. |
| 6,363,414 | B1 | 3/2002 | Nicholls |
| D455,302 | S | 4/2002 | Minami |
| D456,293 | S | 4/2002 | Tsumura et al. |
| 6,364,128 | B1 | 4/2002 | Wohlford |
| 6,367,874 | B2 | 4/2002 | Casini |
| 6,367,880 | B1 | 4/2002 | Niederman |
| 6,370,741 | B1 | 4/2002 | Lu |
| 6,371,309 | B1 | 4/2002 | Smith |
| 6,372,560 | B1 | 4/2002 | Jen |
| 6,374,455 | B1 | 4/2002 | Regele et al. |
| 6,374,548 | B1 | 4/2002 | Ruedinger et al. |
| D457,017 | S | 5/2002 | Muller |
| D457,359 | S | 5/2002 | Chan |
| D457,736 | S | 5/2002 | Simons, Jr. et al. |
| D457,737 | S | 5/2002 | Citterio |
| 5,609,402 | C1 | 5/2002 | Kemp |
| 6,382,747 | B1 | 5/2002 | Catta |
| 6,384,329 | B2 | 5/2002 | Buard |
| 6,393,658 | B1 | 5/2002 | Chong |
| 6,394,001 | B1 | 5/2002 | Giesey |
| D458,040 | S | 6/2002 | Stannis et al. |
| D458,041 | S | 6/2002 | Couture et al. |
| D458,463 | S | 6/2002 | Citterio |
| 6,397,762 | B1 | 6/2002 | Goldberg |
| 6,398,326 | B1 | 6/2002 | Wang |
| 6,401,862 | B1 | 6/2002 | Caron |
| 6,402,111 | B1 | 6/2002 | Stewart |
| 6,402,233 | B1 | 6/2002 | Tseng |
| 6,410,855 | B1 | 6/2002 | Berkowitz |
| 6,422,398 | B2 | 7/2002 | LaFontaine |
| 6,425,219 | B1 | 7/2002 | Barmak |
| 6,427,608 | B1 | 8/2002 | Crinion |
| 6,427,609 | B1 | 8/2002 | Grant |
| 6,430,049 | B1 | 8/2002 | Lai et al. |
| 6,431,436 | B1 | 8/2002 | Evers |
| 6,435,106 | B2 | 8/2002 | Funk |
| 6,435,461 | B1 | 8/2002 | Saylor |
| 6,442,909 | B2 | 9/2002 | Waalkes et al. |
| 6,446,981 | B1 | 9/2002 | Wise |
| 6,447,067 | B1 | 9/2002 | Williams et al. |
| 6,447,080 | B1 | 9/2002 | Rheault |
| 6,454,358 | B1 | 9/2002 | Benincasa |
| 6,457,422 | B1 | 10/2002 | Saul |
| 6,463,701 | B1 | 10/2002 | Baloga |
| 6,469,747 | B1 | 10/2002 | Rai |
| D465,201 | S | 11/2002 | Gershfeld |
| 6,474,025 | B1 | 11/2002 | Faiks |
| 6,480,243 | B2 | 11/2002 | Yamamoto |
| 6,481,163 | B1 | 11/2002 | King et al. |
| 6,481,177 | B1 | 11/2002 | Wood |
| 6,481,678 | B1 | 11/2002 | Chong |
| 6,483,027 | B1 | 11/2002 | Howard |
| 6,484,360 | B1 | 11/2002 | DeBartolo, Jr. |
| D467,092 | S | 12/2002 | Vu |
| 6,488,347 | B1 | 12/2002 | Bienick |
| 6,490,829 | B1 | 12/2002 | Schreiner |
| 6,490,981 | B2 | 12/2002 | Isensee |
| 6,494,335 | B1 | 12/2002 | Kellogg et al. |
| 6,497,184 | B1 | 12/2002 | Whitesitt |
| 6,497,268 | B1 | 12/2002 | Peppett |
| 6,499,608 | B1 | 12/2002 | Sterling |
| D468,837 | S | 1/2003 | Shilling et al. |
| 6,510,663 | B2 | 1/2003 | Jourden |
| 6,516,571 | B1 | 2/2003 | Overthun |
| 6,520,353 | B2 | 2/2003 | Fulbright |
| 6,523,795 | B2 | 2/2003 | Gutgsell |
| 6,527,235 | B1 | 3/2003 | Cotterill |
| 6,530,181 | B1 | 3/2003 | Seiber |
| 6,533,019 | B1 | 3/2003 | King |
| 6,536,147 | B1 | 3/2003 | Funk et al. |
| 6,536,858 | B1 | 3/2003 | Heidmann |
| D473,723 | S | 4/2003 | Pesso |
| D473,850 | S | 4/2003 | Rouleau et al. |
| 6,540,549 | B2 | 4/2003 | Rupert |
| 6,547,086 | B1 | 4/2003 | Harvey |
| 6,550,875 | B1 | 4/2003 | Compton |
| 6,553,731 | B2 | 4/2003 | Hsueh |
| 6,553,919 | B1 | 4/2003 | Nevin |
| D474,287 | S | 5/2003 | Gresham et al. |
| 6,557,191 | B2 | 5/2003 | Bellows |
| 6,557,310 | B2 | 5/2003 | Marshall |
| 6,559,829 | B1 | 5/2003 | Matsuo |
| 6,560,094 | B2 | 5/2003 | Schmidt |
| 6,564,941 | B2 | 5/2003 | Hedges |
| 6,568,335 | B2 | 5/2003 | Hamilton |
| 6,571,519 | B1 | 6/2003 | Diffrient et al. |
| 6,578,498 | B1 | 6/2003 | Draudt |
| 6,581,344 | B1 | 6/2003 | Niewiadomski |
| 6,588,346 | B1 | 7/2003 | Bockheim |
| 6,595,227 | B2 | 7/2003 | Le Gette |
| 6,609,465 | B2 | 8/2003 | Kolavo |
| 6,615,550 | B2 | 9/2003 | Reuschel |
| 6,617,676 | B1 | 9/2003 | Oddou |
| 6,622,771 | B2 | 9/2003 | Plockmeyer |
| D480,883 | S | 10/2003 | Williams et al. |
| 6,629,505 | B1 | 10/2003 | Cronk |
| D482,535 | S | 11/2003 | Williams et al. |
| 6,644,329 | B2 | 11/2003 | Tomason |

(56) References Cited

U.S. PATENT DOCUMENTS 6,647,652 B1 11/2003 Seiber et al.
6,659,023 B2 12/2003 Saltzman et al.
6,659,546 B2 12/2003 Schmeing et al.
6,662,731 B2 12/2003 Teppo
6,662,732 B2 12/2003 Birsel
6,663,201 B2 12/2003 Herron, III
6,666,342 B1 12/2003 House
D484,709 S 1/2004 Cronk et al.
D485,086 S 1/2004 Gomez
6,672,011 B2 1/2004 Garner
6,676,231 B1 1/2004 Kelley et al.
6,682,256 B1 1/2004 Hor
6,687,930 B1 2/2004 Eads
6,712,008 B1 3/2004 Habenicht
6,712,433 B2 3/2004 Hellwig
6,715,837 B2 4/2004 Niederman
6,725,784 B2 4/2004 Crinion
6,726,277 B1 4/2004 Samaha
6,729,085 B2 5/2004 Newhouse
6,736,076 B2 5/2004 Kaltenmark
6,739,096 B2 5/2004 Feldpausch
6,742,307 B2 6/2004 Briskman
6,742,461 B1 6/2004 Sen
6,748,710 B2 6/2004 Gresham
6,749,001 B2 6/2004 Peppett
6,749,074 B1 6/2004 Hileman
6,749,161 B1 6/2004 Will
6,751,914 B2 6/2004 Zeh
6,754,998 B2 6/2004 Diffrient et al.
6,758,355 B2 7/2004 Zidek
6,764,245 B2 7/2004 Popovski
6,765,148 B2 7/2004 Rix
6,766,748 B2 7/2004 Insalaco
6,769,747 B2 8/2004 Chan
D495,514 S 9/2004 Ricci
D495,518 S 9/2004 Ricci
6,786,161 B2 9/2004 Fischer
6,786,340 B2 9/2004 Ford
6,792,876 B2 9/2004 Lin
6,796,443 B2 9/2004 Lippman
6,802,264 B2 10/2004 Kasak
6,802,715 B1 10/2004 Wotton
6,805,060 B2 10/2004 Nicoletti
6,807,776 B2 10/2004 Girdwood
D498,074 S 11/2004 Gomez
6,818,305 B2 11/2004 Murar
6,820,388 B2 11/2004 Newhouse
6,827,028 B1 12/2004 Callaway
6,827,320 B2 12/2004 Yeh
6,829,792 B2 12/2004 Braly
6,837,384 B2 1/2005 Secondino
6,845,723 B2 1/2005 Kottman
D501,330 S 2/2005 Gomez
6,851,140 B2 2/2005 Polevoy
6,851,226 B2 2/2005 MacGregor
6,854,217 B2 2/2005 Bockheim et al.
6,854,233 B2 2/2005 Pitsch et al.
6,857,712 B1 2/2005 Haberman
6,866,890 B2 3/2005 Kiryu
6,877,731 B1 4/2005 Corley, Sr.
6,877,824 B2 4/2005 Winkless
6,880,185 B1 4/2005 McAdams
D505,456 S 5/2005 Green
6,886,890 B2 5/2005 Rowland
6,895,634 B2 5/2005 Tisbo
6,895,868 B1 5/2005 Cronk et al.
6,895,869 B2 5/2005 Lai
6,899,404 B1 5/2005 King
6,901,940 B2 6/2005 Zheng
6,904,719 B2 6/2005 Braun
6,908,148 B2 6/2005 Wang et al.
6,910,306 B2 6/2005 Waalkes et al.
6,912,960 B2 7/2005 Tsai
D508,455 S 8/2005 Oakley et al.
6,928,785 B2 8/2005 Shipman
6,931,795 B1 8/2005 Baloga
6,935,247 B2 8/2005 Schaefers
6,935,517 B1 8/2005 Reed
6,942,306 B2 9/2005 Youngs
D510,699 S 10/2005 Crain et al.
6,951,085 B2 10/2005 Hodges
6,957,878 B2 10/2005 Greenwald
6,960,098 B1 * 11/2005 Tseng ..... A47B 21/06 108/50.02
6,968,957 B2 11/2005 Fynn
6,972,367 B2 12/2005 Federspiel
6,976,732 B2 12/2005 Thomas
6,980,259 B2 12/2005 Strollo
6,986,491 B2 1/2006 Anderson
6,986,556 B2 1/2006 Haberman
6,990,909 B2 1/2006 Gosling
D516,101 S 2/2006 Vardon
D516,227 S 2/2006 Price
7,004,081 B2 2/2006 Chang
7,007,903 B2 3/2006 Turner
7,008,031 B2 3/2006 Doerflinger
7,014,052 B2 3/2006 Dettorre
7,020,911 B2 4/2006 Oldham
7,025,424 B2 4/2006 Harley
7,032,523 B2 4/2006 Forslund, III
D520,263 S 5/2006 Nobles et al.
7,036,438 B2 5/2006 Okamoto
7,040,700 B2 5/2006 Duncan
7,048,333 B2 5/2006 Martinez
7,048,346 B2 5/2006 Saravis
7,051,482 B2 5/2006 MacDonald et al.
7,066,097 B2 6/2006 Gayhart et al.
7,066,098 B2 6/2006 Blasen
7,066,435 B2 6/2006 Oddsen, Jr.
7,070,156 B2 7/2006 Liao
7,075,101 B2 7/2006 Iiyama
7,077,068 B1 7/2006 Agee
7,096,560 B2 8/2006 Oddsen, Jr.
7,100,999 B2 9/2006 Stravitz
D530,929 S 10/2006 Resterhouse et al.
D531,225 S 10/2006 Kent et al.
7,114,972 B1 10/2006 Riner
7,117,802 B2 10/2006 Hoke, Jr.
7,125,088 B2 10/2006 Haberman
7,140,134 B1 11/2006 Flagg
D533,365 S 12/2006 Martin
7,152,918 B2 12/2006 Berkes
7,159,053 B1 1/2007 Lakin
D537,532 S 2/2007 Takeuchi et al.
7,172,166 B2 2/2007 Wang
7,175,152 B2 2/2007 Dittmer
7,182,415 B2 2/2007 Yamada
D538,054 S 3/2007 Lissoni
D539,047 S 3/2007 Auberger
7,185,767 B2 3/2007 Phillips
7,191,713 B2 3/2007 Gayhart
7,195,119 B2 3/2007 Lungo
7,201,107 B1 4/2007 Ruiter
D543,404 S 5/2007 Watkins et al.
7,210,593 B2 5/2007 Stull
D544,062 S 6/2007 Baker
7,225,822 B1 6/2007 Zheng
7,228,977 B2 6/2007 Perkins
7,237,855 B2 7/2007 Vardon
7,241,981 B2 7/2007 Hofmann
7,249,624 B2 7/2007 Zeh
D549,470 S 8/2007 Hutton
7,252,339 B2 8/2007 Owens
7,270,309 B2 9/2007 Burns
7,273,203 B2 9/2007 Carnevali
7,278,360 B2 10/2007 Griepentrog
D554,387 S 11/2007 Nicoletti
7,290,651 B2 11/2007 Irwin
7,300,029 B2 11/2007 Petrick
7,303,417 B2 12/2007 Lubkert
7,325,343 B2 2/2008 Seiber
7,334,762 B2 2/2008 Dittmer
D564,764 S 3/2008 Springer et al.
7,343,864 B2 3/2008 Canin

(56) References Cited

U.S. PATENT DOCUMENTS

D565,849 S 4/2008 Newhouse
6,857,712 C1 4/2008 Haberman
7,357,086 B2 4/2008 Petrick
D568,344 S 5/2008 Baacke et al.
D569,105 S 5/2008 Van Hoorn
D569,142 S 5/2008 Burak
7,369,401 B1 5/2008 Floersch
7,370,907 B2 5/2008 Leong
7,377,078 B2 5/2008 Golino
7,389,564 B2 6/2008 Lautenschläger
D573,820 S 7/2008 Burak
7,406,803 B2 8/2008 Haberman
7,408,114 B2 8/2008 VanderVelde
7,411,126 B2 8/2008 Herzog
7,428,872 B2 9/2008 Strong
7,433,618 B2 10/2008 Bartley
7,434,304 B2 10/2008 Owens
7,441,739 B2 10/2008 Huang
7,461,484 B2 12/2008 Battey
7,469,090 B2 12/2008 Ferris
D584,524 S 1/2009 Ricci
D584,900 S 1/2009 Hackethal et al.
D585,218 S 1/2009 Hamilton et al.
7,472,656 B2 1/2009 Riach
7,481,502 B2 1/2009 Ortiz
7,513,470 B2 4/2009 Lomberk
7,516,708 B2 4/2009 Willy
7,516,854 B2 4/2009 Brown
7,516,929 B2 4/2009 Brustein
7,517,029 B2 4/2009 Cvek
7,520,076 B2 4/2009 Flagg
7,523,903 B1 4/2009 Rindoks
7,527,331 B2 5/2009 Fargason, III
7,530,651 B2 5/2009 Ho
7,544,893 B2 6/2009 Wallgren
D595,865 S 7/2009 Magnusson
D596,876 S 7/2009 Oshinomi et al.
D596,878 S 7/2009 Oshinomi
D597,345 S 8/2009 Oshinomi et al.
7,575,011 B2 8/2009 Zheng
7,578,399 B1 8/2009 Mulaw
D599,122 S 9/2009 Feldpausch et al.
7,586,041 B2 9/2009 VanderVelde
7,591,385 B2 9/2009 Brooks
7,594,700 B2 9/2009 Stumpf
7,594,823 B2 9/2009 Moscovitch
D602,706 S 10/2009 Cramer et al.
D603,065 S 10/2009 Hamilton et al.
7,607,625 B2 10/2009 Wang
D603,617 S 11/2009 Weiss
7,614,350 B2 11/2009 Tuttle
7,621,421 B2 11/2009 Ohayon
7,621,489 B2 11/2009 Cvek
7,621,500 B2 11/2009 Ishizaki
7,624,959 B2 12/2009 Dozier
D608,407 S 1/2010 Medlock
7,641,056 B2 1/2010 Schulman
7,644,456 B2 1/2010 Polevoy
7,658,199 B2 2/2010 Ayers
7,665,255 B2 2/2010 Dressendorfer
7,665,709 B2 2/2010 Cvek
7,673,838 B2 3/2010 Oddsen, Jr.
7,676,992 B2 3/2010 Burns
7,677,182 B2 3/2010 Mueller
7,686,172 B2 3/2010 Wisnoski
7,694,925 B2 4/2010 Kokenge
7,697,268 B2 4/2010 Johnson
7,703,398 B2 * 4/2010 Brauning ..... A47B 1/08 108/155
7,703,469 B2 4/2010 Danziger
D614,844 S 5/2010 Trunfio
D615,308 S 5/2010 Serra Sola et al.
7,721,361 B1 5/2010 Shubert
D616,663 S 6/2010 Natuzzi
D617,112 S 6/2010 Tsai
7,726,617 B2 6/2010 Zambelli
7,735,167 B2 6/2010 Kline
7,740,048 B2 6/2010 Wilson
7,740,310 B1 6/2010 Forster
7,753,063 B1 7/2010 Laws
7,757,869 B2 7/2010 Lawson
7,765,651 B2 8/2010 Seth
D624,084 S 9/2010 Scheper et al.
7,798,463 B2 9/2010 Morgenroth
7,802,407 B2 9/2010 Haberman
7,810,654 B1 10/2010 Wang
7,827,920 B2 11/2010 Beck
7,832,147 B2 11/2010 Weast
D628,403 S 12/2010 Starck
7,856,756 B1 12/2010 Caruso
7,871,048 B2 1/2011 Sculler
7,871,131 B2 1/2011 Rowland
7,878,476 B2 2/2011 Carson
7,891,617 B2 2/2011 Tisbo
7,896,015 B2 3/2011 Milano, Jr.
7,900,781 B2 3/2011 Baine
7,900,783 B2 3/2011 Fernandez
7,905,242 B2 3/2011 Kline
7,909,400 B1 3/2011 Delaney
7,921,615 B2 4/2011 Picchio
7,942,100 B2 5/2011 Grove
8,015,765 B2 9/2011 Stackenwalt
D649,807 S 12/2011 Stoepker
D651,416 S 1/2012 Martin et al.
8,109,215 B2 2/2012 Kitada et al.
D655,541 S 3/2012 Zemel
8,225,723 B2 7/2012 Nakamura et al.
8,276,523 B2 10/2012 Miller et al.
8,534,752 B2 9/2013 Martin et al.
8,667,908 B2 3/2014 Martin et al.
8,689,705 B2 4/2014 Martin et al.
8,960,102 B2 2/2015 Rheault et al.
9,125,486 B2 9/2015 Rheault et al.
9,185,974 B2 * 11/2015 Martin ..... A47B 13/02
9,210,999 B2 * 12/2015 Martin ..... A47B 13/003
2001/0013305 A1 8/2001 Funk et al.
2002/0062933 A1 5/2002 Insalaco et al.
2002/0069794 A1 6/2002 Dame et al.
2002/0189170 A1 12/2002 Reuschel et al.
2003/0005863 A1 1/2003 Chen
2003/0056817 A1 3/2003 Miller et al.
2003/0070595 A1 4/2003 Crinion
2003/0089283 A1 5/2003 Okamoto et al.
2003/0136313 A1 7/2003 Griepentrog
2003/0140985 A1 7/2003 Wang
2003/0182871 A1 10/2003 Gersham et al.
2003/0182885 A1 10/2003 Gersham et al.
2003/0213415 A1 11/2003 Ross et al.
2003/0222545 A1 12/2003 Stravitz
2004/0052053 A1 3/2004 Lee et al.
2004/0060485 A1 4/2004 Chang
2004/0066626 A1 4/2004 Lee et al.
2004/0149177 A1 8/2004 Gayhart et al.
2004/0194669 A1 10/2004 Forslund, III et al.
2004/0231570 A1 11/2004 Landa
2004/0239217 A1 12/2004 Patel
2004/0250480 A1 12/2004 Matthai
2004/0250739 A1 12/2004 Yang
2005/0028272 A1 2/2005 Kanthasamy
2005/0045073 A1 3/2005 Wasley
2005/0056308 A1 3/2005 Birchenough
2005/0115178 A1 6/2005 Schmidt
2005/0126447 A1 6/2005 Smith et al.
2005/0263041 A1 12/2005 Mueller et al.
2005/0268823 A1 12/2005 Bakker et al.
2005/0280339 A1 12/2005 Perkins et al.
2005/0284341 A1 12/2005 Klassy et al.
2006/0010787 A1 1/2006 Hand et al.
2006/0042520 A1 3/2006 Stevens et al.
2006/0080817 A1 4/2006 Klinker
2006/0096506 A1 5/2006 Brauning et al.
2006/0108299 A1 5/2006 Menard
2006/0162065 A1 7/2006 Glattstein et al.
2006/0162626 A1 7/2006 Brauning et al.

(56) References Cited

U.S. PATENT DOCUMENTS

| | | | | |
|---|---|---|---|---|
| 2006/0163003 | A1 | 7/2006 | Wigstrom, Sr. | |
| 2006/0179792 | A1 | 8/2006 | Shaw et al. | |
| 2006/0266900 | A1 | 11/2006 | May et al. | |
| 2006/0278777 | A1 | 12/2006 | Atkinson et al. | |
| 2007/0017888 | A1 | 1/2007 | Falvey et al. | |
| 2007/0018486 | A1 | 1/2007 | Ayers et al. | |
| 2007/0018543 | A1 | 1/2007 | Cribbs | |
| 2007/0039150 | A1 | 2/2007 | Thomas et al. | |
| 2007/0057000 | A1 | 3/2007 | Webster | |
| 2007/0062992 | A1 | 3/2007 | Hepworth et al. | |
| 2007/0095374 | A1 | 5/2007 | Gendriesch et al. | |
| 2007/0114350 | A1 | 5/2007 | Sorci | |
| 2007/0114892 | A1 | 5/2007 | Boxenbaum et al. | |
| 2007/0170823 | A1 | 7/2007 | Stannis et al. | |
| 2007/0204537 | A1 | 9/2007 | Bastian et al. | |
| 2007/0221795 | A1 | 9/2007 | Cutty | |
| 2007/0251428 | A1 | 11/2007 | Mead et al. | |
| 2007/0277710 | A1 | 12/2007 | Gray et al. | |
| 2007/0277711 | A1 | 12/2007 | Grant | |
| 2007/0283631 | A1 | 12/2007 | Grandin et al. | |
| 2008/0010935 | A1 | 1/2008 | Nagel et al. | |
| 2008/0035031 | A1 | 2/2008 | Yamanishi et al. | |
| 2008/0041281 | A1 | 2/2008 | Griepentrog | |
| 2008/0050173 | A1 | 2/2008 | Bruder et al. | |
| 2008/0053931 | A1 | 3/2008 | Newbould et al. | |
| 2008/0074014 | A1 | 3/2008 | Ho | |
| 2008/0078310 | A1 | 4/2008 | VanNimwegen et al. | |
| 2008/0099279 | A1 | 5/2008 | Griswold et al. | |
| 2008/0149001 | A1 | 6/2008 | Hodges et al. | |
| 2008/0223658 | A1 | 9/2008 | Michalec | |
| 2008/0224580 | A1 | 9/2008 | Gibbs et al. | |
| 2008/0276841 | A1 | 11/2008 | Brauning et al. | |
| 2008/0289545 | A1 | 11/2008 | Picchio | |
| 2008/0290768 | A1 | 11/2008 | Haberman | |
| 2008/0295745 | A1 | 12/2008 | Hamilton et al. | |
| 2008/0296245 | A1 | 12/2008 | Punzel et al. | |
| 2008/0296457 | A1 | 12/2008 | Hager et al. | |
| 2009/0001859 | A1 | 1/2009 | Compton et al. | |
| 2009/0013908 | A1 | 1/2009 | Grove et al. | |
| 2009/0014401 | A1 | 1/2009 | Tallman | |
| 2009/0039685 | A1 | 2/2009 | Zernov | |
| 2009/0042428 | A1 | 2/2009 | Henriott et al. | |
| 2009/0051254 | A1 | 2/2009 | Grove | |
| 2009/0133609 | A1 | 5/2009 | Nethken et al. | |
| 2009/0165680 | A1 | 7/2009 | Bakker et al. | |
| 2009/0260547 | A1 | 10/2009 | Epstein et al. | |
| 2009/0273260 | A1* | 11/2009 | Kemp ..... | A47B 21/06 312/223.3 |
| 2009/0282663 | A1 | 11/2009 | Martin et al. | |
| 2009/0284111 | A1 | 11/2009 | Hazzard et al. | |
| 2009/0293391 | A1 | 12/2009 | DeVore | |
| 2009/0293402 | A1 | 12/2009 | Hamilton et al. | |
| 2009/0293773 | A1* | 12/2009 | Miller ..... | A47B 21/00 108/28 |
| 2009/0309464 | A1 | 12/2009 | Schwartz | |
| 2009/0314913 | A1 | 12/2009 | Gillis | |
| 2010/0000449 | A1 | 1/2010 | Botkin | |
| 2010/0045081 | A1 | 2/2010 | Efthimiou | |
| 2010/0073919 | A1 | 3/2010 | Sharpe | |
| 2010/0096349 | A1 | 4/2010 | Schulman | |
| 2010/0126394 | A1 | 5/2010 | Burak et al. | |
| 2010/0181030 | A1 | 7/2010 | Smoyer et al. | |
| 2010/0212139 | A1 | 8/2010 | Oddsen, Jr. et al. | |
| 2010/0270246 | A1 | 10/2010 | Rodriguez | |
| 2010/0326930 | A1 | 12/2010 | Chiang | |
| 2010/0327134 | A1 | 12/2010 | Lundrigan et al. | |
| 2011/0297051 | A1 | 12/2011 | Martin et al. | |
| 2011/0297053 | A1 | 12/2011 | Martin et al. | |
| 2012/0103726 | A1 | 5/2012 | Morfidis et al. | |
| 2012/0298017 | A1 | 11/2012 | Chen | |
| 2014/0312754 | A1 | 10/2014 | Hecht et al. | |
| 2014/0360413 | A1 | 12/2014 | Schenk et al. | |

FOREIGN PATENT DOCUMENTS

| | | | |
|---|---|---|---|
| CN | 2919992 | Y | 7/2007 |
| CN | 101301147 | A | 11/2008 |
| CN | 101420882 | A | 4/2009 |
| DE | 8623882 | U1 | 11/1986 |
| DE | 8707366 | U1 | 7/1987 |
| DE | 3625137 | C1 | 10/1987 |
| DE | 9412469 | U1 | 10/1994 |
| DE | 19733435 | A1 | 2/1999 |
| DE | 19848392 | C1 | 12/1999 |
| DE | 202006016372 | U1 | 11/2007 |
| EP | 0096272 | A2 | 12/1983 |
| EP | 0145410 | A2 | 6/1985 |
| EP | 0147902 | A2 | 7/1985 |
| EP | 0164041 | A2 | 12/1985 |
| EP | 0244582 | A2 | 11/1987 |
| EP | 0447961 | A2 | 9/1991 |
| EP | 0462920 | A1 | 12/1991 |
| EP | 0594939 | A1 | 5/1994 |
| EP | 0791311 | A1 | 8/1997 |
| EP | 0815775 | A2 | 1/1998 |
| EP | 0830825 | A2 | 3/1999 |
| EP | 0903139 | A1 | 3/1999 |
| EP | 0949394 | A1 | 10/1999 |
| EP | 1647205 | A1 | 4/2006 |
| FR | 1232788 | A | 10/1960 |
| FR | 2636511 | A1 | 3/1990 |
| FR | 2865486 | A1 | 7/2005 |
| GB | 2048351 | A | 12/1980 |
| GB | 2100121 | A | 12/1982 |
| GB | 2246801 | A | 2/1992 |
| GB | 2323781 | A | 10/1998 |
| JP | 2002100889 | A | 4/2002 |
| JP | 2004237398 | A | 8/2004 |
| JP | 2004275314 | A | 10/2004 |
| JP | 2004313251 | A | 11/2004 |
| JP | 2005087625 | A | 4/2005 |
| JP | 2008023195 | A | 2/2008 |
| JP | 2008142337 | A | 6/2008 |
| JP | 2008289634 | A | 12/2008 |
| JP | 2009082528 | A | 4/2009 |
| JP | 2009095360 | A | 5/2009 |
| WO | 9609782 | A1 | 4/1996 |
| WO | 9713431 | A1 | 4/1997 |
| WO | 9719617 | A2 | 6/1997 |
| WO | 9801056 | A1 | 1/1998 |
| WO | 9807357 | A1 | 2/1998 |
| WO | 9902071 | A1 | 1/1999 |
| WO | 9960889 | A2 | 12/1999 |
| WO | 03047400 | A2 | 6/2003 |
| WO | 2004021830 | A1 | 3/2004 |
| WO | 2005093197 | A1 | 10/2005 |
| WO | 2005098159 | A2 | 10/2005 |
| WO | 2005120288 | A1 | 12/2005 |
| WO | 2006029895 | A1 | 3/2006 |
| WO | 2008041873 | A2 | 4/2008 |
| WO | 2008150717 | A2 | 12/2008 |
| WO | 2009052656 | A1 | 4/2009 |
| WO | 2009154983 | A2 | 12/2009 |

OTHER PUBLICATIONS

PCT International Preliminary Report on Patentability, PCT/US2008/064457, dated Dec. 1, 2009.

PCT International Search Report and Written Opinion, PCT/US2011/038904, dated Nov. 23, 2011.

PCT International Search Report and Written Opinion, PCT/US2011/038899, dated Nov. 23, 2011.

PCT International Search Report and Written Opinion, PCT/US2011/038892, dated Nov. 24, 2011.

The State Intellectual Property Office of the People's Republic of China, First Office Action and Search Report, Application No. 201180027125.8, dated Jul. 30, 2014, 16 pages.

The State Intellectual Property Office of the People's Republic of China, Second Office Action, Application No. 201180027125.8, dated May 6, 2015, 2014, 7 pages.

(56) References Cited

OTHER PUBLICATIONS

The State Intellectual Property Office of the People's Republic of China, Third Office Action, Application No. 201180027125.8, dated Sep. 28, 2015, 5 pages.
The State Intellectual Property Office of the People's Republic of China, First Office Action and Search Report, Application No. 201180026938.5, dated Jun. 20, 2014, 14 pages.
The State Intellectual Property Office of the People's Republic of China, Second Office Action, Application No. 201180026938.5, dated Jan. 29, 2015, 7 pages.
European Patent Office, Examination Report, Application No. 11725579.4, dated Oct. 9, 2013.
European Patent Office, Further Examination Report, Application No. 11725579.4, dated Mar. 17, 2014.
European Patent Office, Further Examination Report, Application No. 11725579.4, dated Feb. 5, 2015.
European Patent Office, Examination Report, Application No. 11726566.0, dated Sep. 24, 2013.
European Patent Office, Further Examination Report, Application No. 11726566.0, dated Mar. 31, 2014.
European Patent Office, Extended European Search Report, Application No. 14157546.4, dated May 15, 2014.
European Patent Office, Examination Report, Application No. 14157546.4, dated Feb. 26, 2015.
European Patent Office, Summons to Attend Oral Proceedings with Accompanying Communication, Application No. 14157546.4, dated Sep. 2, 2015.
European Patent Office, Extended European Search Report, Application No. 14162832.1, dated Apr. 24, 2014.
European Patent Office, Examination Report, Application No. 14162832.1, dated Apr. 23, 2015.
European Patent Office, Examination Report, Application No. 14162832.1, dated Nov. 25, 2015.
European Patent Office, Communication, Application No. 14162832.1, dated Apr. 13, 2016.
European Patent Office, Extended European Search Report, Application No. 14166432.6, dated May 26, 2014.
Unifor Misura St Catalog, 1986.
Unifor Luca Meda Catalog.
Unifor Pannelli PL Catalog.
Unifor Progetto 25.90 Catalog, 1991.
Canadian Intellectual Property Office, Office Action, Application No. 2,799,938, dated Mar. 20, 2017.
Canadian Intellectual Property Office, Office Action, Application No. 2,799,962, dated Mar. 24, 2017.
Canadian Intellectual Property Office, Office Action, Application No. 2,800,009, dated Mar. 24, 2017.
Canadian Intellectual Property Office, Office Action, Application No. 2,741,905, dated Apr. 5, 2017.
Canadian Intellectual Property Office, Office Action, Application No. 2,741,905, dated Nov. 23, 2017.
Canadian Intellectual Property Office, Office Action, Application No. 2,741,884, dated Apr. 6, 2017.
Canadian Intellectual Property Office, Office Action, Application No. 2,741,884, dated Nov. 22, 2017.

* cited by examiner

FRAME TYPE WORKSTATION CONFIGURATIONS

CROSS-REFERENCE TO RELATED APPLICATIONS

This application is a continuation of U.S. patent application Ser. No. 14/816,658, filed Aug. 3, 2015, which is a continuation of U.S. patent application Ser. No. 13/481,194, filed May 25, 2012, issued as U.S. Pat. No. 9,185,974 on Nov. 17, 2015, which is a continuation-in-part of U.S. patent application Ser. No. 13/092,703 filed on Apr. 22, 2011, issued as U.S. Pat. No. 8,667,908 on Mar. 11, 2014, which claims the benefit of provisional patent application No. 61/350,736 filed on Jun. 2, 2010.

This application is also a continuation of U.S. patent application Ser. No. 14/934,426 filed Nov. 6, 2015, which is a continuation of U.S. patent application Ser. No. 13/092,504, filed on Apr. 22, 2011, issued as U.S. Pat. No. 9,210,999 on Dec. 15, 2015, which claims benefit of U.S. Provisional Patent Application No. 61/350,726 filed on Jun. 2, 2010. All of these applications are hereby incorporated herein by reference in their entireties.

STATEMENT REGARDING FEDERALLY SPONSORED RESEARCH OR DEVELOPMENT

Not applicable.

BACKGROUND OF THE INVENTION

The field of the invention is desks or tables and more specifically desk or table assemblies that include leg members, work surfaces, storage components and wire management components that can be configured and assembled to form one or a plurality of different workstation arrangements using a small number or no tools.

The office furniture industry is always evolving to meet the needs of customers. Benching systems have been developed that can be used in large open spaces to provide either temporary or permanent workstations for one or more employees. To this end, known benching systems typically include a leg structure that supports one or more desk or table top surfaces for use by one or more employees. In many cases, additional top members and leg structures can be added to an initial configuration to add additional employee workstations. Known designs often include some type of wire management system mounted to the undersurfaces of the top members for hiding power and/or data cables needed to support users at the workstations. Power receptacles are typically provided below or at the top surfaces for powering devices (e.g., computers, chargers, lighting, etc.). Storage requirements are often met by providing case goods that either mount to the undersurfaces of the top members or in some fashion to the leg structures. Other accessories such as computer shelves, screens, lighting devices, paper holders and the like are known and often are mechanically mounted to undersurfaces or edges of the top members or to the support leg structure.

While benching systems have proven particularly useful in certain applications, known benching systems have several shortcomings. First, some benching systems have been designed to have a minimal number of component parts and are supposed to be easy to assemble without the use of tools or with minimal tool use. Unfortunately, in these cases, the resulting benching assemblies are often wobbly and do not have a quality look and feel after assembly and during used.

Second, some benching systems have been developed that include a large number of components and mechanical linkages between components in order to provide a relatively high quality look and feel. Here, however, quality look and feel and accessory support typically increase expense appreciably and, because of their relative complexity, these systems typically require multi-step assembly of a large number of components and use of many specialized tools which make it difficult at best for an untrained person to assembly a configuration. Moreover, when optimal configuration requirements change (i.e., five workstations are required instead of eight), system complexity discourages reconfiguration resulting in non-optimal use of space.

Third, with the exception of adding on additional workstations to an existing configuration, known benching systems are not particularly reconfigurable for purposes other than workstation use. Thus, for instance, where a benching assembly currently includes eight workstations in a four facing four configuration and only five workstations are required, it may be advantageous to be able to reconfigure the configuration so that two of the stations could be used as general seating in the area and a third of the stations could be eliminated. Known benching systems cannot be reconfigured in this manner.

Fourth, no known benching system allows the components of a single workstation assembly to be used in their entirely in a face to face two person workstation assembly which is a particularly useful capability as it enables the useful face to face arrangement while still allowing odd numbers of workstations to be configured together for optimally supporting any number of users.

BRIEF SUMMARY OF THE INVENTION

It has been recognized that a reconfigurable benching system can be provided that includes a simplified core frame structure and an additional small number of components that can be assembled in many different ways to suit optimal configuration requirements and that can be disassembled just as easily to reconfigure when desired. Assembly components have been designed specifically so that assembly thereof is intuitive, easy, and requires few (e.g., one), if any, tools. The core frame structure is assembled first and thereafter other components are added one at a time until an entire desired configuration is completed. As additional components are added to the core frame structure, the additional components and core frame structure cooperate to increase rigidity of the overall assembly until an extremely sturdy assembly results. The components together act as a web to increase rigidity.

The core frame structure includes first and second leg members and a rigid channel or rail member that extends between and mounts to the first and second leg members. Each leg member includes a horizontal support surface or rail lip that has a length dimension. The channel or rail member can be mounted to each leg member at more than one location along the rail lip. For instance, the channel/rail member can be mounted centrally along each rail lip to divide a frame space between facing surfaces of the leg members into front and rear spaces and different furniture assemblies can be mounted at least partially within the front and rear spaces or the channel/rail member can be mounted at rear ends of the lip members so that the frame space between the leg members resides to a front side of the rail lips and a single furniture assembly can be mounted within the frame space. The channel/rail members is mounted to the legs for sliding movement along the length dimension of the legs so that channel position can be modified quickly.

The components in addition to the leg members and the channel/rail member include support or bracket members, trough members and table top members that can all be mounted within the frame space or generally within a space defined by facing surfaces of the leg members. In some embodiments different table top sizes are optional and a seating or lounge subassembly may also optionally be positioned within a frame space.

For shipping, the assembly components can be disassembled and shipped in relatively small and flat boxes to save costs. To this end, at their base level, most of the assembly components break down into elongated members that can easily stack up into compact spaces.

In at least some embodiments each of the leg members includes oppositely facing lateral surfaces where each of the lateral surfaces forms at least one mounting slot and/or lip members for mounting table top members, trough members, a channel member, etc. Here, a single leg member can be used to support tables, troughs, etc., on either side so that several workstations can be configured in a side-by-side fashion if desired.

Some embodiments include a table assembly comprising at least a first leg member that forms a leg opening and a first support surface and a rigid elongated channel member that forms a channel that extends between first and second ends, at least the first end forming a wire passing opening suitable to pass wires into and out of the channel, the first end supportable by the first support surface in at least first and second different locations, wherein, when the channel is supported by the support surface at either of the first and second different positions, the wire passing opening is aligned with the leg opening so that wires can pass through the leg opening and into the channel. Some embodiments further include a second leg member that forms a leg opening and a second support surface and wherein the second end of the rigid elongated channel member forms a wire passing opening suitable to pass wires into and out of the channel, the second end supportable by the second support surface in at least first and second different locations wherein, when the channel is supported by the second support surface at either of the first and second different positions, the wire passing opening is aligned with the leg opening so that wires can pass through the leg opening and into the channel.

Some embodiments further include at least a first table top member supported by and extending between the first and second leg members on a first side of the channel member. Some embodiments further include at least a second table top member supported by and extending between the first and second leg members on a second side of the channel member when the channel member is supported by the leg members in the second locations.

In some cases the channel member and channel are a first channel member and a first channel, respectively, the assembly further including at least a second rigid elongated channel member that forms a second channel that extends between first and second ends, at least the first end of the second channel member forming a second wire passing opening suitable to pass wires into and out of the second channel, the first end of the second channel member supportable by the first support surface in at least first and second different locations wherein the second channel is aligned with the first channel when the first and second channels are aligned at the first locations and the second channel is aligned with the first channel when the first and second channels are aligned at the second locations.

In some cases, when the first and second channel members are supported by the leg member at the first and second locations, respectively, the first and second channels are misaligned and each opens into the leg opening. In some cases the channel member is supported by the support surface for sliding movement between the first and second locations. In some cases the support surface forms a leg lip and the channel member includes a channel lip that mates with the leg lip to attach the first end of the channel member to the first leg member.

In some cases the channel member further includes a coupler pair located at the first end of the channel member, the coupler pair including a stationary finger located on one side of the wire passing opening and a moveable finger located on an opposite side of the wire passing opening and a mechanical activator for moving the moveable finger toward and away from the stationary finger, the leg member forming first and second spaced apart coupling members wherein the stationary finger engages the first coupling member and the mechanical activator is adjusted to move the moveable finger into engagement with the second coupling member to secure the channel member to the leg member in either of the first and second locations.

In some cases the leg member includes first and second spaced apart rails that form the first and second coupling members. In some cases the first and second coupling members include first and second lip members that extend toward each other and wherein the stationary finger and the moveable finger include finger extensions that extend generally in opposite directions, the fingers engaging the lip members. In some cases the mechanical activator is located within the channel when the moveable finger is moved away from the stationary finger. In some cases the moveable finger member forms a threaded aperture and the mechanical activator includes a bolt that is threadably received in the aperture.

Other embodiments include a table assembly comprising first and second legs, each leg forming a first substantially horizontal elongated surface, support rail forming a support surface and extending between first and second ends, the first and second ends of the rail supported by the first and second legs, respectively, the support rail positionable at different locations along the elongated surfaces and a table top supported by the support surface between the first and second legs and positionable with the support rail at different positions adjacent the legs.

In some cases the support rail forms a wire management channel. In some cases the support surface is formed along a first edge of the wire management channel and wherein the table top includes a rear edge that is supported by the support surface so that the channel is located rearward of the table top. Some embodiments further include a power receptacle located in the wire management channel. Some embodiments further include first and second couplers located at the first and second ends of the wire management channel for releasably securing the wire management channel at different positions along the first elongated surfaces. In some cases each first surface forms a leg lip and wherein the wire management channel includes a stationary finger member at each end that mate with the leg lips to support the wire management channel between the legs for sliding motion along the leg lips.

In some cases each of the first elongated surfaces is an upper elongated surface and each leg member further includes a second lower elongated surface that is spaced vertically below and substantially parallel to the upper elongated surface. some cases each upper elongated surface forms an upper leg lip, each second elongated surface forms a lower leg lip, the wire management channel including first and second couplers at first and second ends, respectively, each coupler includes a stationary finger member and a moveable finger member that engage the lower and upper leg lips on an adjacent leg member, respectively, to secure the channel member to the leg members.

In some cases the upper and lower leg lips on the first leg extend toward each other and wherein the upper and lower leg lips on the second leg extend toward each other. In some cases the wire management channel forms first and second channel openings at the first and second ends and the first and second channel openings are aligned with the space between the upper and lower elongated surfaces of the first and second legs.

In some cases the first and second legs include facing surfaces and wherein the rail and that table top are located between the facing surfaces of the first and second legs. In some cases the support surface is formed along a first side of the wire management channel and wherein the rail forms a second support surface along a second side of the wire management channel, the table top being a first table top, the assembly further including a second table top supported by the second support surface. In some cases the support rail has a length dimension between the first and second ends, the assembly further including first and second brackets supported by the first and second leg members that support the table top between the legs. In some cases the first and second brackets extend in a direction substantially perpendicular to the length of the support rail.

Still other embodiments include an assembly including a leg member forming a substantially vertical side surface and having front and rear ends wherein a forward direction is from the rear toward the front of the leg member, an elongated support member extending between a connecting end and a distal end and including a connecting portion proximate the connecting end and a distal portion proximate the distal end, the support member forming a support surface, the connecting portion secured to the leg member with the connecting portion adjacent the vertical side surface and the distal portion extending away from the connecting portion in the forward direction and a table top supported by the support surface.

In some cases the leg member includes a front surface and wherein the distal end of the support member extends past the front surface of the leg member. In some cases the vertical side surface forms a slot and the connecting portion includes a lip that is receivable within the slot to secure the support member adjacent the vertical side surface. In some cases wherein the lip member extends along substantially the entire length of the connecting portion and the connecting portion includes substantially half the bracket member. In some cases the leg member includes a substantially horizontal beam member that forms the slot and wherein the slot is formed along at least a portion of the length of the horizontal beam member. In some cases the bracket member can be slid along the slot to be in different positions with respect to the leg member.

In some cases the slot is formed along substantially the entire length of the beam member. In some cases the support member is secured to the leg member for sliding motion there along between at least first and second positions. In some cases the leg member includes a front surface and wherein the distal end of the support member extends past the front surface of the leg member when in the second position.

In some cases the distal end of the support member is rearward of the front surface of the leg member when the support member is in the first position. In some cases the distal portion extends from the connecting portion along a trajectory that forms an angle of less than sixty degrees with the vertical side surface. In some cases the distal portion extends from the connecting portion along a trajectory that forms an angle between five degrees and twenty degrees with the vertical side surface.

In some cases the distal portion is longer than the connecting portion. In some cases the leg member forms a top surface and wherein a top surface of the table top is substantially flush with the top surface of the leg member.

In some cases the leg member and the support member are a first leg member and a first support member, respectively, the assembly further including a second leg member including a second vertical side surface and a second elongated support member extending between a connecting end and a distal end and including a connecting portion proximate the connecting end and a distal portion proximate the distal end, the second support member forming a second support surface, the connecting portion secured to the leg member with the connecting portion adjacent the vertical side surface of the second leg member and the distal portion extending away from the connecting portion in the forward direction where the table top member is also supported by the second support surface. In some cases the first and second support members are securable to the first and second leg members in at least first and second different positions along length dimensions of the vertical support surfaces. In some cases a frame space is formed between facing surfaces of the leg members and wherein, when the support members are in the first positions, the distal ends are within the frame space and when the support members are in the second positions, the distal ends are located forward of the frame space.

Some embodiments include a table assembly comprising first and second leg members that form first and second facing surfaces, respectively, an elongated channel member extending between the first and second leg members and connected at opposite ends between the first and second facing surfaces, the channel member forming a wire management channel along a length dimension and forming at least a substantially horizontal channel support surface along at least a portion of the length dimension, first and second support members mounted to and extending from the first and second facing surfaces, respectively, each support member forming a substantially horizontal support member support surface and a table top assembly supported by the channel support surface and the support member support surfaces.

In some cases the table top assembly includes a table top member having a rear edge and an undersurface wherein a portion of the undersurface adjacent the rear edge is supported by the channel support surface. In some cases the table top assembly includes a table top member and a trough member, the trough member extending between the facing surfaces of the leg members and including a rear edge that is supported by the channel support surface, the trough member forming a front edge that forms a trough support surface, the table top having a rear edge and an undersurface, a portion of the undersurface adjacent the rear edge supported by the trough support surface. In some cases the trough member and the table top member are both supported by the support member support surfaces. In some cases the channel member and the support members are mounted to the leg members for substantially horizontal sliding motion along the facing surfaces of the leg members.

In some cases the leg members each have a front surface and wherein, in at least one position, distal ends of the bracket members extends past the front surfaces of the leg members. In some cases each leg member includes a top surface and wherein a top surface of the table top assembly is flush with the top surfaces of the leg members.

Some embodiments include a table assembly comprising first and second leg members that form first and second facing surfaces, respectively, a frame space located between the facing surfaces of the leg members, each leg member forming a leg member top surface, an elongated channel member connected at opposite ends to the first and second facing surfaces and located within the frame space, the channel member forming a wire management channel along its length, a table top member forming a table top surface and supported by the leg members wherein the table top member is located entirely within the frame space and the table top surface is substantially flush with the leg member top surfaces.

Yet other embodiments include a table assembly comprising a plurality of leg members, each leg member having first and second oppositely facing lateral side surfaces, the leg members spaced apart to define frame spaces between adjacent pairs of the leg members, the frame spaces including at least a first frame space, the leg members including at least a first leg member and a last leg member wherein each of the first and last leg members are only adjacent one other leg member and pairs of table top members including at least a first table top member pair, each table top member pair including first and second table top members supported at least in part within one of the frame spaces and extending between the leg member pair that defines the frame space in which the table pair is supported, the first and second table top members in each pair forming first and second table top surfaces, respectively, where the first and second table top surfaces at the same height.

Some embodiments further include a first end table member supported by the first leg member on a side of the first leg member opposite the one leg member that is adjacent the first leg member, the first end table member forming a top surface that is at the same height as the first and second table top members. In some cases the first end table member forms a semicircular top surface. Some embodiments further include a second end table member supported by the last leg member on a side of the last leg member opposite the one leg member that is adjacent the last leg member, the second end table member forming a top surface that is at the same height as the first and second table top members. In some cases each of the first and second end table members form a semicircular top surface. In some cases each of the leg members forms a top surface and wherein each of the top surfaces of the leg members are at the same height as the top surfaces of the first and second table top members.

Some embodiments further include at least a first trough member mounted in each frame space, each trough member mounted at opposite ends to the leg members that define the frame space in which the trough member is mounted, each trough member including a bottom wall member having a top surface located at a height below the height of the first and second table top members. Some embodiments further include a separate channel member for each of the frame spaces, each channel member mounted at opposite ends to the leg members that define the frame space in which the channel member is mounted, each channel member forming a wire management channel along a length dimension where a top opening opens into the wire management channel. In some cases the assembly includes at least three leg members that define two frame spaces and at least two table top pairs wherein each pair is supported in a separate one of the frame spaces.

Some embodiments include a furniture assembly comprising a frame for supporting an article of furniture, the frame including first and second spaced apart frame members, each frame member having a top end and a bottom end, the first and second frame members forming first and second substantially oppositely facing bearing surfaces along at least a portion thereof wherein the oppositely facing bearing surfaces are angled away from each other when moving from the top toward the bottom ends, at a first height, the oppositely facing bearing surfaces defining a first width dimension and a storage unit forming an opening defined by an opening rim including at least first and second substantially opposed bearing surfaces, the first and second opposed bearing surfaces defining a first length dimension that is similar to the first width dimension, wherein, the storage unit can be mounted to the frame by passing at least upper portions of the first and second frame members through the opening so that the first and second opposed bearing surfaces contact the first and second oppositely facing bearing surfaces at the first height.

In some cases the first and second oppositely facing bearing surfaces form similar angles with respect to a vertical axis. Some cases further include at least one rail member mounted between the first and second frame members wherein the rail member forms at least one T-slot along at least a portion of its length for mounting accessories. In some cases the storage unit includes a collar member that forms a channel, the channel defined on one end by the opening rim, at least portions of the first and second frame members positioned within the collar when the storage unit is mounted to the frame.

In some cases the collar is open at a top end and wherein at least portions of the first and second frame members extend above the collar when the storage unit is mounted to the frame. In some cases the frame further includes at least one rail member mounted between the first and second frame members that forms at least one T-slot for mounting accessories, the at least one rail member residing above the storage unit when the storage unit is mounted to the frame. In some embodiments the storage unit includes at least one substantially horizontal shelf member that forms the opening.

In some cases the first and second frame members include first and second oppositely facing side surfaces and wherein the horizontal shelf member only extends to the side of the first oppositely facing side surface. In some cases the first and second frame members include first and second oppositely facing side surfaces and wherein the horizontal shelf member extends to the sides of both the first and second oppositely facing side surfaces.

In some cases the frame forms a top surface that resides above the first and second oppositely facing bearing surfaces and the storage unit includes a first shelf member that forms an undersurface, the undersurface of the first shelf member contacting the top surface when the storage unit is mounted to the frame. In some embodiments the storage unit further includes a second shelf member spaced below the first shelf member, the second shelf member forming the opening.

In some embodiments the storage unit further includes a collar member mounted between the first and second shelf members, at least a portion of each of the first and second frame members positioned within the collar member when the storage unit is mounted to the frame. In some cases each of the first and second shelf members includes first and second ends, the storage unit further including a first end wall member linked between the first ends of the first and second shelf members and a second end wall member linked between the second ends of the first and second shelf members to form a storage space between the first and second shelf members.

A furniture assembly comprising a frame for supporting an article of furniture, the frame including first and second spaced apart frame members, each frame member having a top end and a bottom end, the first and second frame members forming first and second substantially oppositely facing bearing surfaces along at least a portion thereof wherein the oppositely facing bearing surfaces are angled away from each other when moving from the top toward the bottom ends, at a first height, the oppositely facing bearing surfaces defining a first width dimension and a storage unit including a collar that defines a collar passage, the collar passage including at least first and second substantially opposed bearing surfaces, the first and second opposed bearing surfaces defining a first length dimension that is similar to the first width dimension, wherein, the storage unit can be mounted to the frame by passing at least portions of the first and second frame members into the collar passage so that the first and second opposed bearing surfaces contact and bear against the first and second oppositely facing bearing surfaces at the first height.

In some cases the storage unit further includes a case structure including a top wall member, a bottom wall member and first and second end wall members, the top and bottom wall members each having first and second ends and arranged parallel to each other, the bottom wall member forming an opening, the collar mounted between facing surfaces of the top and bottom wall members and aligned with the opening, the first end wall mounted between the first ends of the top and bottom wall members and the second end wall mounted between the second ends of the top and bottom wall members.

In some embodiments, the present disclosure provides a furniture assembly comprising a first frame structure including a leg member supporting a substantially horizontal first rail member, a second frame structure including a leg member supporting a substantially horizontal second rail member. The first and second frame structures are located to define an assembly space therebetween for mounting a furniture assembly. A length dimension of at least one of the first and second rails is at a counter height, and a table top member is selectively supported by at least one of the first and second rails at the counter height to provide a work surface.

Each of the first and second rails can be at a counter height, and the table top member can be supported between the first and second rails in the assembly space. Alternatively, the the rail member of the other of the first and second frame structures can be at a table height and a second table top member supported at the table height. The frame structure comprising the rail member at a counter height can also comprise an additional rail member at a table height, and a second table top member can extend between the table height rail members in the first and second rail members in the assembly space. The rail members in each of the first and second frame members can also be at a counter height, and the table top member can be mounted between the counter height rail members in the assembly space. In another alternative, the rail members in each of the first and second frame structures can be at a counter height, and each of the first and second frame structures can further comprise a corresponding first and second table height rail member, and the table top member can be selectively mountable to at least one of the first and second table height rails and the first and second counter height rails. In still another alternative, at least one of the first and second frame structures can include a rail member at a canopy height. Various other configurations will be apparent.

In other embodiments, the substantially horizontal table top member can be supported along a length of at least one of the first and second rails and selectively extend at least one of toward the assembly space and away from the assembly space. The furniture assembly can further include a second table top member supported by the table height rail, the second table top member extending away from the assembly space.

In another embodiment, the furniture assembly can comprise panel screen members. The furniture assembly can include, for example, a panel screen member mounted between a table height rail member and a counter height rail member. The furniture assembly can also include a panel screen member mounted between a counter height rail member and a canopy height rail member. Panel screen members can also extend between the leg members.

In yet another aspect, a furniture kit is described including first and second spaced apart leg members including front and rear end portions and a frame space between facing surfaces, where each of the first and second spaced apart leg members include a substantially horizontal rail at a counter height. A first table top has first and second ends and front and rear portions wherein (i) a first furniture configuration is configurable that includes the first table top supported between the leg members by the horizontal rails and generally within the frame space with the front and rear portions of the first table top adjacent the front and rear end portions of the leg members, respectively, and (ii) a second furniture configuration is configurable that includes the first table top supported between the leg members by the horizontal rails generally within the frame space with the front and rear portions of the table top adjacent the rear and front end portions of the leg members, respectively.

A third furniture configuration is configurable that includes the rear portion of the table top supported adjacent the front portions of the leg members and the front portion of the table top extending out from the frame space and wherein a fourth furniture configuration is configurable that includes the rear portion of the table top supported adjacent the rear portions of the leg members with the front portion of the table top extending out from the frame space.

A wire management channel can be provided in the kit, and wherein the first furniture configuration can include the wire management channel mounted at opposite ends to the first and second leg members along a rear edge of the frame space with the table top member located to a front side of the wire management channel within the frame space, the second furniture configuration can include the wire management channel mounted at opposite ends to the first and second leg members along a front edge of the frame space with the table top member located to a rear side of the wire management channel within the frame space, the third furniture configuration can include the wire management channel mounted at opposite ends to the first and second leg members along an intermediate portion of the frame space with the table top member located to a front side of the wire management channel and the fourth furniture configuration can include the wire management channel mounted at opposite ends to the first and second leg members along an intermediate portion of the frame space with the table top member located to a rear side of the wire management channel.

In other embodiments, the first and second spaced apart leg members in the kit can each include a table height horizontal rail and a counter height horizontal rail, and the table top member can be selectively moved between the counter height horizontal rail and the table height horizontal rail. At least one of the first and second spaced apart leg members can includes a table height horizontal rail, a counter height horizontal rail, and a canopy height horizontal rail, and the kit can further comprise at least one substantially flat surface member adapted to be selectively mountable to at least one of the table height rail, the counter height rail, and the canopy height rail.

The kit can also include a panel screen member sized and dimensioned to be inserted in one of the first and second spaced apart leg members between at least one of the table height member and the counter height member and the counter height member and the canopy height member. The panel screen can, for example, provide additional privacy in the assembly.

The furniture kit can include first and second spaced apart leg members each including substantially horizontal rails at a first and a second height and front and rear end portions and a frame space between facing surfaces, each of the first and second leg members includes a front surface and a rear surface. A first furniture assembly can include a table top member having first and second ends and having front and rear portions. A first furniture configuration can be configured to include the table top member supported by the substantially horizontal rails between the leg members and generally within the frame space with the front and rear portions of the first furniture assembly adjacent the front and rear end portions and substantially flush with the front and rear surfaces of the leg members, respectively. A second furniture configuration can be configured to include the table top member rotated 180 degrees about a vertical axis to be supported by the horizontal rails between the leg members and generally within the frame space with the front and rear portions of the table top member adjacent the rear and front end portions and substantially flush with the front and rear surfaces of the leg members, respectively. A third furniture configuration can be configured to include the rear portion of the table top member supported by the horizontal rails adjacent the front portions of the leg members and the front portion of the table top member extending out from the frame space. The first and second heights can be at a table and a counter height level, respectively. The first and second spaced apart leg members can also each include substantially horizontal rail at a third height.

These and other aspects of the invention will become apparent from the following description. In the description, reference is made to the accompanying drawings which form a part hereof, and in which there is shown an exemplary embodiment of the invention. Neither the summary, nor the exemplary embodiments described in the description below, represent the full scope of the invention and reference is made therefore, to the claims herein for interpreting the scope of the invention.

BRIEF DESCRIPTION OF THE SEVERAL VIEWS OF THE DRAWINGS

FIG. 121 is a top perspective view similar to the view shown in FIG. 118, albeit shown a lighting device attached to the canopy assembly;

FIG. 122 is a partial cross-sectional view taken along the line 122-122 in FIG. 106, albeit showing the components in an exploded orientation;

FIG. 123 is similar to FIG. 122, albeit showing the components in an assembled orientation;

FIG. 124 is a perspective view of the modesty panel member shown in FIG. 109;

FIG. 125 is a perspective view showing a mounting block used to mount the modesty panel shown in FIG. 109;

FIG. 126 is a perspective view showing a second mounding block that cooperates with the first mounting block in FIG. 125 to mount the modesty panel of FIG. 124;

FIG. 127 is a partial cross-sectional view showing how the mounting blocks of FIGS. 124 and 125 mount to the modesty panel shown in FIG. 124;

FIG. 128 is a cross-sectional view showing the blocks and modesty panel of FIGS. 124, 125 and 127 in an assembled configuration and installed in a channel member;

FIG. 129 is a perspective view of a work station configuration including a privacy shade assembly;

FIG. 130 is a perspective exploded view of shade assembly brackets and support tubes of an exemplary two tube mounting bracket that is consistent with at least some aspects of the present invention; and FIG. 131 is a cross-sectional view showing how one of the tubes in FIG. 129 mounts one arch rail;

DETAILED DESCRIPTION OF THE INVENTION

One or more specific embodiments of the present invention will be described below. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
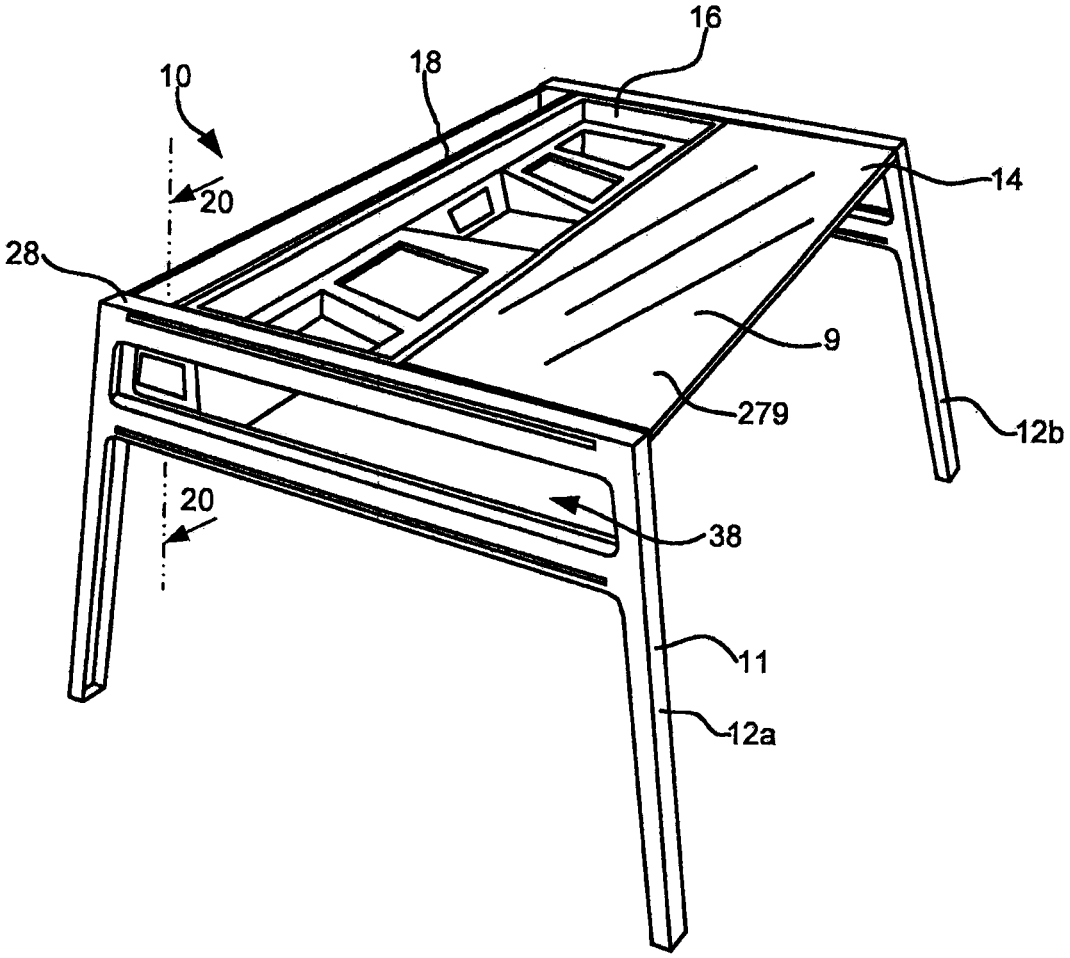
FIG. 1 is a perspective view of the a table/desk assembly that is consistent with at least some aspects of the present invention.
Figure 2:
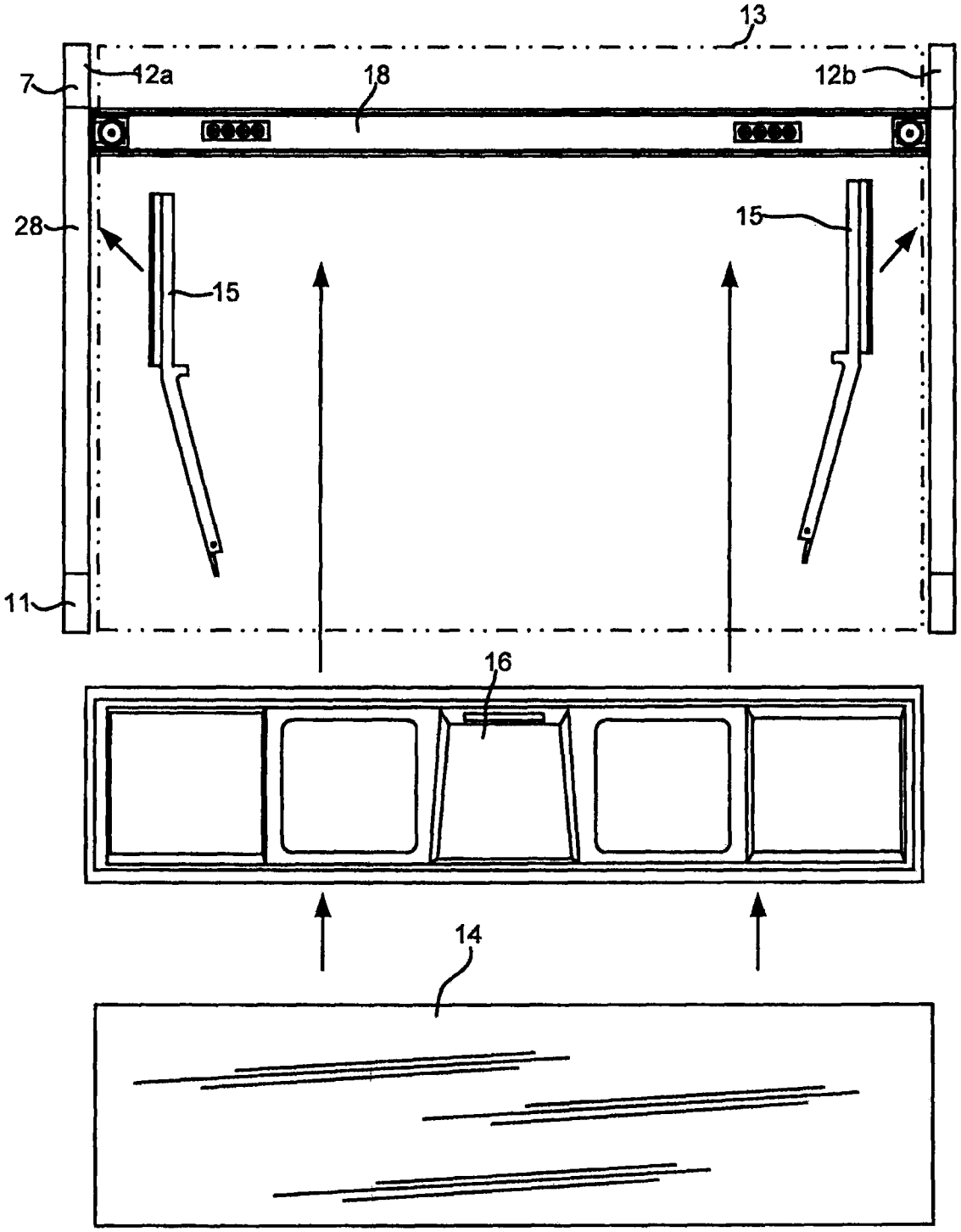
FIG. 2 is a partially exploded top plan view of the assembly shown in FIG. 1.

Referring now to the drawings wherein like reference numerals correspond to similar elements throughout the several views and, more specifically, referring to FIG. 1, the present invention will initially be described in the context of an exemplary single workstation desk/table configuration 10 that includes a small number of basic components. Referring also to FIG. 2, configuration 10 includes first and second leg assemblies 12*a* and 12*b* (also referred to as leg members hereafter), a table top assembly 14, a trough member 16, a wire management channel assembly or member 18 and first and second arm support members 15. In general, the leg assemblies 12*a* and 12*b* are spaced apart such that a frame space 13 (see phantom in FIG. 2) is formed there between. Channel assembly 18 is mounted at opposite ends between the leg assemblies 12*a* and 12*b* and near back or rear portions thereof to form a rigid frame construction. Arm members 15 are mounted to facing surfaces of leg assemblies 12*a* and 12*b* with distal ends thereof extending generally in a direction away from channel assembly 18 (i.e., members 15 extend in a forward direction). Trough member 16 is mounted between leg members 12*a* and 12*b* within frame space 13 and is supported by an adjacent front edge of channel assembly 18 as well as top support surfaces of arm support members 15. Table top member 14 is supported along a rear edge by an adjacent support surface formed by trough member 16 as well as by the distal ends of arm members 15 within frame space 13. Thus, in general all of the configuration 10 components in addition to leg assemblies 12*a* and 12*b* are located within frame space 13 between facing surfaces of assemblies 12*a* and 12*b* after assembly.

Figure 3:
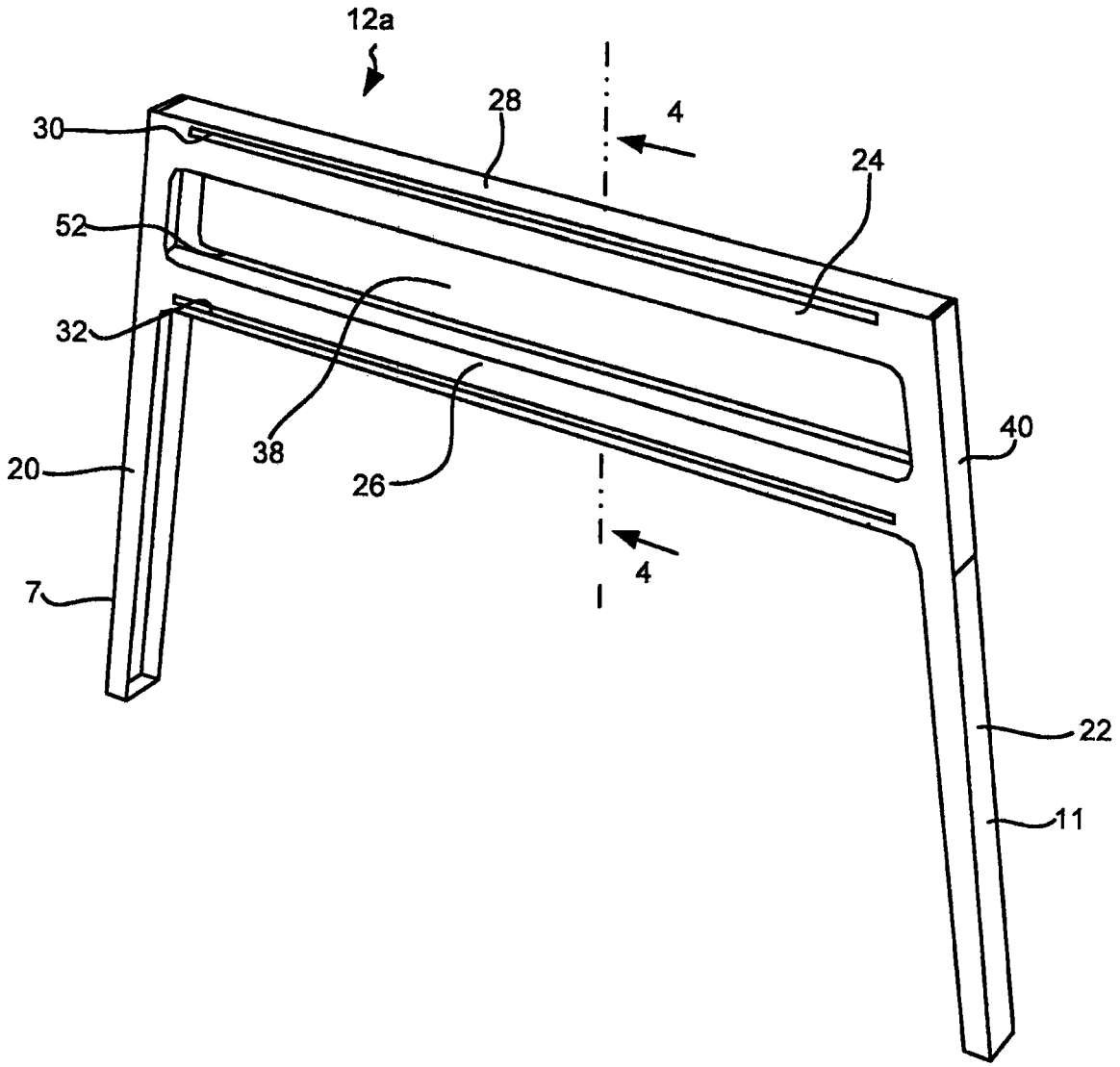
FIG. 3 is a perspective view of one of the leg assemblies shown in FIG. 1.
Figure 4:
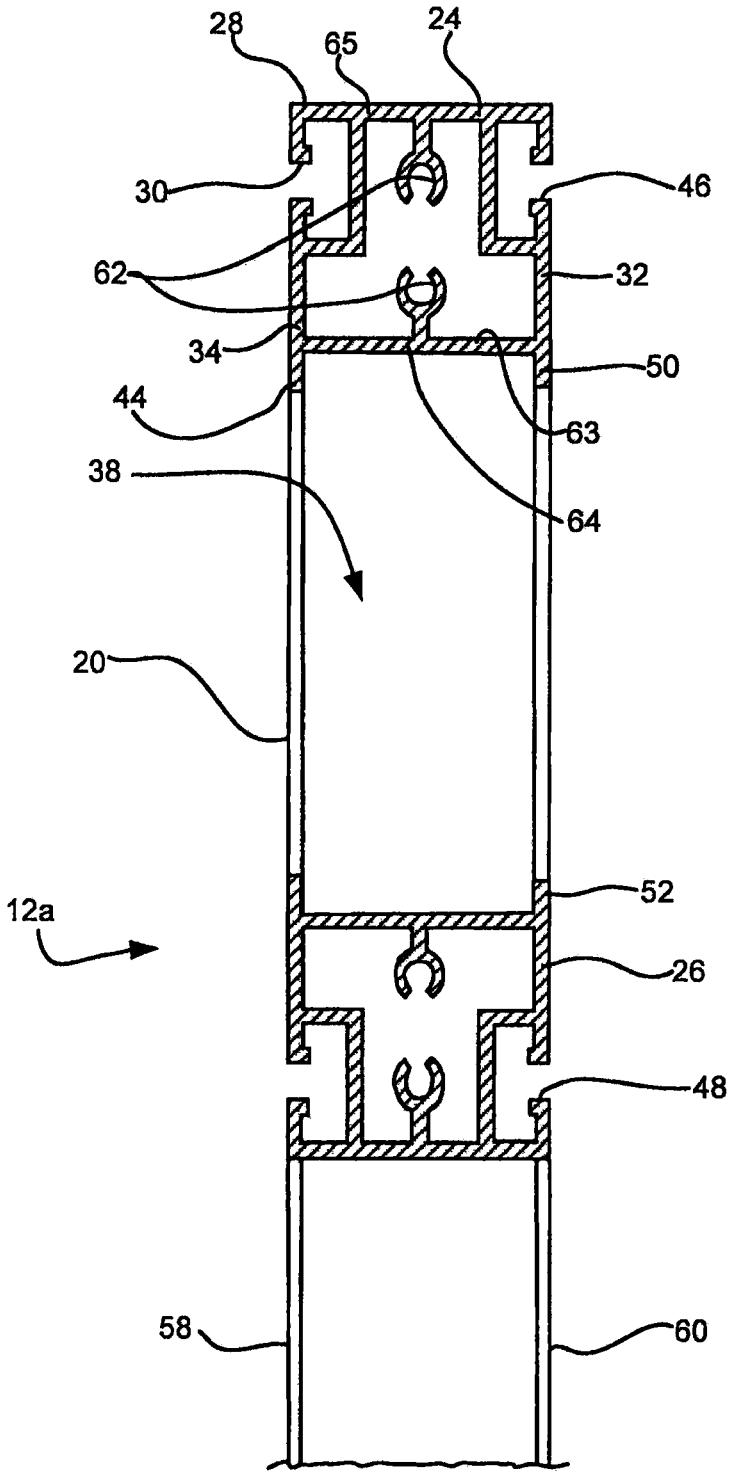
FIG. 4 is a cross-sectional view taken along the line 4-4 in FIG. 3.

Referring again to FIG. 1, each of leg assemblies 12*a* and 12*b* is similarly constructed and operates in a similar fashion and therefore, in the interest of simplifying this explanation, only leg assembly 12*a* will be described here in detail. Referring also to FIGS. 3 and 4, exemplary leg assembly 12*a* includes four elongated members as well as two cover assemblies 40 (only one shown in FIG. 3). The elongated members include first and second generally vertical members 20 and 22, respectively, an upper horizontal rail member 24 and a lower horizontal rail member 26.

Each of the vertical members 20 and 22 is similarly constructed and operates in a similar fashion and therefore, only member 20 is described here in detail. Member 20 has a lower end and an upper end and, referring also to FIG. 5, forms an upper rail mounting plate 70 near the upper end and a lower rail mounting plate 72. The plates 70 and 72 have cross-sections that are similar in shape to the cross-sections of rail members 24 and 26, respectively, and include features that facilitate alignment and connection of the rails to the plates. To this end, plate 70 includes four alignment ribs 74 that extend from the face of the plate 70 and that are received within a slot 63 formed by rail 24 as shown in FIG. 4. Similarly, four ribs 74 are formed on the surface of plate 72 for alignment with a slot (not labeled) formed by rail 26 (see again FIG. 4). A pair of apertures are formed through each of the plates 70 and 72 that align with screw channels (see 62 in FIG. 4) formed by rails 24 and 26, respectively, when the rails 24 and 26 are mounted to the plates 70 and 72.

Figure 5:
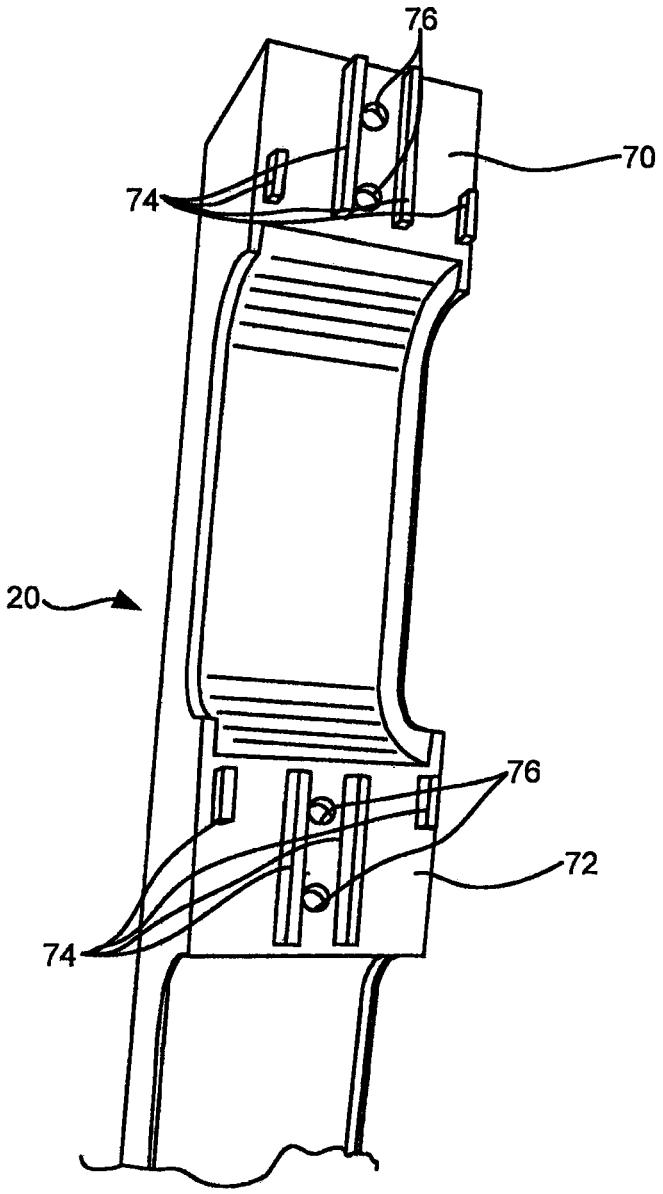
FIG. 5 is a partial perspective view of a top end of one of the vertical members that forms part of the leg assembly shown in FIG. 3.
Figure 6:
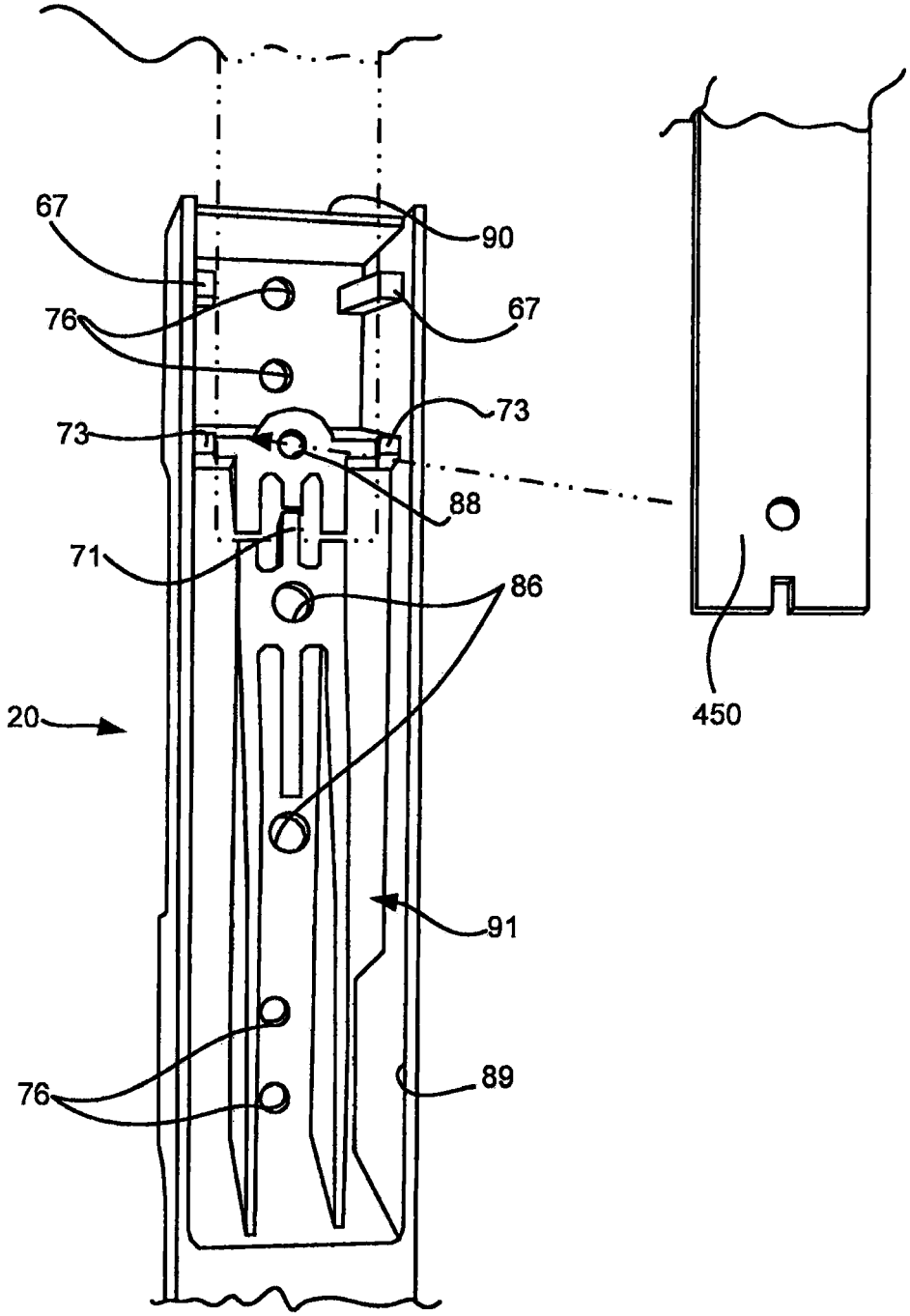
FIG. 6 is a view similar to FIG. 5, albeit showing an opposite side view of the top of the vertical member in FIG. 5.

Referring still to FIGS. 3 through 5 and also to FIG. 6, on a side of member 20 opposite plates 70 and 72, member 20 forms an opening 89 into a recessed space 91 where bolt heads associated with bolts that extend through openings 76 can be recessed. Opening 89 wraps around a top surface of member 20 to form an upper surface open slot 90 useful for attaching additional components (e.g., an arch) above leg assembly 12*a* (see FIGS. 49 and 50 described below). The structure within the recess also forms two additional openings 86 for securing one of the covers 40 (see again FIG. 3) via screws (see FIG. 7) to member 20 to close off the recessed space 91 and provide a finished look to member 20.

Figure 7:
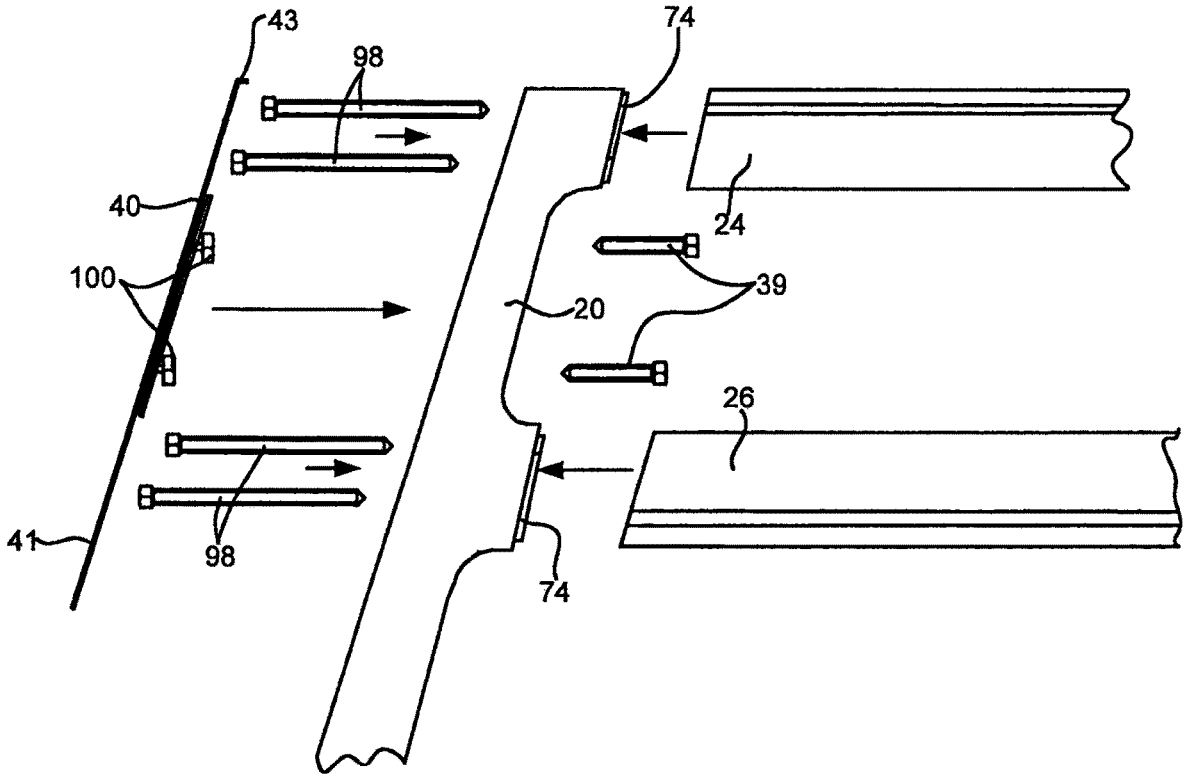
FIG. 7 is a partially exploded view showing various components that form part of the leg assembly shown in FIG. 3.

Referring to FIG. 7, cover assembly 40 includes a generally flat metal cover plate 41 with a lip 43 at a top end as well as two metal posts 100 that form threaded apertures at distal ends where the posts 100 extend from an internal surface of plate 41. Cover 40 is installed by aligning the post 100 apertures with openings 86 and using two screws 39 to secure cover 40 via holes 86. Once installed cover plate 41 is flush with an external surface of vertical member 20.

Referring to FIG. 4, rails 24 and 26 are shown in cross-section. Each of rails 24 and 26 comprises an extruded aluminum member and, as shown in FIG. 4, the rails 24 and 26 have identical cross-sections. When leg assembly 12*a* is assembled, if rail 24 is considered to be upright, rail 26 is inverted with respect to rail 24. Because the rails 24 and 26 have similar cross-sections, only rail 24 will be described here in detail in order to simplify this explanation.

Referring still to FIG. 4, rail 24 is generally square in cross-section and includes a top wall member 65, a bottom wall member 64, and first and second lateral or side wall members 34 and 32, respectively. Rail 24 has a number of interesting characteristics. First, a top surface 28 of top wall member 65 is substantially flat. Second, rail 24 forms T-slots 30 and 46 in opposite side wall members 34 and 32, respectively. Third, rail 24 forms an inverted internal "T" shaped slot 63 that cooperates with ribs 74 (see again FIG. 5) that extend from plate 70 for aligning rail 24 with plate 70 during assembly. Fourth, rail 24 forms two screw channels 62 within internal slot 63 that align with the screw holes 76 formed by member 20 when ribs 74 are received in slot 63. Fifth, side wall members 34 and 32 extend downward past an external surface of lower wall member 64 and thereby form rail lip members or coupling members or fingers 44 and 50, respectively. In FIG. 4, one of the side wall slots 48 and one of the rail lips 52 formed by lower rail member 26 are labeled so those features can be distinguished hereafter.

Referring now to FIGS. 3 and 7, to assemble the rail members 24 and 26 and leg members 20 and 22 to form the leg assembly 12*a*, rails 24 and 26 are aligned with plates 70 and 72 and are moved toward the plates until ribs 74 are received within slots 63 (see also FIGS. 4 and 5) formed by rail members 24 and 26. When ribs 74 are aligned with slots 63, the holes 76 formed by members 20 and 22 are aligned with screw channels 62 formed by rail members 24 and 26. Bolts 98 are slid through holes 76 and are threadably received within channels 62 to secure rail members 24 and 26 to vertical members 20 and 22. Referring again to FIG. 6, upon installation of bolts 98, the bolt heads are received within recesses space 91 adjacent holes 76 and therefore are located within the top ends of members 20 and 22.

Next, covers 40 are aligned with openings 89 at the top ends of members 20 and 22 and are attached by pressing sphere members 100 into openings 86 so that sphere members 100 are frictionally received therein. Referring again to FIGS. 2 through 4, leg assembly 12*a* forms a top surface 28, a front surface 11, a rear surface 7, leg opening 38 and first and second side surfaces 58 and 60 after assembly.

Once rails 24 and 26 are secured to the vertical members 20 and 22, the lips 50 and 52 formed by the bottom walls of the rail members extend toward each other. For example, as shown in FIG. 4, lip member 50 formed by rail 24 is aligned with and extends toward lip member 52 formed by rail member 26. A frame or leg opening 38 is formed between rails 24 and 26.

Referring now to FIGS. 8 through 11, channel assembly 18 includes an elongated rigid housing member 110, a plurality of receptacles 112 and 113 and first and second clamping coupler assemblies or expansion jaw assemblies 114 and 116. Housing member 110 is generally formed of bent sheet metal and extends between first and second opposite ends 121 and 123, respectively. The housing member 110 forms an upper channel or cavity 126 and a lower channel or cavity 132. To form the channels, housing member 110 includes first and second side walls 118 and 120 on front and rear sides, respectively, a bottom wall 122 and an intermediate dividing or floor member 127. A top end of the housing 110 is open at 125 along a channel length dimension. The side walls 118 and 120 are generally vertical and angle away from each other generally from top to bottom to a small degree (e.g., a 10° angle with respect to vertical).

Each of the side wall members 118 and 120 forms openings (see 150 in FIG. 8) for passing power or data wires into and out of the upper channel 126. In addition, each of the wall members 118 and 120 forms other openings for receiving power outlet receptacles 112 that can be arranged to face the exterior of assembly 18 so that the outlets are accessible from outside assembly 18. In the illustrated embodiment shown in FIG. 8, each of the wall members 118 and 120 forms a single access opening 150 as well as a single central power receptacle opening for mounting a receptacle 112 while the openings 150 and receptacle openings may be preformed, in some embodiments knockout panels may be formed within the openings where the panels initially close the openings and can be removed by a user if desired by applying force to the panels. An exemplary knockout panel 800 is shown in phantom in FIG. 8.

Figure 10:
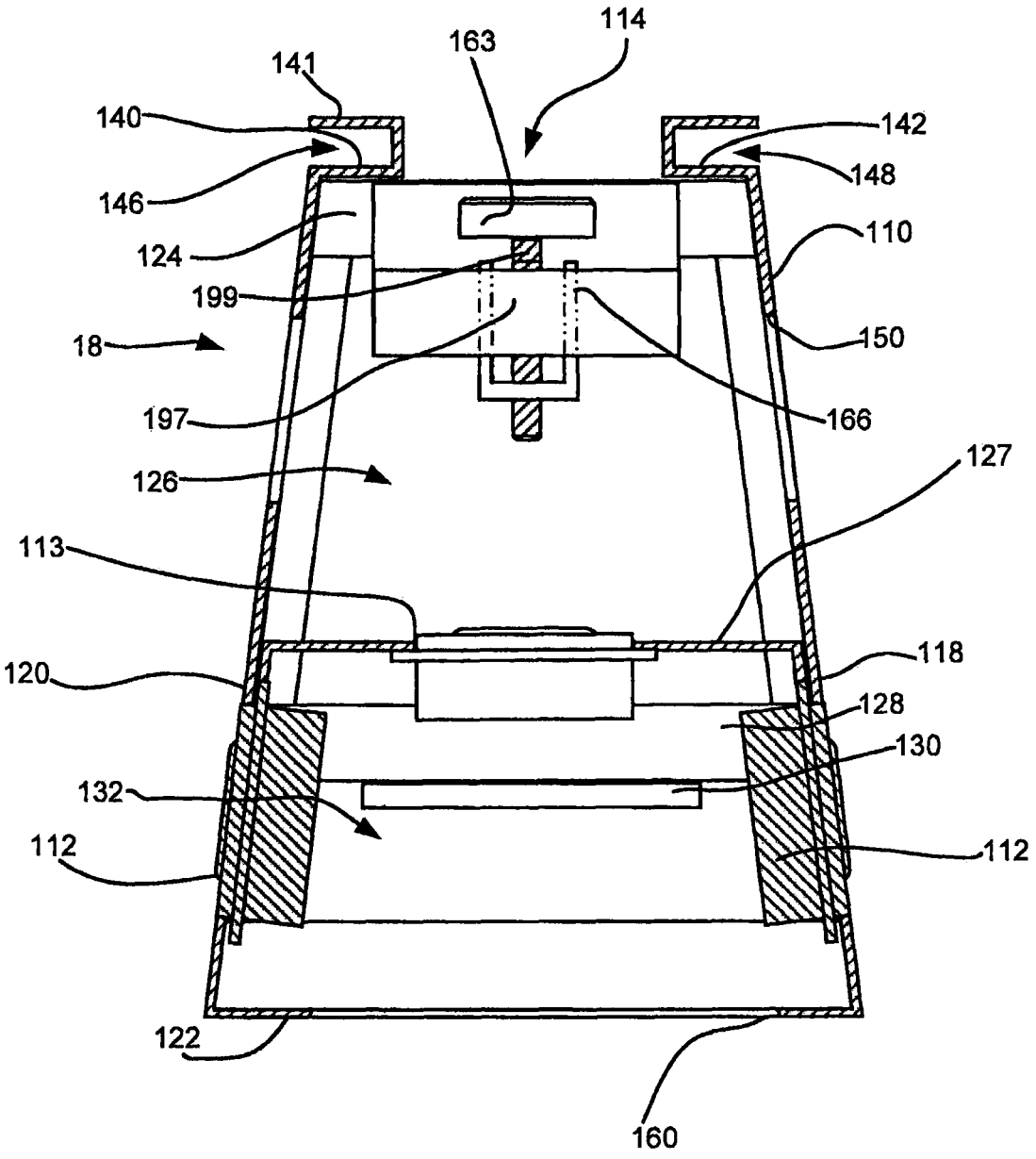
FIG. 10 is a cross-sectional view taken along the line 10-10 in FIG. 9.

Referring now to FIG. 10, at a top end wall member 118 is bent toward wall member 120, then upward and again outward thereby forming an elongated channel 148 and a channel support surface 142 along a length dimension of the housing 110 that extends between the first and second ends 121 and 123, respectively. Similarly, along a top edge, wall member 120 also forms an channel 146 and a support surface 140 along its length dimension where channel 146 opens in a direction opposite the direction in which channel 148 opens channel housing 110 forms a top surface 141 (see FIG. 10).

Referring still to FIGS. 8 through 11, bottom wall member 122 generally closes off the space between lower edges of side wall members 118 and 120 and extends between the first and second ends 121 and 123, respectively. Bottom wall member 122 forms relatively large openings 160 (see FIG. 10) along its length for allowing power or data cables to be strung into an out of the lower channel 132 and to allow access to components mounted within housing 110 for installation, adjustment, etc.

Figure 9:
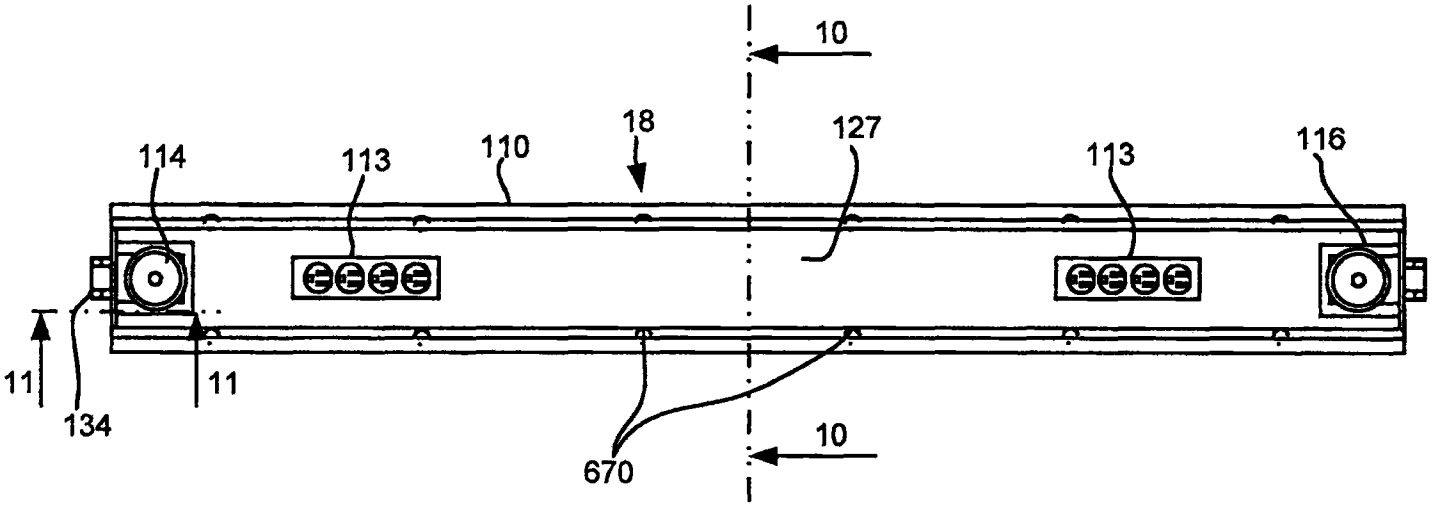
FIG. 9 is a top plan view of the channel assembly shown in FIG. 8.

Referring specifically to FIGS. 9 and 10, intermediate wall member 127 is mounted between internal surfaces of side wall members 118 and 120 and divides the space between wall member 118 and 120 essentially into the upper and lower channels 126 and 132. Intermediate member 127 forms openings in which additional power or data outlet receptacles 113 are mounted (see FIGS. 9 and 10). Lower channel 132 is used for running power/data wires. Upper channel 126 is used for plugging in cords from lights, computers, etc., and for storing excess power/data connecting cables.

Figure 8:
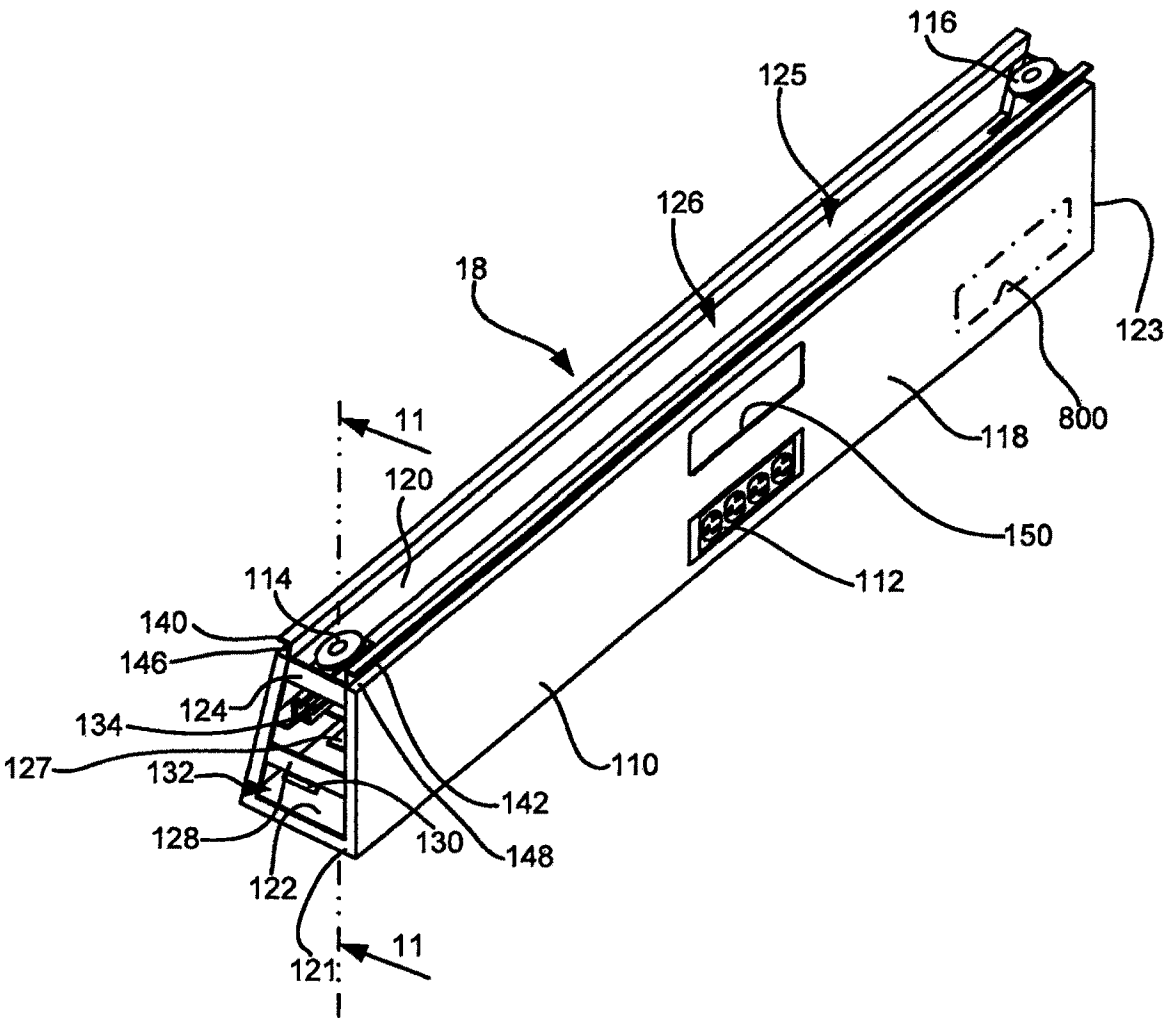
FIG. 8 is a perspective view of the channel assembly shown in FIG. 2.
Figure 11:
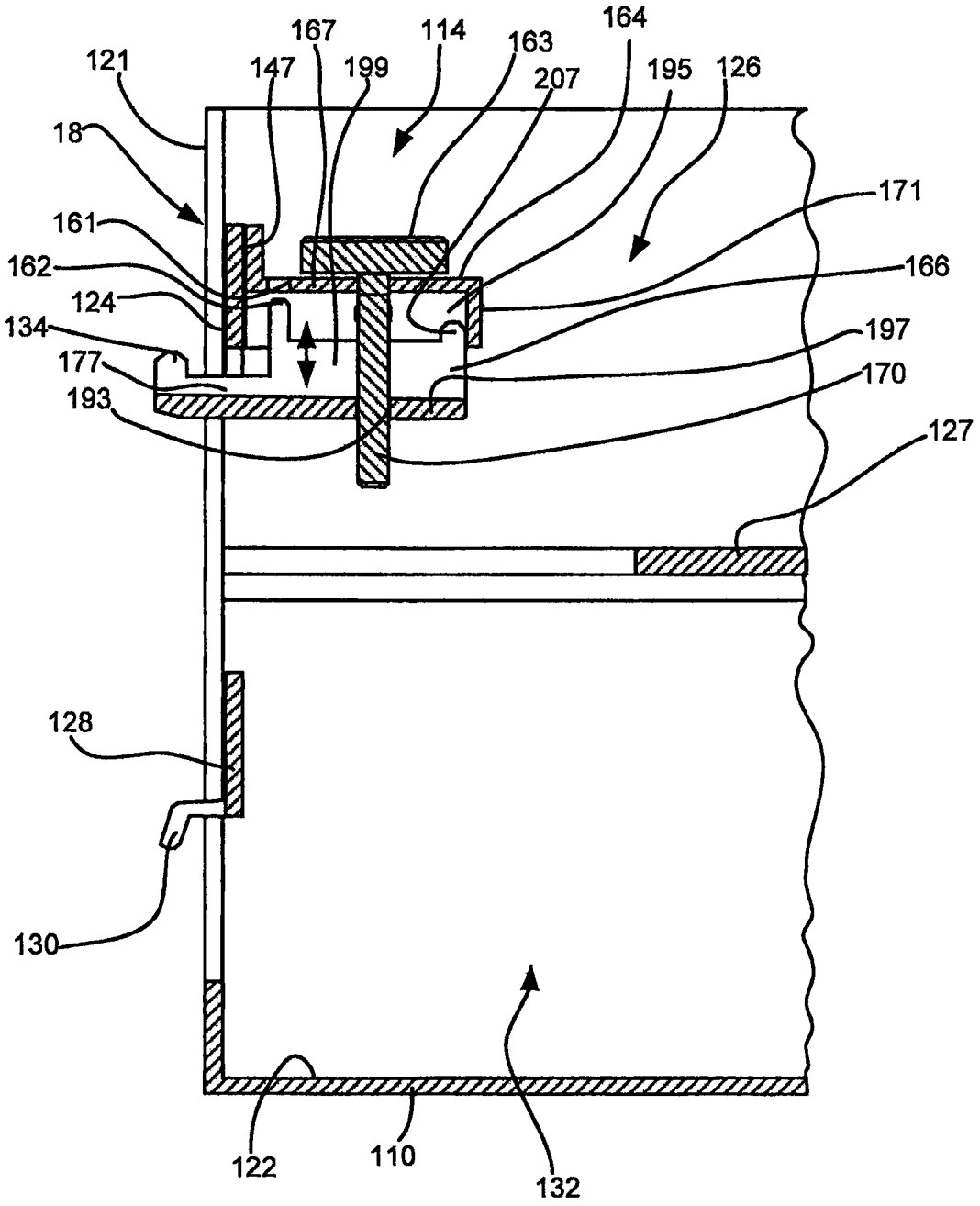
FIG. 11 is a partial cross-sectional view taken along the line 11-11 in FIG. 8.

Referring to FIGS. 8, 10 and 11, at each of the distal ends 121 and 123, assembly 18 includes a rigid metal top cross member 124 and a rigid metal intermediate cross member 128. The top cross member 124 is welded or otherwise attached between top ends of side wall members 118 and 120 and includes an internal surface 147 (see FIG. 11) to which one of the coupling assemblies 114 or 116 is welded or otherwise attached. Intermediate cross member 128 is also a rigid metal member that is welded or otherwise secured between wall members 118 and 120 and includes a lip member or stationary finger or coupler 130 along a lower edge that extends outward and downward from a distal end.

Referring once again to FIGS. 8, 10 and 11, coupling assemblies 114 and 116 are similarly constructed and operate in a similar fashion and therefore, in the interest of simplifying this explanation, only coupling assembly 114 is described in detail. Coupling assembly 114 includes a support bracket 164, a clamping bolt 163 and a coupler block or moveable jaw member 166. Bracket 164 includes an integrally formed flat support plate 167 and a plurality of wall members that extend downward from edges of the support plate 167. One of the downward extending wall members is a guide wall 166 that extends along an edge opposite the edge of plate 167 that is secured to surface 147 (see FIG. 11). Plate 167 forms an opening for passing a threaded shaft 170 of bolt 163 and also forms guide slots 162 (only one shown in FIG. 11) near the edge of plate 167 that mounts to surface 147.

Jaw member 166 is generally U-shaped in cross-section (see FIG. 10) including a flat bottom wall member 197 and first and second parallel wall members 199 that extend along opposite edges of bottom wall member 197. Bottom wall member 197 forms a threaded opening 193 for receiving shaft 170. As best seen in FIG. 11, top edges of side wall members 199 undulate to form a lip or moveable finger member 134 at one end, an intermediate guide finger extension 162 and an end finger extension 207 at a second end opposite lip 134 where lip 134 and extensions 162 and 207 all extend away from bottom wall member 197 in the same direction. The dimensions of, and spacing between, members 134, 162 and 207 are such that when an edge of member 207 contacts an internal surface of wall member 171 (see FIG. 11) with shaft 170 passing through plate 167 and threadably received in opening 193. Finger extensions 162 are aligned with openings 161 in plate 167 and lips 134 extend past an adjacent edge of plate 167.

To install assembly 114, bracket 164 is welded or otherwise secured to cross member 124. Jaw member 166 is placed with intermediate finger members 162 aligned with openings 161 and with finger members 207 adjacent the internal surface of wall member 166 and with the opening in plate 162 aligned with threaded opening 193. Shaft 170 is fed through plate 167 and into opening 193. At this point jaw member 134 extends out an end opening formed by housing 110 as shown in FIG. 11.

Referring again to FIG. 11, as bolt 163 is rotated, jaw member 166 and finger member 134 move up and down. Jaw member 166 is restricted from rotating by intermediate finger members 162 and openings 161 as well as by finger members 207 that ride along the internal surface of wall member 171. Lip 130 and lip 134 form a coupler pair and a similar coupler pair is located at the second end 123 of assembly 18. As illustrated, the bolt 163 and bracket 164 are entirely located inside channel 126.

Figure 12:
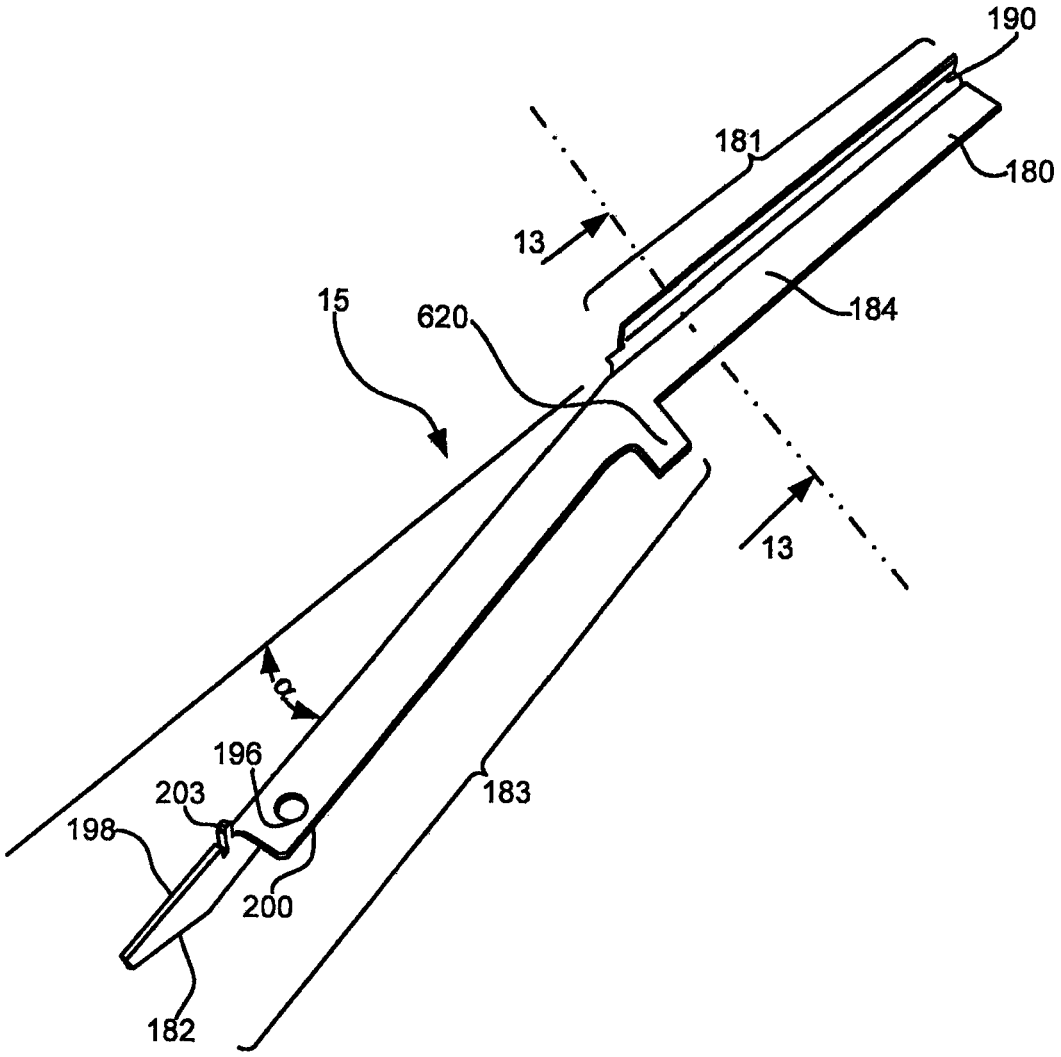
FIG. 12 is a perspective view of one of the support arm members shown in FIG. 2.
Figure 13:
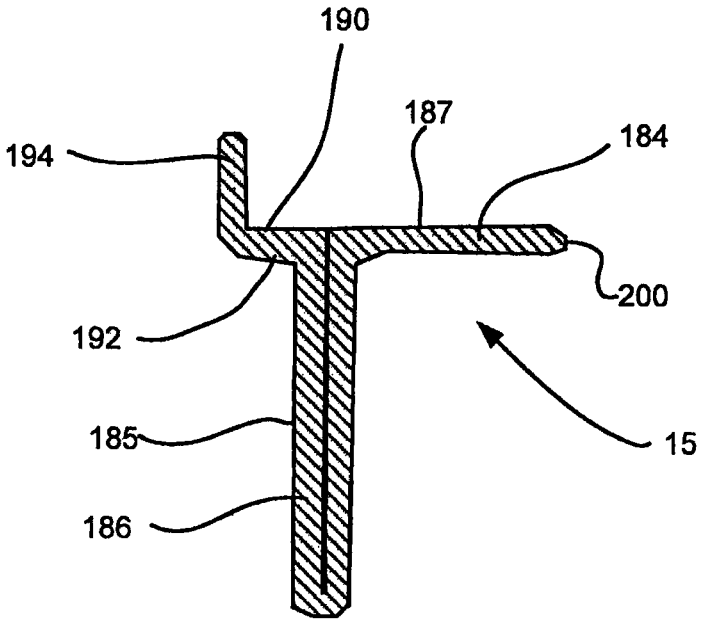
FIG. 13 is a cross-sectional view taken along the line 13-13 in FIG. 12.

Referring again to FIG. 2, each of the arm support or bracket support members 15 is similarly constructed and operates in a similar fashion and again, in the interest of simplifying this explanation, only one of the support members 15 will be described here in detail. Referring also to FIGS. 12 and 13, exemplary support member 15 is a rigid elongated metal member having a proximal or connecting end 180 and a distal end 182 where proximal and distal portions 181 and 183 are located at the proximal and distal ends 180 and 182, respectively. The proximal portion 181 has a generally uniform cross section along its length as shown in FIG. 13 that includes a vertical member 186 and a horizontal shelf member 184 that extends at a right angle from a top edge of vertical member 186. Shelf member 184 has a distal edge 200 along its length. Vertical member 186 forms a bearing surface 185 on a side opposite the side from which shelf member 184 extends.

Figure 26:
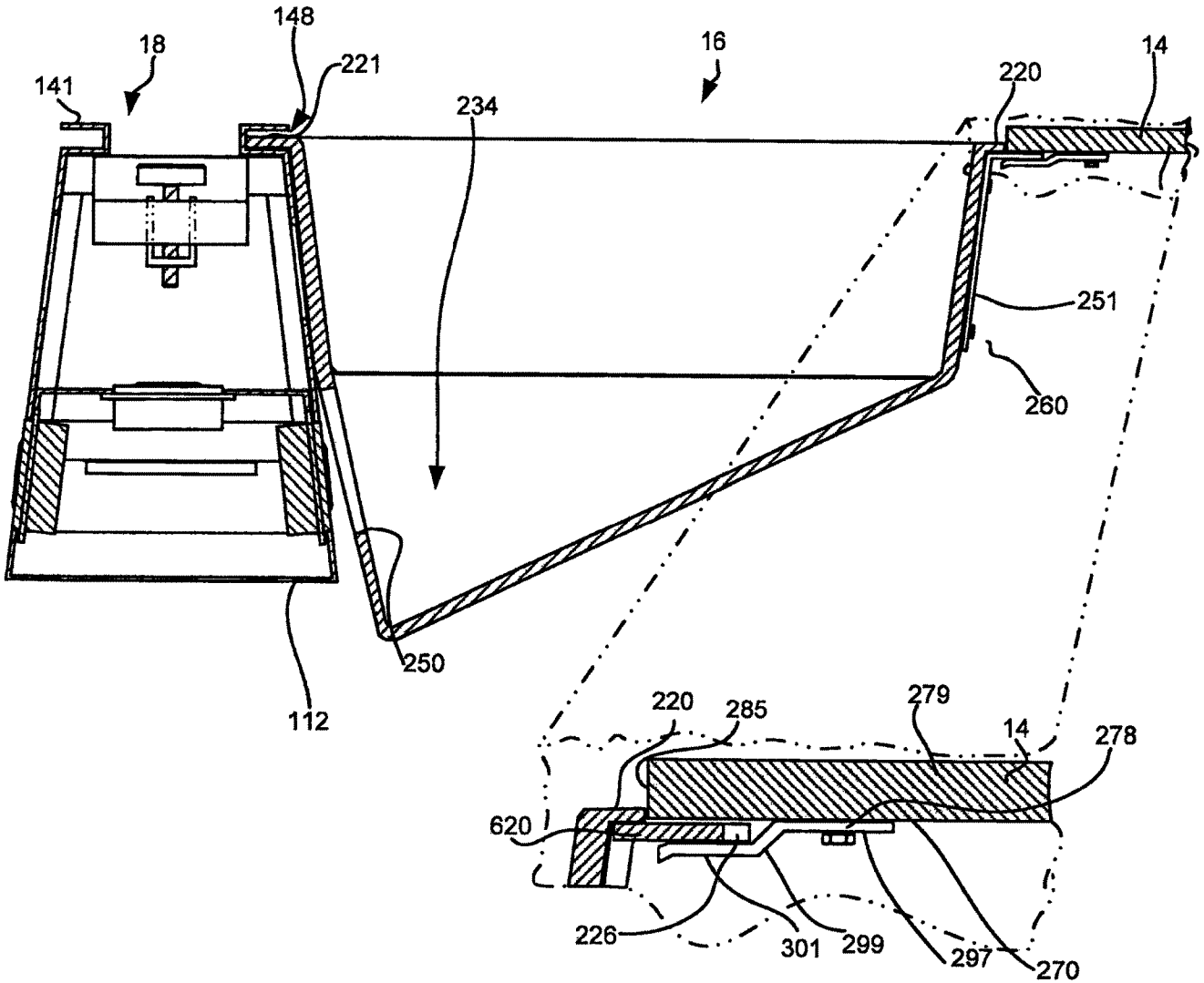
FIG. 26 is a partial cross-sectional view similar to the view of FIG. 10, albeit where a trough member 16 is mounted to a channel assembly and a table top assembly 14 is mounted to the trough member.

Shelf member 184 forms a substantially horizontal upper support surface 187. In addition to vertical member 186 and shelf member 184, proximal portion 181 also includes a lip member 190 that extends from the top end of vertical member 186 along a direction which is generally opposite the direction in which shelf member 184 extends. Lip member 190 includes an arm member 192 and a distal lip or finger member 194 that extends vertically upward from a distal end of member 192. Referring also to FIG. 26, lip member 190 is shaped and dimensioned so as to be receivable within one of the slots (e.g., 46 in FIG. 26) formed by rail member 24 such that vertical member 186 extends vertically downward therefrom and bearing surface 185 rests against the outer surface of the wall member 32 that forms the slot 46 when lip member 90 is received in the slot.

Referring to FIG. 12, the distal portion 183 has a cross section along most of its length that is similar to the cross section in FIG. 13, albeit not including lip member 190. Distal portion 183 extends at an angle $\alpha$ with respect to proximal portion 181. In at least some embodiments angle $\alpha$ is between zero and 60 degrees and in some cases angle $\alpha$ is between ten and twenty-five degrees.

At the distal end 182 member 15 only includes the vertical member 186 and does not include shelf member 184. Shelf member 184 forms an opening 196 near distal end 182 and forms a key member 203 that extends perpendicular to member 184. The distal end of member 186 is referred to hereafter as a finger member 198. Referring again to FIG. 12, a shoulder member 620 extends from an edge of and co-planar with shelf member 184 in a direction opposite lip member 190.

Referring now to FIGS. 14 through 19, exemplary trough member 16 is an elongated rigid body member that extends between first and second opposite ends 216 and 218, respectively. In at least some cases, trough member 16 is formed of rigid plastic via a vacuum forming process that is particularly suited for forming a feature rich trough member that includes a bottom wall member 225 including undulations that can define different trough depths and other interesting features useful for dividing a trough space 228 into several different trough sub-compartments particularly suitable for specific purposes. In other embodiments the trough member may be formed of bent metal.

Figure 15:
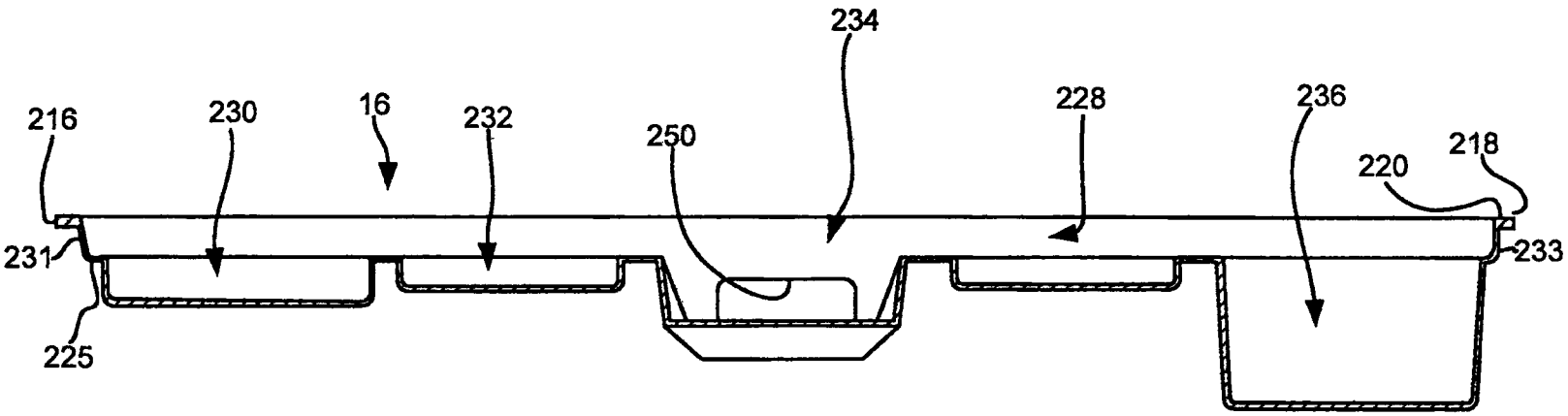
FIG. 15 is a cross-sectional view taken along the line 15-15 in FIG. 14.
Figure 16:
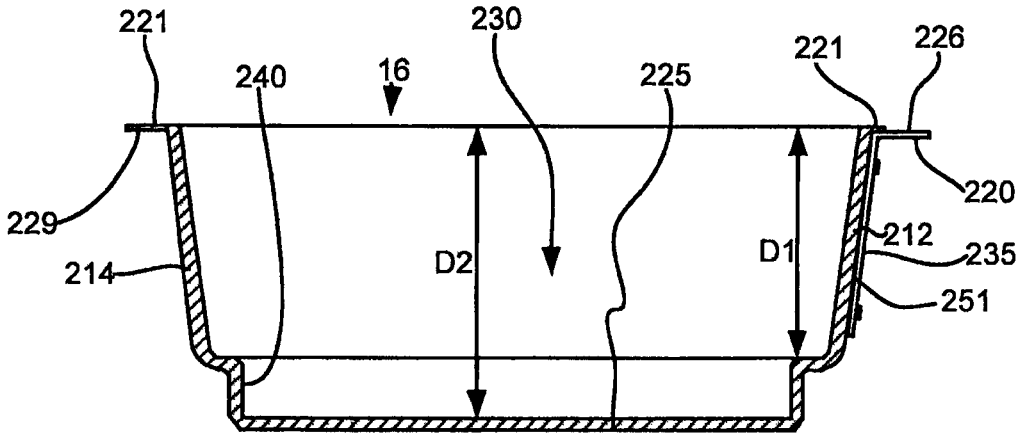
FIG. 16 is a cross-sectional view taken along the line 16-16 in FIG. 14.
Figure 17:
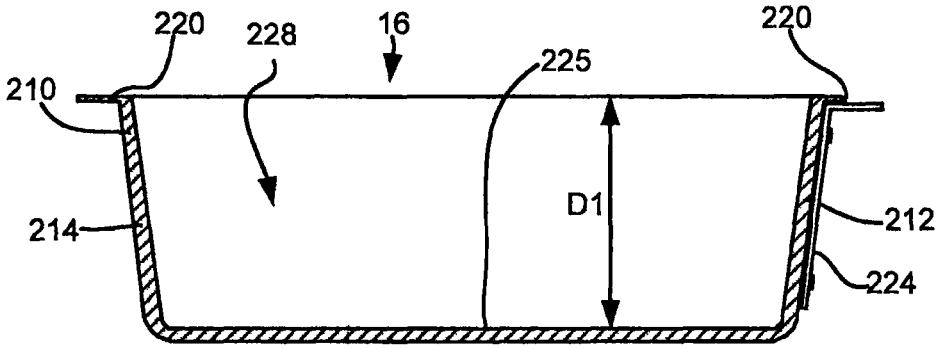
FIG. 17 is a cross-sectional view taken along the line 17-17 in FIG. 14.

Referring specifically to FIGS. 15 and 16, generally, trough member 16 includes a front wall member 212, a rear wall member 214, a first side wall member 231, a second side wall member 233 and a floor or bottom wall member 225. The front and rear wall members 212 and 214 and side wall members 231 and 233 are spaced apart to generally define a rectilinear trough space 228 and bottom wall member 225 generally closes off the bottom end of space 228 while the top end is left open to facilitate access into the trough space. At upper ends of the front and rear wall members 212 and 214 and the side wall members 231 and 233, an outwardly extending lip member 220 is formed. Lip member 220 forms an upper surface 221 as well as a lower surface 229. A trough width dimension generally between the front and rear wall members 212 and 214 is generally between three and twenty-two inches and, in some embodiments is around 18 inches.

Figure 14:
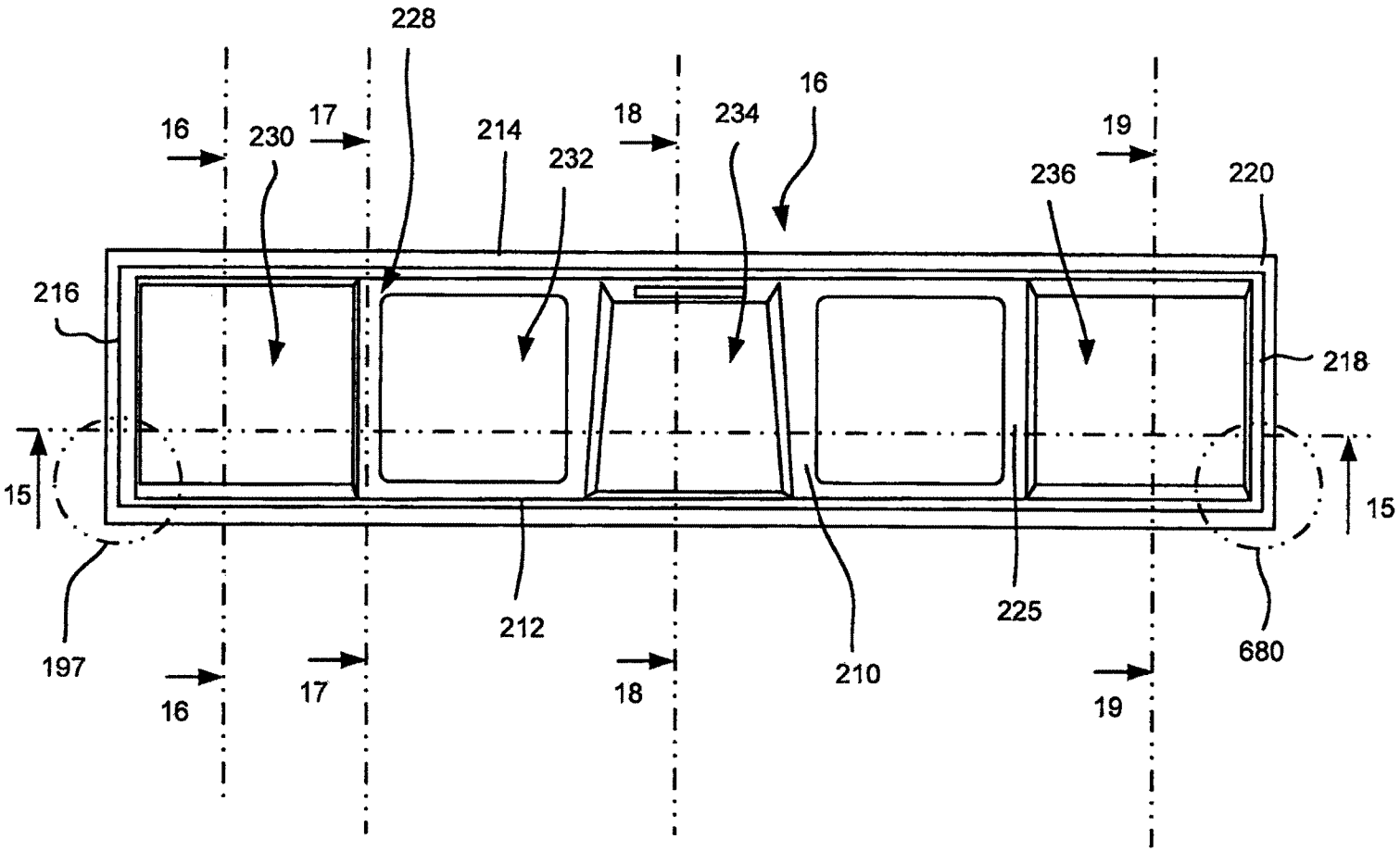
FIG. 14 is a top plan view of the trough member that forms part of the assembly shown in FIG. 1.
Figure 18:
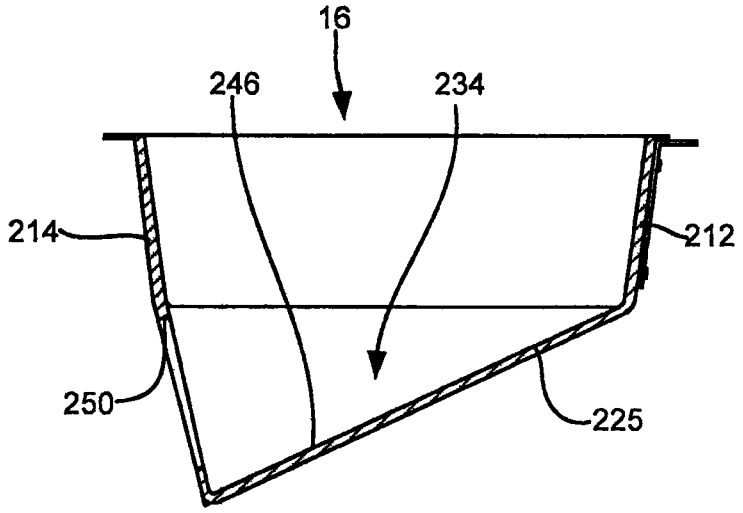
FIG. 18 is a cross-sectional view taken along the line 18-18 in FIG. 14.
Figure 19:
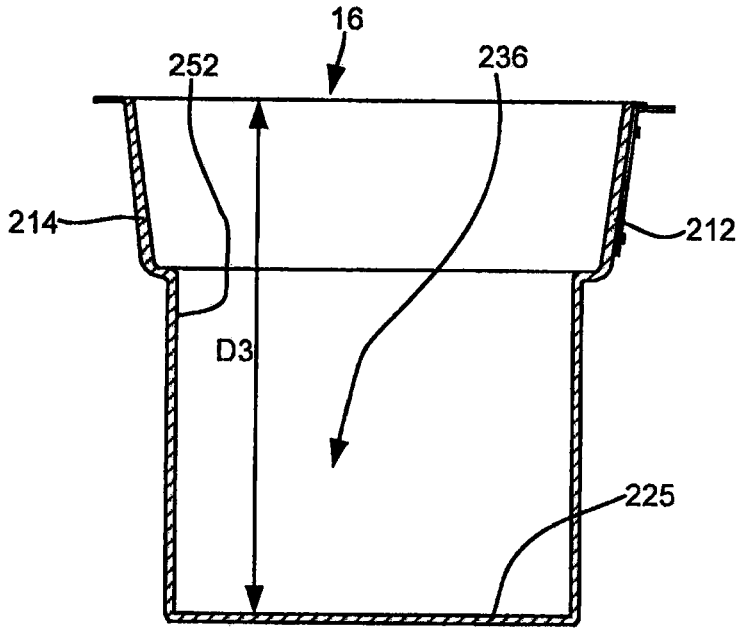
FIG. 19 is a cross-sectional view taken along the line 19-19 in FIG. 14.
Figure 20:
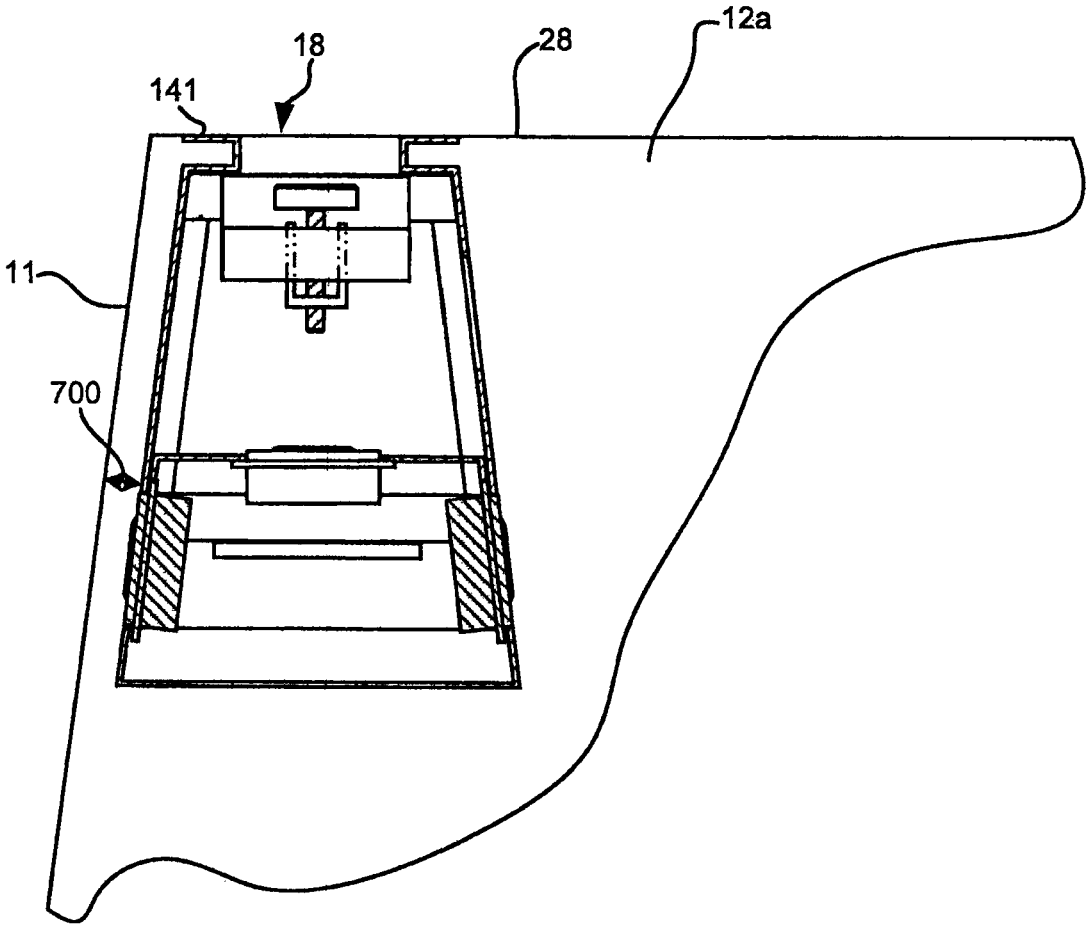
FIG. 20 is a partial cross-sectional view taken along the line 20-20 in FIG. 1.

Referring still to FIGS. 14 through 19, bottom wall member 225 has different depth portions (e.g., from three to twenty inches) along the length dimension of trough member 16. For example, referring to FIG. 17, a general depth portion of trough space 228 is illustrated where the depth is labeled D1. Referring to FIGS. 14, 15 and 16, a left most portion 230 of the trough space forms a further recessed portion 240 having a depth D2 which is greater than depth D1. Here, for instance, depth D2 may be one inch deeper than depth D1 and provide a space for storing pencils, pens, a stapler, a scissors, etc. Referring to FIGS. 14, 15 and 19, at a right most portion of the trough space as illustrated in FIGS. 14 and 15, the lower wall 225 extends to a depth D3 to form a file bin 252 portion suitable for receiving standard size office files or the like.

Figure 25:
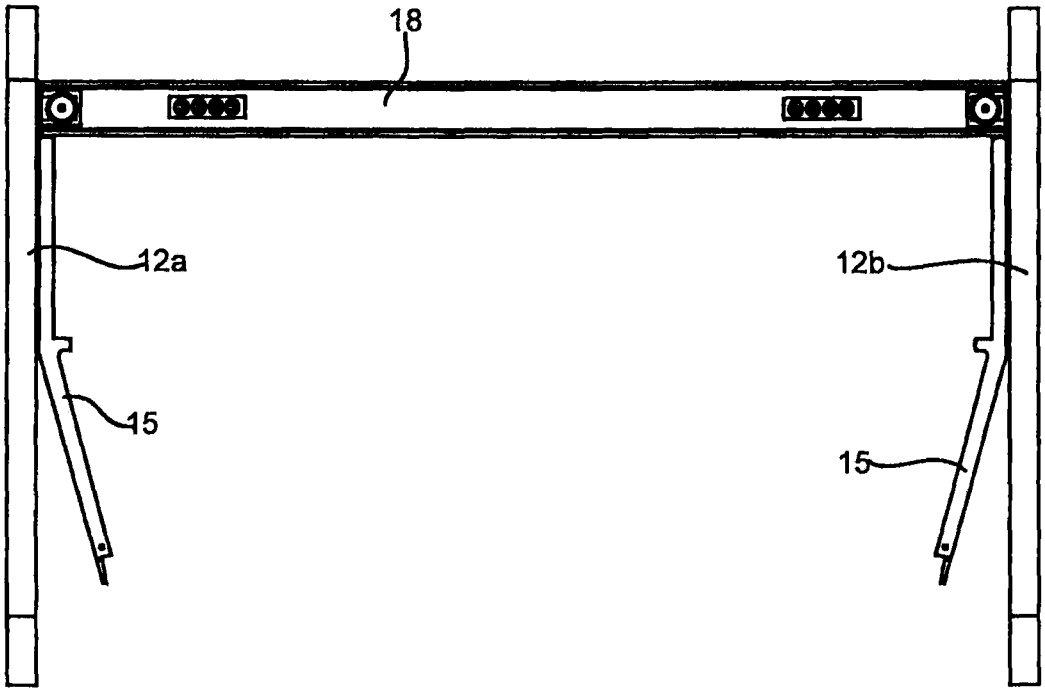
FIG. 25 is a top plan view of a subset of the components that comprise the assembly of FIG. 1 in a partially assembled condition.

Referring still to FIGS. 14 and 15 and also to FIG. 18, centrally, trough bottom wall 225 forms an internal surface 246 that slants from the bottom edge of front wall member 212 downward to a location below the bottom edge of wall member 214 to form a wire access space 234. Here, bottom wall 225 also forms an opening 250 below rear wall member 214. Referring also to FIG. 25, opening 250 is formed at a location that aligns with one of the outlet receptacles 212 mounted in the channel housing member 110 when the overall assembly shown in FIG. 1 is configured.

Because trough member 16 is formed of a plastic material, while rigid, member 16 is also relatively flimsy and therefore, while sufficient for supporting most office supplies, member 16 alone cannot withstand greater loads without potentially bending or flexing along its length dimension. After assembly, as shown in FIG. 25, the rear edge of trough member 16 is received within channel 148 formed by channel housing member 110 and therefore the rear edge of trough member 16 is additionally supported. To help support the front edge portion of trough member 16, a metal stringer member 251 is secured to the outer surface of front wall member 212 just below lip member 220 via screws, rivets, an adhesive, or some other type of mechanical fastener. Stringer member 251 extends the length of trough member 16 between ends 216 and 218 (see again FIG. 14) to provide support along the entire length dimension of trough member 16. As seen in FIG. 16, stringer member 251 is generally L-shaped including a first member 235 and a second or extending member 226 that extends along a length of dimension of member 235 and forms a slightly obtuse angle with member 235. Stringer member 251 is mounted with first member 235 mounted to the external surface of member 212 and member 226 disposed under and extending past a distal edge of lip member 220. The distal portion of extending member 226 forms a top trough support surface (i.e., a support surface associated with the trough member 16 that supports a table top as described hereafter).

Figure 21:
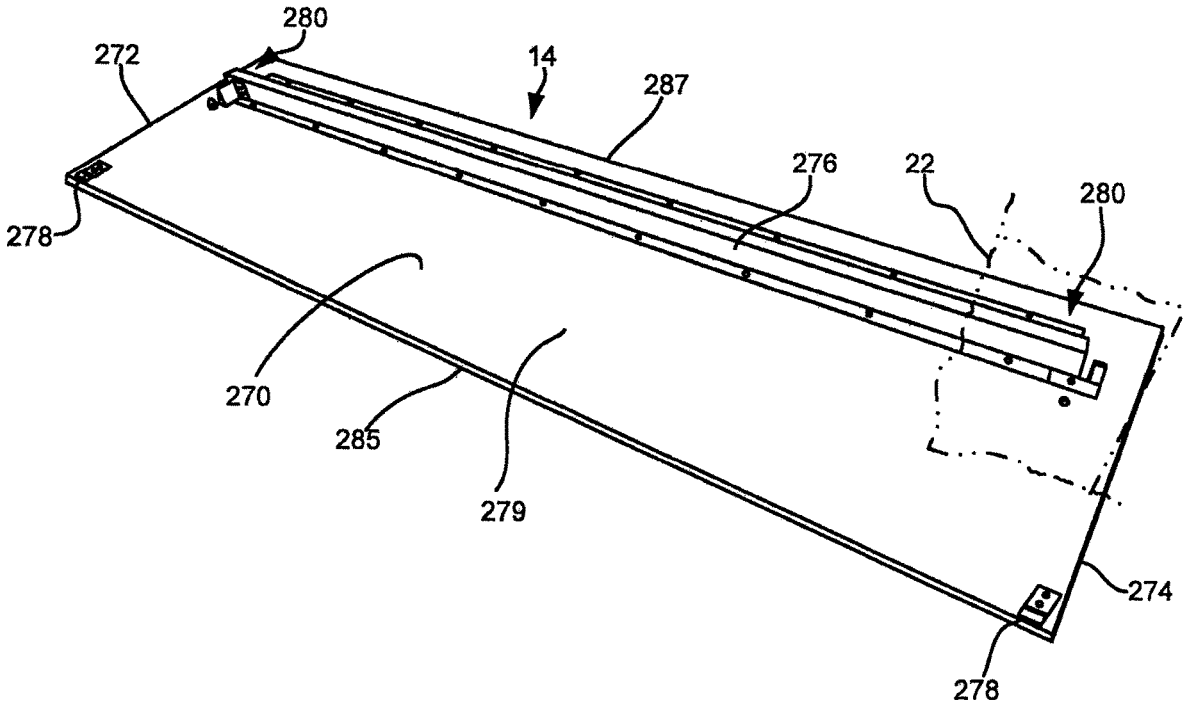
FIG. 21 is a perspective view of the table top assembly shown in FIG. 1, albeit upside down showing an undersurface and structure thereon.
Figure 22:
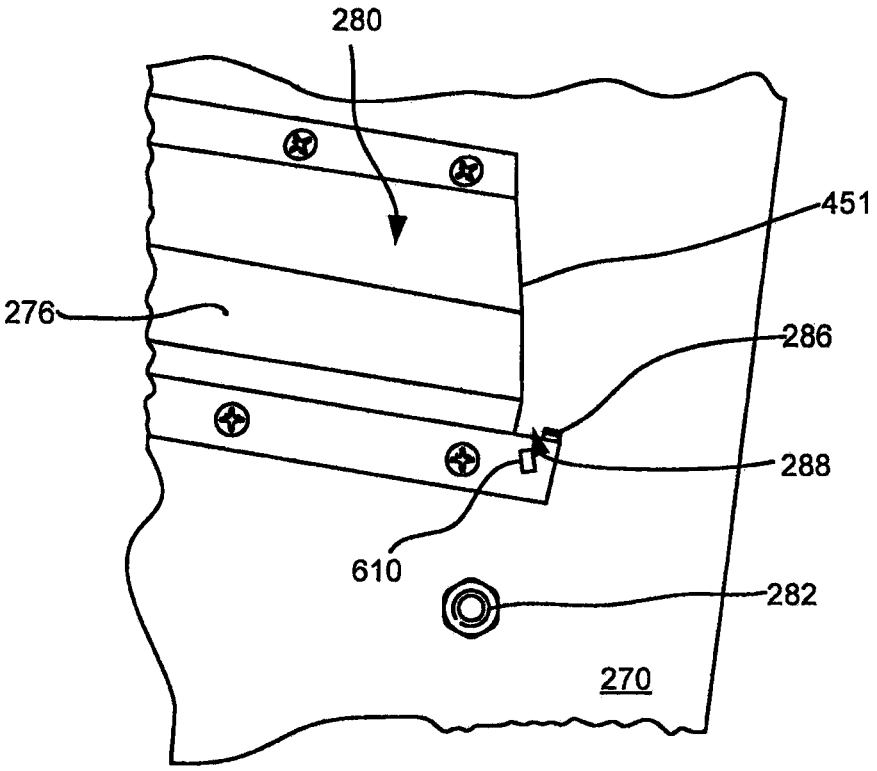
FIG. 22 is a partial perspective view of the coupling assembly at one end of the table top member shown in FIG. 21.

Referring now to FIGS. 21 and 22, table top assembly 14 includes a table top member 279, first and second edge brackets 278, a metal strengthening runner 276 and first and second coupling assemblies 280. Top member 279 is a rigid rectilinear member that extends along a length dimension between side edges 272 and 274 and that has oppositely facing front and rear edges 287 and 285, respectively. Member 279 also has a top surface (see FIG. 1) and a bottom surface 270. Brackets 278, strengthening runner 276 and coupling assemblies 280 are all mounted to bottom surface 270 of top member 279.

Referring still to FIG. 21 and also to FIG. 26, each of the edge brackets 278 has a generally flattened S-shape (best seen in FIG. 26) including a mounting plate 279, an arm plate 299 and a finger member 301. The mounting plate 297 is flat and rectilinear and mounts to the undersurface of top member 270. Arm plate 299 forms an angle with mounting plate 297 so that a distal end is spaced apart from the undersurface of top member 270 and finger member 301 extends from the distal end of arm plate 299 and is generally parallel to mounting plate 297 such that finger member 301 and the undersurface of top member 270 form a slot. The width of the slot is similar to a thickness of the runner member 236 that extends along the length of trough member 16 as shown in FIG. 26. Edge brackets 278, as best shown in FIG. 21, are mounted adjacent rear edge 285 and adjacent lateral edges 272 and 274 of top member 279.

Referring again to FIGS. 21 and 22, strengthening runner 276 is a bent sheet metal member that extends along the length dimension of, and is attached to, the undersurface 270 of top member 279 where distal ends are spaced apart from side edges 272 and 274. Member 276 is located generally along front edge 278 of top member 279. Runner 276 provides additional strength for top member 279 along the front edge thereof.

Referring specifically to FIG. 22, at each end, strengthening runner 280 forms an edge 451 that is generally perpendicular to undersurface 270. In addition, spaced apart from edge 311, runner 276 includes a relatively small finger member 286 (see also FIGS. 29 and 30) that extends generally perpendicular to bottom surface 270 such that the edge of member 286 facing strengthening runner edge 450 and edge 450 form a slot 288. Slot 288 has a width dimension that is slightly greater than the width of finger member 198 at the distal end of arm support member 15 as shown in FIG. 12. Opening 610 is sized and dimensioned to receive key member 203 on support member 15 (see again FIG. 12).

Referring still to FIG. 22, a metal stud 282 is embedded (e.g., adhered within an opening) in the undersurface 270 proximate slot 288 so that when alignment member 203 (see again FIG. 12) is received in slot 610, opening 196 is aligned with a threaded opening formed by the metal stud 282.

Figure 23:
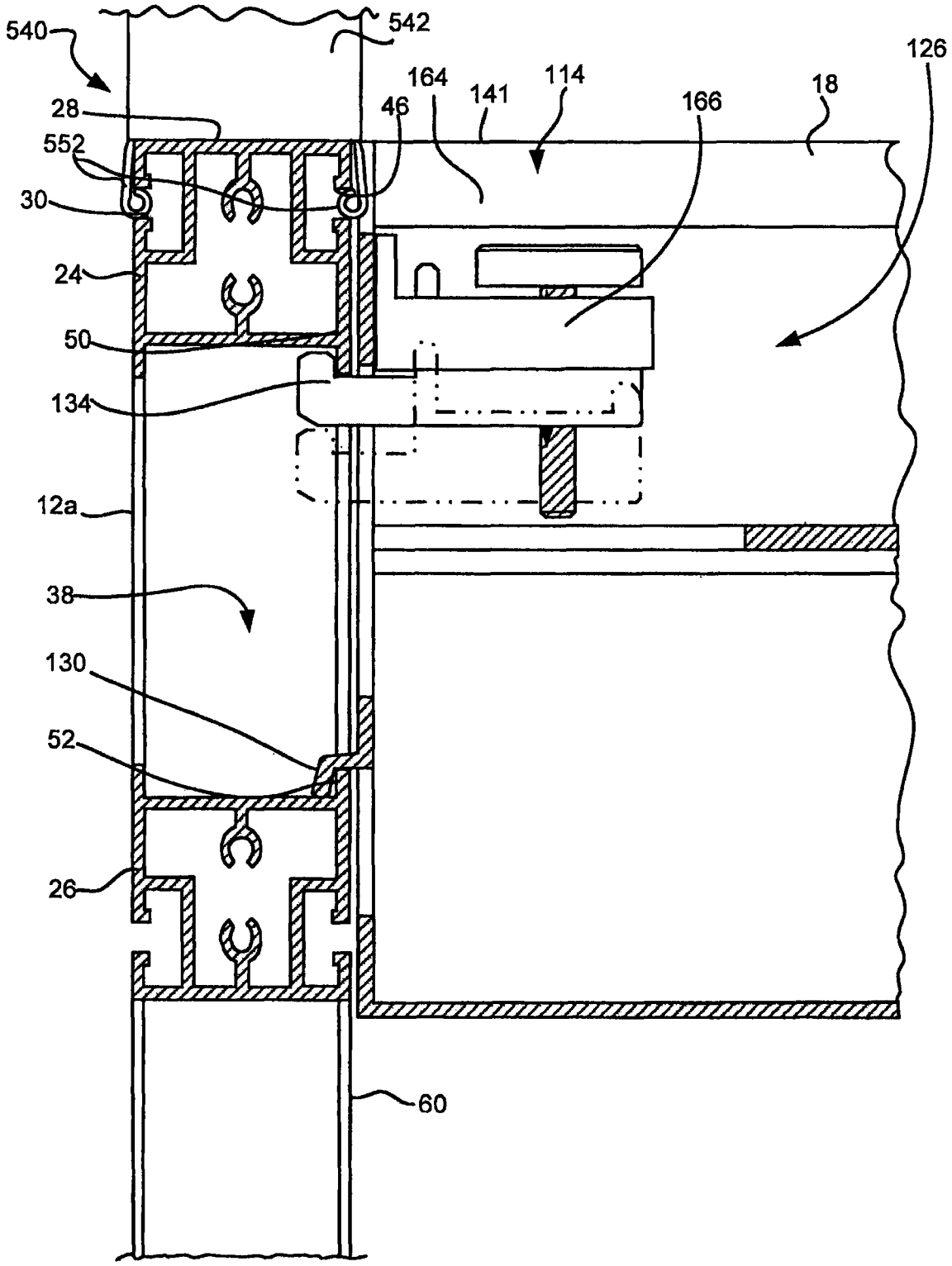
FIG. 23 is a view similar to the view shown in FIG. 4, albeit with the channel assembly of FIG. 1 attached to the leg assembly of FIG. 4.

Referring now to FIGS. 1, 2, 8 and 9, to assemble the configuration shown in FIG. 1, initially, coupling assemblies 114 and 116 are loosened so that finger members 134 are generally spaced apart from top cross members 124. Next, holding one of the leg assemblies 12*a* in an upright position as shown in FIG. 23, channel assembly 18 is aligned with the top end of the leg assembly 12*a* so that lip members 134 and 130 are generally aligned with opening 38 formed between rail members 24 and 26. Channel assembly 18 is moved toward the external surface 60 of leg assembly 12*a* until lip members 134 and 130 are located within the space between rail lip members 50 and 52 and then is moved downward until lip member 52 is received by lip member 130. The second leg member 12*a* is temporarily attached to the opposite end of channel assembly 18 in a similar fashion. To assemble the FIG. 1 configuration 10, channel assembly 18 is located at rear portions of leg assemblies 12*a* and 12*b* so that most of the frame space 13 is to a front side of assembly 18 (see FIG. 25).

Figure 29:
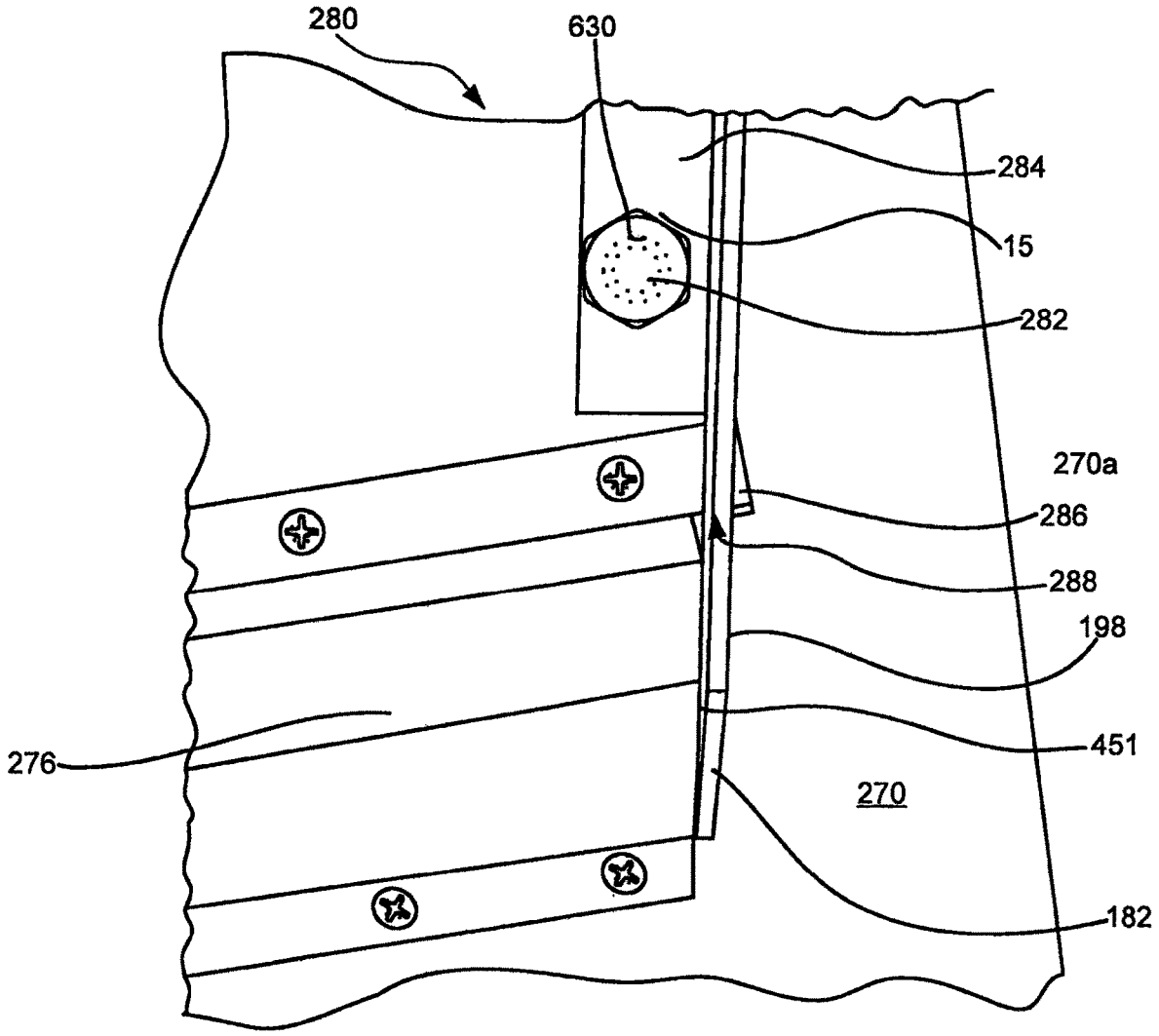
FIG. 29 is a view similar to the view shown in FIG. 22, albeit where a table top assembly is coupled to the distal end of one of the arm support members.

Referring still to FIG. 23, bolt 163 is rotated causing jaw member 164 and associated lip 134 to move upward until lip member 134 catches rail lip 50. Upon further tightening of bolt 163, channel member 18 is tightly secured to leg assembly 12*a*. The other coupling assembly 116 is similarly tightened to secure the opposite end of channel member 18 to second leg assembly 12*b*. At this point, frame space 13 is defined by the facing surfaces of leg members 12*a* and 12*b*, where the frame space has a rear edge portion adjacent channel assembly 18 and a front edge portion near leg member front surfaces 11 and an intermediate portion between the front and rear portions. Referring to FIG. 29, channel assembly 18 is spaced 700 slightly (e.g., ½ inch) from the rear surface of the leg assemblies 12*a*, 12*b* and top surface 141 is flush with the top surfaces 28 of leg members 12*a* and 12*b*.

Referring again to FIG. 23, after channel member 18 is secured to one of the leg assemblies 12*a*, the portion of the upper rail slot 46 aligned with the top opening 114 in the upper channel 126 is exposed within the opening 114. Thus, in at least some cases additional optional accessories may be mounted to upper rail 24 via the exposed portion of slot 46 (e.g., see clips 552 in FIG. 23 that help to attach a privacy screen 540 (see also FIG. 54 described below).

Figure 24:
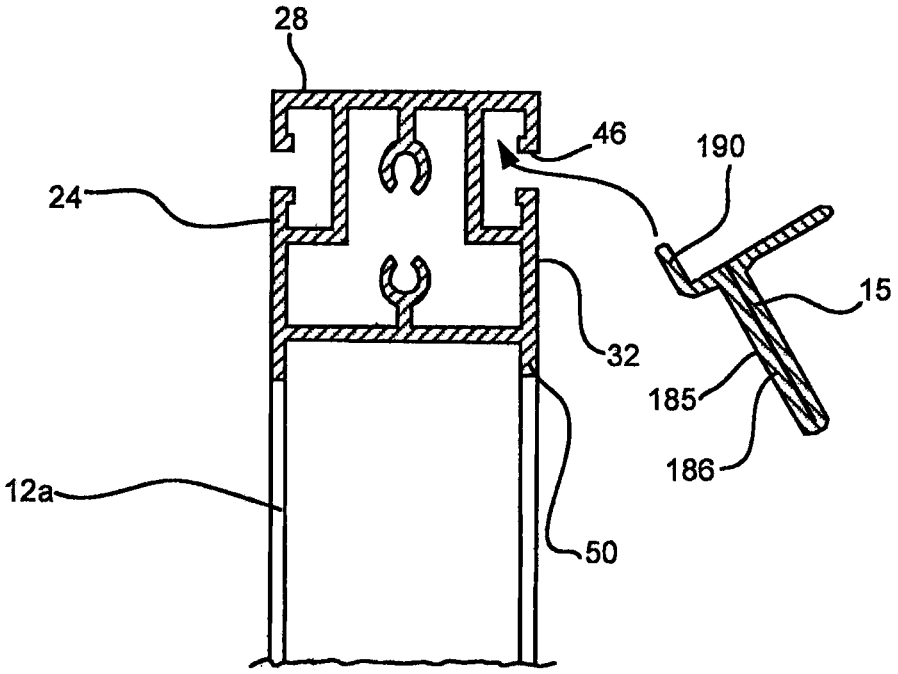
FIG. 24 is similar to the view shown in FIG. 4, albeit showing the support arm member of FIG. 12 being attached to an upper rail of one of the leg assemblies.
Figure 27:
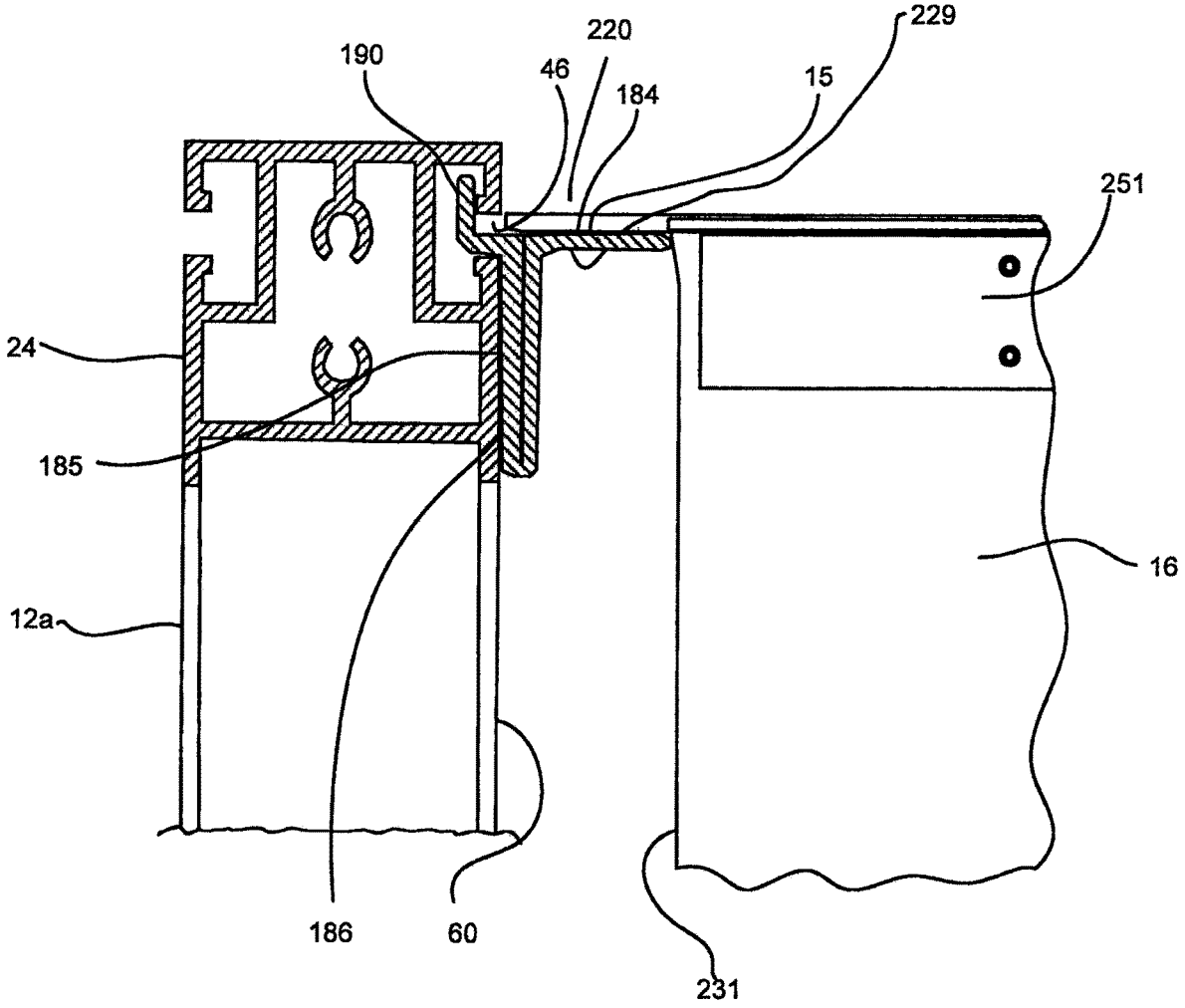
FIG. 27 is similar to FIG. 24 albeit showing the support arm member of FIG. 12 mounted to a top rail of a leg assembly and a trough member mounted to the support arm member.

Referring again to FIG. 2 and also now to FIG. 24, arm support members 15 are next attached to facing surfaces of leg assemblies 12*a* and 12*b*. To this end, the upwardly extending lip member 190 of one of the arm members 15 is aligned with the T-slot 46 formed by top rail 24 and is manipulated there into so that lip member 190 extends into the slot 46 and bearing surface 185 bears against an outer surface of wall member 32 that forms slot 46 (see also FIG. 27). The other arm member 15 is attached to the other leg assembly 12*b* in a similar fashion. At this point, the sub-assembly appears as shown in FIG. 25.

Referring again to FIG. 2 and also to FIG. 26, trough member 16 is next installed. To this end, the rear edge of lip member 220 is aligned with channel 148 formed by channel assembly housing 110 and is moved into the channel 148 while the front edge portion of the trough member is held up above the supporting surfaces of the arm members 15. Once the rear portion of lip member 220 is received within channel 148, the front edge portion of trough member 16 can be lowered until the undersurface of lip member 220 bears against the top support surfaces 184 of support members 15. At this point the sub-assembly configured has the appearance shown in FIG. 28.

Figure 28:
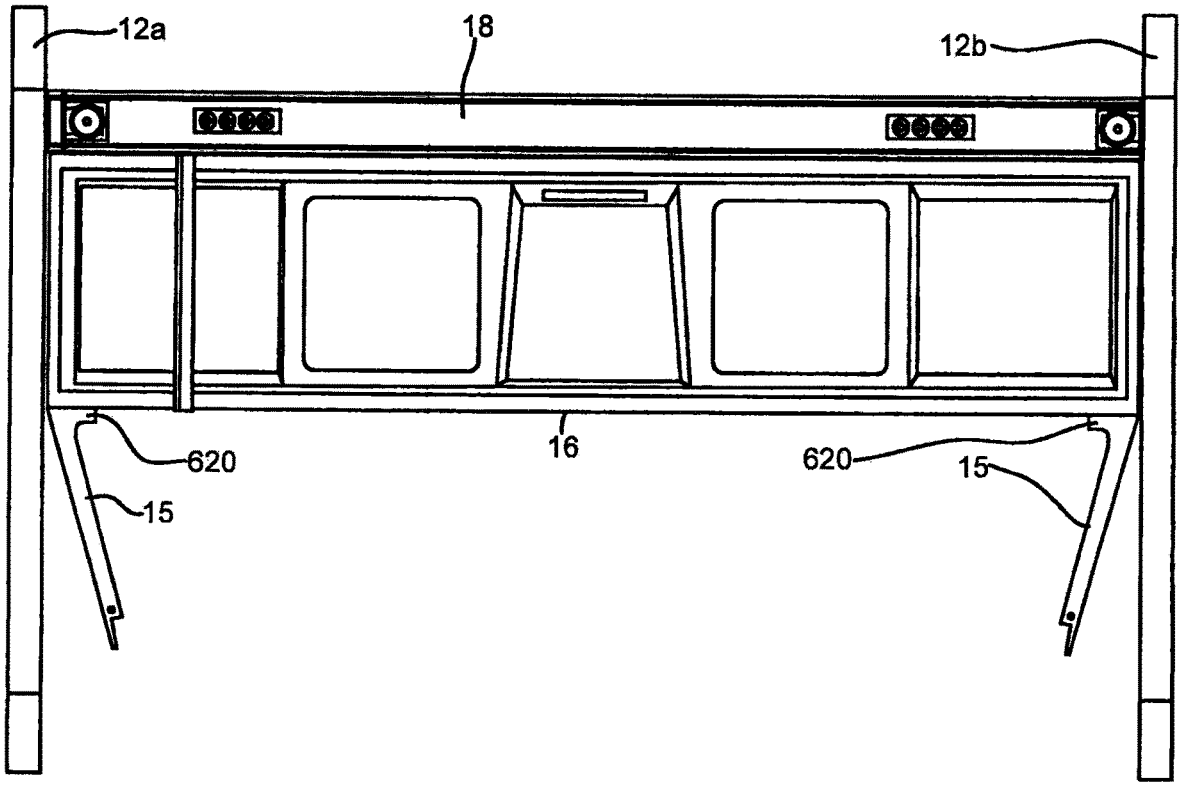
FIG. 28 shows a subset of the components of FIG. 1 in an intermediately assembled state.

Referring again to FIGS. 21 and 26, to mount table assembly 14 to the sub-assembly shown in FIG. 28, the table assembly 14 is positioned with the rear edge 285 adjacent the front edge portion 236 of runner 251 and so that brackets 278 are generally aligned with shoulder members 620 formed by support members 15 (see FIG. 12). Top assembly 14 is moved toward through member 16 until shoulder members 620 are sandwiched between the table top member undersurface 270 and clip member 301. In at least some embodiments the end portions of runner lip member 226 may also be sandwiched between undersurface 270 and clip member 301. Next, front edge 287 portion of table top assembly 14 is rotated downward above the distal ends of arm members 15 with slots 610 aligned with key members 203 (see FIGS. 12 and 22).

Figure 30:
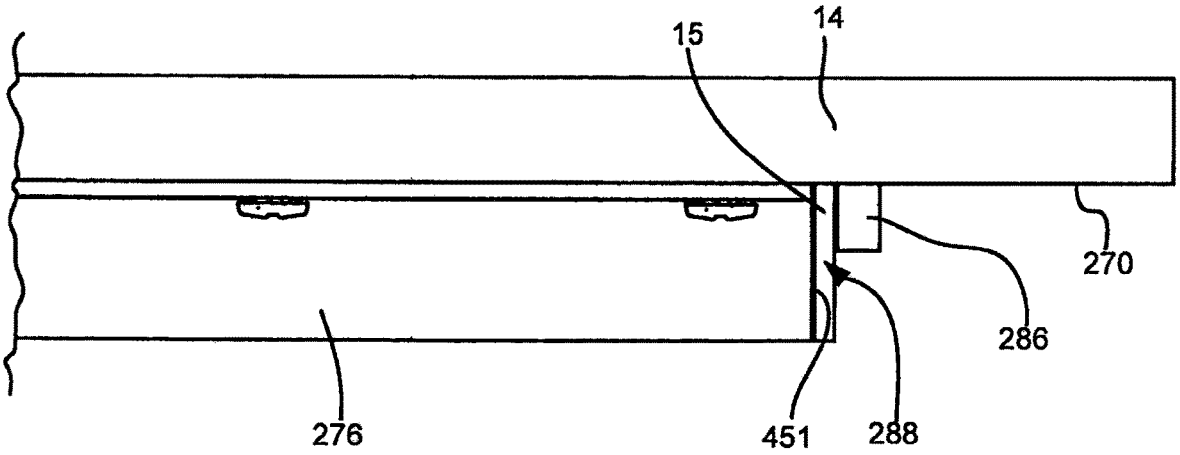
FIG. 30 is a front end view of the coupling assembly and arm support member of FIG. 29.
Figure 31:
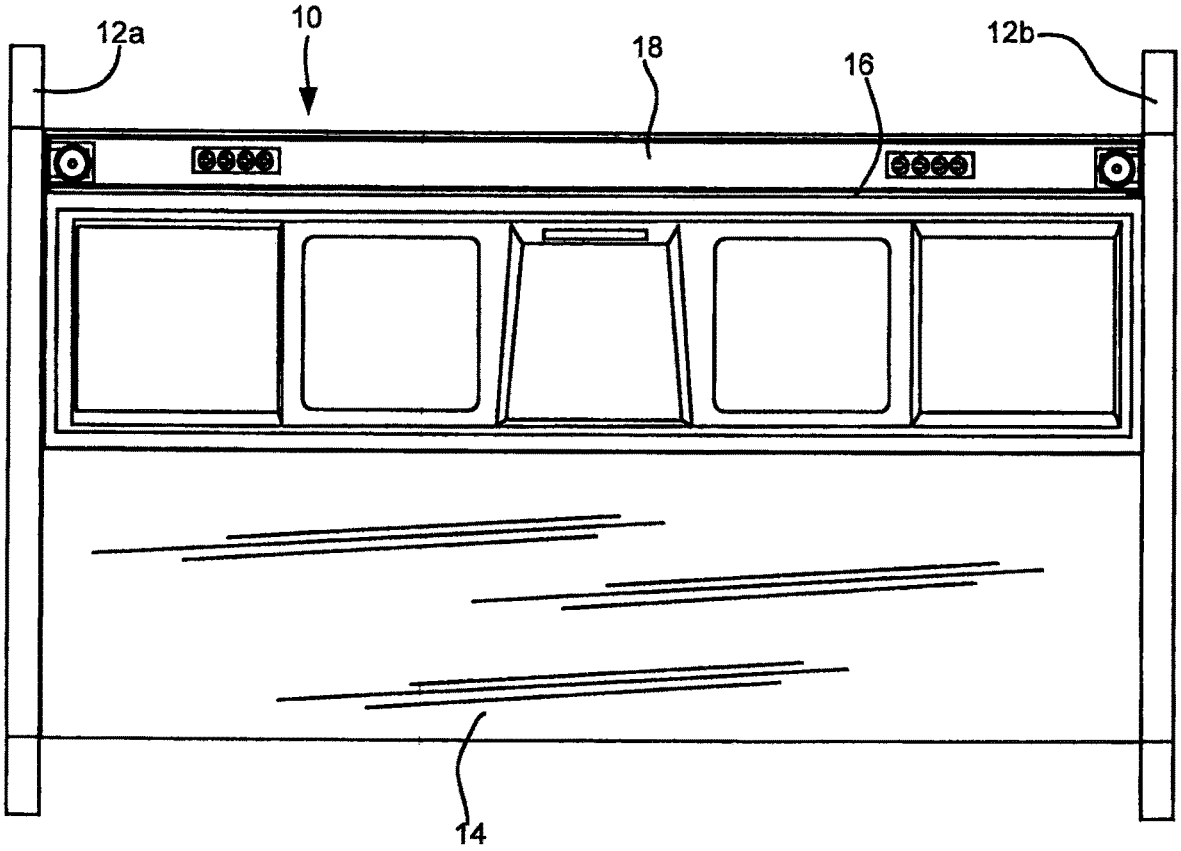
FIG. 31 is a top plan view of the assembly of FIG. 1.

While the front edge portion of the table assembly is being lowered, key members 203 slide into slots 610. In addition, finger members 198 formed at the distal ends of support arm members 15 are received within slots 288 between edge 451 of strengthening runner 176 and the facing edge of finger member 286 as shown in FIGS. 29 and 30. Finger tightenable bolts 630 are passed through openings 196 (see FIG. 12) and are threadably received in studs 282 to secure top member 297 to arm support members 15. Together, the mating between pin 282 and opening 196, the mating between finger member 198 and slot 288 and mating between bolts 630 and studs 282 securely connect top member 279 to arm members 15. Referring once again to FIG. 1, at this point the configuration shown in FIG. 1 is completely assembled. See also FIG. 31 that shows the configuration of FIG. 1 in a top plan view.

Referring again to FIG. 1, top member 279 has a thickness dimension such that after installation, top surface 9 of member 279 is at a height that is flush with the top surfaces 28 of leg assemblies 12*a* and 12*b*. Similarly, referring also to FIG. 10, the top surface 141 of channel housing 110 is at a height that is flush with top surfaces 28 of leg assemblies 12*a* and 12*b* after installation (see also FIG. 23). Referring to FIG. 26, a top surface 221 of trough lip member 220 is recessed below (e.g., one-quarter inch) the top surfaces of the leg assemblies 12*a* and 12*b*.

Figure 32:
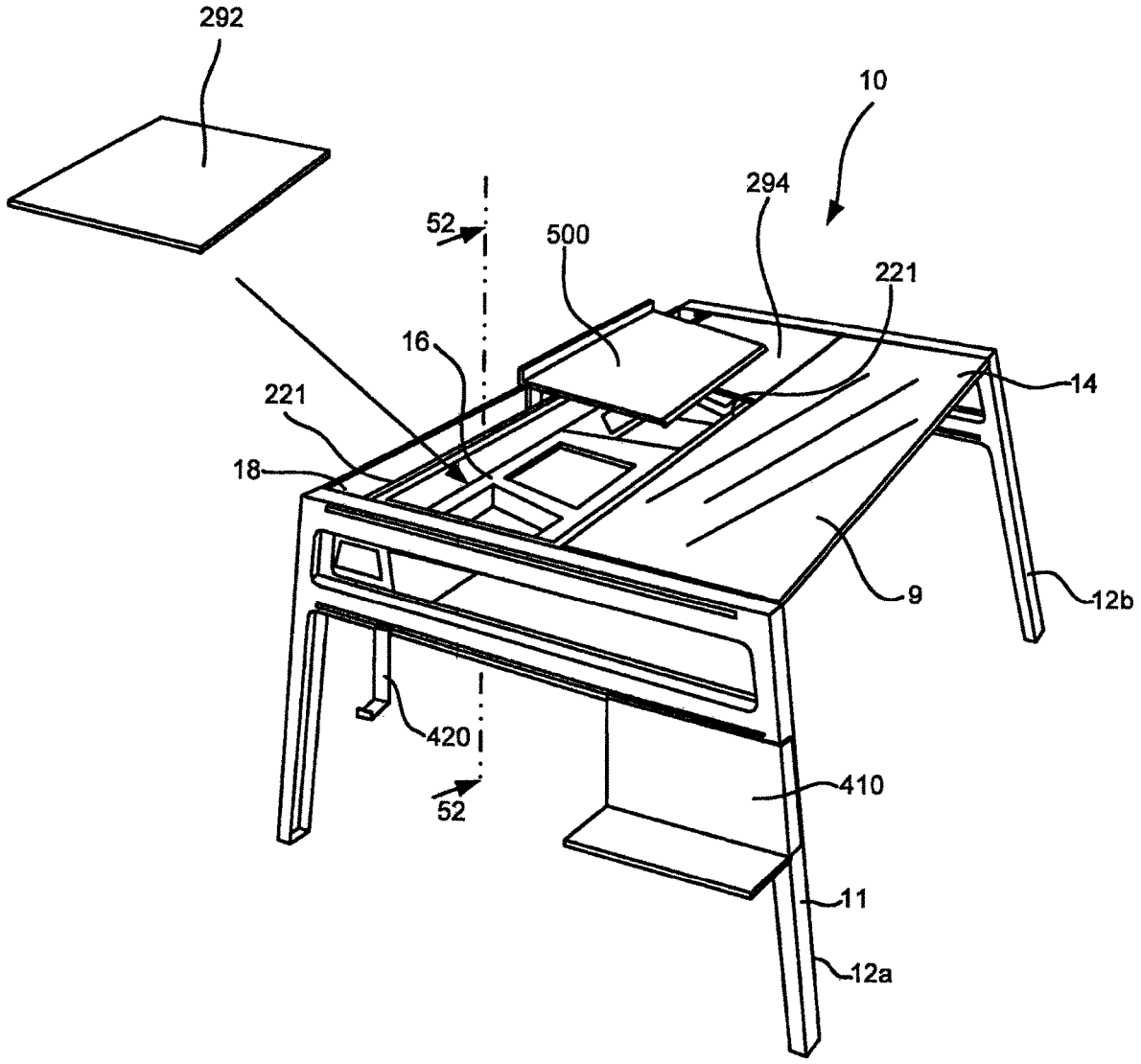
FIG. 32 is a perspective view similar to the view shown in FIG. 1, albeit including sliding board members, a shelf bracket and a purse hook or bracket.

Referring once again to FIG. 16, in at least some embodiments it is contemplated that one or more sliding board or plate members may be provided that are dimensioned to be received on the shelf support surface 221 for sliding motion along the length dimension of trough member 16. Referring also to FIG. 32, exemplary sliding board members 292 and 294 are illustrated that may be placed on the shelf support 221 as shown. Board members 292 and 294 have thicknesses such that, when supported on surface 221, top surfaces of the boards are generally at the same height as top surface 9 of table top member 279. Thus, with boards 292 and 294 installed, the top surfaces thereof operate to provide additional work surface space if desired.

Figure 33:
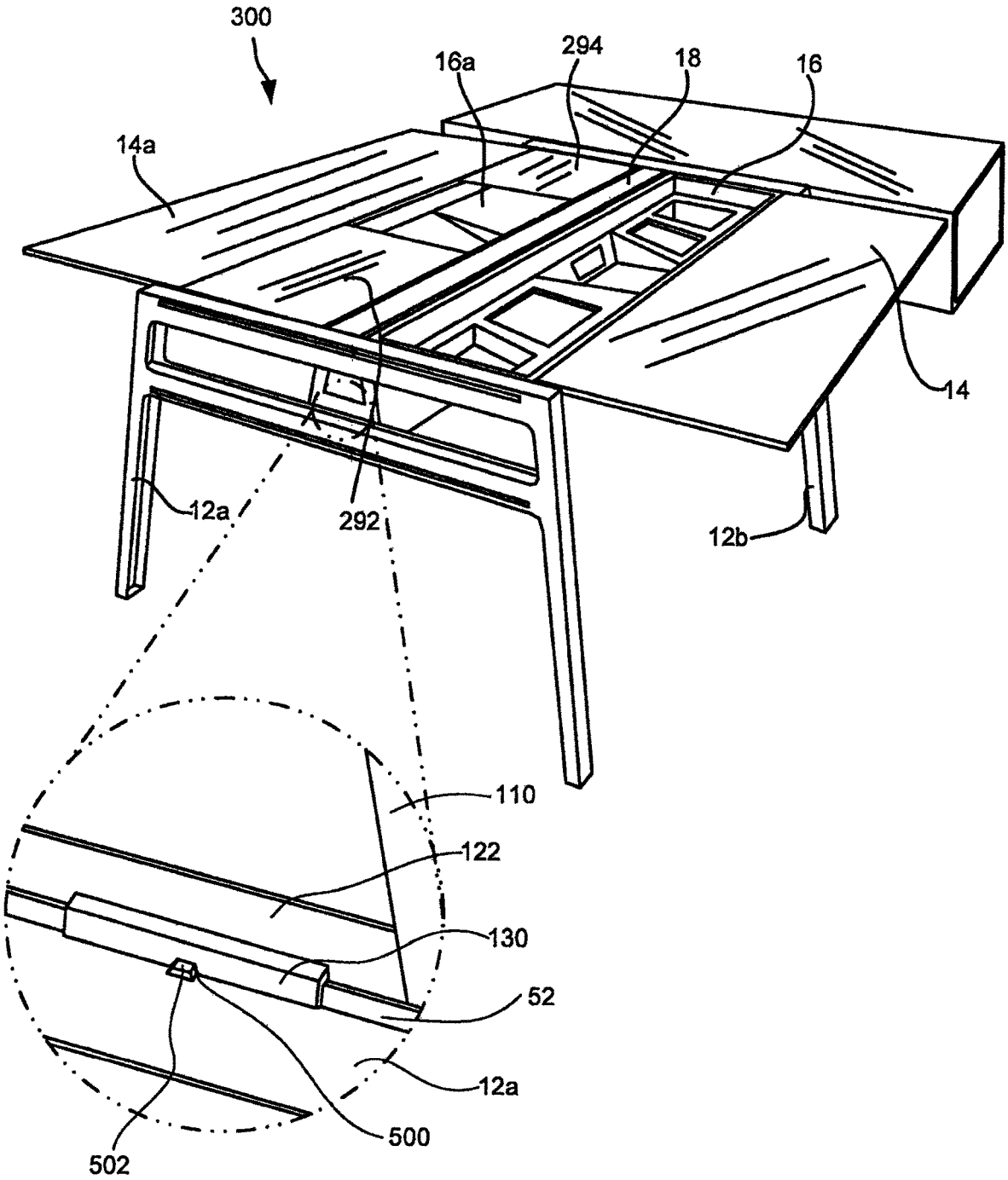
FIG. 33 is a view similar to the view shown in FIG. 1, albeit showing a second desk/table assembly that is consistent with at least some aspects of the present invention.

Referring now to FIG. 33, a second exemplary configuration 300 that is consistent with various aspects of the present invention is illustrated. This second configuration 300 includes all of the components described above with respect to the first configuration 10 as well as some additional components. To this end, configuration 300 includes first and second leg assemblies 12*a* and 12*b*, table top assembly 14, trough member 16 and channel assembly 18. In addition, second configuration 300 includes a second table top assembly 14*a* and a second trough assembly 16*a*. Configuration 300 is also shown with first and second sliding board or plate members 292 and 294 supported by the shelf surface of trough member 16*a*.

To configure the configuration 300 shown in FIG. 33, the configuration shown in FIG. 1 can simply be reconfigured. To reconfigure the configuration shown in FIG. 1, referring to FIG. 34, the coupling assemblies 114 and 116 can be loosened so that channel assembly 18 can be slid along the openings 38 (see again FIG. 1) to a central location with respect to, or to an intermediate portion of, leg assemblies 12*a* and 12*b*. When channel assembly 18 is slid, trough member 16 and table assembly 14 slide therewith into the positions shown in FIG. 34 where trough member 16 and table assembly 14 are generally adjacent front end portions of leg assemblies 12*a* and 12*b*. In addition, referring again to FIGS. 12 and 34, arm support members 15 slide to the locations shown in phantom in FIG. 34 where distal portions 183 thereof extend past the front surfaces 11 and forward of the frame space 13. Next, the coupling assemblies 114 and 116 can be tightened to secure channel assembly 18 in the central position. At this point, table assembly 14 extends past the front surfaces 15 of leg assemblies 12*a* and 12*b* but is still solidly supported by the distal ends of the support arm members 15 and the strengthening member 276 there below.

Figure 34:
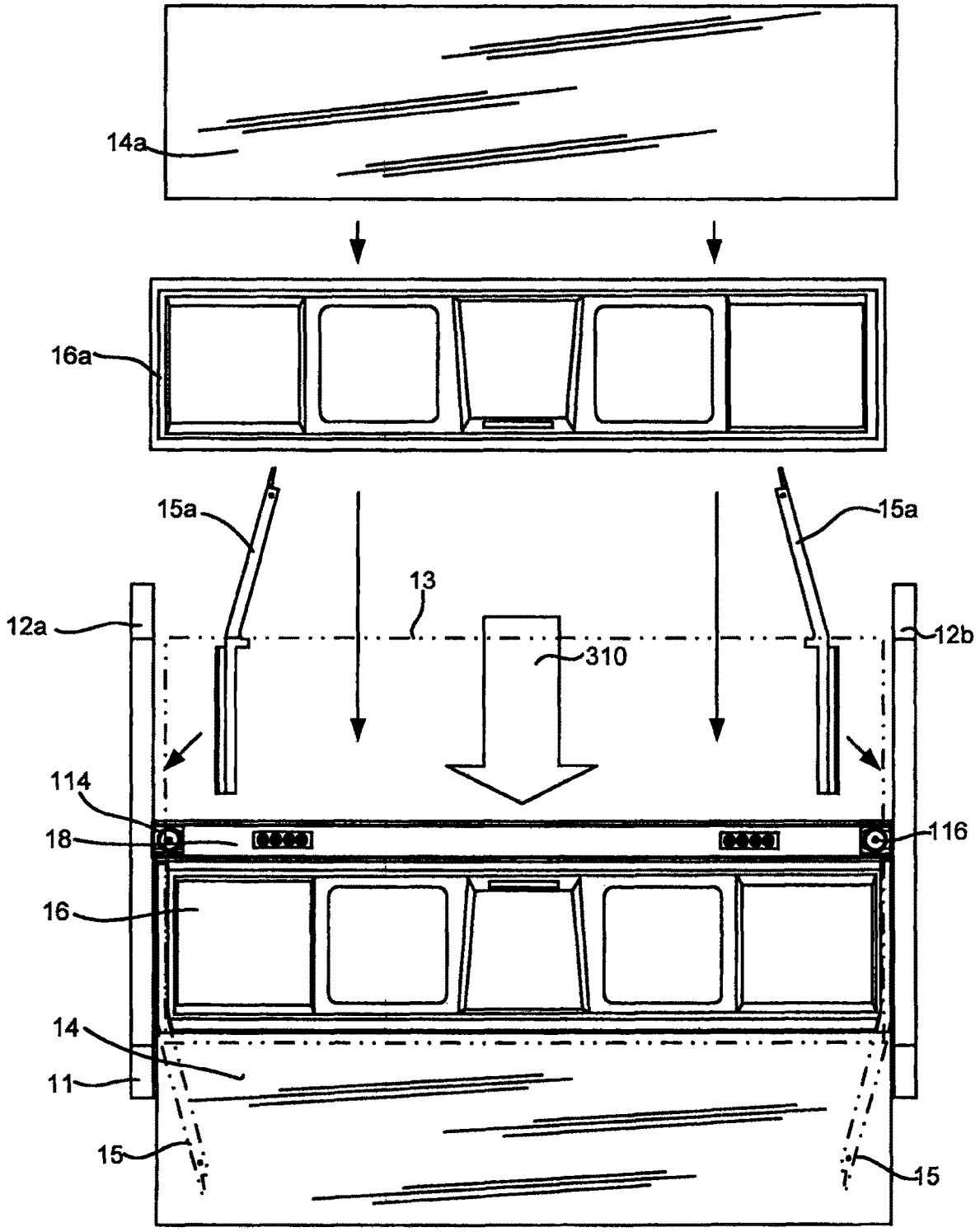
FIG. 34 is a top plan view showing the assembly of FIG. 33 in a partially assembled state.
Figure 35:
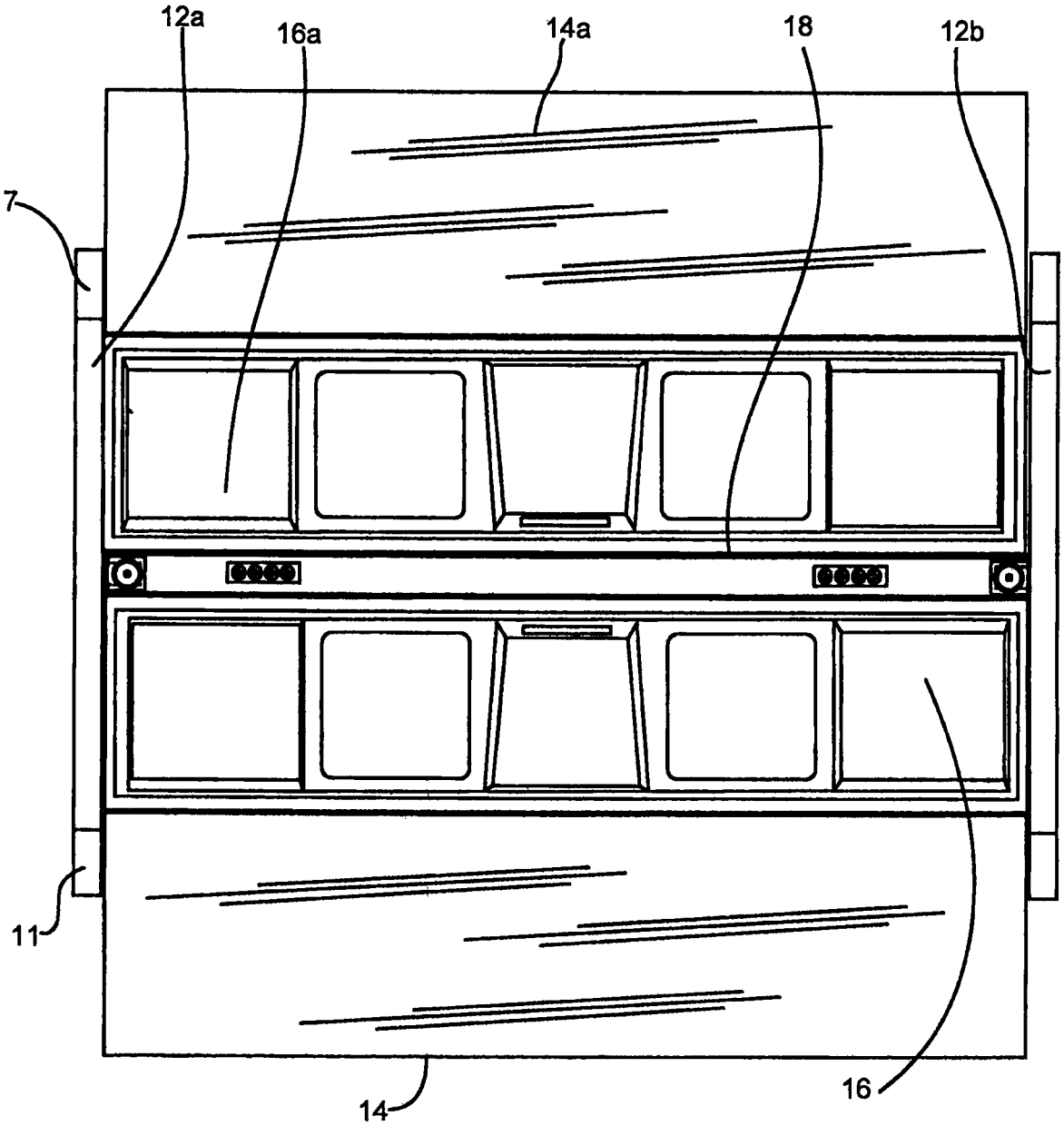
FIG. 35 is a top plan view of the assembly shown in FIG. 33.

Referring still to FIG. 34, third and fourth arm support members 15*a* are attached to the facing surfaces of leg assemblies 12*a* and 12*b* in an similar fashion to that described above with respect to members 15, albeit with the distal ends of arm members 15*a* extending in a rearward direction. Trough member 16*a* is attached with the rear edge thereof received in the second channel 146 (see again FIG. 10) formed by channel housing member 110 and side portions thereof supported by the top support surfaces formed by support arm members 15*a*. Table top assembly 14*a* is attached to the front edge of trough member 16*a* and distal portions of the top surfaces formed by arm members 15*a*. A top plan view of the resulting configuration 300 is shown in FIG. 35 where it can be seen that table assembly 14*a* and trough member 16*a* are generally adjacent rear end portions of leg assemblies 12*a* and 12*b*.

Thus, it should be appreciated that the configuration 10 in FIG. 1 can be reconfigured easily and intuitively to use all of the assembly 10 components from a single person workstation to configure a two person face-to-face workstation that includes a pair of table tops supported at least in part within the frame space formed by the facing surfaces of leg assemblies 12*a* and 12*b*. As shown, the table tops 14 and 14*a* form a split top space between facing rear edges where trough members 16 and 16*a* as well as channel assembly 18 are located in the split top space and are supported by the leg members. The sliding capability of channel assembly 18 with respect to the leg openings 39 (see again FIG. 1) enables fast and easy one-to-two station reconfiguration and vice versa.

Figure 36:
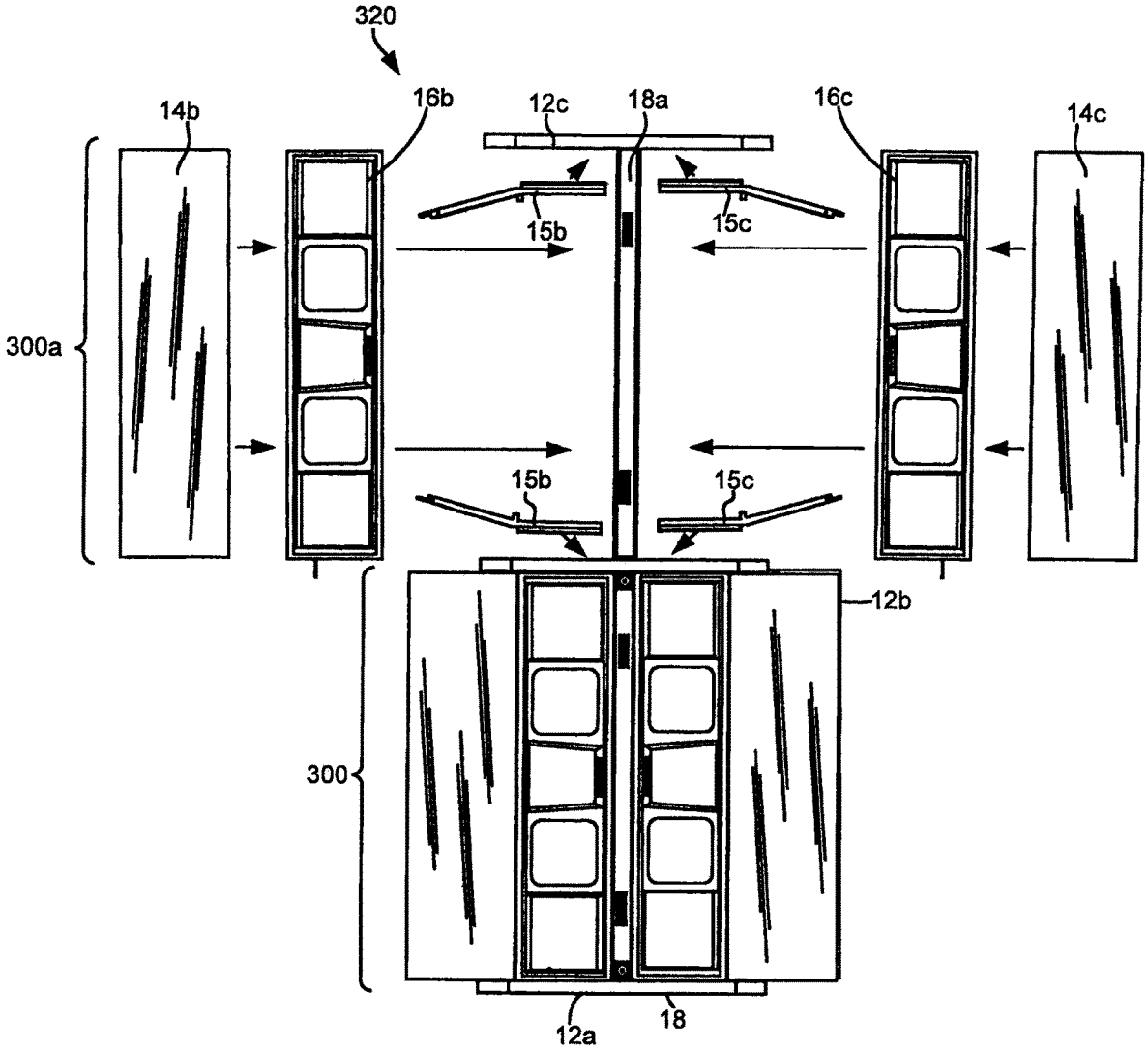
FIG. 36 is a top plan view of a partially assembled desk/table assembly for constructing four different workstations.
Figure 37:
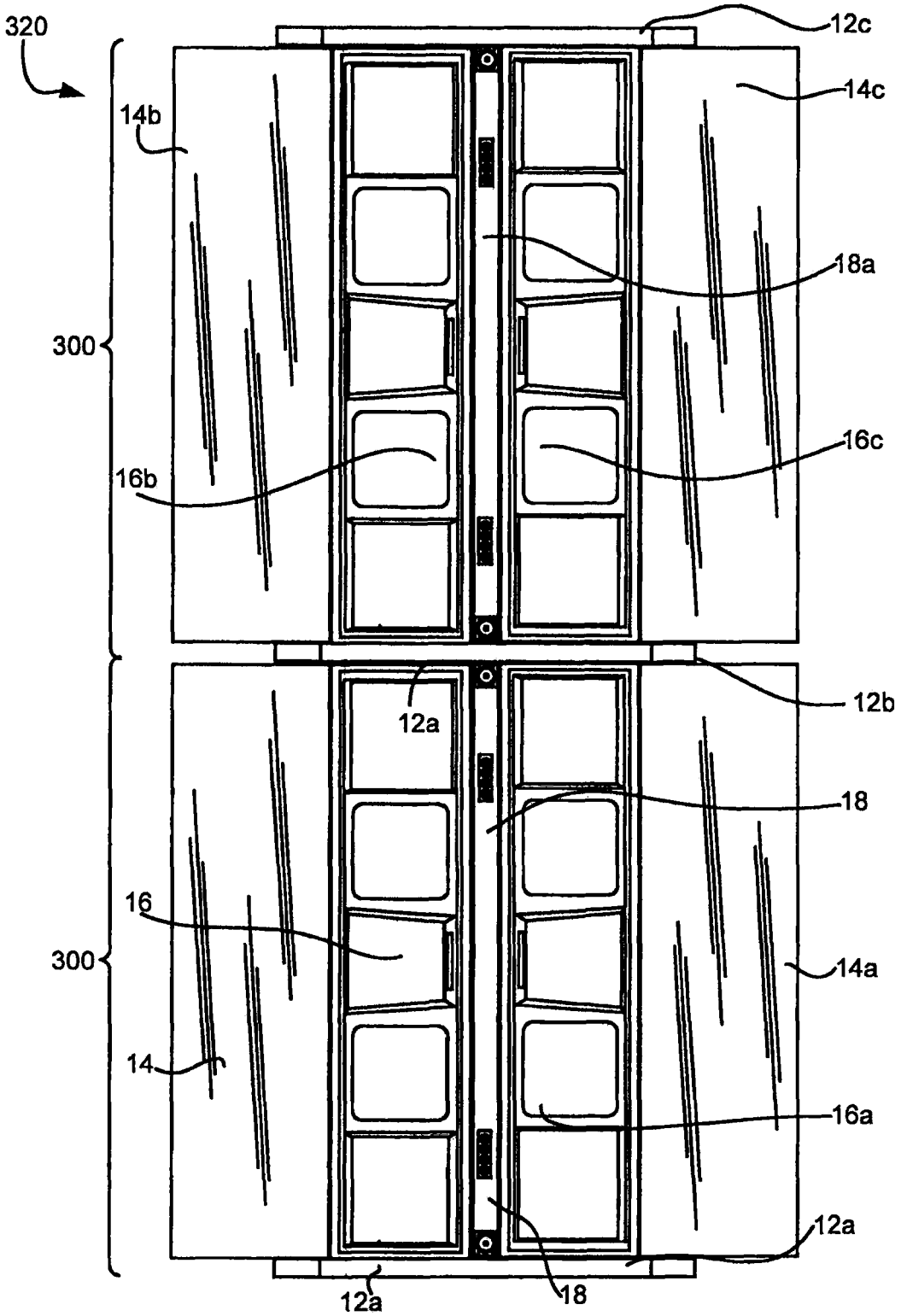
FIG. 37 is a top plan view of the assembly of FIG. 36 in a completely assembled condition.

In addition to the embodiments described above, additional components like those described above can be continually added to a configuration to configure additional work spaces for additional users. To this end, referring again to FIG. 33, after configuration 300 is configured, the outer exposed surfaces of leg assemblies 12*a* and 12*b* have slot and lip arrangements that can be used to secure additional channel assemblies 18 and support arms (see again FIG. 12) that can in turn support additional trough members 16 and table assemblies 14. In this regard, see now FIG. 36 that shows yet another partially assembled workstation configuration 320 that is consistent with at least some aspects of the present invention. As shown in FIG. 36, the configuration 320 includes an instance 300 of the configuration shown in FIG. 33 plus additional components 300*a* for forming two additional workstations. The additional components include a second channel assembly 18*a*, four additional support arm members 15*b* and 15*c*, third and fourth trough members 16*b* and 16*c*, third and fourth table top assemblies 14*b* and 14*c* and a third leg assembly 12*c*. Here, second channel assembly 18*a* is mounted to a surface of leg assembly 12*b* opposite the surface to which channel assembly 18 is mounted and extends in line with and parallel to channel assembly 18 to a second end that is securely connected to one of the side surfaces of leg assembly 12*c*. Support arm members 15*b* and 15*c* are mounted to facing surfaces of leg assemblies 12*b* and 12*c* to extend in opposite directions, trough members 16*b* and 16*c* are installed and table top assemblies 14*b* and 14*c* are installed. The resulting "four pack" of workstations 320 is illustrated in FIG. 37 in top plan view.

Referring still to FIG. 36, the components that comprise configuration 320 generally include two overlapping pairs of leg members including a first pair 12*a*, 12*b* and a second pair 12*b* and 12*c* where each pair of adjacent leg members forms a separate frame space and where a separate pair of table tops (e.g., 14*b* and 14*c*) are supported at least partially within each frame space. Although not shown, additional leg members and table top pairs can be provided to construct additional face-to-face workstations in a similar fashion. In this regard, an additional leg member may be spaced apart from an existing member to form another pair of adjacent leg members that define another frame space and a pair of table top members can then be mounted within the additional frame space.

After assembly 320 has been configured, the wire passing openings at adjacent ends of channel assemblies 18 and 18*a* are aligned and both open into the leg openings 38 (see again FIG. 1) formed by central leg assembly 12*b* so that power/data wires can be directly routed from one channel assembly 18 to the next 18*a*.

Other configurations are contemplated. For example, referring now to FIG. 38, yet one additional configuration 330 is illustrated that is consistent with at least some aspects of the present invention. Configuration 330 includes an instance of the configuration 300 shown above in FIG. 33 as well as additional components 332 attached to configuration 300 to form a third workstation. The additional components 332 include a second channel assembly 18*a*, a third trough member 16*b*, a third table top assembly 14*b* and a third leg assembly 12*c*. Second channel assembly 18*a* is mounted to a side of leg member 12*b* opposite the side on which channel assembly 18 is mounted and extends parallel to channel assembly 18. Here, however, second channel assembly 18*a* is not directly aligned with channel assembly 18 and is instead offset to the rear portion of leg assemblies 12*b* and 12*c* in a fashion similar to that described above with respect to assembly 10 in FIG. 1. The trough member 16*b* and table top assembly 14*b* are then attached to the leg assemblies 12*b* and 12*c* and channel assembly 18*a* as described above.

In the case of configuration 330, while channel assemblies 18 and 18*a* are not aligned, both assemblies 18 and 18*a* open into the large leg opening 38 (see again FIG. 1) and therefore power/data wires can be routed from assembly 18 through the leg opening 38 and into assembly 18*a*.

Although not illustrated, many other workstations may be strung on to either side of one of the above described assemblies in a fashion similar to that described above to configure any number of desired workstations (e.g., five, eight, twenty, etc.).

All of the embodiments described above include different "inserts" or rigid furniture components or furniture assemblies that can be mounted between leg assemblies 12 to configure different overall workstation configurations. For instance, in the case of the FIG. 1 configuration 10, the "furniture assembly" that can be secured between first and second leg assemblies 12*a* and 12*b* includes channel assembly 18, trough member 16 and table top assembly 14 (i.e., a first rigid furniture component). In the case of second configuration 300 shown in FIG. 33 above, in addition to the first furniture assembly, a second furniture assembly is included that includes trough member 16*a* and second table top assembly 14*a* (i.e., a second rigid furniture component).

In at least some embodiments it is contemplated that additional different types of furniture assemblies may be provided that can be installed between a pair of leg assemblies 12 to provide yet additional furniture configurations. For example, referring to FIG. 39, an exemplary additional configuration 340 is shown that includes a seating or lounge furniture assembly or sub-assembly 344 that has been substituted for the trough member 16 and table top assembly 14 shown in FIG. 33.

Figure 40:
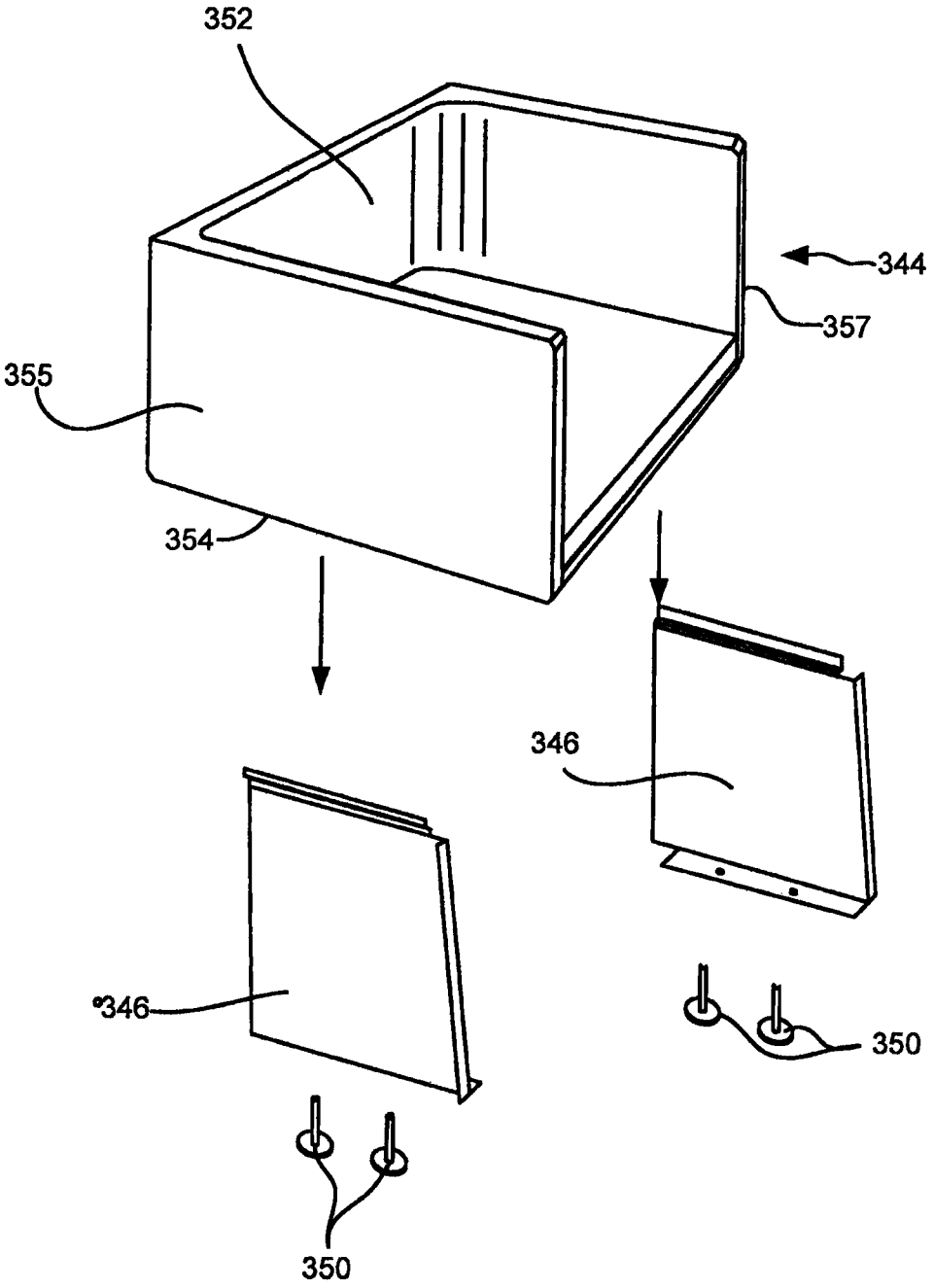
FIG. 40 is a perspective exploded view of the lounge sub-assembly of FIG. 39.
Figure 41:
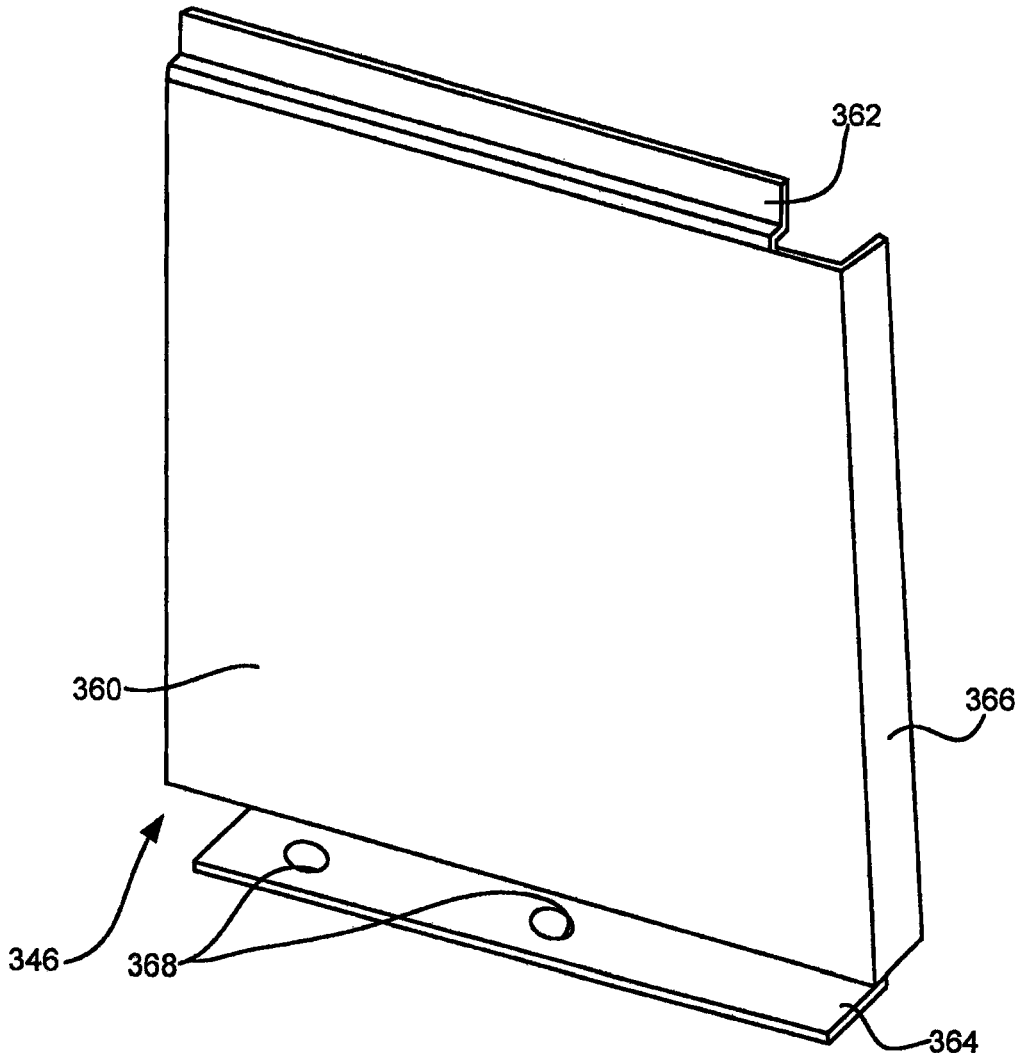
FIG. 41 is a perspective view of one of the lounge brackets shown in FIG. 40.

Referring to FIGS. 40 and 41, lounge sub-assembly 344 includes a lounge or sofa-type structure 352 (i.e., a third rigid furniture component), first and second lounge brackets 346 and finger tightening locking bolts 350. Lounge structure 352 forms a seating structure and includes an undersurface 354 and first and second side surfaces 355 and 357. The lounge structure 352 is dimensioned such that its length is substantially identical to the length dimension of channel assembly 18 described above so that lounge structure 352 can fit snuggly between facing surfaces of leg assemblies 12*a* and 12*b* when channel assembly 18 is connected there between.

Lounge bracket 346 includes a large rectangular plate 360 that forms a lip 362 that extends to a first side of plate 360 and that has a form and dimensions similar to lip 190 shown in FIGS. 12 and 13. Along an edge opposite the edge from which lip member 362 extends, a shelf member 364 extends in a direction opposite the direction in which the lip member 362 extends. Member 364 forms two openings 368 for passing locking bolts 350. Along a front edge of plate member 360, a flange 366 extends generally perpendicular to plate member 360 and in a direction opposite the direction in which shelf member 364 extends.

Figure 42:
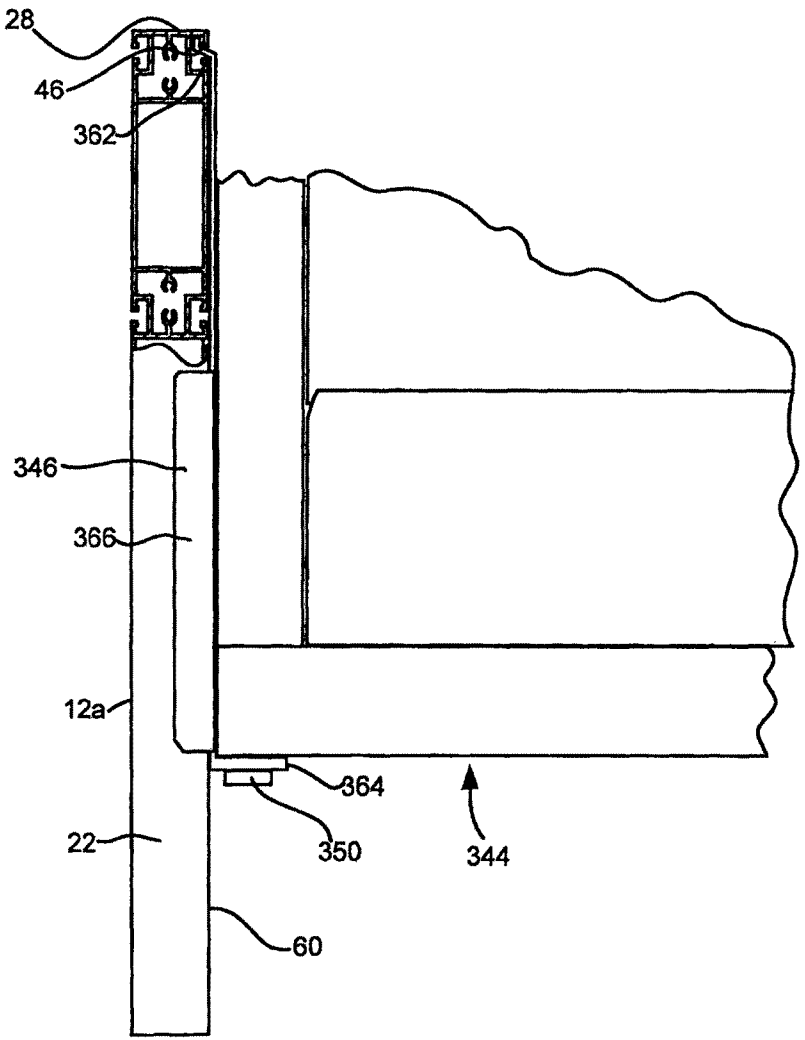
FIG. 42 is a partial cross-sectional view of the assembly of FIG. 39 showing the lounge bracket attached to a leg assembly and a lounge structure attached to the lounge bracket.

Referring once again to FIG. 39, initially it is assumed that channel assembly 18 is securely connected between leg assemblies 12*a* and 12*b*. Referring also to FIGS. 40 and 42, to install lounge sub-assembly 344, first brackets 346 are attached to the leg members 12*a* and 12*b*. To attach a bracket to a leg assembly, the lip member 362 is generally aligned with one of the upper rail slots 46 and is manipulated there into. Next, bracket 346 is rotate downward about the slot 348 until a rear surface of plate member 360 contact an adjacent side surface 60 of member 22. Here, flange member 366 extends in front of and generally contacts a front surface 11 of leg assembly 12*a* to restrict movement of the bracket 346 with respect to slot 48. Next, lounge structure 352 is aligned with the space between brackets 346 and is slid there into and set down on the shelf members 364 as shown in FIG. 42. Finger tightenable bolts 350 are slid through the bracket openings 368 and into threaded apertures in the undersurface 354 of lounge structure 352 to secure the lounge structure in place. The resulting configuration 340 is again shown in FIG. 39.

Figure 43:
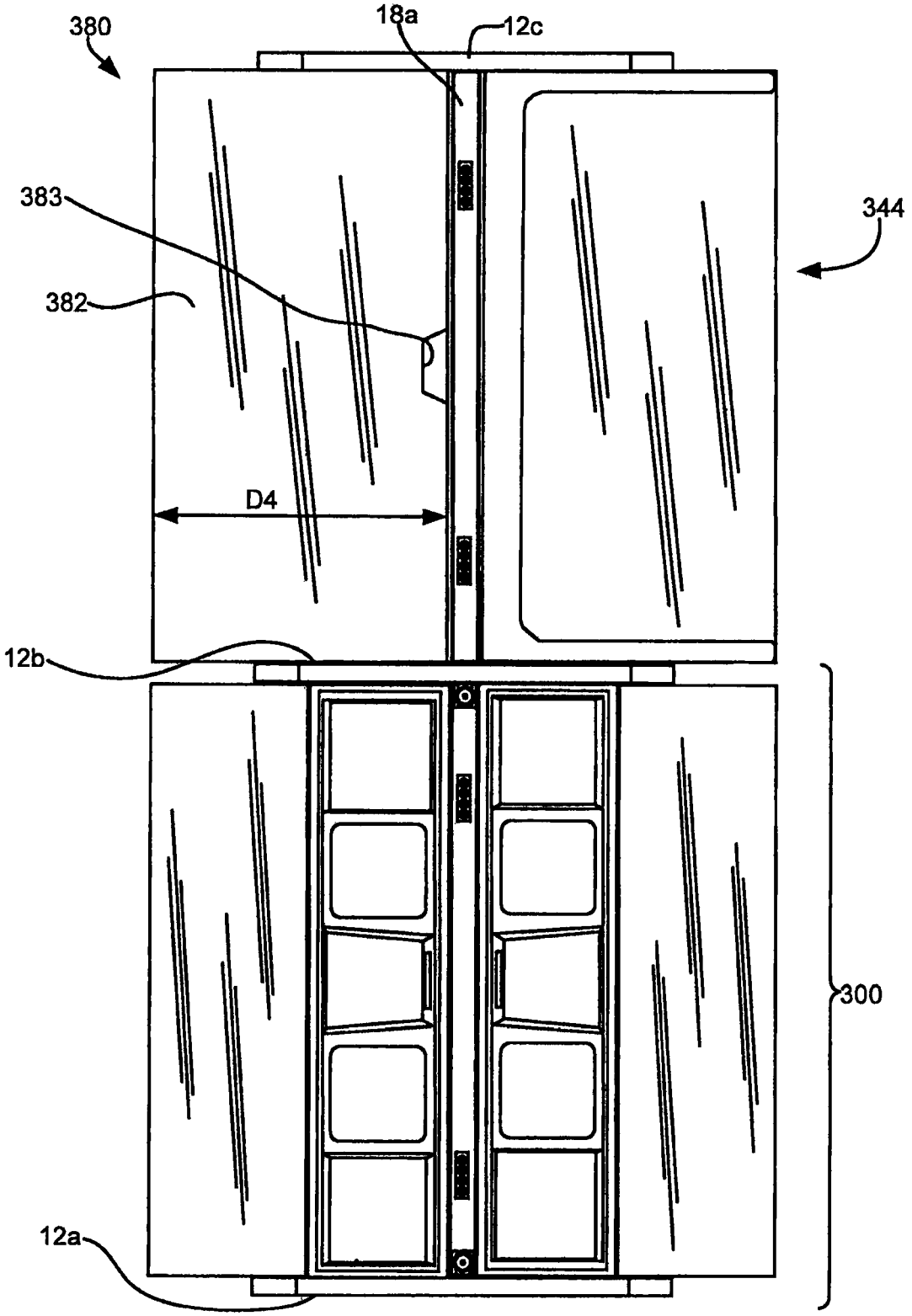
FIG. 43 is a top plan view showing yet another assembly that includes three workstations and a single lounge sub-assembly.

Referring to FIG. 43, another exemplary configuration 380 is illustrated that includes one of the configurations 300 shown in FIG. 33 as well as one of the lounge structures described above with respect to FIGS. 40 through 42 and a relatively deep table top assembly 382. Here, table top assembly 382 has a configuration that is similar to table top assembly 14 described above except that table top assembly 382 has a depth dimension D4 that is equal to the combined depths of the table top assembly 14 and one of the exemplary trough members 16 described above. Thus, table top assembly 382 takes the place of one of the table top assemblies 14 and a trough member 16 between leg members 12*b* and 12*c* and adjacent channel assembly 18*a*. Although not illustrated, table assembly 382 includes all of the components described above with respect to FIG. 21 on an underside thereof and mounts to the support arm members 15 (see again FIG. 15) in a similar fashion to that described above with respect to table top assembly 14. In this case brackets 278 (see FIG. 26) would be located about midway along each lateral edge of top member so as to be positioned to receive shoulder members 620 formed by support arm members 15 (see again FIG. 12). Table top assembly 382 forms a scalloped edge opening 383 along a rear edge to allow power/data wires to pass there through down to a space there below.

Thus, according to one aspect of the disclosed system, a kit of parts may be provided where addition parts can be added to an existing kit to add additional workstation or seating functionality. In addition, an existing configuration can be reconfigured to swap one furniture assembly for another furniture assembly while using a single core structure that includes leg assemblies 12*a* and 12*b* and a channel assembly 18. Any combinations of seating and workstation furniture assemblies may be constructed to fit requirements of specific applications. For instance, two lounge subassemblies 344 may be configured back-to-back, all workstation assemblies may include wide depth table top assemblies 382 (see again FIG. 43), etc.

Figure 44:
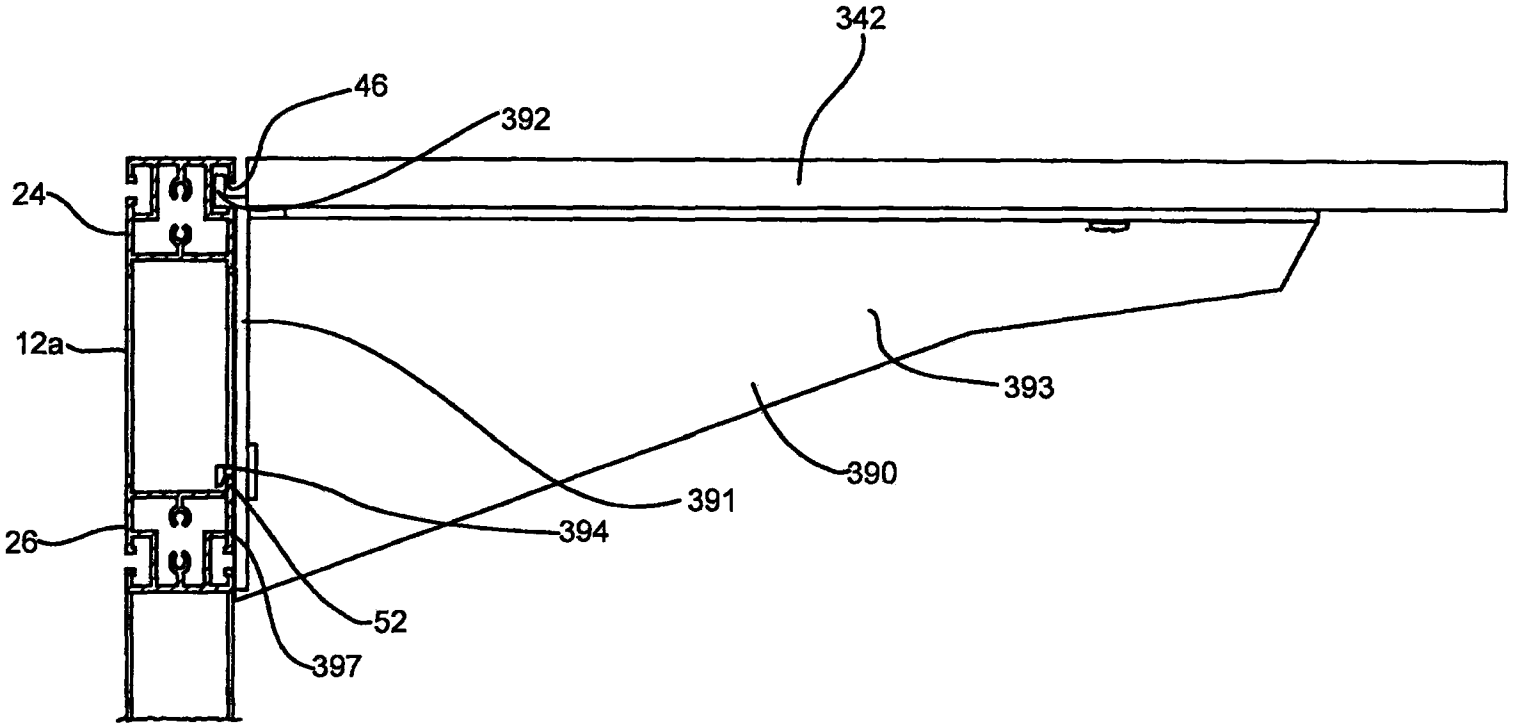
FIG. 44 is a partial cross-sectional view showing an end table and end bracket assembly that may be used to accessorize the assemblies shown in the other figures.

In addition to the components described above, at least some embodiments will include additional accessory components that can be attached to leg assemblies 12*a*, 12*b*, 12*c*, etc., via the slots and/or lips formed by the leg assembly rail members 24 and 26. For example, referring to FIG. 44, end table support brackets 390 (only one shown) may be provided for supporting a half-round table top 342 (see FIG. 39) or other type of end table via an upper rail slot 46 and lower rail lip 52. Exemplary bracket 390 includes a mounting plate 391 and an arm plate 393 that generally form a right angle. The mounting plate 391 includes a rearward and upward extending lip 392 along a top edge that is size and shaped similar to lip 190 in FIGS. 12 and 13 to be received in a rail slot 46. After lip 392 is received in slot 46, the lower portion of bracket 390 is rotated downward until a rear surface of plate 391 contacts an outer or external surface of side wall 397 of lower rail 26 so that arm member 393 is cantilevered from the leg assembly 12.

In the illustrated embodiment, a locking hook 394 is provided through plate 391 that aligns with upward extending lip 52 on rail 26 where the locking hook 394 can be rotated causing the hook 394 to engage lip 52 and retain bracket 390 on leg assembly 12. Half-round top member 342 is mounted via screws or other mechanical fasteners to the top of arm member 393.

As shown, the top surfaces of the half-round member 342, leg assembly 12*a* and top assembly 14 (see FIG. 39) are at the same height in at least some embodiments. Thus, the top surface of table top 342 and leg assembly top surface 28 form an extension of the worksurface 9 of top assembly 14.

Figure 45:
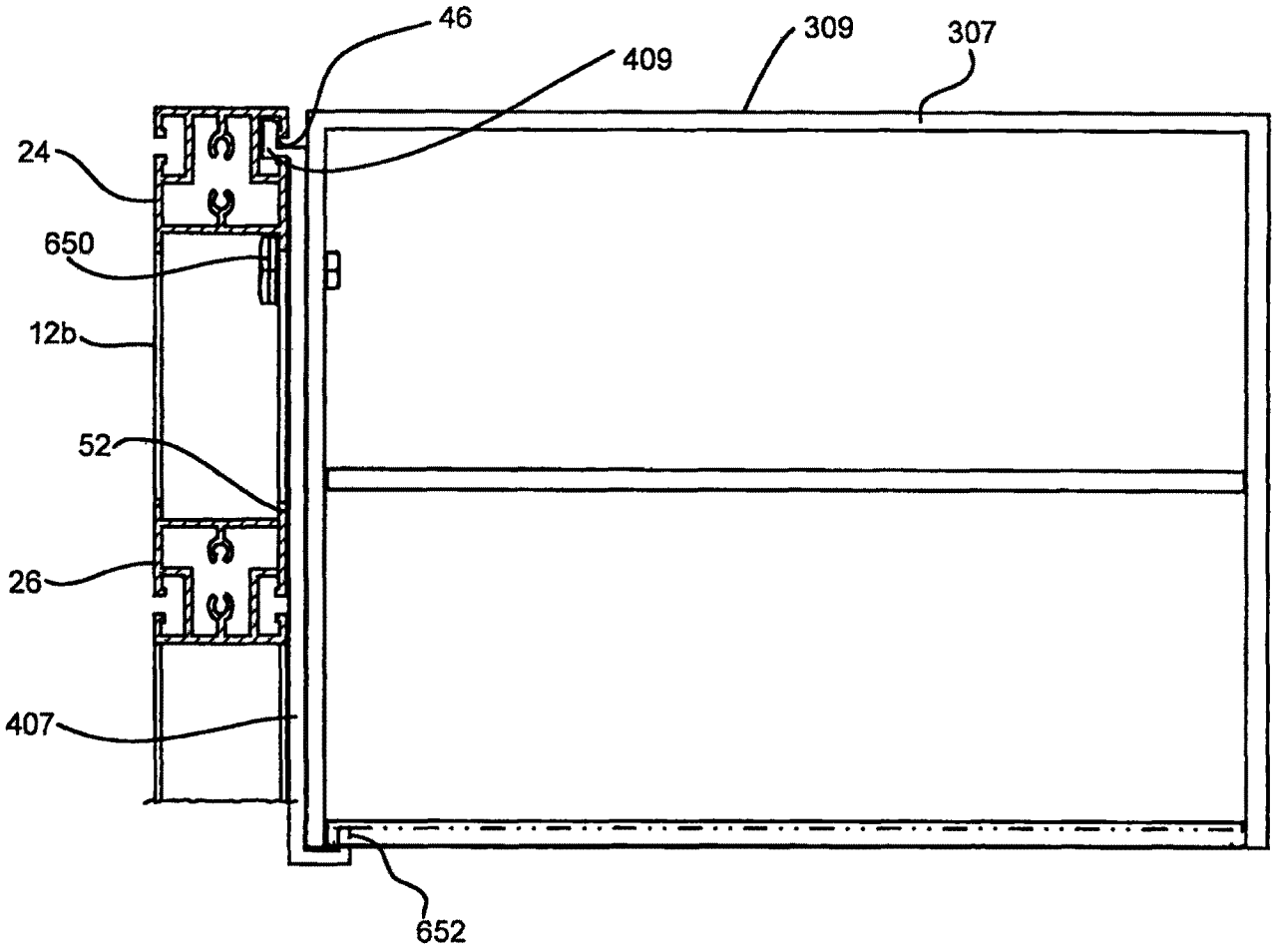
FIG. 45 is a partial cross-sectional view of a casegood accessory mounted to a side surface of one of the leg assemblies of FIG. 33.

Referring again to FIG. 33, a casegood accessory 307 is shown mounted to a vertical side surface of leg assembly 12*b* so that a top surface 309 of accessory 307 is at the same height as the top surfaces of assemblies 14 and 14*a*. Referring also to FIG. 45, to mount a casegood accessory 307 to leg 12*b*, two brackets 407 (one shown) that mount to a side surface of accessory 307 and that form upwardly extending lips 409 akin to lip 190 in FIGS. 12 and 13 are provided. As shown, lips 409 are received in upper rail T-slot 46 to hang accessory 307 along the side of the leg assembly 12*b*. The bottom of bracket 407 forms an upwardly extending hook or lip member 652 that hooks on to a lower edge of one of the side walls that forms a casegood 307 (i.e., the bottom wall of casegood 307 is recessed). Top surface 309 provides an extension of the worksurface of top assemblies 14 and 14*a* as shown in FIG. 33. two nut and bolt pairs 650 (only one shown) are provided for each of the brackets 407. each nut and bolt pair includes a large head bolt and an associated nut. A threaded shaft of each bolt extends through aligned openings in bracket 407 and a side wall of casegood 307 and is received in the associated nut to secure casegood 307 to the brackets 407. In at least some embodiments the openings in bracket 407 and casegood 307 are aligned immediately adjacent a lower edge of lip member 50 formed by upper rail 24 so that lip 50 is sandwiched between facing surfaces of brackets 407 and the large head of bolt 650 so that the bolt head restricts rotation of casegood 307 about slot 46.

Figure 46:
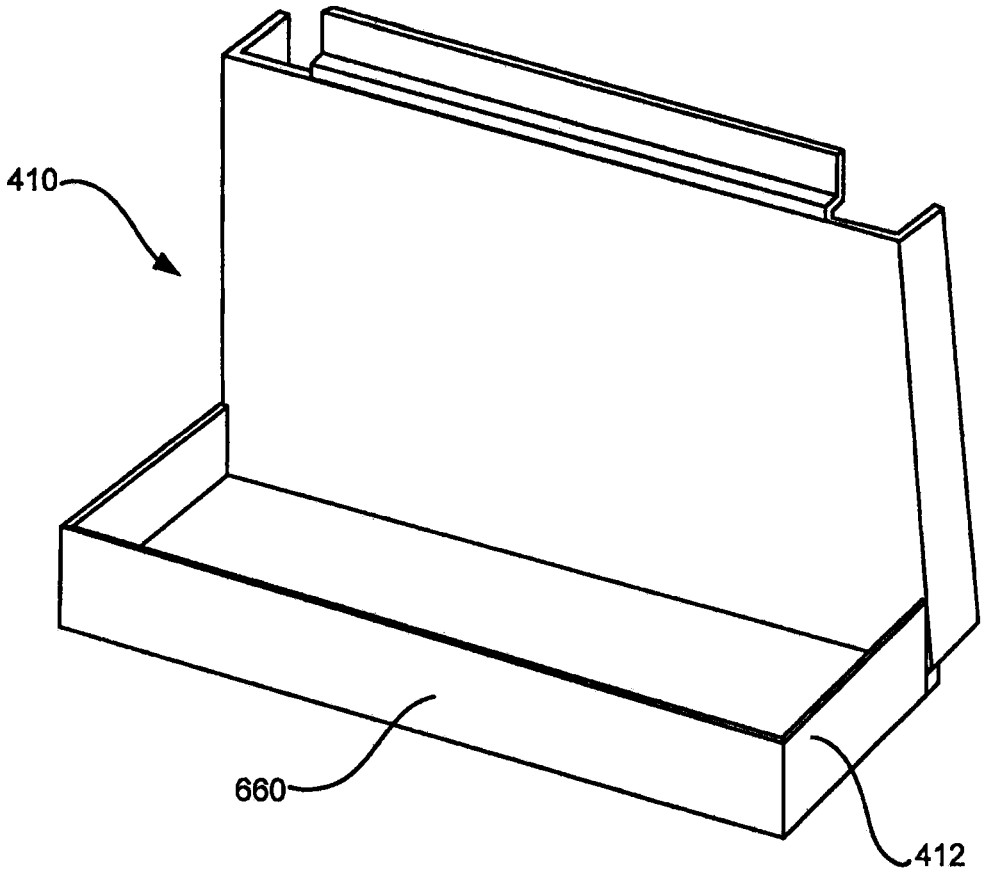
FIG. 46 is a perspective of the shelf bracket shown in FIG. 32.

Referring to FIG. 46, another exemplary accessory that may be provided for use with the configurations described above includes a shelf bracket 410. Here, bracket 410 has characteristics that are similar to the lounge bracket 346 described above except that the member 364 (see FIG. 41) is replaced by a larger shelf member 412 that does not form bolt passing holes. Exemplary shelf 410 is shown in FIG. 32 with an upwardly extending lip member received in a lower rail channel. While shelf bracket 410 is shown on an external surface of the leg assembly 12, it should be appreciated that the shelf bracket 410 may also be attached on an internal surface via an internal rail slot.

Figure 47:
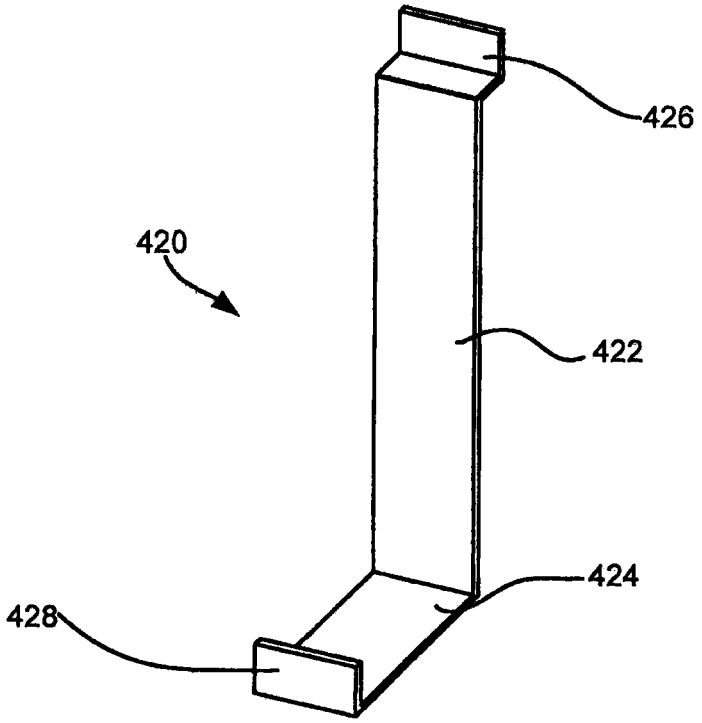
FIG. 47 is a perspective view of the purse or hook bracket shown in FIG. 32.

Referring to FIG. 47, another exemplary accessory includes a purse or hook type accessory 420 that includes a vertical member 422, a horizontal shelf member 424, an end lip member 428 and an attaching lip member 426. Referring again to FIG. 32, the exemplary hook bracket 420 is shown attached to a slot formed by a lower leg assembly rail with the lip member 426 received within the slot.

Figure 48:
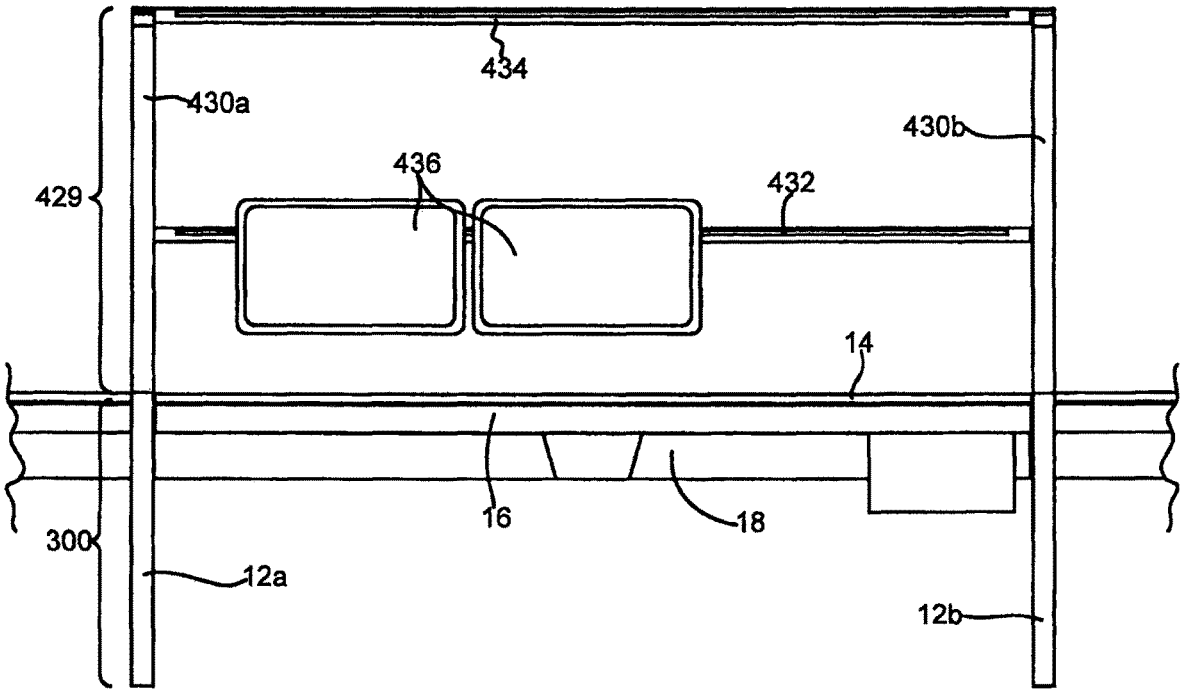
FIG. 48 is a front plan view of a desk assembly including an arch assembly added to the desk assembly.

Referring once again to FIG. 33, in at least some embodiments, it is contemplated that where facing workstations are configured, station users may desire additional arch type structure for supporting computer display screens, additional storage space, etc. To this end, referring to FIG. 48, in at least some embodiments, an additional arch assembly 429 may be added to the configuration 300 described above. Arch assembly 429 includes vertical arch assemblies 430*a* and 430*b* that mount to and extend generally upwardly from leg assemblies 12*a* and 12*b*, an upper cross rail member 434 and an intermediate cross rail member 432. In FIG. 48, two display screens 436 are shown mounted to intermediate cross rail member 432. The rail members 432 and 434 mount to the vertical frame assemblies 430 and extend there between generally above a centrally located channel member 18.

Figure 49:
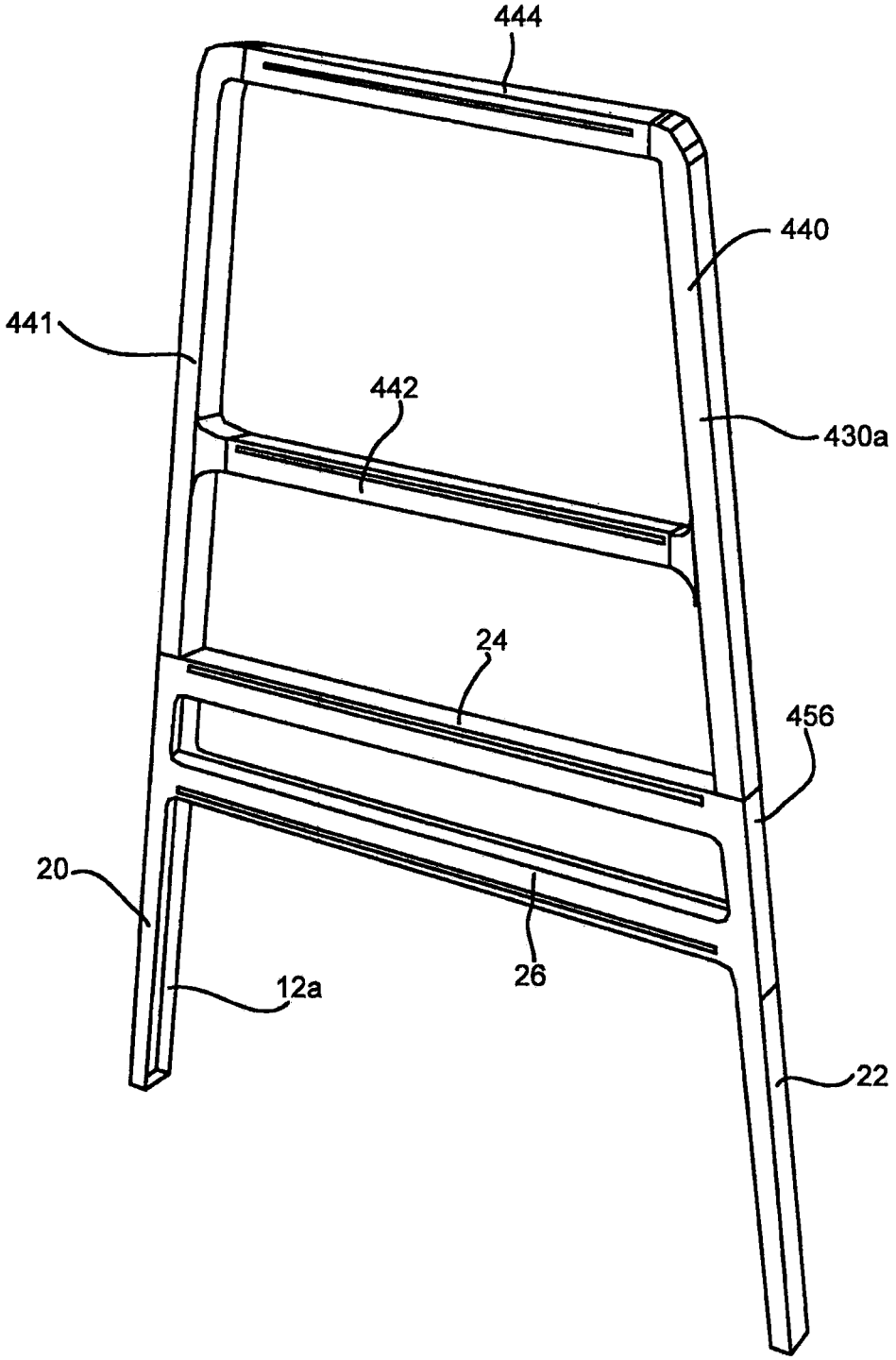
FIG. 49 is a perspective view of the exemplary leg and arch extension structure shown in FIG. 48.

Referring to FIG. 49, an exemplary vertical arch assembly 430*a* includes first and second vertical members 440 and 441 as well as a top rail member 444 and an intermediate or lower rail member 442. The rail members 444 and 442 are formed of the same extruded rail stock that is used to form the leg assembly rail members 24 and 26. Vertical members 440 and 441 attach at lower ends to the top ends of vertical leg members 20 and 22. To this end, referring again to FIG. 6, an arch mounting threaded hole 88 is provided within vertical leg member 20 for attaching an arch mounting bracket 450. In addition, a web/lattice structure including a plurality of ribs 67, 71, 73 is formed within space 91 (see FIG. 6) that operates to guide or restrict placement of the lower end of bracket 450 (see phantom in FIG. 6) upon attachment. In addition to restricting placement, the ribs 67, 71, 73 cooperate with bracket 450 to increase rigidity in the connection between the leg assembly and the arch assembly and to limit side-to-side sway between the two assemblies. Referring also to FIG. 7, the leg assembly 12 cover 40 can be removed to gain access to hole 88.

Figure 50:
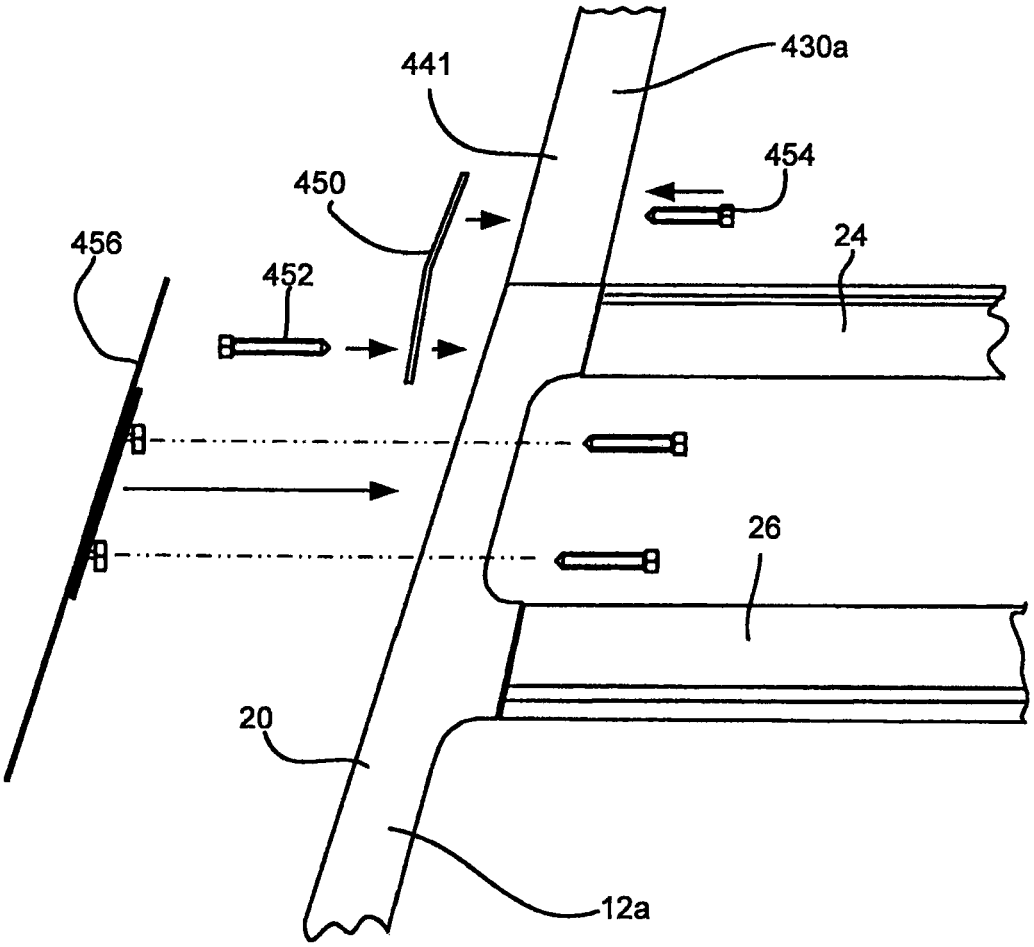
FIG. 50 is a partially exploded view of an arch attachment mechanism that is consistent with at least some aspects of the present invention.
Figure 51:
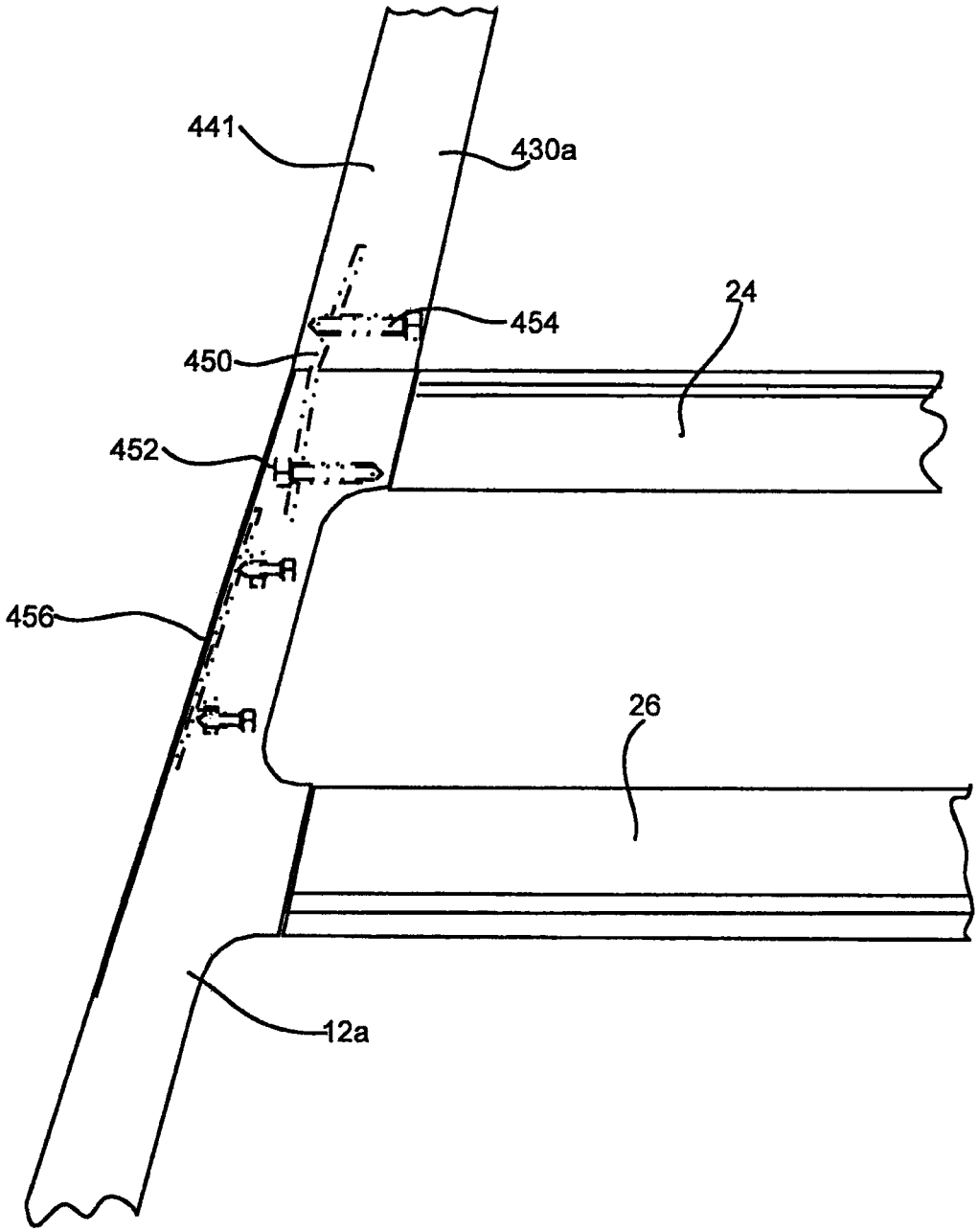
FIG. 51 is similar to FIG. 50, albeit showing the attachment mechanism assembled.

Referring to FIG. 50, a rigid metal bracket 451 and arch mounting screws 452 and 454 are provided. Bracket 451 mounts at one end via screw 452 to hole 88 (see again FIG. 6) where the lower end of bracket 450 is aligned with hole 88 via ribs 67, 71, 73. The top end of arch mounting bracket 450 passes through top slot 90 (see FIG. 6) and is inserted into a slot in the lower end of vertical member 440. Screw 454 is used to lock the bracket 450 to member 440. Next, a second cover member 456 that is designed for use when arch assembly is attached to the leg assembly 12 to close the space formed at the top of vertical leg member 20. FIG. 51 shows the arch/leg assembly connection in phantom.

Figure 52:
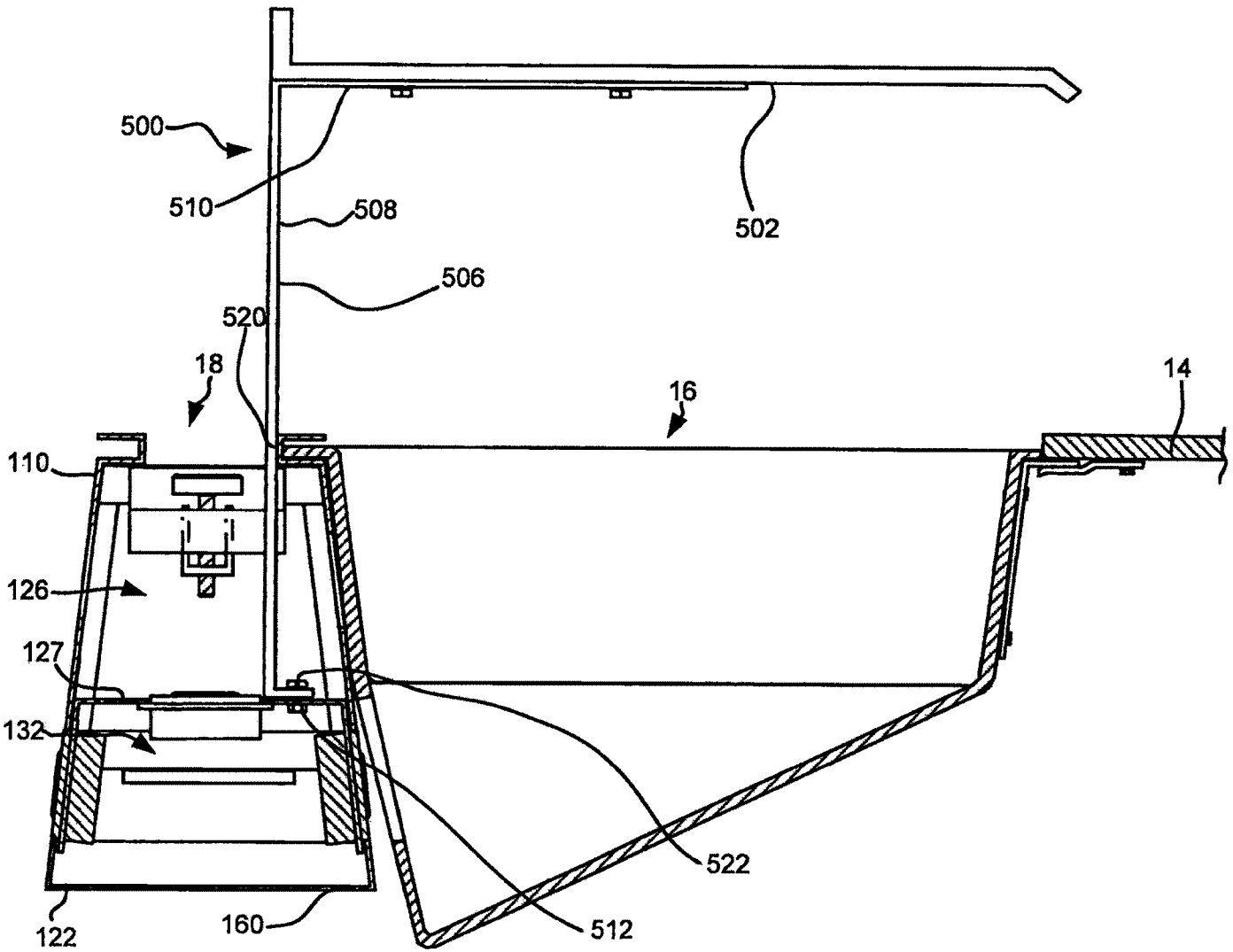
FIG. 52 is a partial cross-sectional view taken along the line 52-52 in FIG. 32 showing a channel mounted shelf assembly.
Figure 53:
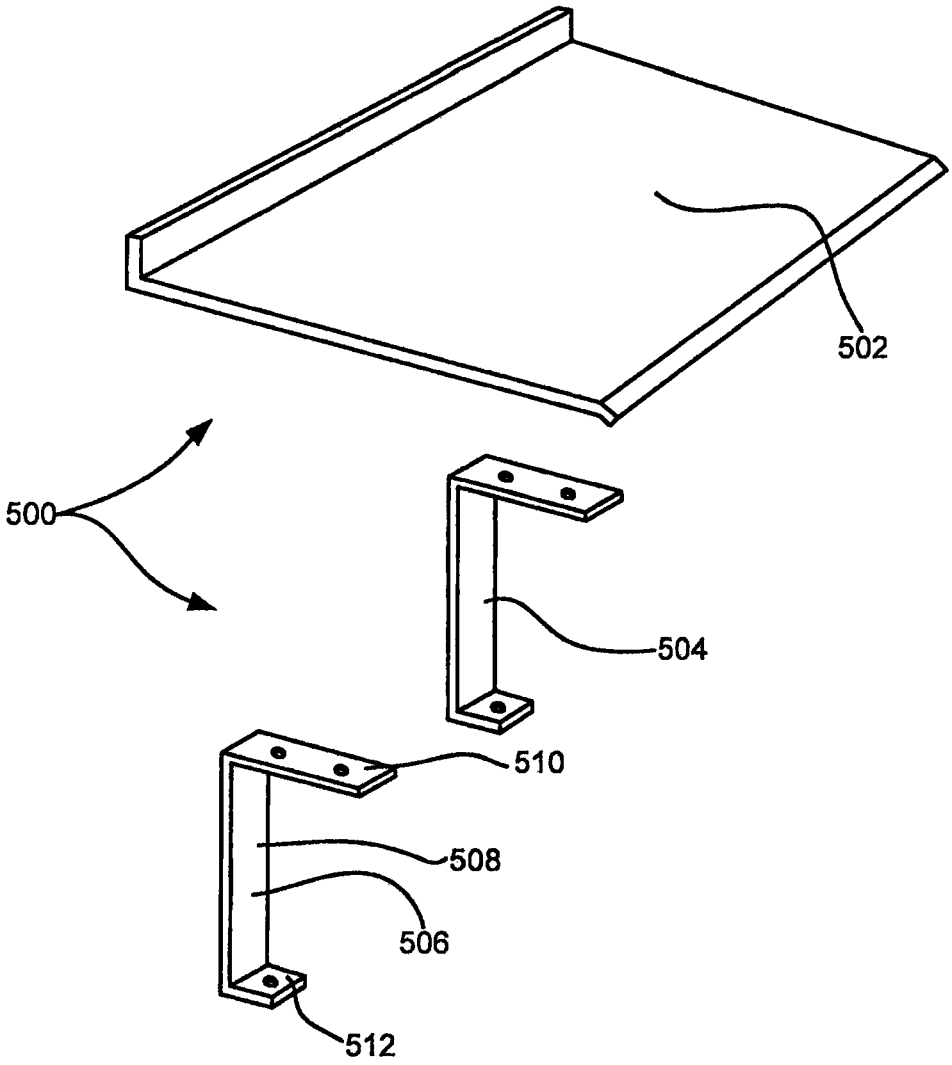
FIG. 53 is an exploded perspective view of the shelf assembly shown in FIG. 52.

Referring again to FIG. 32 and also to FIG. 52, a shelf assembly 500 for providing an over trough shelf is shown mounted within channel 126 formed by channel assembly 18. Referring also to FIG. 9, pairs of mounting holes 670 (shown in phantom) are provided within the intermediate wall 127 of channel housing 110. In the illustrated example six hole pairs 670 are shown, three pairs adjacent each side wall of housing 110 where each three pairs include a left pair, a right pair and a center pair. Referring to FIG. 53, shelf assembly 500 includes a shelf member 502 and first and second brackets 504 and 506. Exemplary bracket 506 includes a foot member 512, a leg member 508 and an arm member 510 where the foot and arm members 512 and 510 extend from opposite ends of leg member 508 in the same direction and are perpendicular to leg member 58. Each of the foot and arm members 512 and 510 form mounting holes. Arm members 510 are longer than foot members 512. Shelf member 502 includes a top shelf surface and an undersurface.

Referring to FIG. 52, a lower end of each bracket 504 and 506 is mounted via a bolt 522 to one of the mounting holes 670 inside channel 126 with leg members 508 extending up and out of the channel housing 110. A surface of leg member 508 facing housing 110 provides additional support to leg member 508. Arm members 510 extend over trough member 16 and shelf member 502 is mounted to arm members 510 as shown in FIGS. 32 and 52. While not shown, two or three shelf assemblies may be mounted over each trough member in a table configuration in a side-by-side manner.

Figure 54:
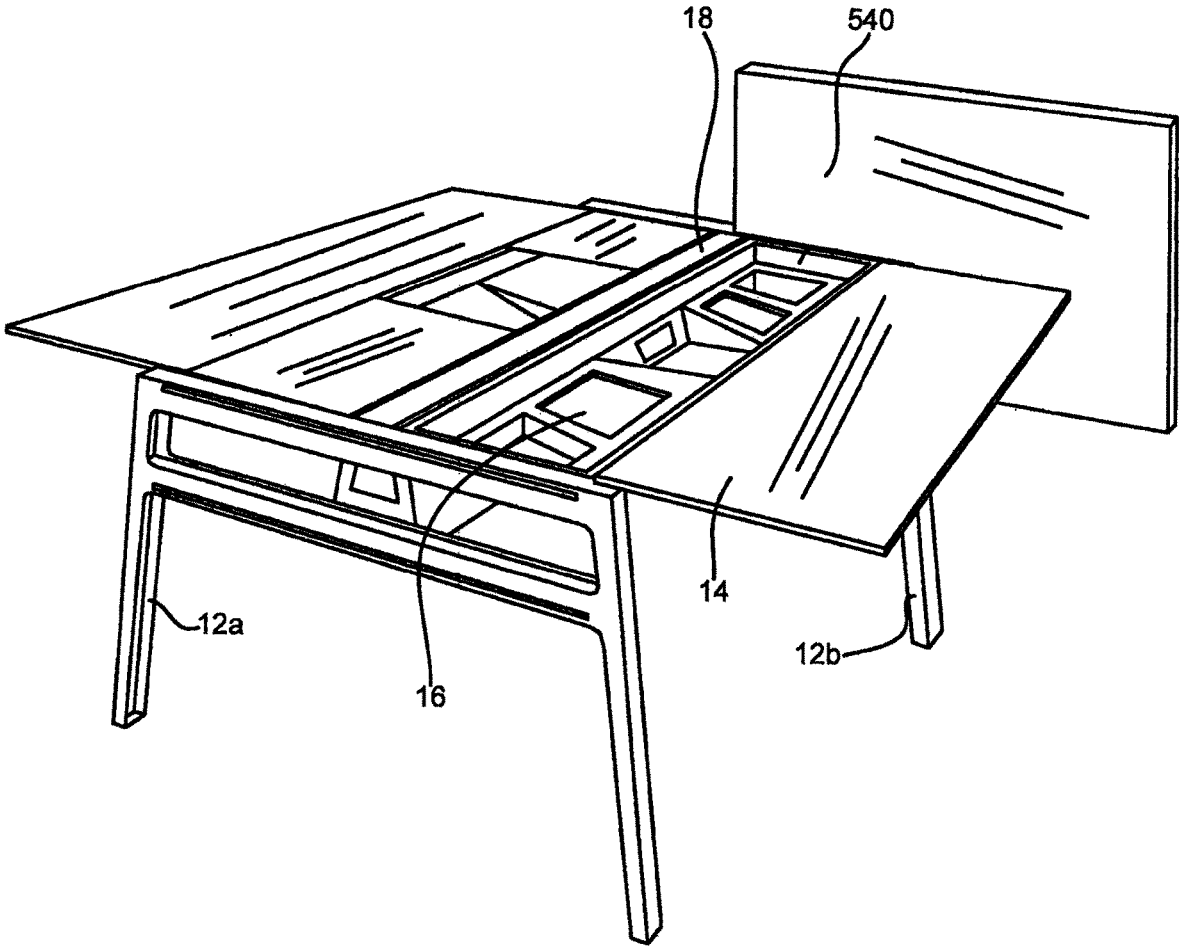
FIG. 54 is a perspective view of a table assembly similar to the table assembly shown in FIG. 33; albeit where a privacy screen assembly has been installed on one of the leg assembly.

Referring now to FIG. 54, yet one other accessory that may be provided in some table configurations includes a space dividing or privacy screen assembly 540 that can be mounted to either end of any of the leg assemblies described above. Referring also to FIGS. 55 through 57 and FIG. 23, exemplary screen assembly 540 includes a screen member 542, a bolting bracket member 548 and a clip type bracket member 550. Screen member 542 can be formed of any rigid and generally planar material. Illustrated screen member 542 is generally rectangular with a lower corner cut out to form a horizontal intermediate edge 544 and an angled intermediate edge 546. The angle between edges 544 and 546 is identical to the angle between the top surface 28 of one of the leg assemblies 12*a* and the front surface 22 of the same leg assembly 12*a* (see FIG. 3) so that after being installed, screen member 542 generally conforms to the top and front surfaces of the leg assembly.

Figure 55:
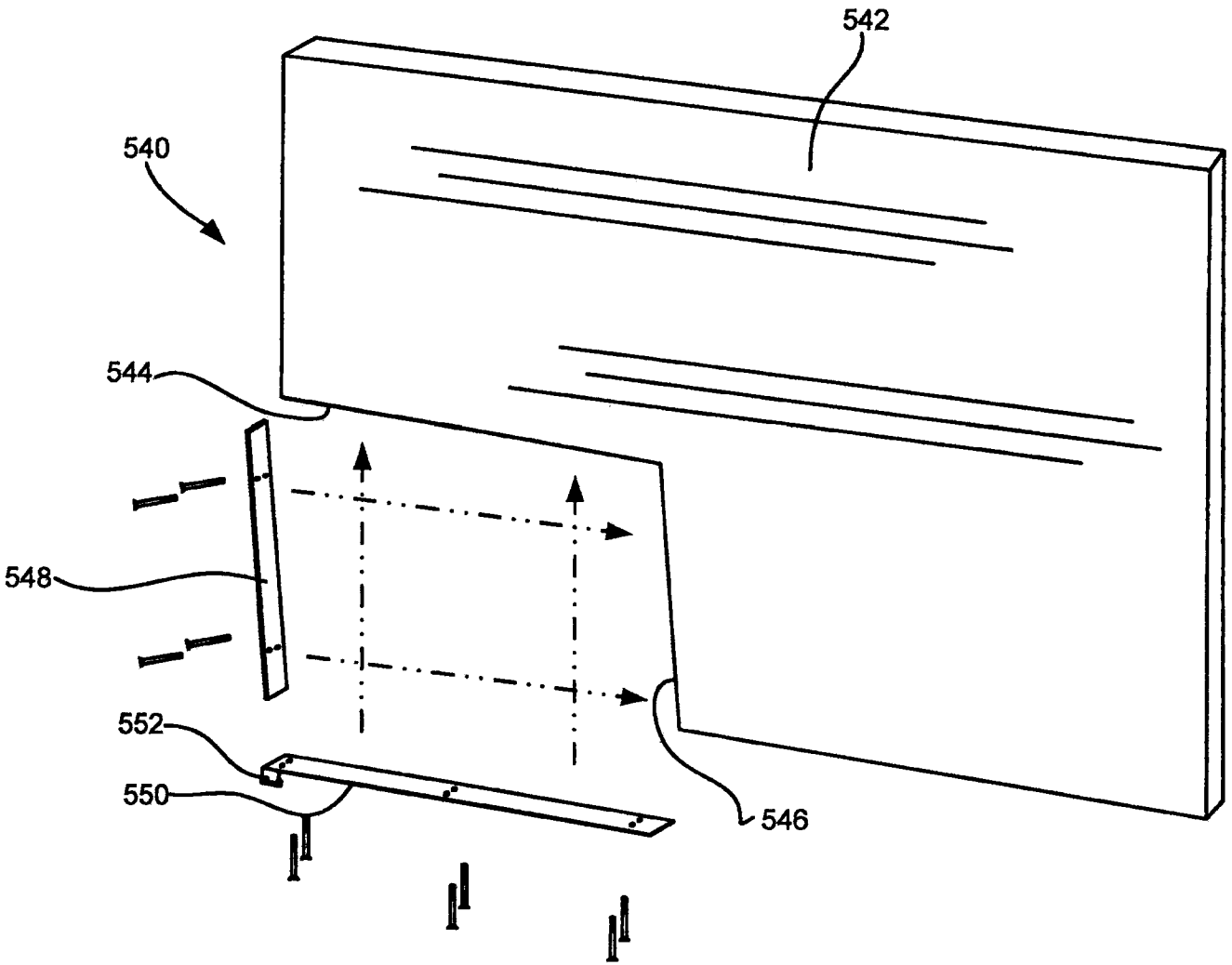
FIG. 55 is an exploded view of the screen assembly shown in FIG. 54.
Figure 56:
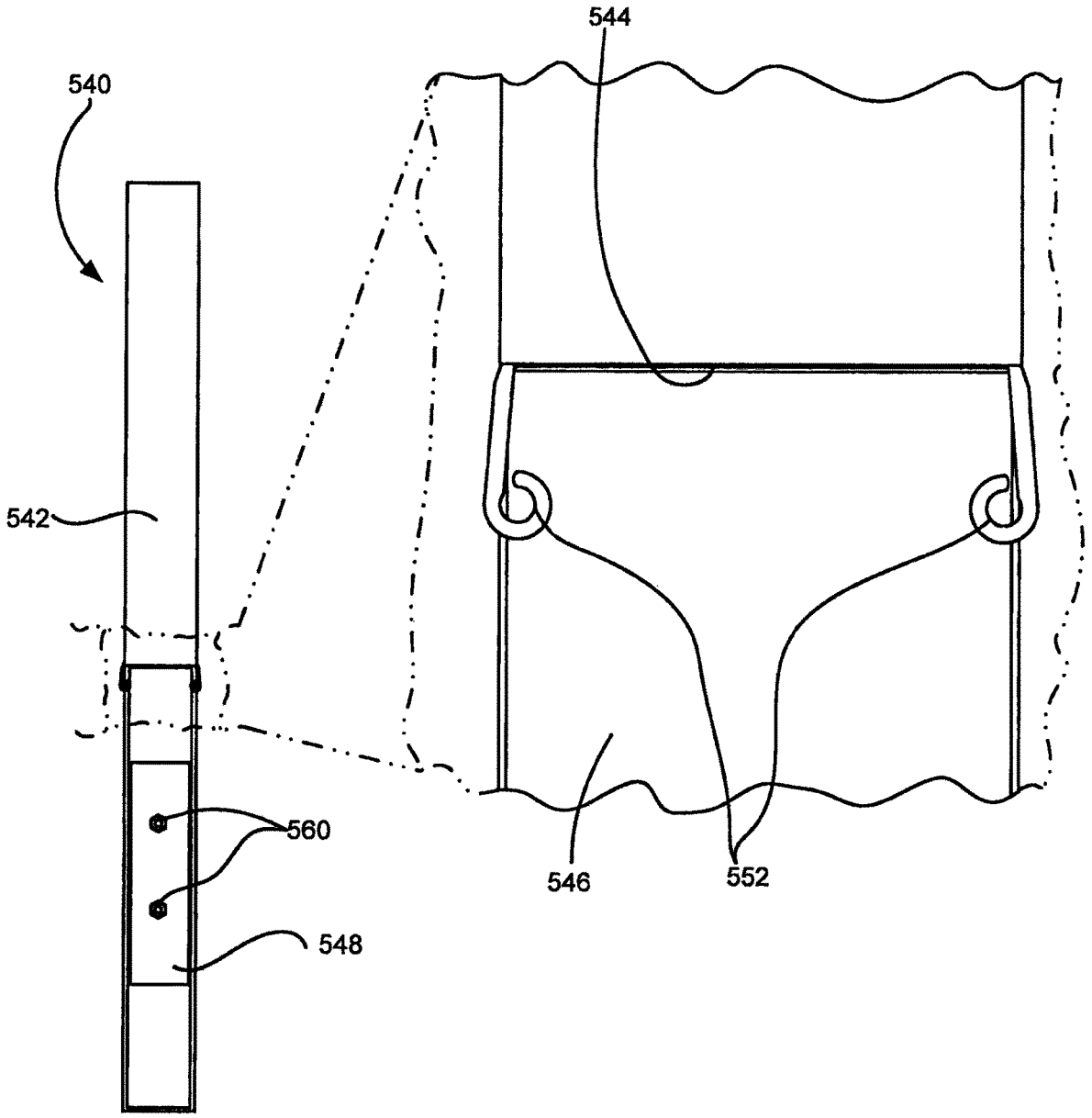
FIG. 56 is an end view of the screen assembly shown in FIG. 54.
Figure 57:
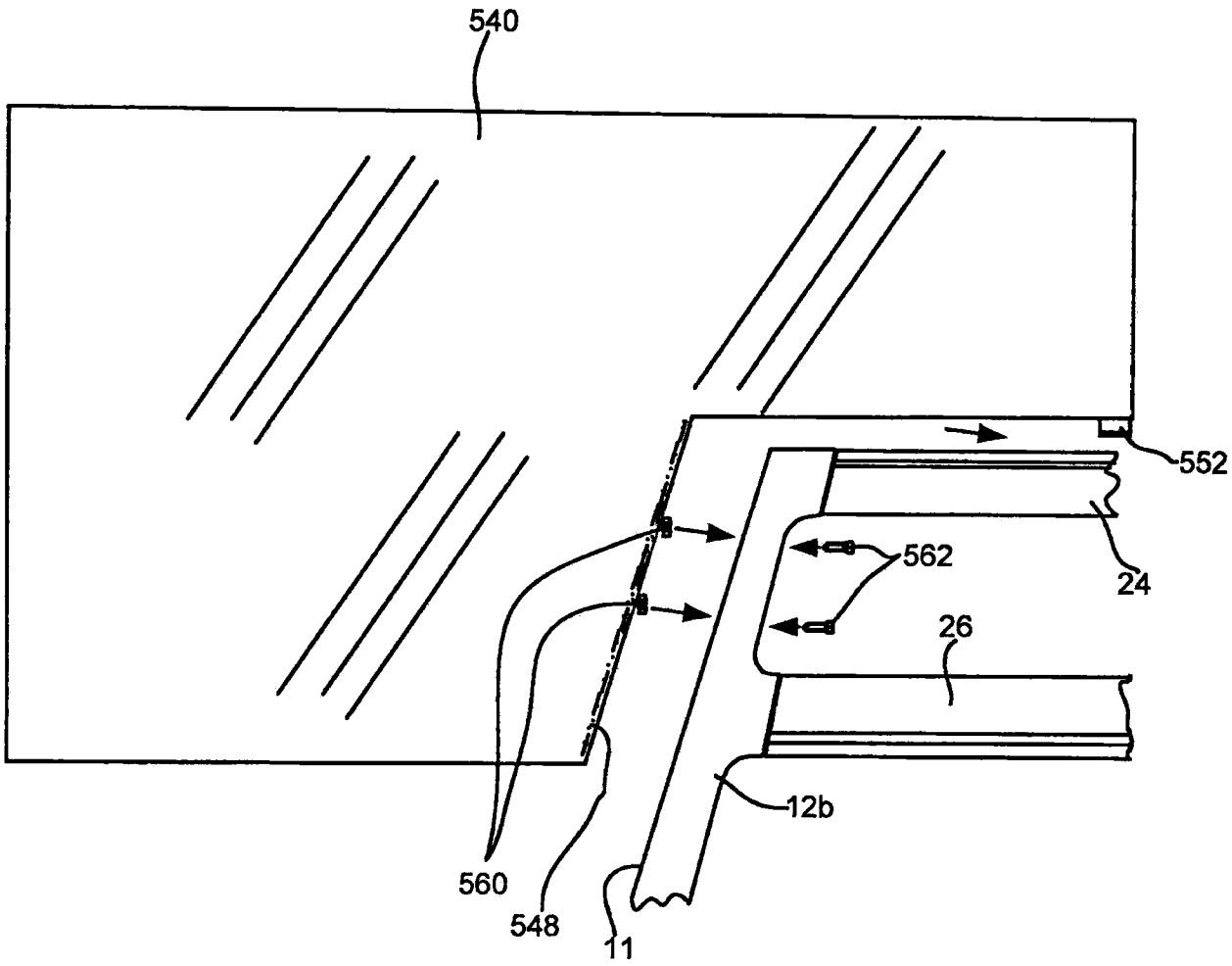
FIG. 57 is a side view of the screen assembly of FIG. 54 and a related leg assembly.

Referring still to FIGS. 55-57, bolting bracket 548 is a metal strip that is secured via screws, adhesive or some other means to angled edge 546. Bracket 548 forms posts 560 that form threaded openings that are sized and arranged to be identical to the mounting structure on the inside surface of one of the cover members described above (see again FIG. 7) so that bracket 548 and the associated screen assembly can be mounted to one of the leg assemblies 12*a* after a corner member has been removed.

Bracket 550 is an elongated rigid metal strip that includes two spring clip members 552 at one end. Clip members 552 are spaced apart a distance similar to the width of rail 24 (see again FIG. 23). Bracket 550 is screwed to, adhered to or otherwise attached to horizontal edge 544 of member 542 with clip members 552 extending downward therefrom at an end opposite the location of bolting bracket 548. In other embodiments members 548 and 550 may form a portion of a larger metal frame type screen structure.

To secure assembly 540 to a leg assembly 12*b*, referring to FIG. 57, assembly 540 is aligned along a side of leg assembly 12*b* and is forced downward until clip members 552 contact edges of top surface 28 and are forced apart. Assembly 540 is forced further downward until distal ends of clip members are received within oppositely opening slots 30 and 46 in top rail 24 (see FIG. 23). Assembly 540 is slid along top surface 28 until bracket 548 is adjacent an outer surface 11 of leg assembly 12*b* and screws 562 are passed through openings 86 and are received in post 560 holes. Thus, screws 562 and clips 552 cooperate to secure screen assembly 540 to leg assembly 12*b*.

Figure 58:
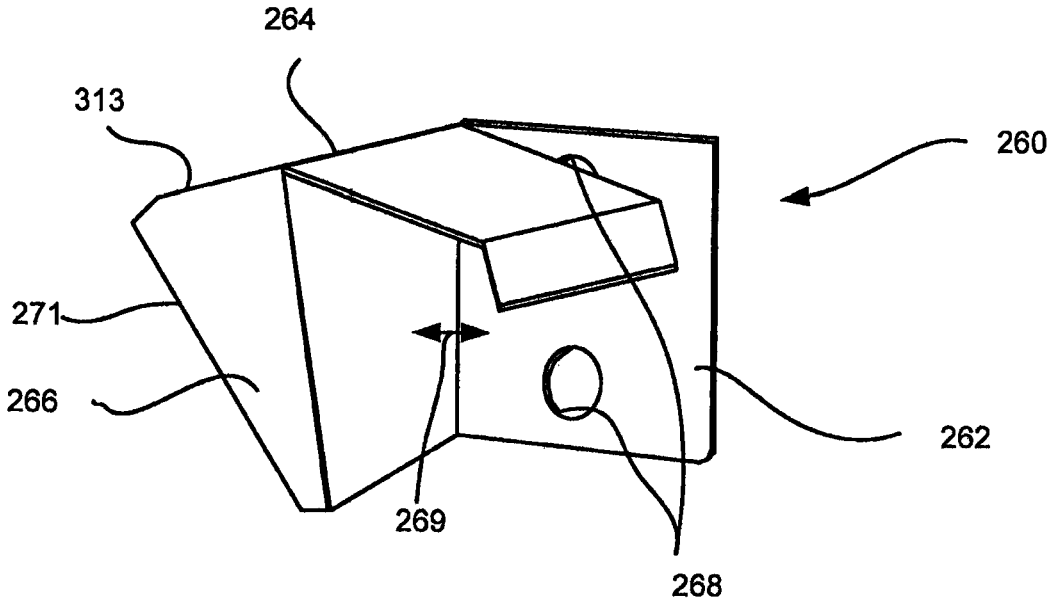
FIG. 58 is a perspective view of a latching bracket used to latch a trough member and/or a table top assembly a to a support arm members according to one additional aspect of the present disclosure.

While one way to secure a trough and a table top assembly to support arm members has been described above, other structure for accomplishing this task is also contemplated. To this end, an exemplary spring clip latching bracket 260 is shown in FIG. 58. Latching bracket 260 is an integrally formed resiliently flexible metal member that includes a mounting plate 262, a spring plate 264, a latch plate 266 and a handle member 271. Exemplary mounting plate 262 is rectilinear and forms two holes 268 for passing screws or bolts for mounting latching bracket 260 to trough member 16. Spring plate 264 extends from one of the long edges of mounting plate 262, is generally rectilinear and forms an obtuse angle with mounting plate 262. Latch plate 266 extends from one of the long edges of spring plate 264 opposite the edge that is attached to mounting plate 262 and generally has a triangular shape. A long edge opposite the edge attached to spring plate 264 forms a bearing edge 271. A short top edge of latch plate 266 forms a latch edge 270.

Latch plate 270 generally extends from spring plate 264 in a direction opposite the direction in which mounting plate 262 extends. Handle member 273 is attached along an upper short edge of spring plate 264 and generally extends to the same side of spring plate 264 as does mounting plate 262. While spring plate 264 has a steady-state configuration as shown in FIG. 58, as the label implies, spring plate 264 can be resiliently deformed by temporarily bending as indicated by arrow 269. To this end, when a force is applied along edge 271, spring plate 264 tends to bend generally toward mounting plate 262. Similarly, when force is applied to handle member 273 tending to move member 273 toward plate member 262, spring plate 264 likewise moves towards member 262.

Figure 59:
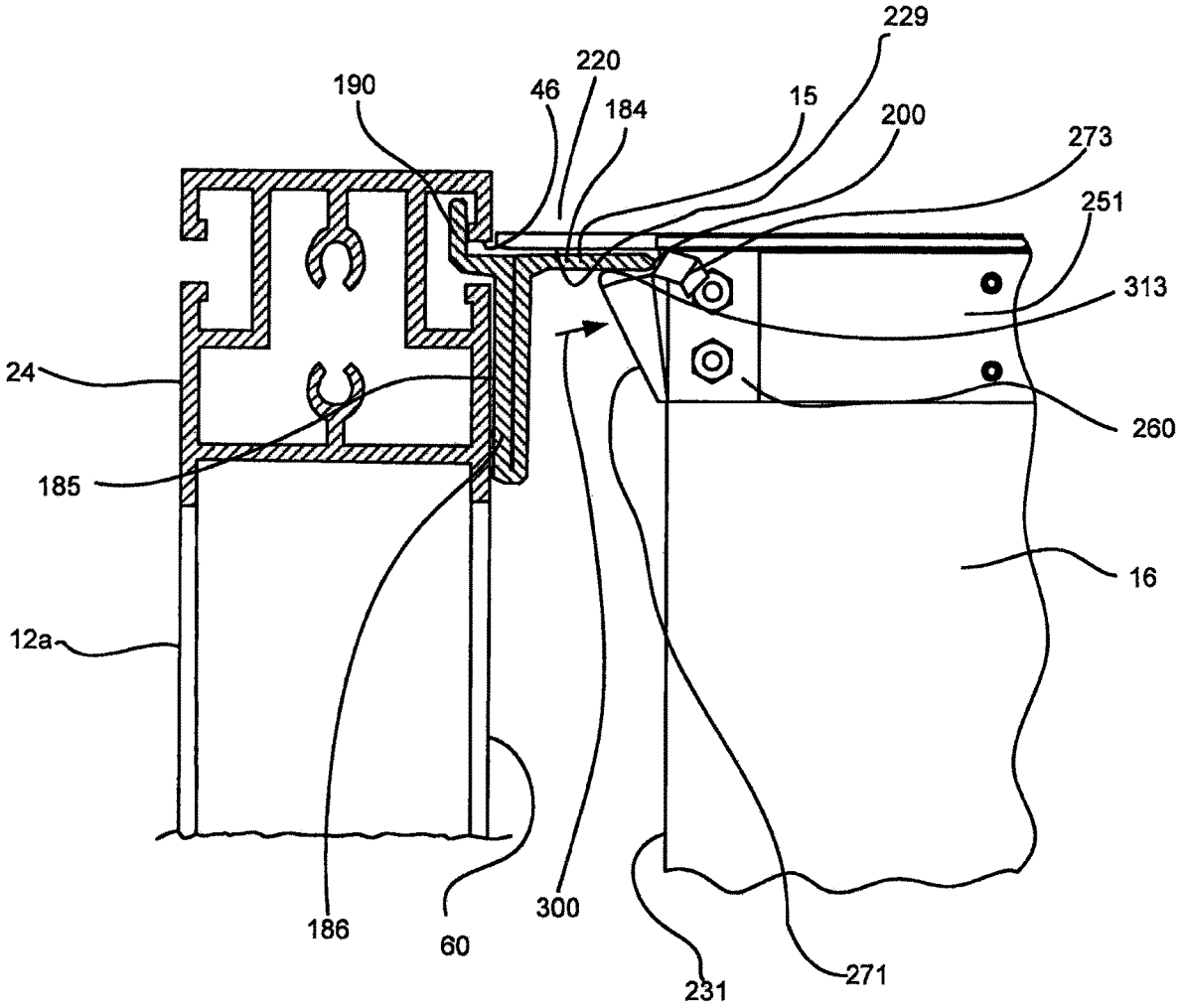
FIG. 59 shows the bracket of FIG. 58 latching a trough member to a support arm member.

Referring now to FIG. 59, an exemplary latching bracket 260 is shown mounted to an external surface of trough member 16 at one end of metal stringer member 251. As shown, latch plate 266 extends past an external surface of side wall member 231 and generally under a bottom surface of the trough lip member 220. Referring also to FIG. 14, the exemplary latching bracket shown in FIG. 59 is mounted generally at the location indicated by numeral 197. Although not shown in detail, a second latching bracket 260 is mounted at the second end 218 of trough member 16 in the area indicated by numeral 680 for interacting with the second arm support member 15 upon assembly.

Where brackets 260 are mounted to a trough member 16, to secure the trough member 16 to a channel assembly 16 and support arm members 15, after the rear portion of lip member 220 is received in channel 148 (see FIG. 26 again), the front edge portion of trough member 16 is lowered until the bearing edges 271 of latching brackets 260 contact adjacent edges 200 of shelf members 180 (see again FIG.

12). As the trough member 16 is forced downward, edges 200 apply a force to bearing surfaces 271 causing spring plates 269 to temporarily deform until latch members 266 clear edges 200. Once members 266 clears edges 200, spring plates 269 springs back to their steady-state positions and members 184 are sandwiched between latch edges 313 and the undersurfaces 229 of the lip member 220.

Bracket 260 in FIG. 58 can also be used as part of a different coupling assembly to mount table top assembly 14 to support arm members 15. To this end, referring to FIG. 60, an exemplary coupling assembly 280 includes a bracket 260*a* akin to bracket 260 illustrated in FIG. 58 and described above as well as a pin member 282. Like bracket 260 described above, bracket 260*a* includes a handle 273*a*, a latch edge 270*a* and a bearing edge 271*a*. Bracket 260*a* is mounted to strengthening runner 276 adjacent edge 451 with latch edge 270*a* generally facing the undersurface 270 of top member 279. In this embodiment a pin 282 is mounted to undersurface 270 and extends therefrom adjacent latching bracket 260*a*.

Figure 60:
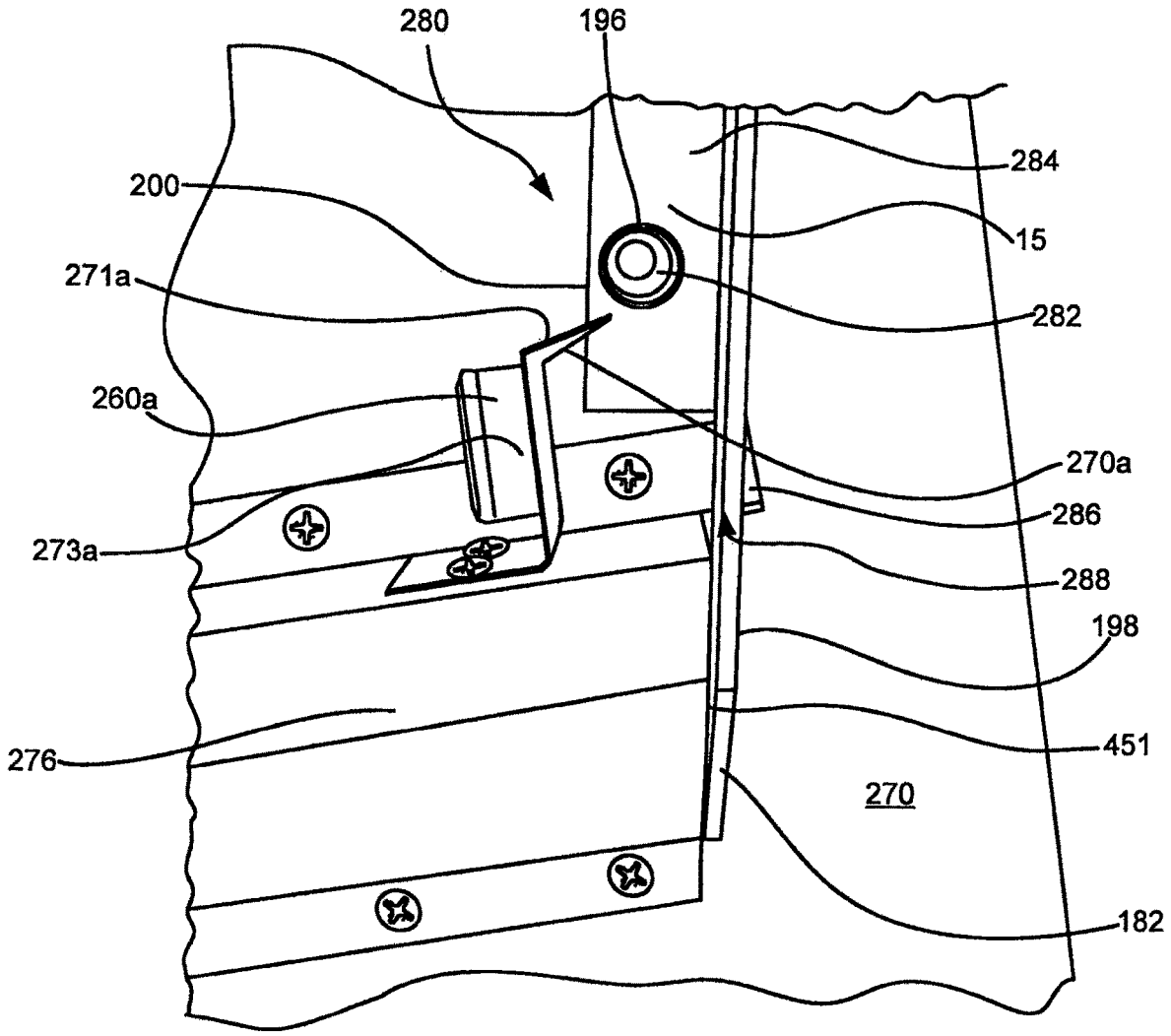
FIG. 60 shows one of the latching brackets of FIG. 58 latching a table top assembly to a support arm member according to another embodiment of the present disclosure.

Referring still to FIG. 60, again to FIG. 12, coupling assembly 280 components are mounted relative to each other such that, upon assembly of the configuration shown in FIG. 1, distal ends of the arm support members 15 are generally aligned with the coupling assemblies 280 and cooperate therewith to secure the table top member 279 to the support arm members 15. To this end, generally, as seen in FIG. 60, upon assembly, finger member 198 at the distal end of one of the support arm members 15 is received within slot 288 formed between edge 451 and the facing edge of finger member 286, pin 282 is received within hole 196 and shelf support member 184 is sandwiched between latch edge 270*a* and the undersurface 270 of the table top member. When so attached, the top member cannot be removed unless an assembly user affirmatively de-latches the latching bracket 260*a* by forcing handle member 273*a* into the unlatched position.

To secure a table top assembly 14 that includes brackets 260*a* to the support arm members 15, as the front edge of the table assembly 14 is lowered, bearing edges 271*a* of brackets 260*a* contact edges 200 formed by arm members 15 (see again FIG. 12) and force is applied through the bearing surfaces 271*a* to the spring plates that form part of brackets 260*a* causing the spring plates to deform until the latch members of the brackets 260*a* clear edges 200. After the latch members clear edges 200, the spring plates spring back into their steady-state positions and members 284 are sandwiched between undersurface 270 of the top member and the latch edge 270*a*.

While the invention may be susceptible to various modifications and alternative forms, specific embodiments have been shown by way of example in the drawings and have been described in detail herein. However, it should be understood that the invention is not intended to be limited to the particular forms disclosed. For example, while the embodiments described above each include a channel assembly 18, it should be appreciated that at least some embodiments may include a rigid rail as opposed to a channel forming member where the rail is slidably mounted at opposite ends to facing leg assembly slots. In this case, separate wire management structure could be mounted to undersurface of table tops. As another example, the leg assemblies may form coupling or support surfaces other than lip members for channel/rail attachment in at least some embodiments.

As still one other example, many other multiple person work station configurations can be constructed using the components described above. For example, referring now to FIG. 61, another configuration 580 is illustrated that includes three separate work station spaces. In configuration 580, the work stations all generally face in the same direction but they are staggered side-by-side. The components that are used to provide configuration 580 include all the components described above with respect to configuration 10 shown in FIG. 1 as well as other station subassemblies 10*a* and 10*b*. Subassembly 10*a* includes a third leg assembly 12*c*, a second table top assembly 14*a*, a second channel assembly 18*a* and a second trough member 16*a*. Similarly, subassembly 10*b* includes a fourth leg assembly 12*d*, a third table top assembly 14*b*, a third channel assembly 18*b* and a third trough member 16*b*. As shown, first channel assembly 18 is mounted at one end to a rear portion of leg assembly 12*a* and at the opposite end centrally to leg assembly 12*b* with trough member 16 and table top assembly 14 arranged to a forward side of channel assembly 18. Thus, while table top assembly 14 resided generally along one of the side surfaces of leg assembly 12*a*, table top assembly 14 is cantilevered generally to a front side of leg assembly 12*b*.

Figure 61:
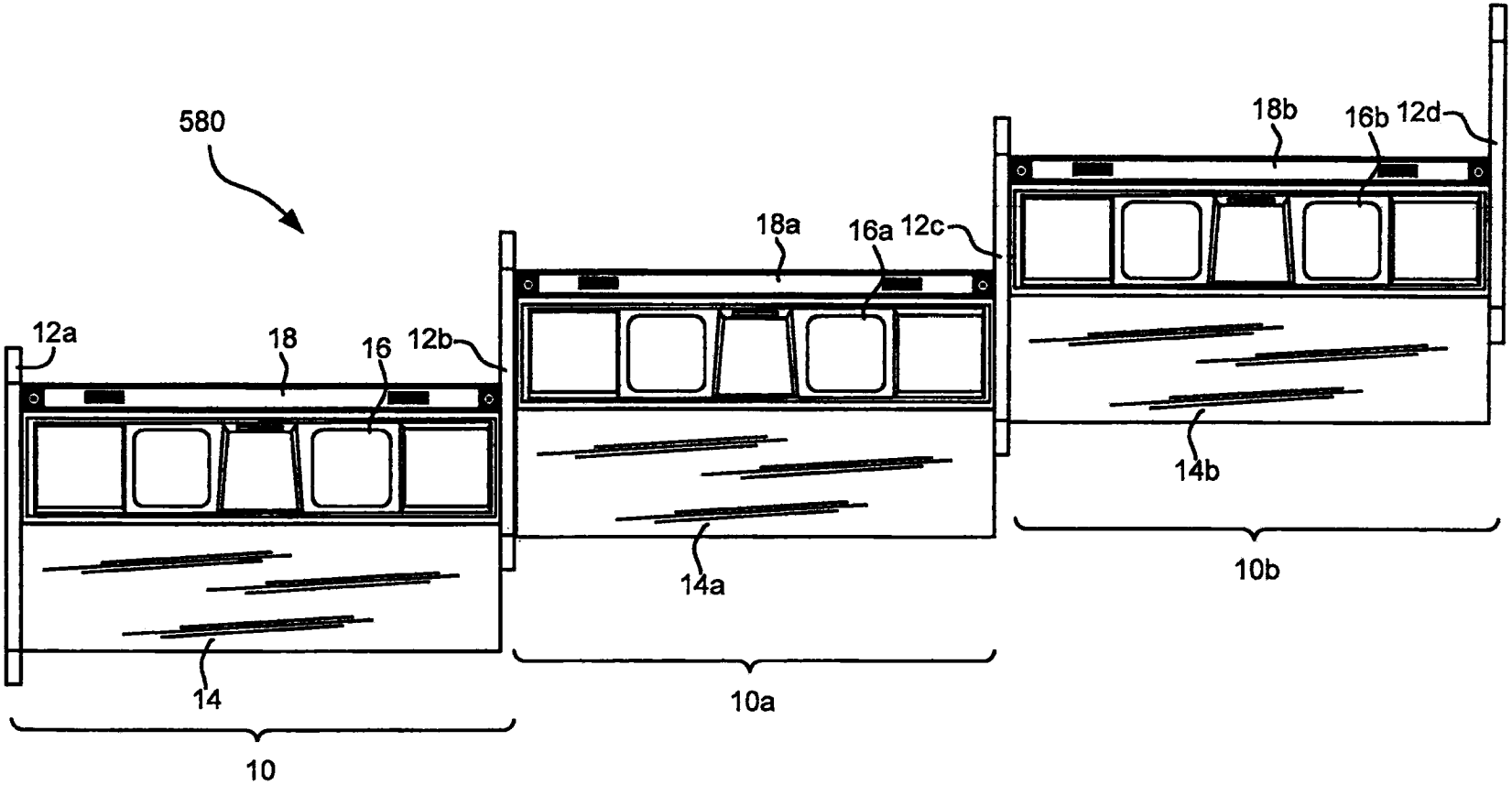
FIG. 61 shows a top plan view of three single person staggered work stations according to another embodiment of the present disclosure.

Referring still to FIG. 61, similarly, second channel assembly 18*a* is mounted at one end to a rear portion of second leg assembly 12*b* and centrally to third leg assembly 12*c* so that second table top assembly 14*a* is positioned to one side of leg assembly 12*b* and is cantilevered generally in front of third leg assembly 12*c*. Channel assembly 18*b* is mounted at one end to a rear portion of third leg assembly 12*c* and centrally to fourth leg assembly 12*d* in a fashion similar to that described above with respect to channel assemblies 18 and 18*a*.

Referring still to FIG. 61, the end result of attaching the components described above in the fashion described above is that the three work stations are staggered one from the other. In this configuration 580, channel assemblies 18, 18*a* and 18*b* are misaligned. Nevertheless, again, because each of the channel assemblies 18, 18*a* and 18*b* is open at its opposite ends and the channel assembly openings are open to the large leg assembly openings 38 (see again FIG. 1), power and data wires and cables can be routed from one channel assembly through the leg opening 38 to an adjacent one of the channel assemblies.

Figure 62:
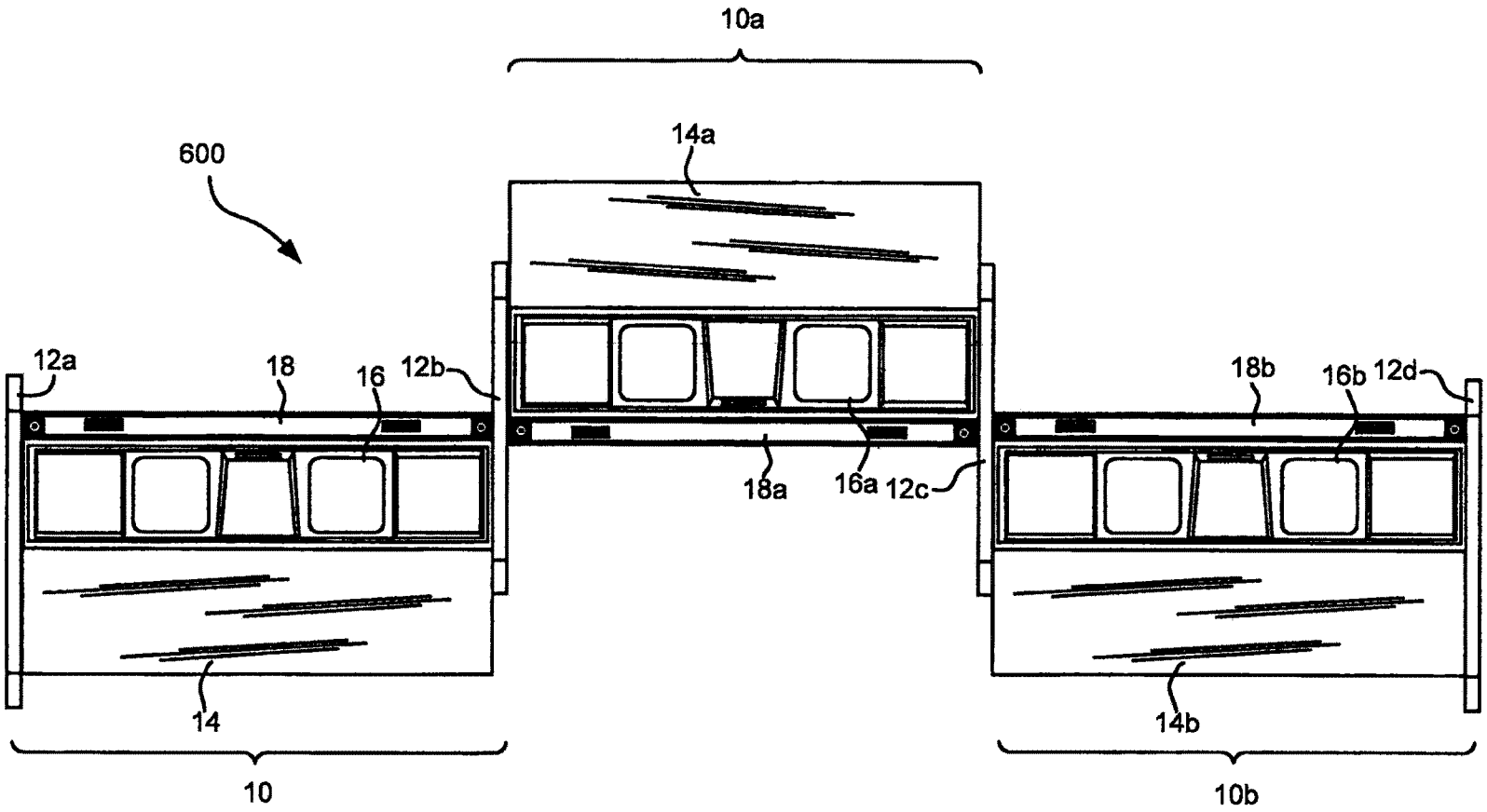
FIG. 62 shown a top plan view of three single person work stations in another staggered configuration.

Referring now to FIG. 62, one additional exemplary configuration 600 is illustrated that includes components for configuring three separate work stations. Here, adjacent work stations are staggered but face in opposite directions. To this end, exemplary configuration 600 includes one work station having all of the components described above with respect to configuration 10 shown in FIG. 1 as well as second and third work station subassemblies 10*a* and 10*b*. Subassembly 10*a* includes a third leg assembly 12*c*, a second channel assembly 18*a*, a second trough member 16*a* and a second table top assembly 14*a* while subassembly 10*b* includes a fourth leg assembly 12*d*, a third channel assembly 18*b*, a third trough member 16*b* and a third table top assembly 14*b*.

Referring still to FIG. 62, first channel assembly 18 is mounted at one end to a rear portion of first leg assembly 12*a* and centrally to second leg assembly 12*b* with first trough member 16 and first table top assembly 14 mounted to a forward side of channel assembly 18. Second channel assembly 18*a* is centrally mounted to each of second leg assembly 12*b* and third leg assembly 12*c* with second trough member 16*a* and second table top assembly 14*a* mounted to a rearward side of assembly 18*a*. Third channel assembly 18*b* is centrally mounted to third leg assembly 12*c* and to a rear portion of fourth leg assembly 12*d* with third trough member 16*b* and third table top assembly 14*b* supported to a front side of channel assembly 18*b*. Thus, as shown, all of the channel assemblies 18, 18*a*, and 18*b* are aligned with the first and third work stations corresponding to table top assemblies 14 and 14*b* located to the front side of the channel assemblies and the second or middle work station corresponding to table top assembly 14*a* located rearward of the channel assemblies.

Figure 63:
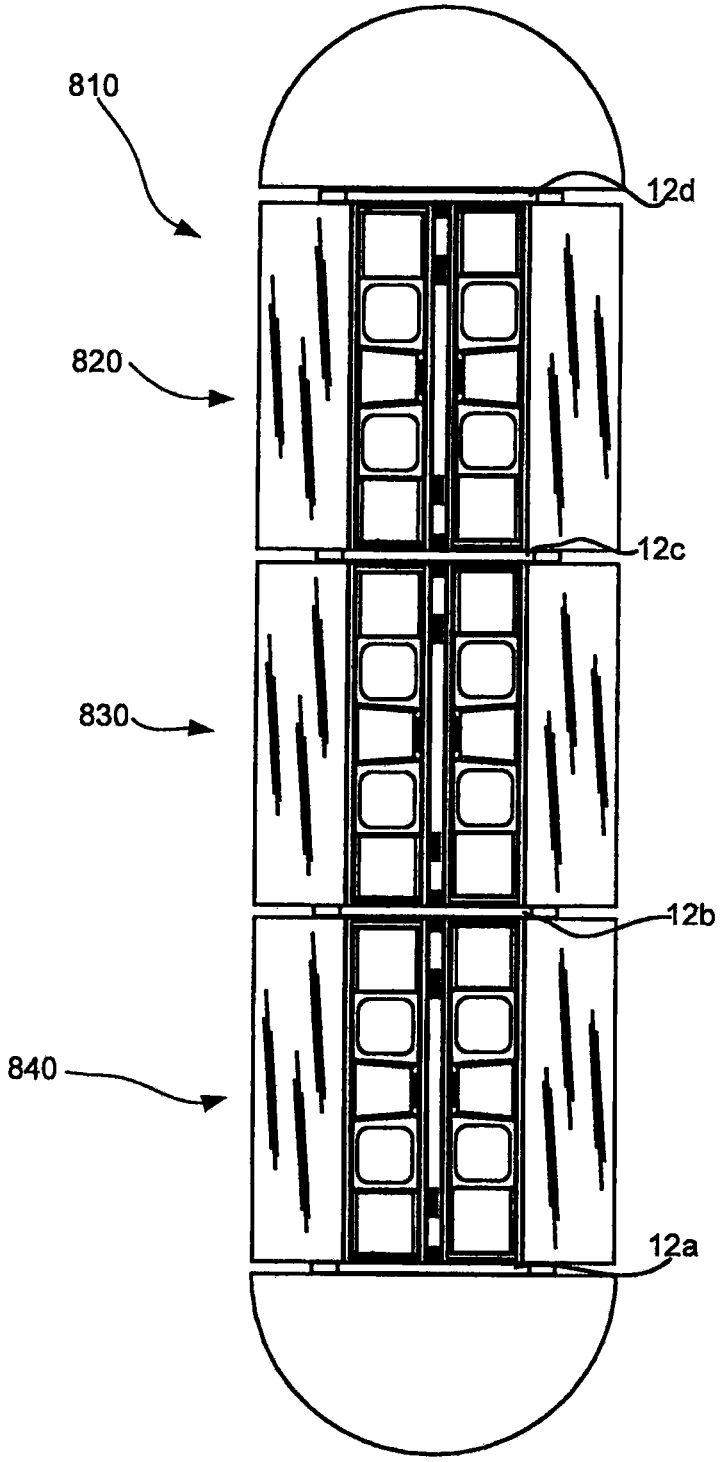
FIG. 63 is a top plan view of a six station configuration consistent with at least some aspects of the present invention.

One additional configuration 810 is shown in FIG. 63 that includes components to configure three pairs of face-to-face workstations 820, 830, 840 and two half-round end tables 850 and 860 supported by four leg assemblies 12*a*, 12*b*, 12*c* and 12*d* where all of the top surfaces of the table tops, end tables, leg members and channel assemblies are at the same height.

In addition to the exemplary high vertical arch assembly 430*a* described above with respect to FIGS. 48-51, an intermediate arch assembly is also contemplated. To this end, referring now specifically to FIG. 64, another table/desk configuration 900 is illustrated that forms facing workspaces for two users where the configuration 900 includes one high vertical arch assembly 430*a* similar to the arch assemblies described above and one intermediate arch assembly 902. High assembly 430*a* is mounted to the top end of a first leg assembly 12*a* while intermediate arch assembly 902 is mounted to the top end of second leg assembly 12*b*. Although not shown in detail, here, intermediate arch assembly 902 would mount to the top end of leg assembly 12*b* in a fashion similar to that described above with respect to FIGS. 50 and 51 and therefore, in the interest of simplifying this explanation, the structure and manner for mounting intermediate arch assembly 902 to leg assembly 12*b* will not be described again here in detail.

Structurally, intermediate arch assembly 902 includes first and second generally vertical members 904 and 906 that extend upwardly from leg assembly 12*b* and an intermediate height rail member 908 that extends between top ends of vertical members 904 and 906. Rail member 908 has a cross section similar to the cross section of rail member 24 described above with respect to FIG. 4 and therefore, among other things, forms T slots in each of its two lateral side surfaces akin to T slots 30 and 46 shown in FIG. 4 as well as a top flat surface labeled 909 in FIG. 64.

In at least some embodiments, additional storage accessories may be provided for use with one or more of the configurations described above. One general type of particularly useful storage accessory is referred to generally as a gravity mount type accessory. Here, in general, as the label implies, gravity mount accessories are mounted to other configuration opponents via a gravity type interference fit connection. Many of the gravity mount type accessories can advantageously be mounted to other components without the use of tools and therefore are intuitive and easy to mount.

To this end, referring again to FIG. 64, exemplary intermediate arch structure 902 includes first and second frame members 904 and 906 that form substantially oppositely facing surfaces 911 and 913 which form an angle such that a width dimension between the two surfaces 911 and 913 becomes greater when moving from top ends of the members 904 and 906 downward toward bottom ends. It has been recognized that surface 911 and 913 can be used as bearing surfaces to support storage units to be described hereafter. More specifically, storage units may be constructed that each include opposing bearing surfaces which define a length dimension which matches the width dimension between the oppositely facing bearing surfaces 911 and 913 so that when the storage unit is positioned with the top portion of arch structure 902 passing between the opposing bearing surfaces, the opposing bearing surfaces contact and are supported by the oppositely facing bearing surfaces 911 and 913 and the storage unit is supported by the arch assembly 902 in a useful position.

Referring now to FIGS. 65-68, one exemplary gravity mount type storage assembly 912 is shown in the context of a table/desk configuration 910 that includes a single intermediate arch assembly 902 as described above with respect to FIG. 64. Here, storage assembly 912 is mounted to the top end of intermediate arch assembly 902 so as to afford storage space accessible on either side of arch assembly 902. Thus, persons using either of the facing work spaces defined by assembly 910 may use a portion of the space defined by storage assembly 912 to store office materials and/or space on the side of arch assembly 902 opposite the work spaces may be used to store office materials as well.

Figure 65:
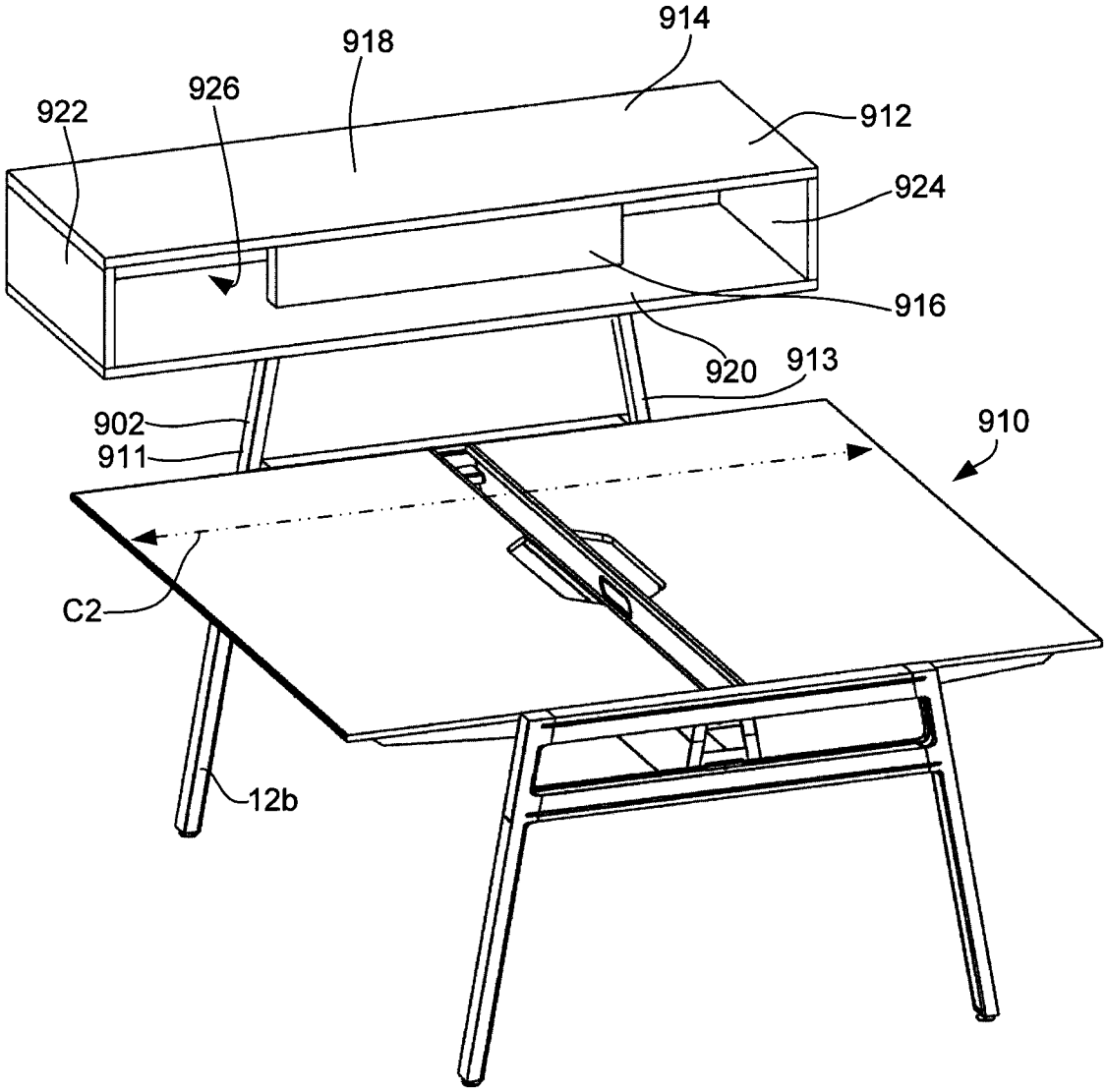
FIG. 65 is a perspective view showing an exemplary table/desk assembly including a first embodiment of a gravity-type storage assembly.
Figure 67:
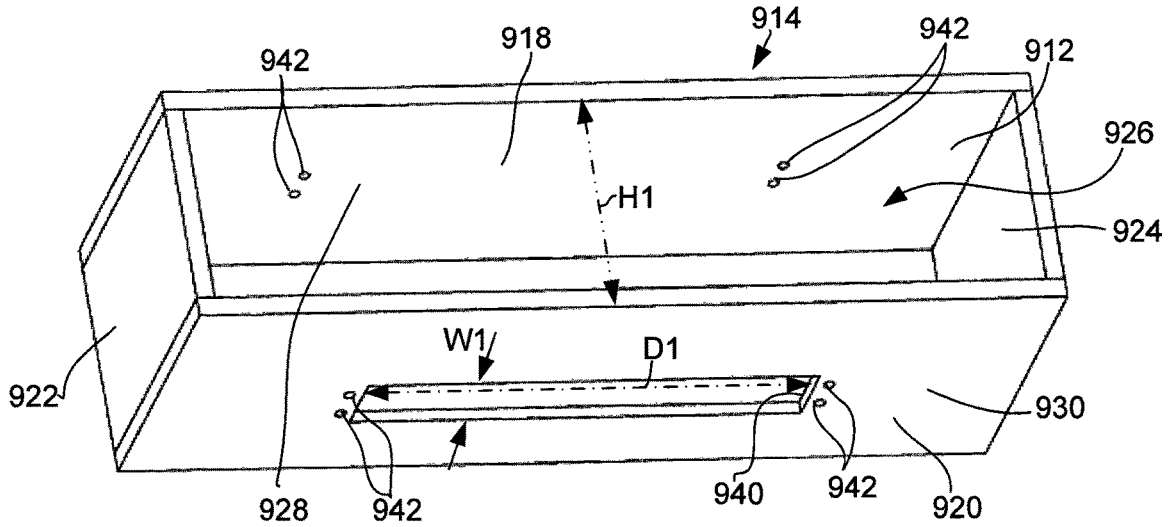
FIG. 67 is a perspective view of a portion of the storage assembly of FIG. 66.
Figure 68:
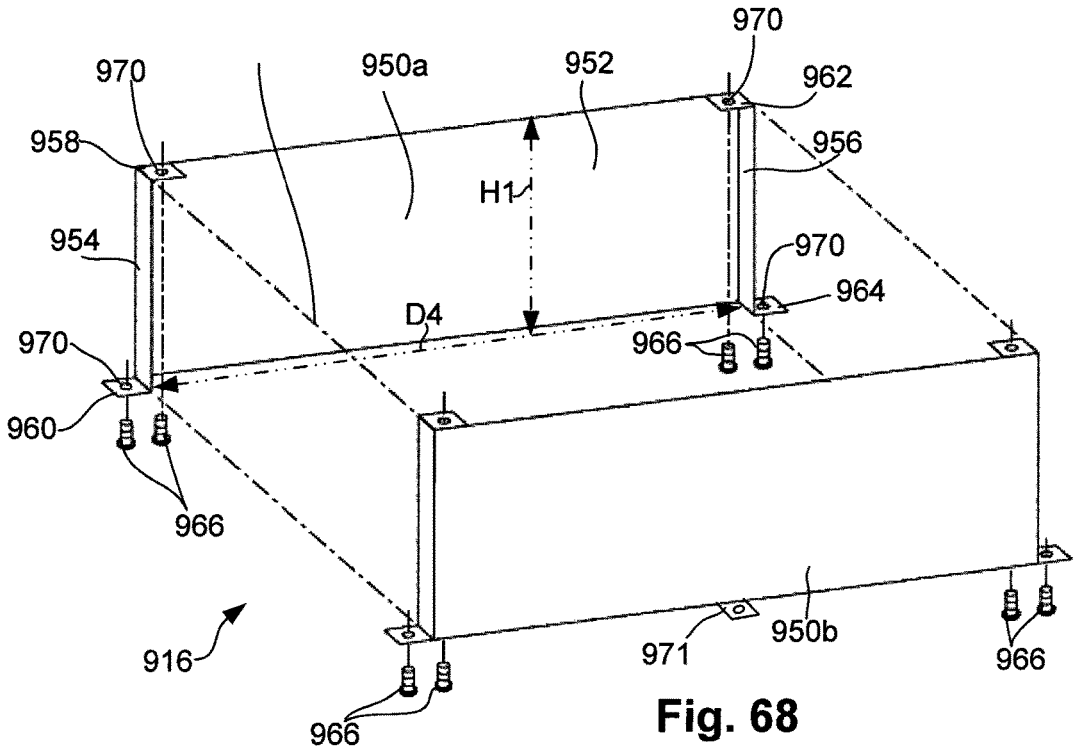
FIG. 68 is a perspective exploded view of a portion of the storage assembly of FIG. 66.

Referring still to FIG. 65 and also to FIGS. 67 and 68, storage assembly 912 includes a case assembly 914 as well as a mounting insert of collar 916. Case assembly 914 includes four rectilinear rigid wall members that together form a box like storage space 926. The four wall members include a top member 918, a bottom member 920, a first side member 922 and a second side member 924. The top and bottom members 918 and 920 have similar rectilinear shapes and top member 918 is spaced above bottom member 920 so as to define the storage space 926 there between. In at least some embodiments, top member 918 will be spaced between 8 and 20 inches above bottom member 920 although other spacings are contemplated. Each of the top and bottom members 918-920 have a length dimension that is similar to a dimension C2 between oppositely facing edges of the tabletop members that form the workspaces defined by configuration 910 (see FIG. 65). Side members 922 and 924 are spaced apart at opposite ends of the top and bottom members 918 and 920 and traverse the distance there between thereby further defining the storage space 926.

Referring specifically to FIG. 67, top member 918 forms a bottom surface 928 and bottom member 920 forms a bottom surface 930. Bottom member 920 forms an elongated rectilinear opening 940 that extends parallel to the length dimension of bottom member 920 and that is centrally located with respect to the dimensions of member 920. Opening 940 has dimensions such that at least a top portion of intermediate arch 902 (i.e., top portions of first and second frame members 904 and 906 in FIG. 64) can extend there through as will be described in more detail below.

Bottom member 920 forms treaded mounting holes 942 at either end of opening 940. More specifically, two threaded mounting holes 942 are provided at either end of opening 940. Top member 918 also forms threaded mounting holes 942 in its undersurface 928. The holes 942 formed in bottom surface 928 are spaced relatively closer to each other than the holes 942 formed in bottom surface 930 such that the holes 942 in bottom surface 928 are vertically aligned with end portions of opening 940. Opening or rim 940 as a width dimension W1 and a length dimension (not labeled). The bottom surfaces 928 and 930 form a height dimension labeled H1 in FIG. 67.

Referring now to FIG. 68, mounting insert 916 includes first and second mounting insert members 950*a* and 950*b* in the exemplary embodiment, each of members 950*a* and 950*b* is similarly constructed and operates in a similar fashion and therefore, in the interest of simplifying this explanation, only member 950*a* will be described here in detail. Member 950*a* is formed of rigid sheet metal that is bent to form integrally connected members including a central plate member 952, first and second end flanges 954 and 956 and four mounting tabs 958, 960, 962 and 964. Plate member 952 is a substantially rectilinear and rigid plate member having a height dimension H1 which is identical to the dimension labeled H1 in FIG. 67 between the bottom surfaces 928 and 930 of members 918 and 920, respectively. Plate member 952 as a length dimension similar to the length of opening 940 that extends between first and second end edges (not labeled). Flanges 954 and 956 extend in the same direction and are parallel to each other, extend from opposite ends of a plate member 952 and extend a dimension equal to approximately half the width dimension W1 of opening 940 (see again FIG. 67). Mounting tabs 958 and 962 extend toward each other from top ends of flanges 954 and 956 and along the top edge of plate member 952. Mounting tabs 960 and 964 extend away from each other from bottom ends of tabs 954 and 956. In at least some embodiments one or more additional mounting tabs 971 may be provided along the lower long edges of each of the central plates 952 (see exemplary tab 971 extending from mounting insert member 950*b*). Each of the mounting tabs 958, 960, 962 and 964 (and 971 if they exist) forms a mounting hole 970. The lower edges of flanges 954 and 956 define a dimension D4.

Figure 66:
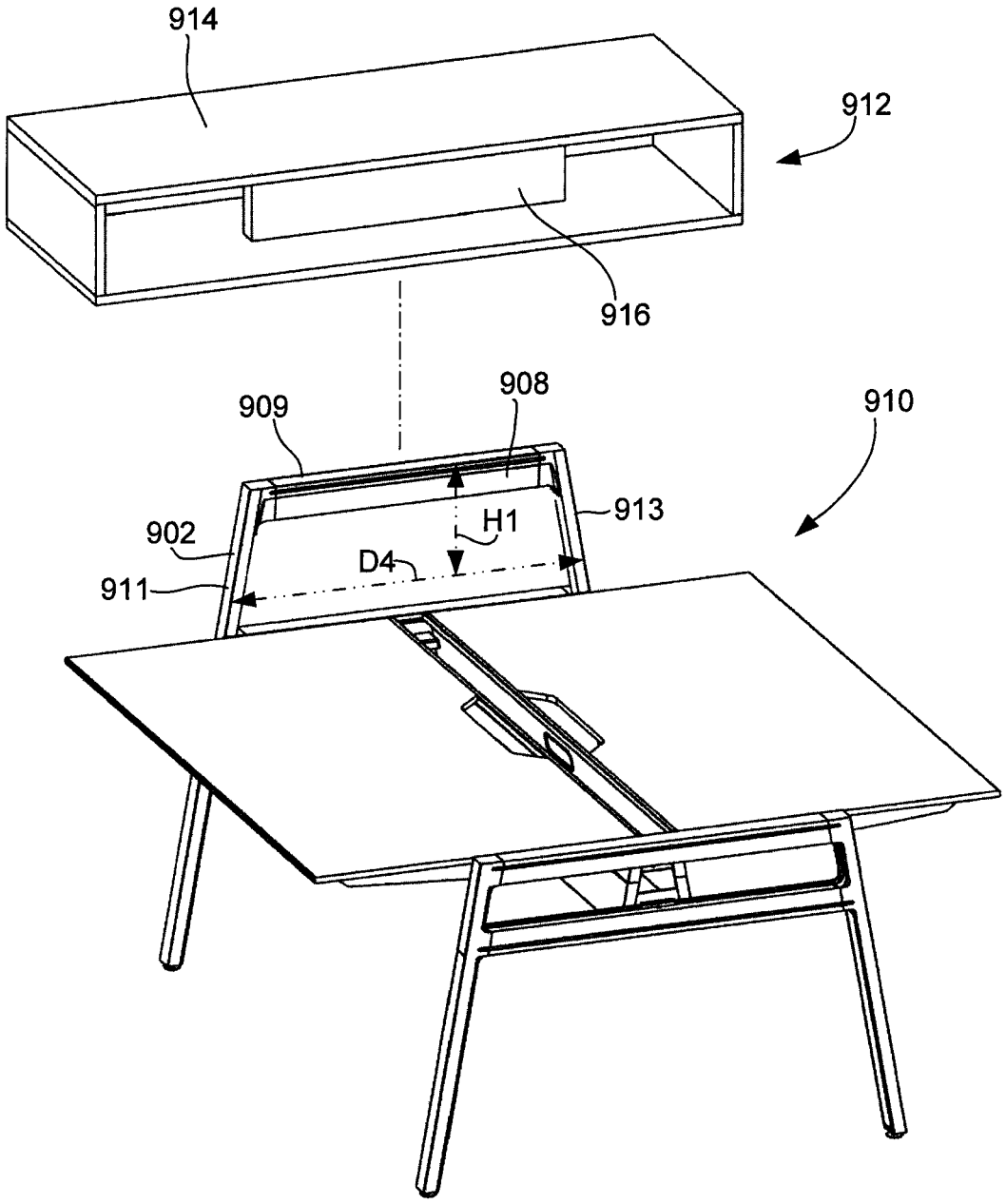
FIG. 66 is similar to FIG. 65, albeit showing the storage assembly prior to mounting to an intermediate arch assembly.

Referring to FIG. 68 and also now to FIG. 66, the dimension D4 is substantially identical to a dimension D4 between oppositely facing bearing surfaces 911 and 913 of intermediate arch assembly 902 at a dimension H1 from the top surface 909 of arch assembly 902 where a dimension H1 is identical to the dimension H1 shown in FIGS. 67 and 68.

Referring again to FIGS. 65, 67 and 68, to assemble storage assembly 912, the insert members 950*a* and 950*b* are positioned with their flanges 954 and 956 extending toward each other to form a flattened box-like subassembly. The subassembly is inserted through opening 940 with flanges 958 and 962 aligned with the threaded mounting holes 942 formed in undersurface 928 and tabs 960 and 964 aligned with the threaded mounting holes 942 formed in undersurface 930. Next, mounting screws 966 (see FIG. 68) are inserted through the tabs 958 through 964 and into the threaded mounting holes to secure insert 960 to case assembly 914.

To mount case assembly 914 to intermediate arch 902, referring to FIG. 66, case assembly 914 is positioned above arch assembly 902 with the bottom opening formed by mounting insert 916 aligned with top surface 909 and the storage assembly 914 is lowered. Eventually, top surface 909 contacts the undersurface 928 of top member 918 between tabs 958 and 962 and intermediate arch 902 supports top member 918 and the other portions of storage assembly 912 attached thereto. In addition, in at least some embodiments, because dimension D4 formed by the opposing bearing surfaces at opposite ends of mounting insert 916 (see again FIG. 68) is similar or identical to the dimension D4 formed by oppositely facing bearing surfaces 911 and 913 of intermediate arch 902 at distances H1 (see FIGS. 66 and 67), the oppositely facing surfaces of arch 902 should contact the lower facing edges of the mounting insert 916 to provide additional support to the storage assembly 912 as well as to limit or eliminate any movement of the storage assembly 912 with respect to the supporting arch assembly 902.

Figure 70:
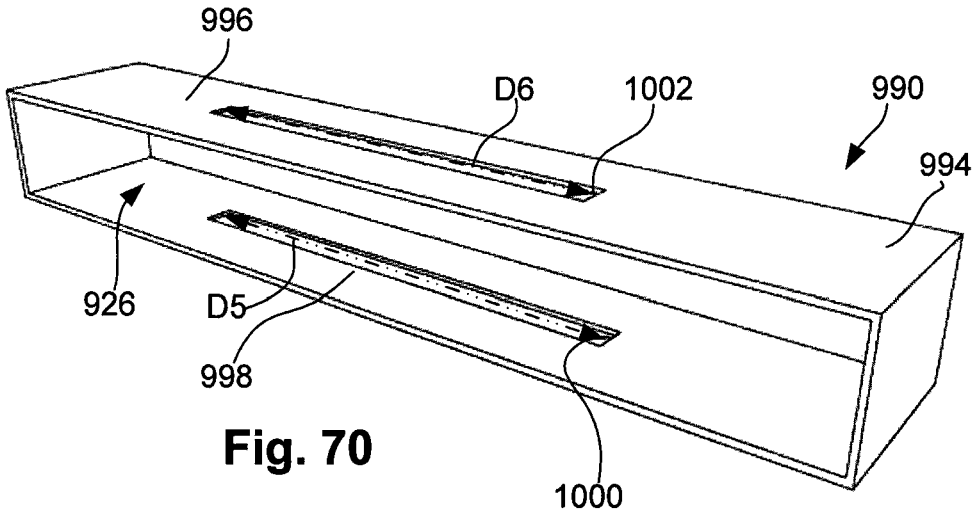
FIG. 70 is a perspective view of the second storage assembly of FIG. 69, albeit independent of the arch assembly.
Figure 69:
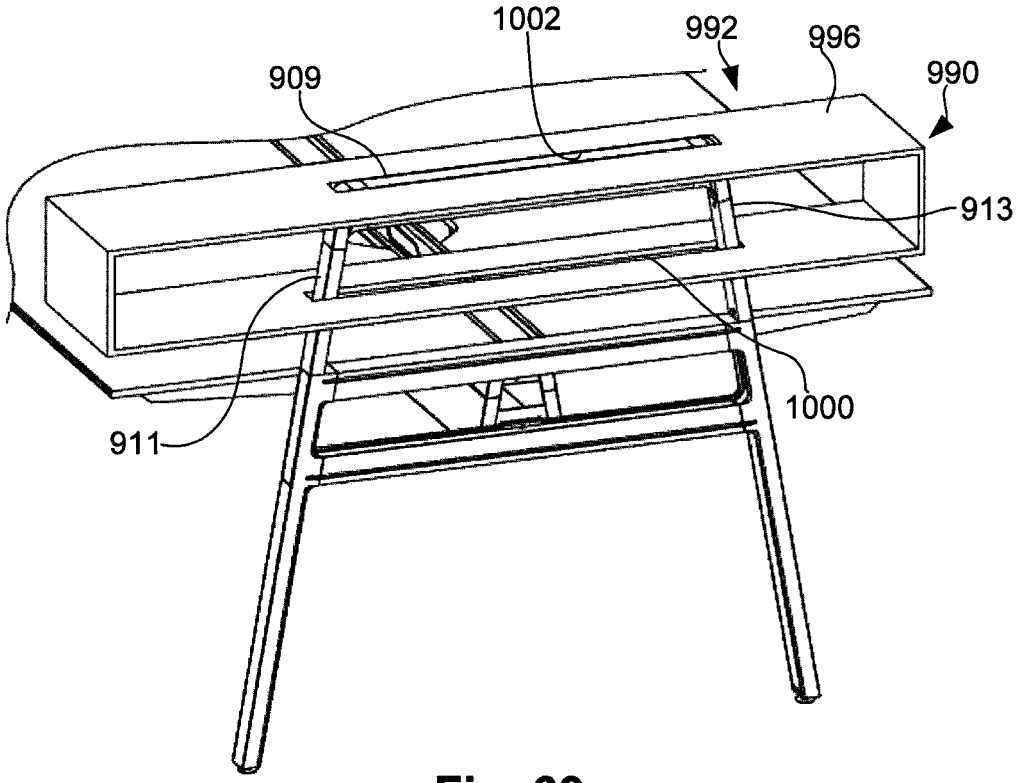
FIG. 69 is a perspective view of a second gravity-type storage assembly mounted to an intermediate arch assembly.

Additional gravity type storage assemblies are contemplated. To this end, referring to FIG. 69, a second exemplary gravity-type storage assembly 990 is shown mounted to an intermediate arch assembly 902 that forms part of another desk/table configuration 992. Referring also to FIG. 70, storage assembly 990 is similar to the assembly 912 described above in that it includes a case assembly 994 including top and bottom wall members or first and second shelf members 996 and 998, respectively, where the bottom wall member 998 forms an opening 1000 akin to opening 940 shown in FIG. 67. Here, however, storage assembly 990 does not include a mounting insert 916 and top wall member 996 forms a second mounting opening 1002 that is generally aligned above opening 1000. Opening 1000 has a length dimension D5 while opening 1002 as a length dimension D6 which is smaller than dimension D5. Dimensions D5 and D6 are similar to dimensions defined by different portions of the opposite facing lateral surfaces of the vertical members that form intermediate arch assembly 902 such that when storage assembly 990 is installed, each of the top and bottom members 996 and 998 form an interference fit with intermediate arch assembly 902. Thus, after installation, the storage assembly 990 is supported via an interference fit at each of four locations where end edges of openings 1000 and 1002 contact adjacent portions of intermediate arch assembly 902. As best shown in FIG. 69, after installation, and in at least some embodiments, the top surface 909 of intermediate arch assembly 902 should be flush with a top surface of top wall member 996.

Figure 64:
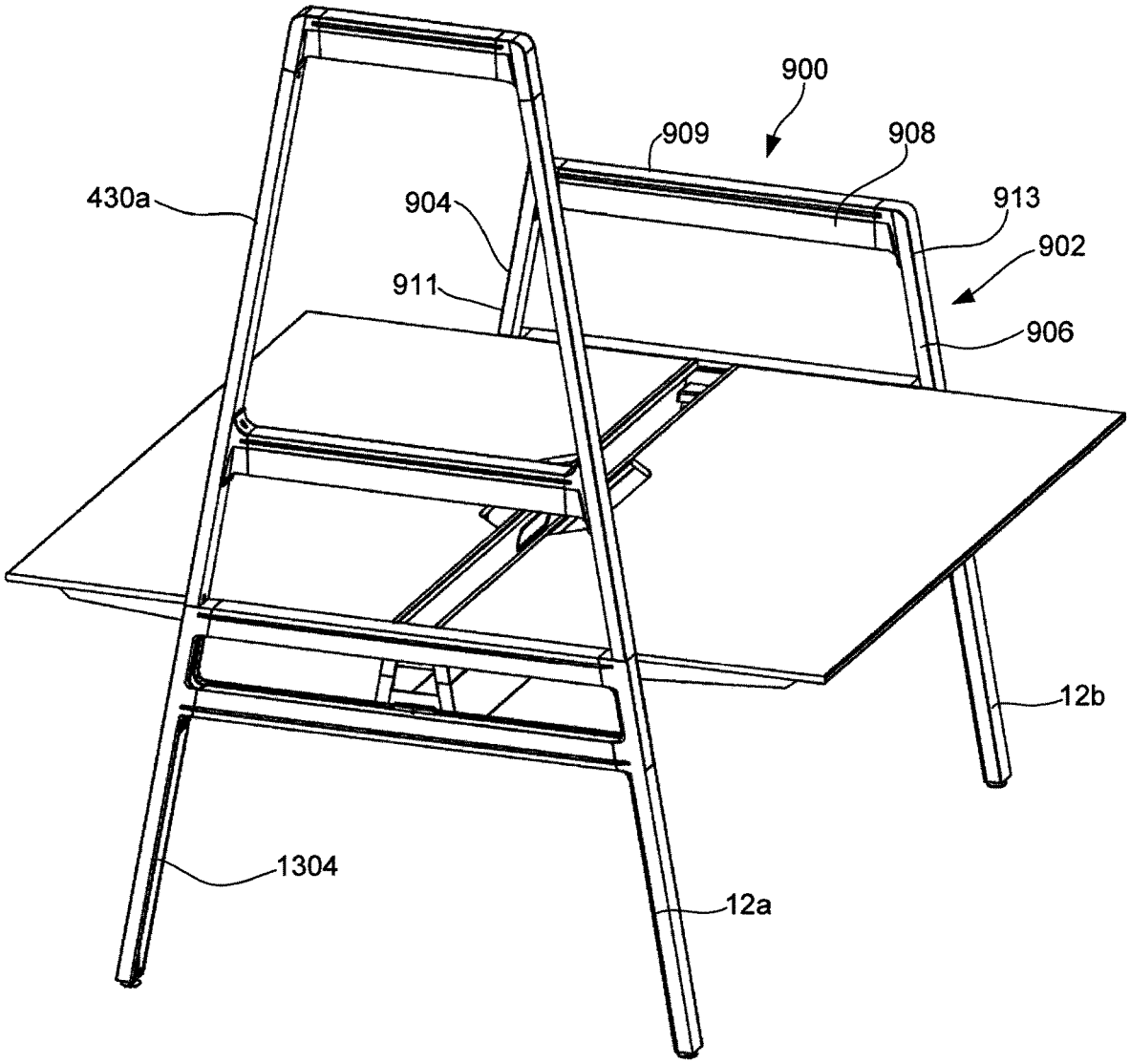
FIG. 64 is a perspective view of yet one additional table/desk assembly that is consistent with at least some aspects of the present invention that includes both a high vertical arch assembly and an intermediate arch assembly.

While not shown, it should be appreciated that the storage unit 990 of FIG. 69 may also be used with a high arch assembly 430*a* as in FIG. 64. In this case, the top portion of arch assembly 430*a* would extend up above unit 990 as unit 990 would slide down upon installation until an interference fit occurs.

In at some embodiments gravity-type storage assemblies may also be provided for use with high vertical arch assemblies to mount storage accessories at higher levels with respect to work spaces there below. In addition, gravity-type storage assemblies may be provided that facilitate intermediate height storage even where the storage assemblies are mounted to high vertical arch assemblies. To this end, see FIG. 71 that shows a gravity-type storage assembly 1010 in the form of a metal collar which can be used to attach magnets or the like. Assembly 1010 is mounted at an intermediate height to a high vertical arch assembly 430*a*. Here, the collar 1010 is formed of bent sheet metal forming an internal channel and has internal length dimensions that mirror dimensions of the arch assembly 430*a* along a portion of the height of the arch assembly 430*a* such that the internal surface of the metal collar 1010 forms an interference fit with the arch assembly 430*a* at the intermediate height. Other collar embodiments may include different dimensions that cause the interference fit to occur at other heights with respect to the arch assembly 430*a*.

Figure 71:
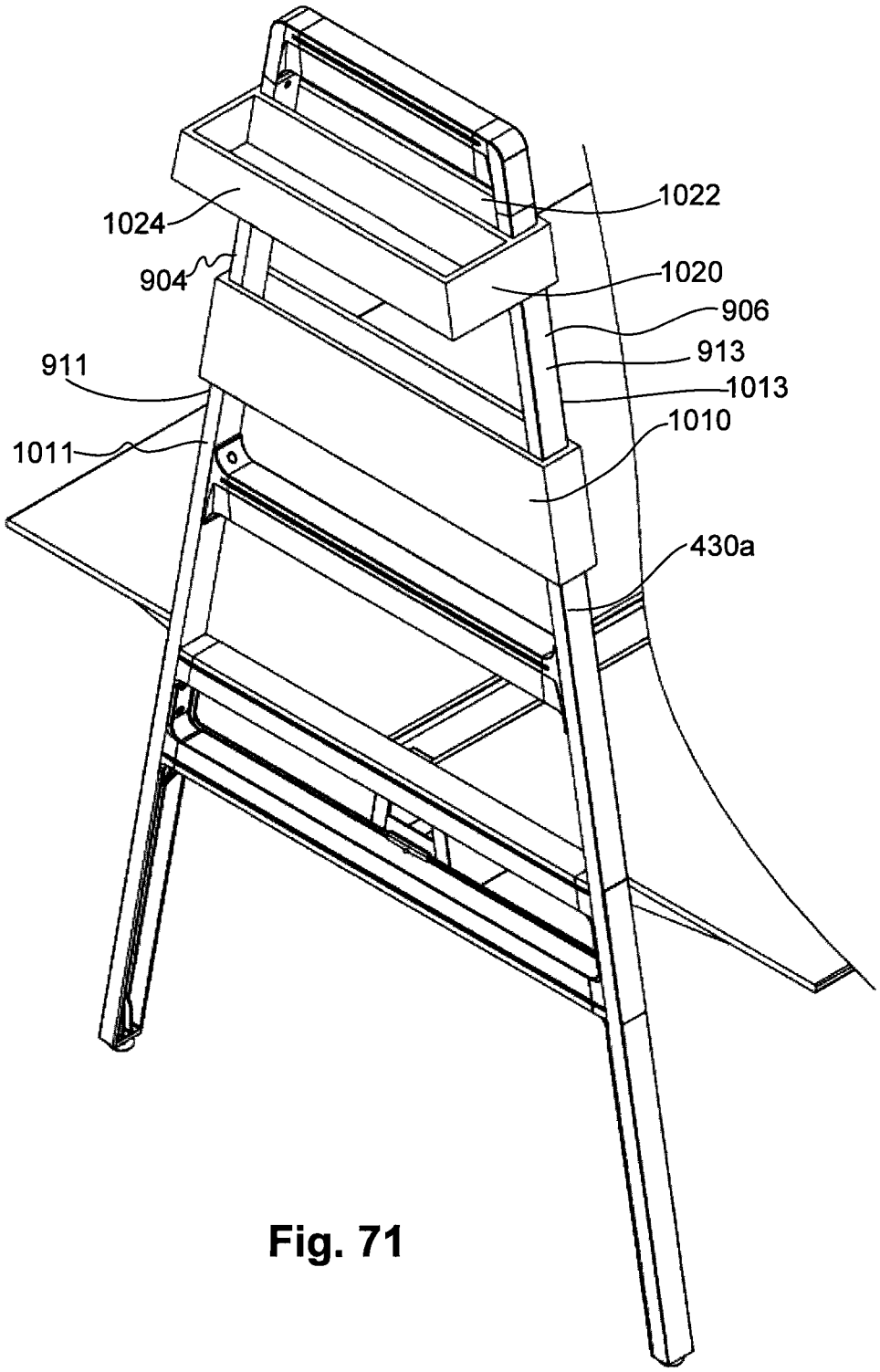
FIG. 71 is a perspective view of two additional gravity-type storage assemblies mounted to a high arch assembly.

Referring still to FIG. 71, yet another gravity-type storage assembly 1020 is illustrated that provides a storage space located to one side of the arch assembly 430*a*. To this end, the first and second frame members 904 and 906 include first and second oppositely facing side surfaces 1011 and 1013 and unit 1020 is designed to provide a storage capability to only the first side of the frame members. Storage assembly 1020 forms a rectilinear box 1024 and forms a collar 1022 to one side of the box 1024 and opposing bearing surfaces of the collar channel define a dimension that will cause an interference fit at a desired height with respect to the oppositely facing bearing surfaces 911 and 913 of the frame members that form the arch. Here, the opposing bearing surfaces form length dimensions that mirror width dimensions of arch assembly 430*a* along a relatively high portion of assembly 430*a* so that the interference fit between collar 1022 and assembly 430*a* occurs at a relatively higher location than the interference fit between collar 1010 and assembly 430*a*. As shown, assembly 1020 provides a storage box 1024 to a side of assembly 430*a* opposite work spaces. It should be appreciated that storage 1020 may simply be lifted from assembly 430*a* and re-installed with the box 1024 extending to the opposite side of assembly 430*a* if desired by work space users.

Figure 72:
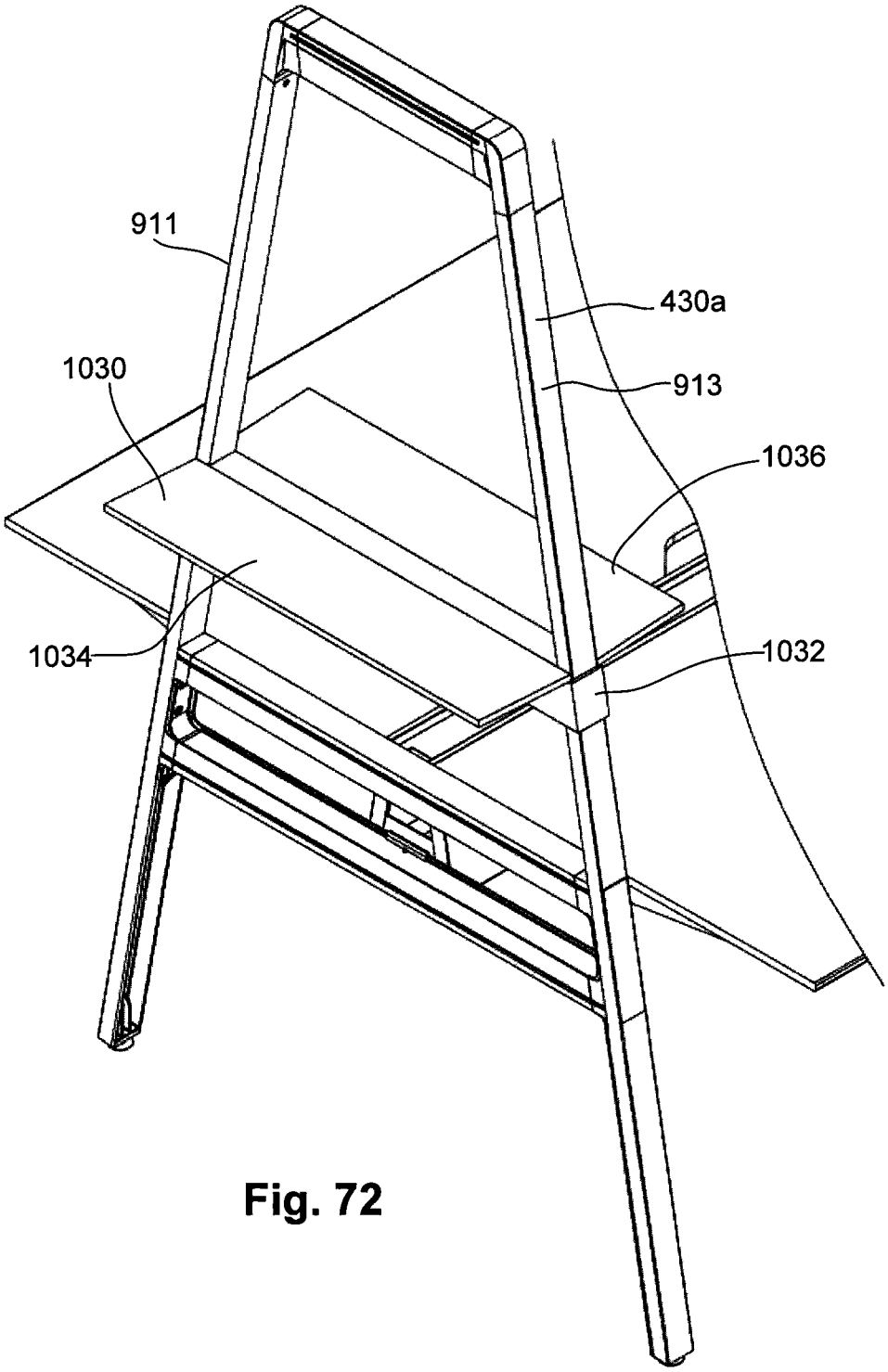
FIG. 72 shows another gravity-type storage assembly mounted to a high arch assembly.

Referring now to FIG. 72, yet another gravity-type storage assembly 1030 mounted to a high vertical arch assembly 430*a* is illustrated. Here, the assembly 1030 includes a collar 1032 for facilitating an interference fit with arch assembly 430*a* along a portion of the height of assembly 430*a* and includes first and second rigid shelf members 1034 and 1036. The shelf members 1034 and 1036 extend from opposite top edges of collar member 1032 to provide shelf surfaces to either side of arch assembly 430*a*.

Figure 73:
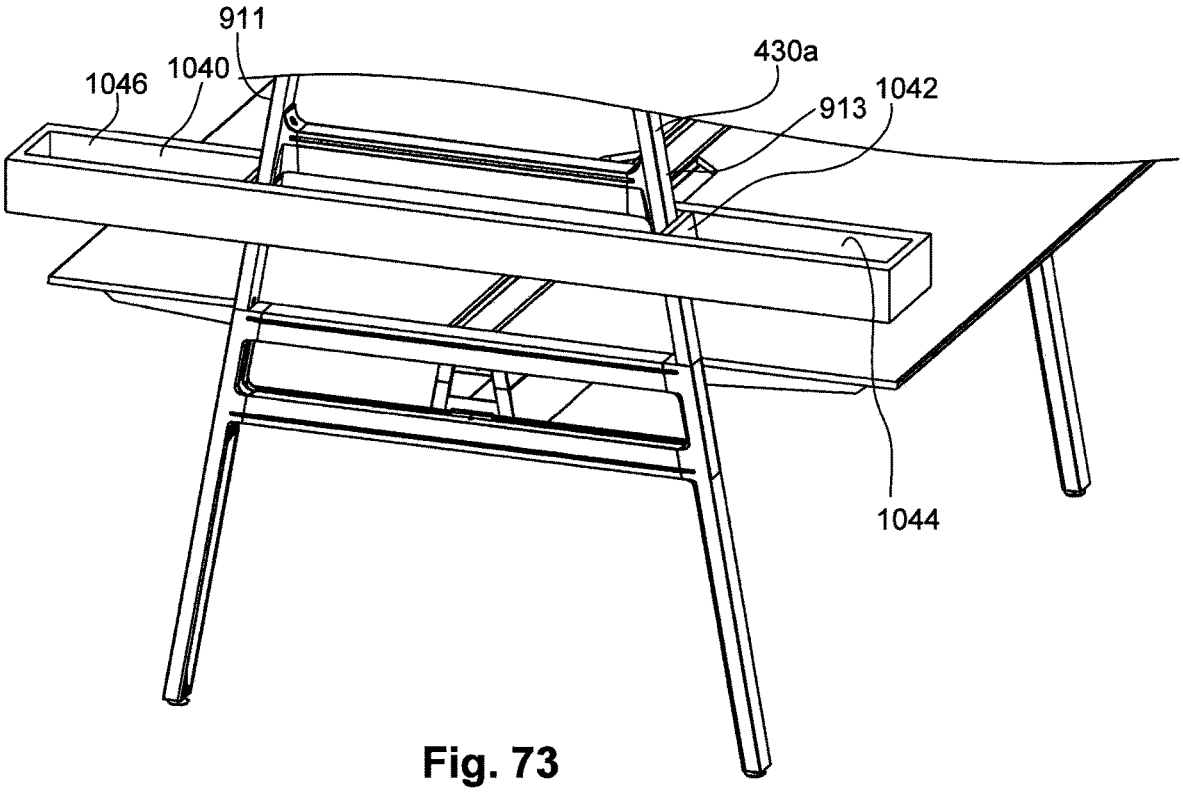
FIG. 73 shows yet one additional gravity-type storage assembly mounted to an arch assembly.

Referring now to FIG. 73, yet one additional gravity-type storage assembly 1040 is shown mounted to a high vertical arch assembly 430*a*. Here, storage assembly 1040 includes a collar 1042 having a storage box 1044 and 1046 located at each of the opposite ends of the collar 1042 to provide storage spaces that are essentially in line with the arch assembly 430*a*. Here, again, collar 1042 provides facing surfaces that define dimensions that are similar to the dimensions formed by the oppositely facing lateral surfaces of assembly 430*a* along at least a portion of the length thereof so that assembly 1040 forms an interference fit at a specific height with respect thereto.

Thus, in general there are two different types of gravity storage units contemplated including ones like unit 912 in FIGS. 65 and 66 that include a top member having an undersurface which bears against a top rail of a frame member or arch and one like 990 in FIG. 69 where openings of a collar that form part of a storage unit include opposing bearing surfaces which bear against side surfaces of a frame structure that face in opposite directions.

Figure 74:
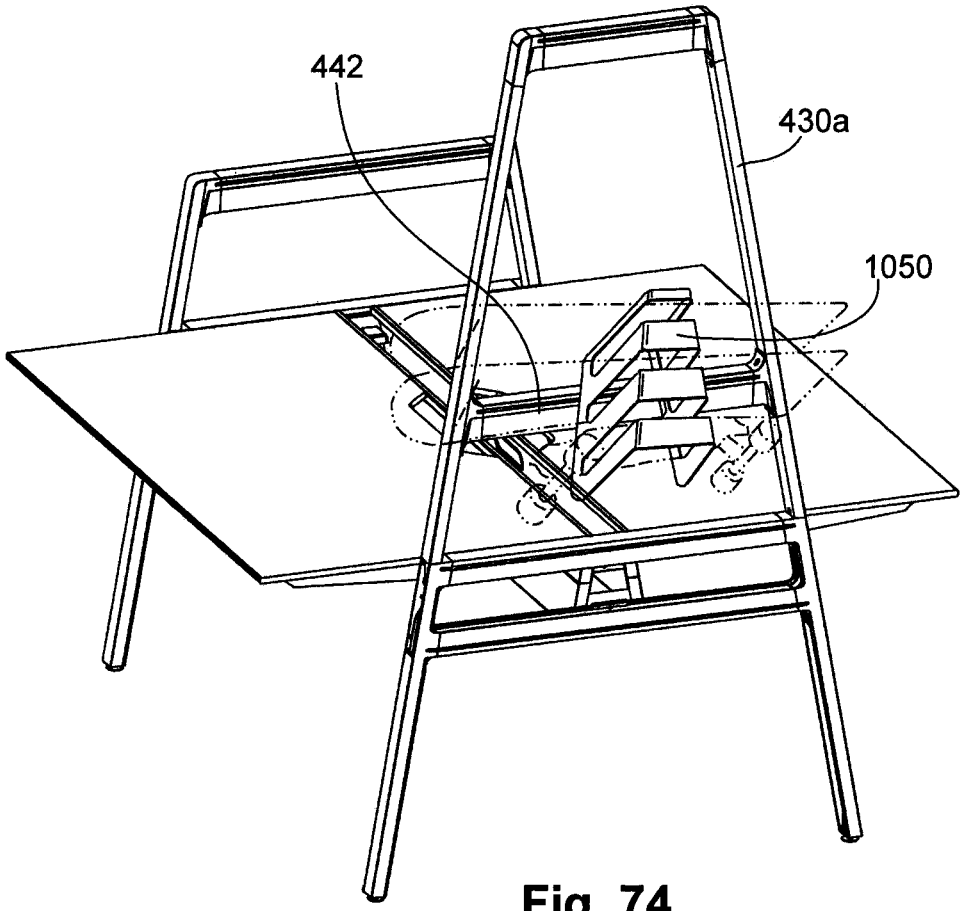
FIG. 74 is a perspective view showing a board bracket mounted to a high arch assembly.
Figure 75:
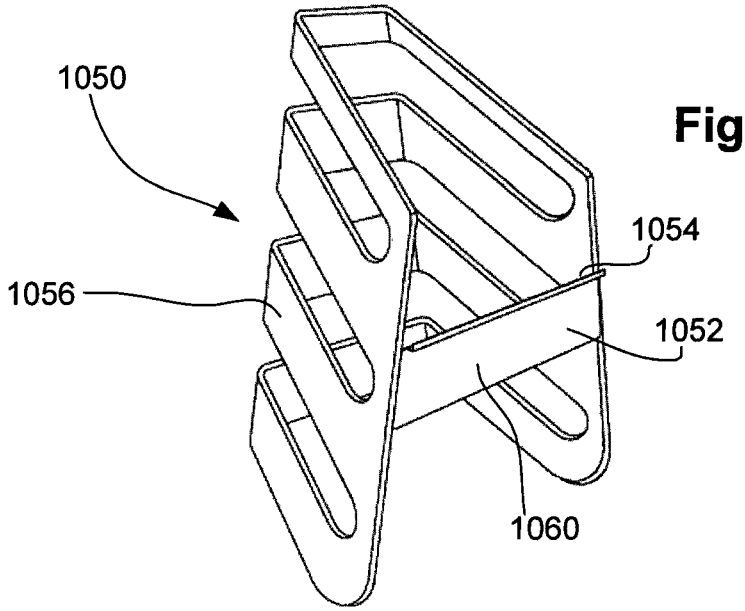
FIG. 75 is a perspective view of the board mount bracket of FIG. 74.
Figure 76:
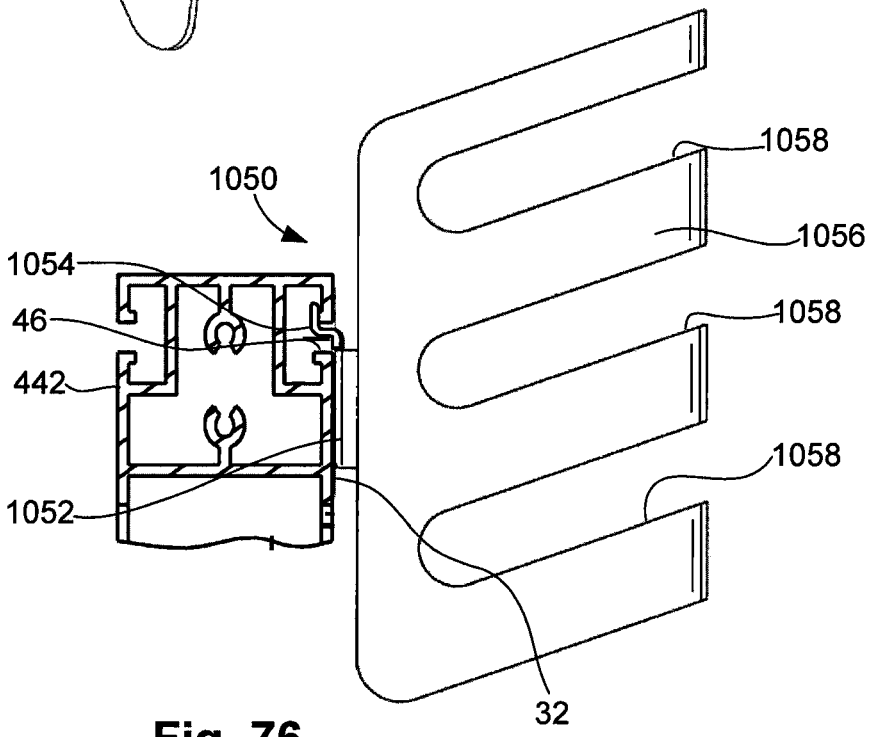
FIG. 76 is a partial cross-sectional view showing the board bracket of FIG. 75 mounted to a rail of an arch assembly.

While two hook-type storage accessories are described above with respect to FIGS. 46 and 47, other hook-type accessories are contemplated including a board (e.g., snow, skate, etc.) assembly, a planter-type assembly and a bike-hanging assembly. In FIG. 74, an exemplary board storage assembly 1050 is shown mounted to the intermediate rail 442 of a high vertical arch assembly 430*a*. Referring also to FIGS. 75 and 76, board storage assembly 1050 includes a body member 1056 and a mounting bracket 1060 that is integrally formed with (e.g., welded to) body member 1056. Body member 1056 forms three board receiving channels collectively identified by numeral 1058 which angle upwardly when assembly 1050 is mounted for receiving boards (see phantom in FIG. 74). Mounting bracket 1060 includes a plate 1052 that forms a rearwardly and upwardly extending lip 1054 along the top edge thereof akin to the lip 362 shown in FIG. 41. As seen in FIG. 76, to mount assembly 1050 to the intermediate rail 442, lip 1054 is inserted into one of the side wall T-slots 46 of rail member 442 with a rear surface of plate member 1052 contacting a side surface 32 of rail 442.

Figure 38:
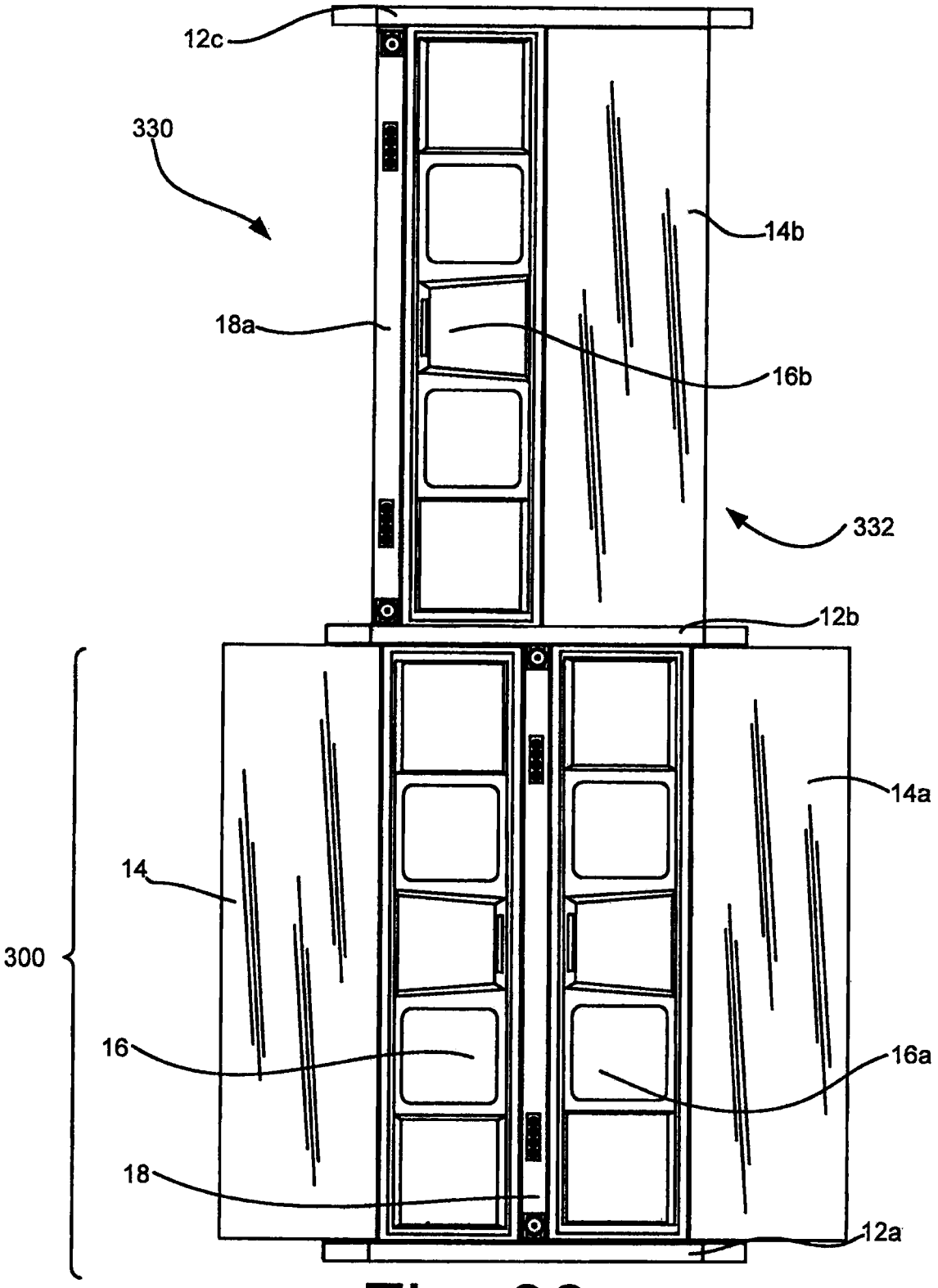
FIG. 38 is a top plan view of yet another workstation assembly.
Figure 77:
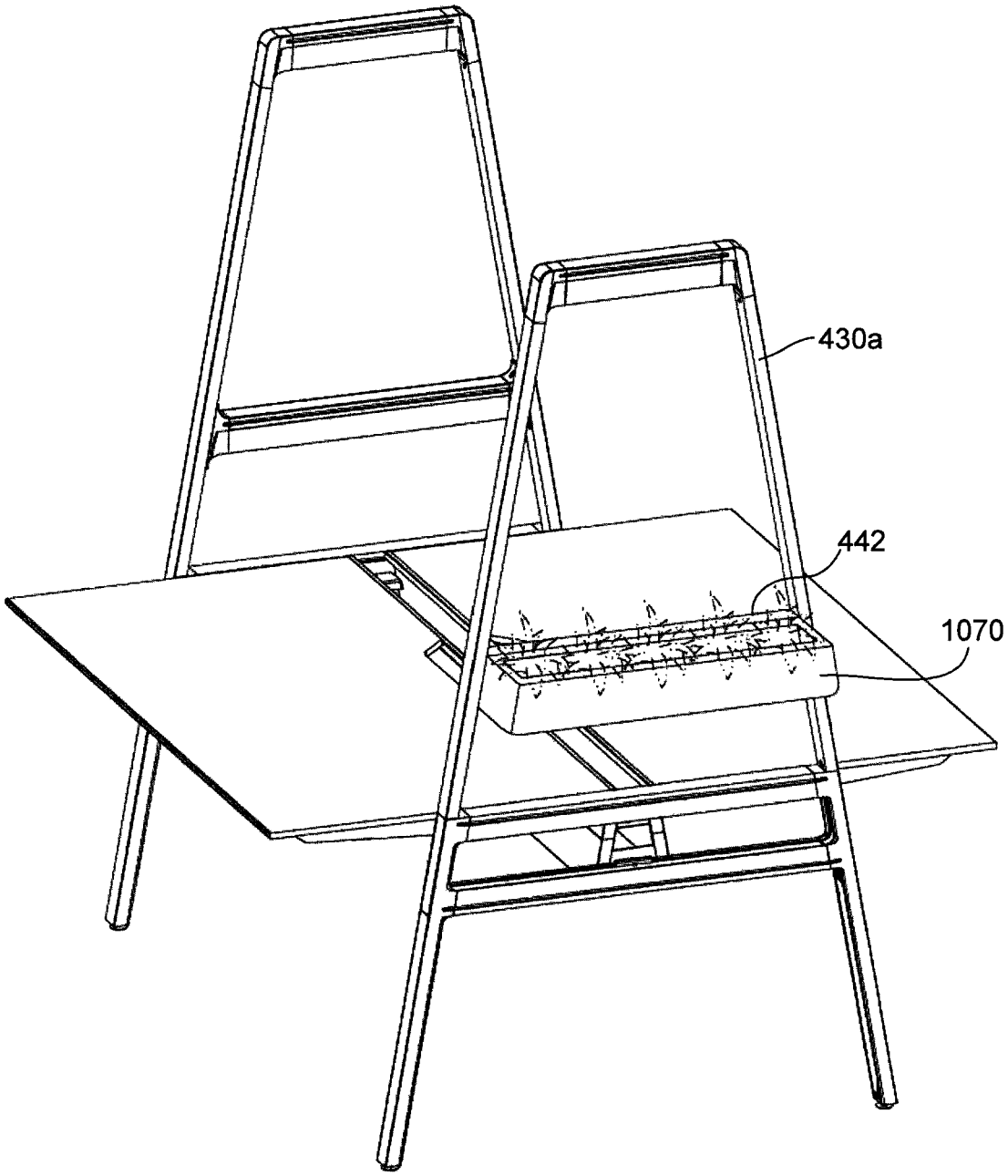
FIG. 77 is a perspective view of a planter assembly mounted to an arch assembly.

Referring now to FIG. 77, an exemplary planter assembly 1070 is shown mounted to the intermediate rail of a high vertical arch assembly 430*a*. Referring also to FIG. 38, assembly 1070 includes first and second mounting brackets 1072*a* and 1072*b*, a housing member 1074 and a planter insert 1076. Each of the brackets 1072*a* and 1072*b* is similarly constructed and therefore, in the interest of simplifying this explanation, only bracket 1072*a* will be described in detail.

Figure 79:
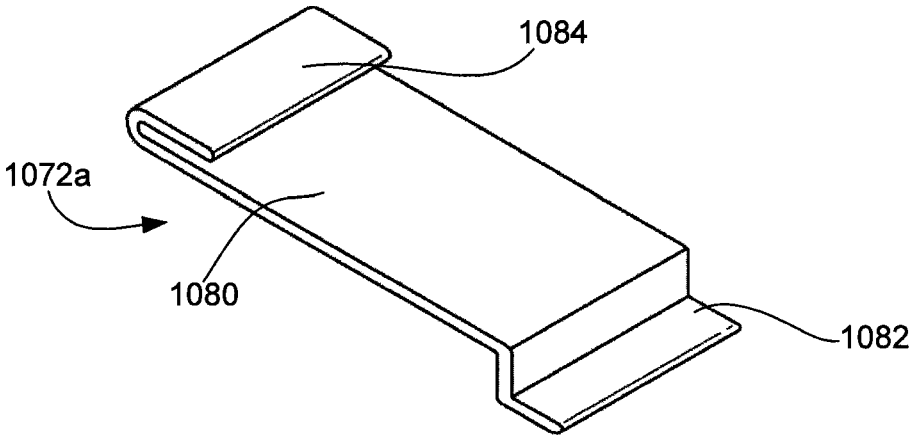
FIG. 79 is a perspective view of one of the mounting brackets of FIG. 78.

Referring to FIG. 79, mounting bracket 1072*a* is a rigid steel member. In at least some embodiments bracket 1072*a* includes a rectilinear plate member 1080 that forms an upwardly and rearwardly extending lip 1082 at a top end as well as an upwardly curling hook 1084 at a bottom end opposite the top end. Lip member 1082 is configured to be receivable within one of the T-slots (e.g., see 46 in FIG. 4 as well as in FIG. 76) formed by the intermediate rail 442.

Figure 80:
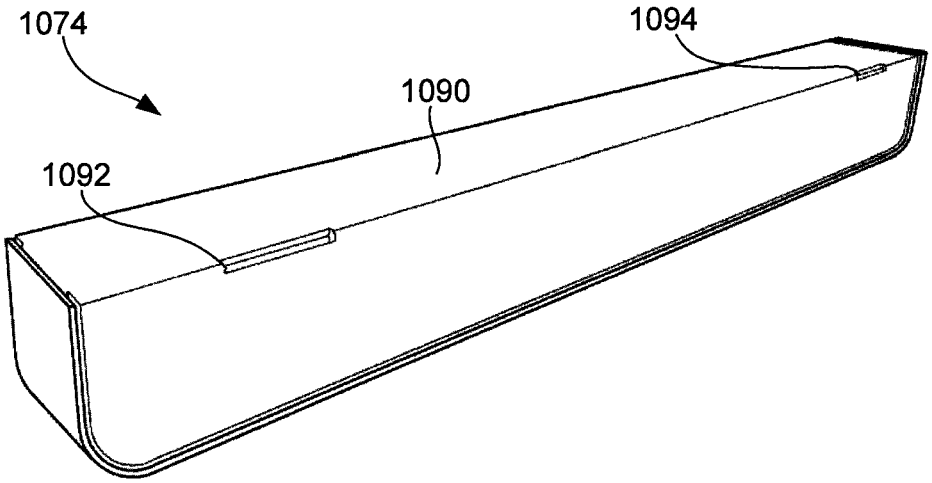
FIG. 80 is a perspective view of the housing member shown in FIG. 78.

Housing member 1074 is formed of rigid bent sheet metal and includes a side wall 1086 that circumscribes an elongated planter space 1088 therein as well as a bottom wall 1090 (see FIG. 80). Bottom wall 90 forms first and second spaced apart slots 1092 and 1094 adjacent a rear wall portion of wall 1086 that are dimensioned to tightly receive hook members 1084 (see again FIG. 79) of mounting brackets 1072*a* and 1072*b*. Planter insert 1076 is a water tight insert that may be formed of plastic or any other type of suitable material. The insert 1076 is dimensioned to be received within the planter space 1088 formed by housing member 1074 and receive support therefrom.

To mount the planter assembly 1070 to the intermediate rail 442, the brackets 1072*a* and 1072*b* are aligned with one of the intermediate rail T-slots (e.g., see 46 in FIG. 76) and are inserted there into so that the rear surfaces of the plates 1080 contact the side surface (e.g., 32 in FIG. 76) of the rail adjacent the T-slot and with the hooks 1084 extending vertically upward. Next, housing member slots 1092 and 1094 are aligned with the mounting bracket hook members 1084 and the housing member 1074 is forced downward so that the hook members 1084 are received within slots 1092 and 1094. Planter insert 1076 is inserted into the space 1088.

Figure 78:
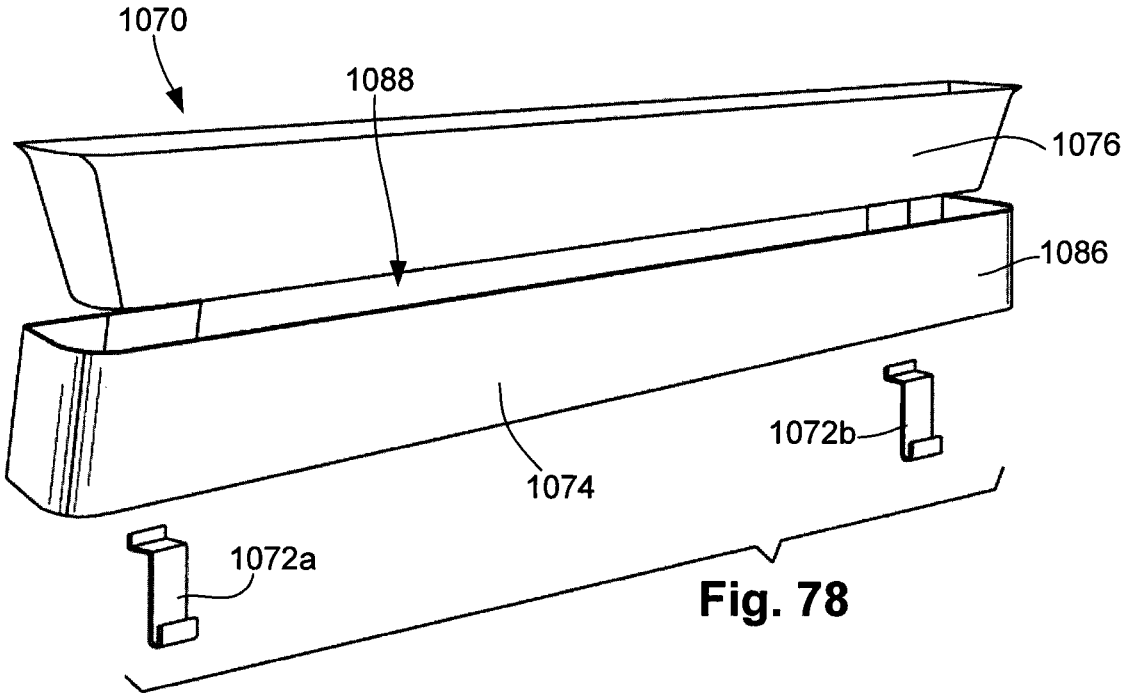
FIG. 78 is an exploded view of the plant assembly shown in FIG. 77.

Referring again to FIGS. 77, 78 and 80, in at least some embodiments slats 1092 and 1094 are spaced and positioned such that brackets 1072*a* and 1072*b* have to be positioned at the opposite ends of the T-slot formed by intermediate rail 442 in order to be received in slots 1092 and 1094. This limitation makes assembly more intuitive and also serves to center the planter assembly with respect to the supporting frame assembly as shown in FIG. 77.

Figure 82:
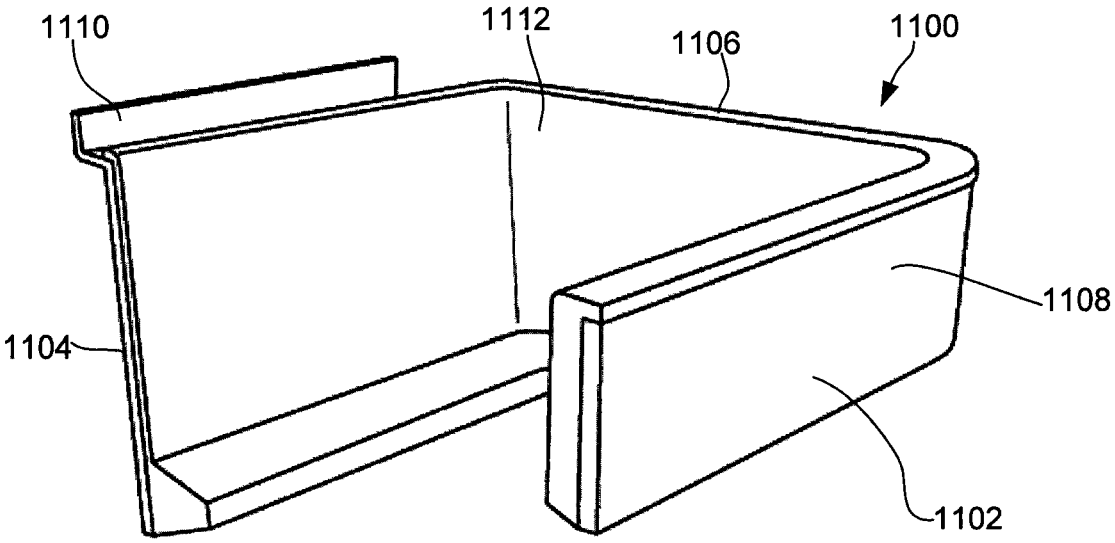
FIG. 82 is a perspective view of the bike mounting bracket shown in FIG. 81.
Figure 81:
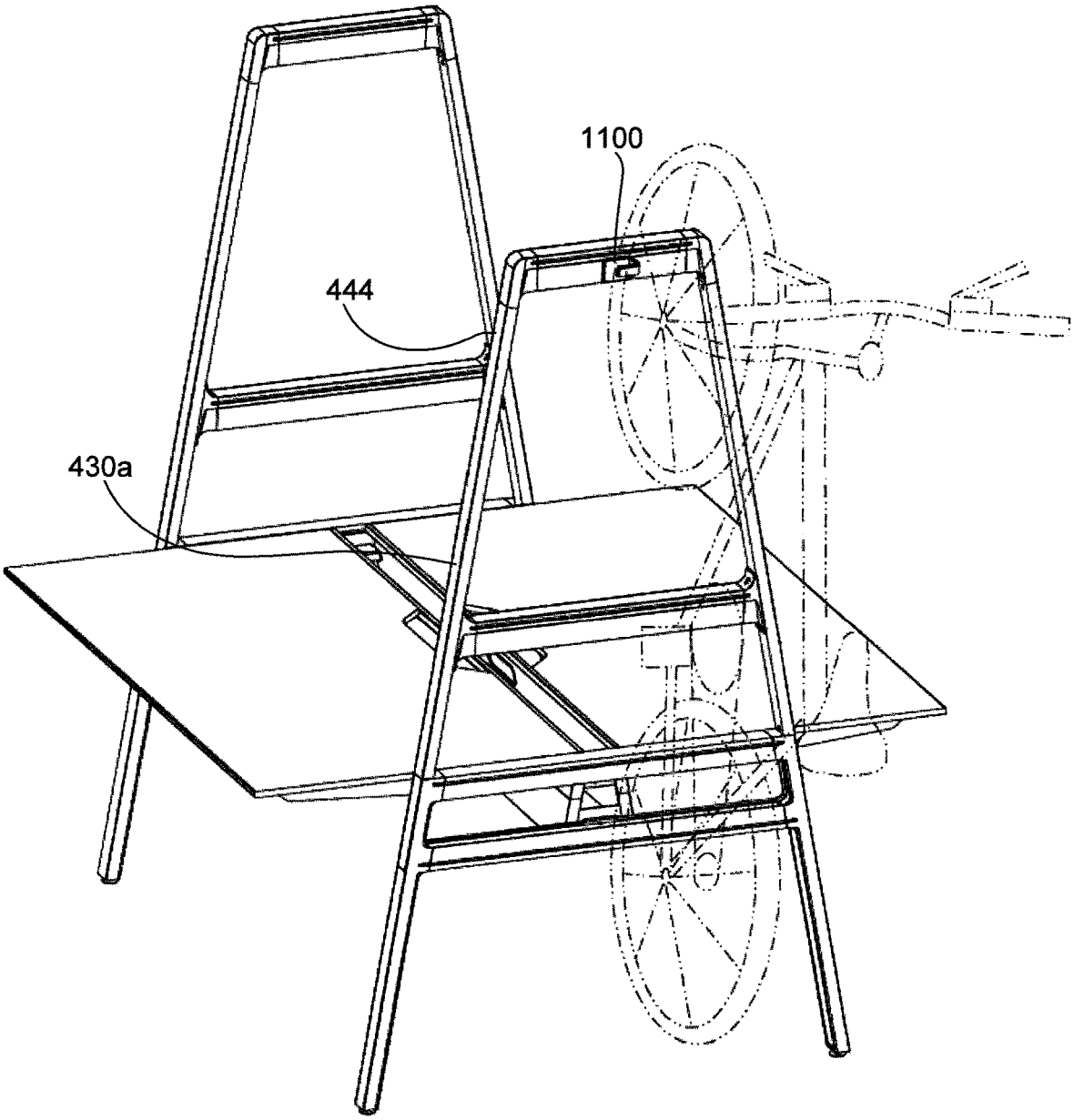
FIG. 81 is a perspective view showing a bike mounting bracket mounted to a top rail of an arch assembly.

Referring now to FIG. 81, an exemplary bike mounting bracket 1100 is shown mounted to a top rail 444 of a high arch assembly 430*a*. Referring also to FIG. 82, the exemplary bike mounting bracket 1100 includes a rigid and integral bracket body member 1102 and a rubber insert 1112. Bracket body member 1102 includes a rigid metal plate member 1104 that forms a rearward and upward extending lip member 1110 along a top edge thereof. A shoulder member 1106 extends from a lateral edge of plate member 1104 and forms an essentially 90-degree angle therewith. An arm member 1108 extends from an edge of shoulder member 1106 opposite plate member 1104 and to the same side of shoulder member 1106 as does plate member 1104 where arm member 1108 is substantially parallel to plate member 1104 so as to form a generally horizontally extending hook (i.e., a hook that faces sideways as opposed to upward). Rubber insert 1112 is shaped generally like an internal surface formed by members 1104, 1106 and 1108 and can be press fit thereto to provide a soft surface for contacting the internal portion of a bike wheel rim as shown in phantom in FIG. 81.

To mount the bike mounting bracket 1100 to top rail 444, lip 1110 is placed with one of the rail T-slots with a rear surface of plate member 1104 contacting an external surface of the rail below the slot as shown in FIG. 81. A bike wheel rim can be placed within the space between plate member 1104 and arm member 1102 with a bike extending down therefrom. As shown in FIG. 81, the rear wheel of the bike may contact a lower assembly rail to hold the bike in a cantilevered fashion to the side of the table/desk assembly.

Figure 83:
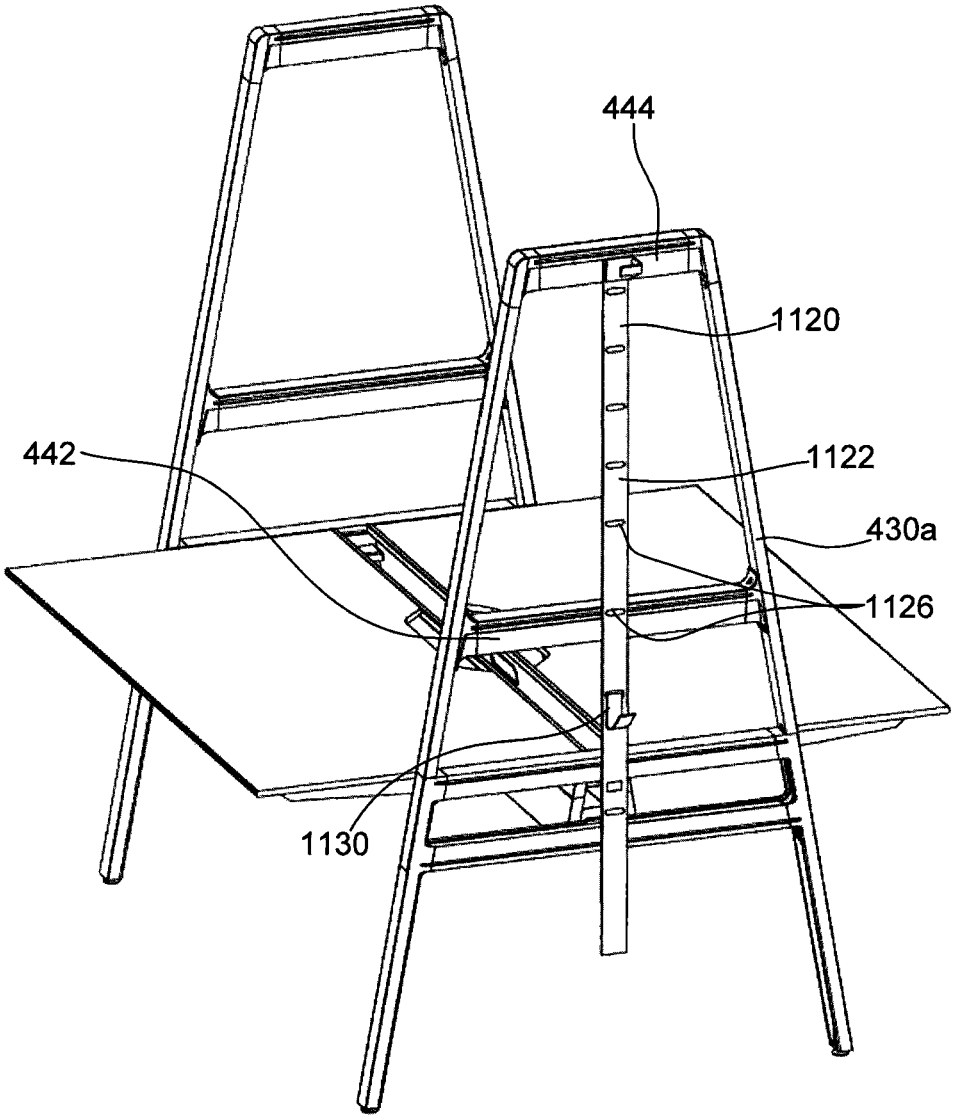
FIG. 83 is a perspective view of a bike track member mounted to an arch assembly.
Figure 84:
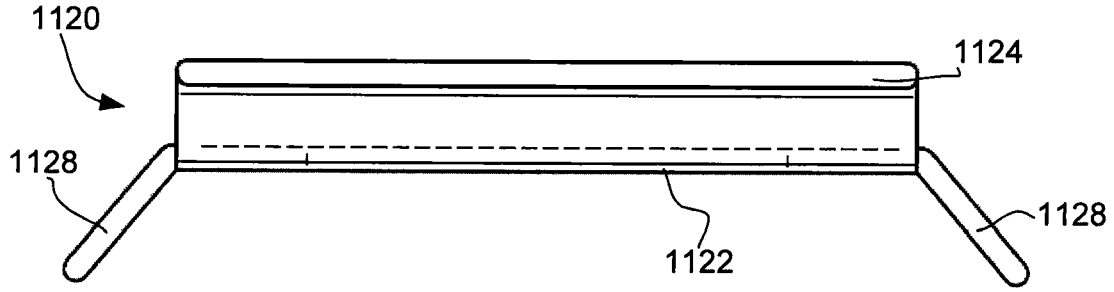
FIG. 84 is a top end view of the bike rack member of FIG. 83.

Referring now to FIG. 83, in at least some embodiments a bike track member 1120 may also be mounted to a high vertical rail assembly 430*a* for providing additional support for a bike. Referring also to FIG. 84, the exemplary track member 1120 includes an elongated rigid metal plate 1122 that should be long enough to accommodate both tires of a bike mounted thereto. In addition, at a top end of the plate 1122, a rearward and upward extending lip 1124 may be provided for interfacing with a top rail T-slot in a fashion similar to that described above with respect to other hook type accessory attachments. As shown in FIG. 84, in at least some embodiments, side flange members 1128 may be provided which extend from lateral edges of plate member 1122 along the entire length thereof to help maintain bike tires aligned with plate member 1122 when a bike is mounted using the bike track member 1120.

Figure 85:
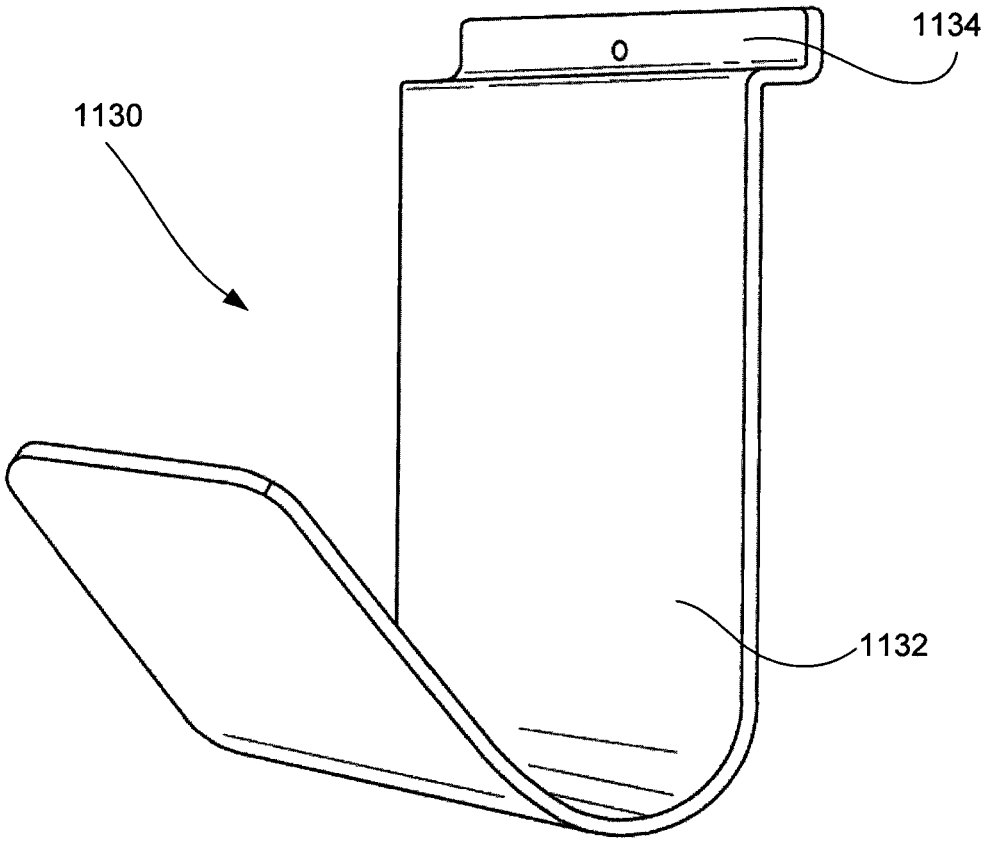
FIG. 85 is a perspective view of a hook that is shown in FIG. 83.

Referring once again to FIG. 83, in at least some embodiments, the bike track member 1120 can be made more versatile by providing a series of mounting slots 1126 spaced apart along the length of member 1122. Additional mounting hooks 1130 may be provided that can mount to any one of the slots 1126 for hanging a helmet, a book bag, etc. An exemplary additional hook-type bracket 1130 is shown in FIG. 85. Bracket 1130 includes a hook forming member 1132 and a rearwardly and upwardly extending lip member 1134. Lip member 1134 is dimensioned to be received within any one of the slots 1126. In addition, in at least some embodiments, referring to FIGS. 82 and 85, lip member 1134 may have dimensions similar to lip member 1110 such that hook member 1130 can be mounted to either one of the slots 1126 formed by member 1120 or directly into one of the rail T-slots of the upper rail 444 or the intermediate rail 442 or either of the other two rails formed there below. Where bike member 1120 is used, the bike mounting bracket 1100 may mounted to any one of the slots 1126 also.

Figure 86:
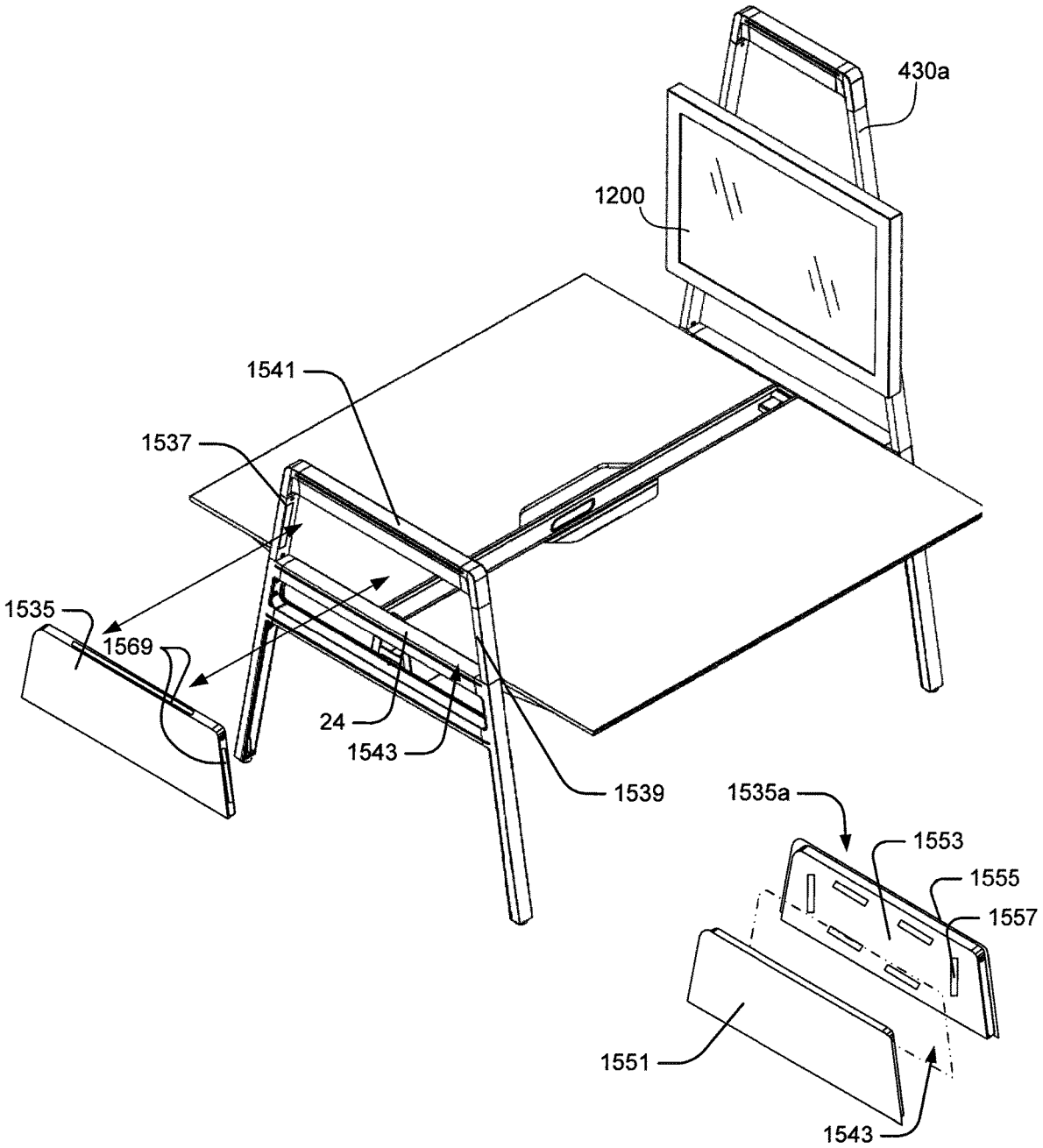
FIG. 86 is a schematic view showing a monitor mounted to an arch assembly according to at least another aspect of the present invention.

In at least some embodiments, it is contemplated that a configuration user may want to mount one or more flat panel display monitors to one of the arch assemblies. To this end, an exemplary monitor 1200 is shown in FIG. 86 mounted to the intermediate rail of a high arch assembly 430*a*. Referring also to FIGS. 87 through 90, an exemplary monitor mounting assembly includes a rail mounting bracket 1202, a monitor mounting bracket 1204 and a plurality of mounting screws collectively identified by numeral 1206. Rail mounting bracket 1202 is an integral component formed of rigid bent sheet metal and includes a substantially square flat mounting plate 1208, a lower mounting flange 1212 and first and second lateral flanges 1218*a* and 1218*b*. Mounting plate 1208 is a rigid flat substantially square member having a top edge 1220, a bottom edge 1222 and first and second lateral edges 1224*a* and 1224*b*, respectively. An opening (not labeled) is formed near lower edge 1222 where the material from the opening is bent rearward to form a rearward and upwardly extending lip member 1210 (see specifically FIGS. 88 and 89). Here, the lip member 1210 is designed in a fashion similar to that described with regard to lip 362 shown in FIG. 41 so that the lip member 1210 can be received within one of the rail slots (e.g., see 46 in FIG. 88).

Figure 88:
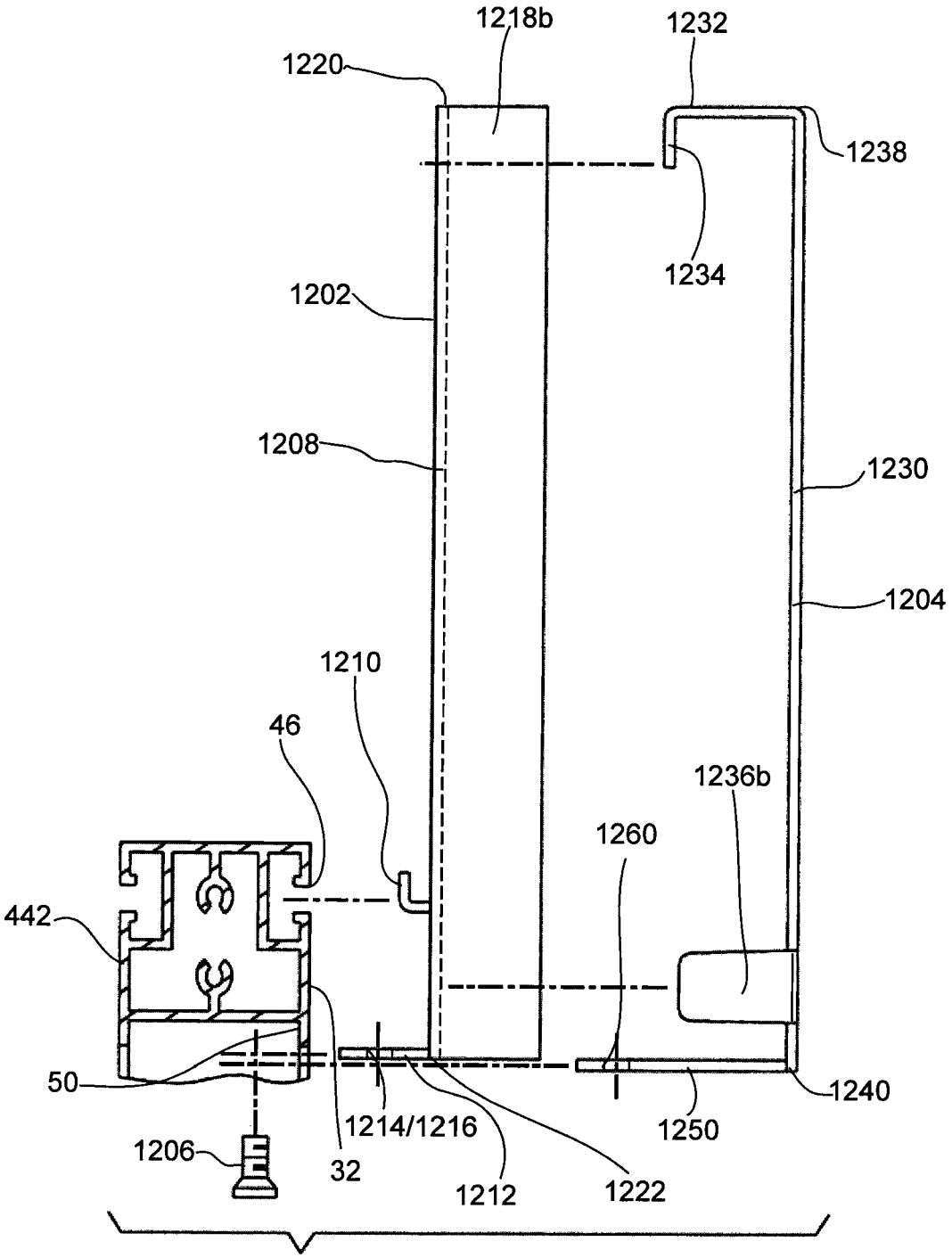
FIG. 88 is a partial cross-sectional view showing the bracket components of FIG. 87 in an exploded fashion.

Referring again to FIGS. 88 and 89, at lower edge 1222, mounting flange 1212 extends rearward in the same direction as lip member 1210. As shown in FIG. 88, the spacing between lip member 1210 and flange 1212 is such that, when lip member 1210 is received within one of the T-slots 46, flange 1212 is located just below one of the downwardly extending rail fingers 50. Flange 1212 is dimensioned such that it extends past the thickness of the finger member 50. Flange 1212 forms three holes including two threaded holes labeled 1214 and a central unthreaded hole 1216.

Figure 87:
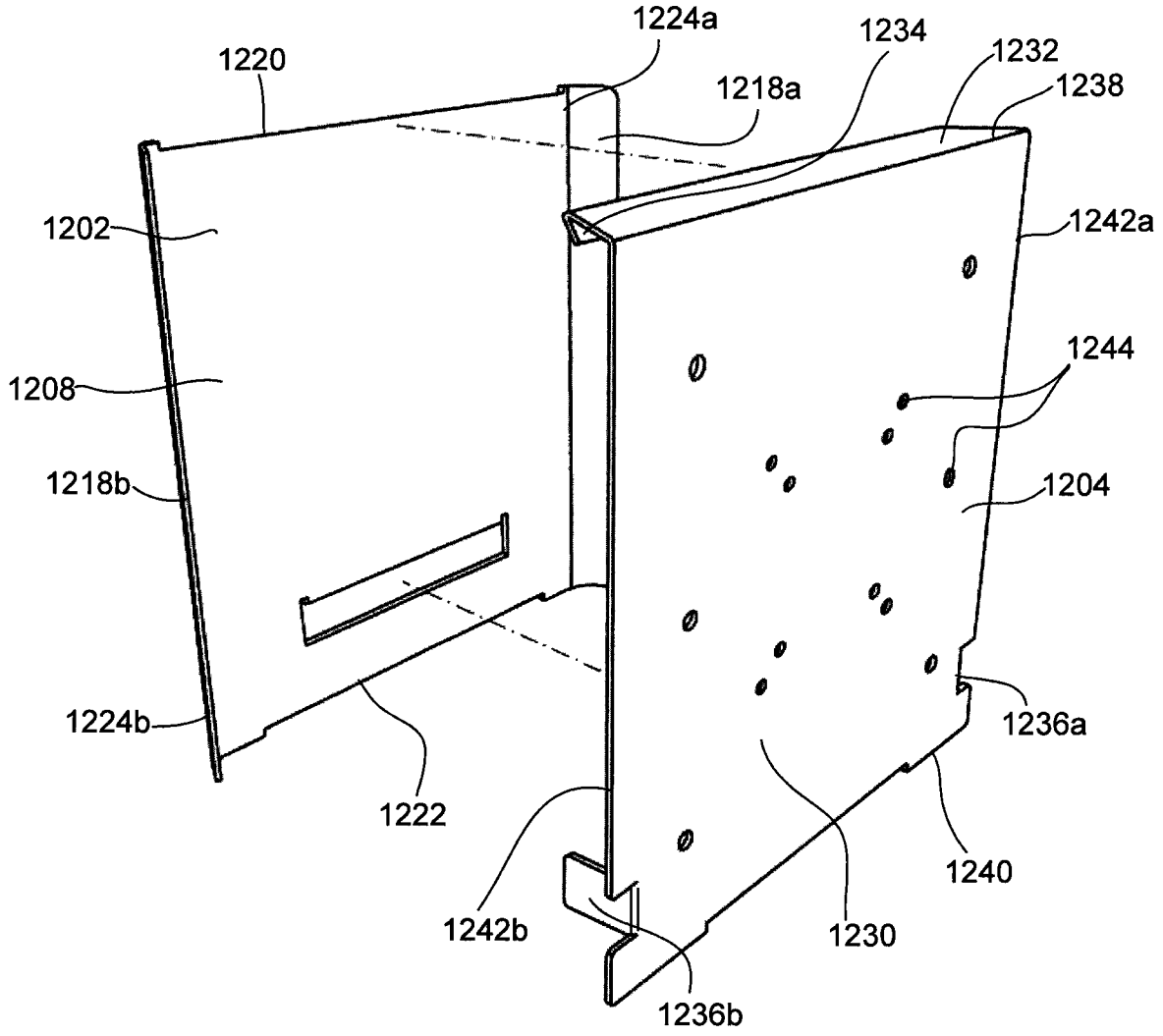
FIG. 87 is a perspective view of a bracket assembly used to mount the monitor as illustrated in FIG. 86.
Figure 89:
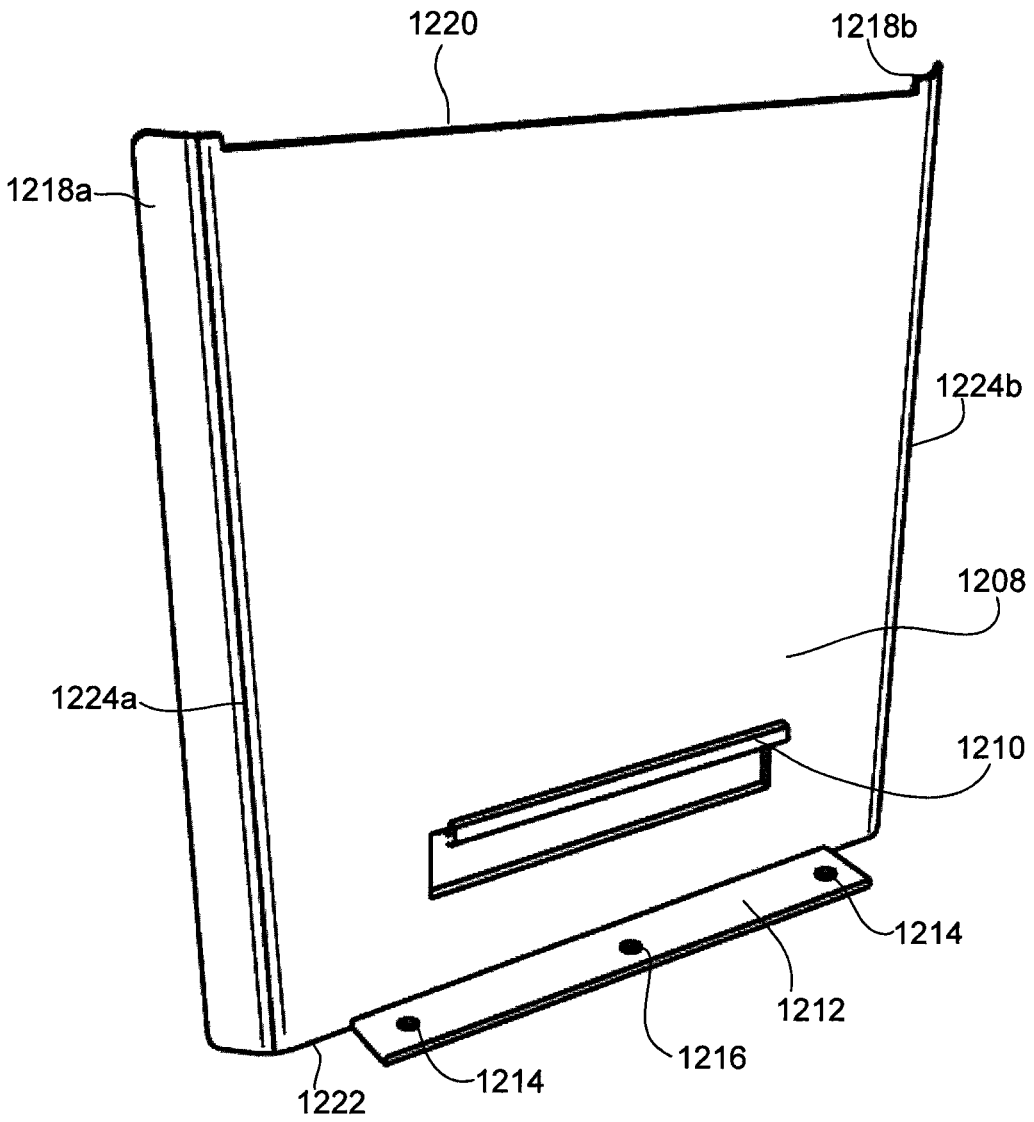
FIG. 89 is a perspective view of the rail mounting bracket show in FIG. 87.

Referring to FIGS. 87 through 89, lateral flanges 1218*a* and 1218*b* extend forward from the lateral edges 1224*a* and 1224*b* at approximately 45-degree angles outwardly. In at least some embodiments lateral flanges 1218*a* and 1218*b* extend between one-half and two inches depending on designer preference.

Referring still to FIGS. 87 and 88, monitor mounting bracket 1204 is an integral bracket formed of bent sheet metal and includes a plate 1230, a mounting shoulder 1232, a mounting lip 1234, alignment tabs 1236*a* and 1236*b* (see also FIG. 90) and a lower mounting flange 1250. Plate 1230 is flat and substantially square having a top edge 1238, a bottom edge 1240, and first and second lateral edges 1242*a* and 1242*b*. Plate 1230 forms mounting holes 1244 in standard monitor mounting patterns that are used, along with mounting screws (not illustrated), to mount plate 1232 the rear surface of a monitor as well known in the art.

Figure 90:
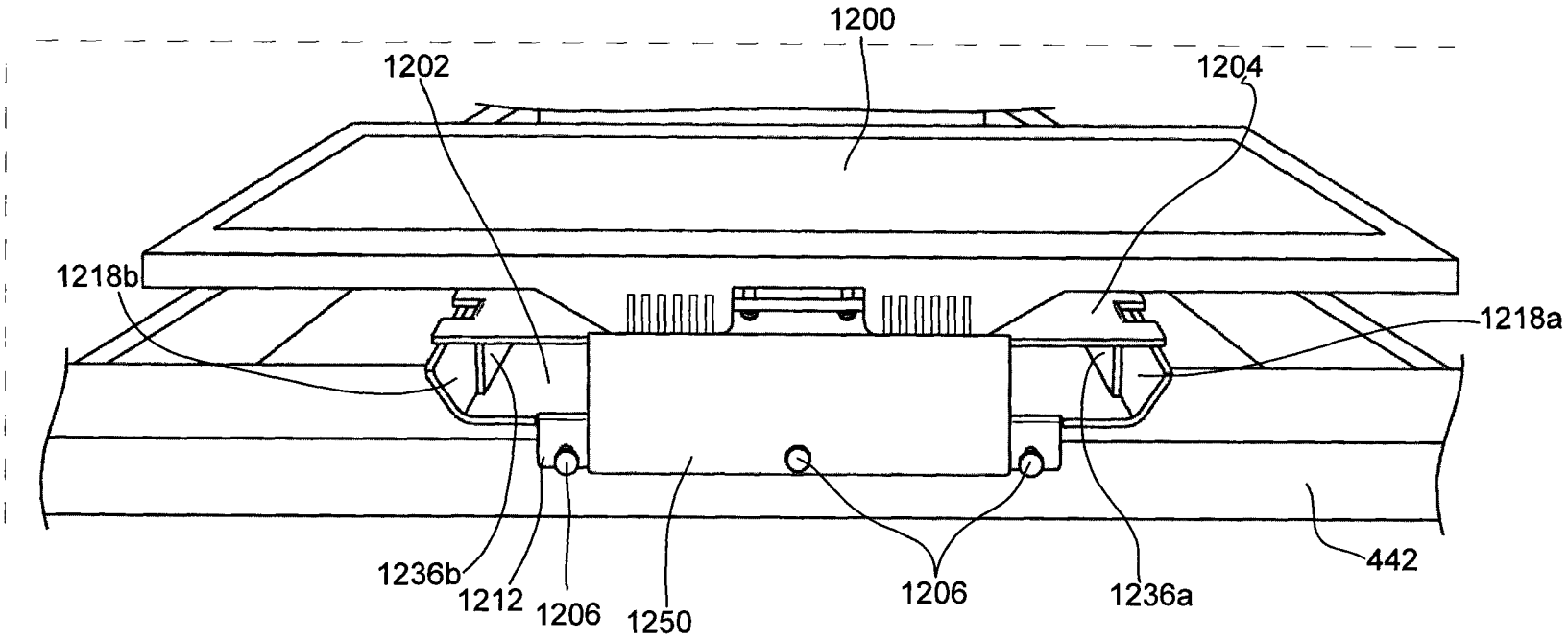
FIG. 90 is a lower perspective view of the monitor and arch assembly shown in FIG. 86.

Referring still to FIGS. 87 and 88, shoulder member 1232 extends rearward from top edge 1238 at an essentially right angle and mounting lip 1234 extends from an distal end of shoulder member 1232 downward and is substantially parallel with the rear surface with plate member 1230. Mounting lip 1234 has a length that is similar to the length of top edge 1220 of rail mounting bracket 1202. Alignment tabs 1236*a* and 1236*b* extend rearward from edges 1242*a* and 1242*b*. The tabs 1236*a* and 1236*b* are spaced apart such that they will contact a front surface of plate member 1202 immediately adjacent to lateral flanges 1218*a* and 1281*b* as best shown in FIG. 90 after installation. Thus, tabs 1236*a* and 1236*b* cooperate with the front facing surfaces of flanges 1218*a* and 1218*b* to laterally align the brackets during installation.

Referring again to FIG. 88, lower mounting flange 1250 extends rearward along lower edge 1240 of plate member 1230. Monitor mounting bracket 1204 has a height dimension such that when shoulder member 1232 is received on the top edge 1220 of plate member 1202, lower flange 1250 can pass closely by lower flange 1212 of rail mounting bracket 1202. Lower flange 1250 forms a single threaded opening 1260 which aligns with opening 1216 (see again FIG. 89) formed by flange 1212 after installation.

To use the brackets 1202 and 1204 to mount a monitor to the intermediate rail 442 (see again FIG. 88), screws are used to mount monitor mounting bracket 1204 to the rear surface of a monitor as known in the art. Next, rail mounting bracket 1202 is mounted to an intermediate rail 442 by moving lip member 1210 into the T-slot 46 and manipulating the bracket 1202 until lower mounting flange 1212 is positioned to extend below the rail 442. Next, two screws 1206 are threaded through the threaded openings 1214 in flange 1212 (see again FIG. 89) until the distal ends of the screws abut an undersurface of the rail 442 thereby locking bracket 1202 to rail 442.

Continuing, with the monitor mounting bracket 1204 secured to the rear surface of a monitor, the monitor and mounting bracket subassembly is lifted in to a position such that the mounting lip 1234 is received on the rear side of member 1202 with shoulder member 1232 resting on the top edge 1220 of member 1202. The subsassembly is rotated such that mounting flange 1250 passes below mounting flange 1212 and therefore below rail 442 with tabs 1236*a* and 1236*b* contacting the front surface of member 1202 adjacent flanges 1218*a* and 1218*b*, respectively. Again, the sloped front surface of flanges 1281*a* and 1218*b* help guide distal ends of tabs 1236*a* and 1236*b* into positions such that bracket 1204 becomes optimally aligned with bracket 1202.

At this point, threaded opening 1260 should be aligned with the central opening 1216 formed by flange 1212 and a single screw is threaded through opening 1260 and passes through opening 1216 and a distal end thereof contacts the undersurface of rail member 442 to lock the monitor mounting bracket 1204 to the rail mounting bracket 1202. The monitor is securely attached, as shown in FIG. 90, via the three screws 1206, to the intermediate rail 442.

While the monitor 1200 is described above as mounted to an intermediate rail of an arch, it should be appreciated that all of the rails that form the leg assemblies 12*a*, 12*b* and arches have the same cross-section in at least some embodiments and therefore the mounting assembly may be used to mount a monitor to any of the frame rails. In addition, two mounting bracket assemblies could be used to mount two separate monitors to opposite sided of the same rail member via the oppositely opening T-slots.

In addition, while flange 1212 in FIG. 89 is shown forming three openings 1214, 1214 and 1216, in some embodiments flange 1212 may only form the single central opening 1216 and locking may be accomplished via a single bolt passing through aligned openings 1260 and 1216 in a fashion similar to that described above. In still other embodiments it is contemplated that flange 1212 may be altogether eliminated and one or more bolts passing through flange 1250 (see again FIG. 88) may be used to secure both brackets 1204 and 1002 to a rail.

Figure 91:
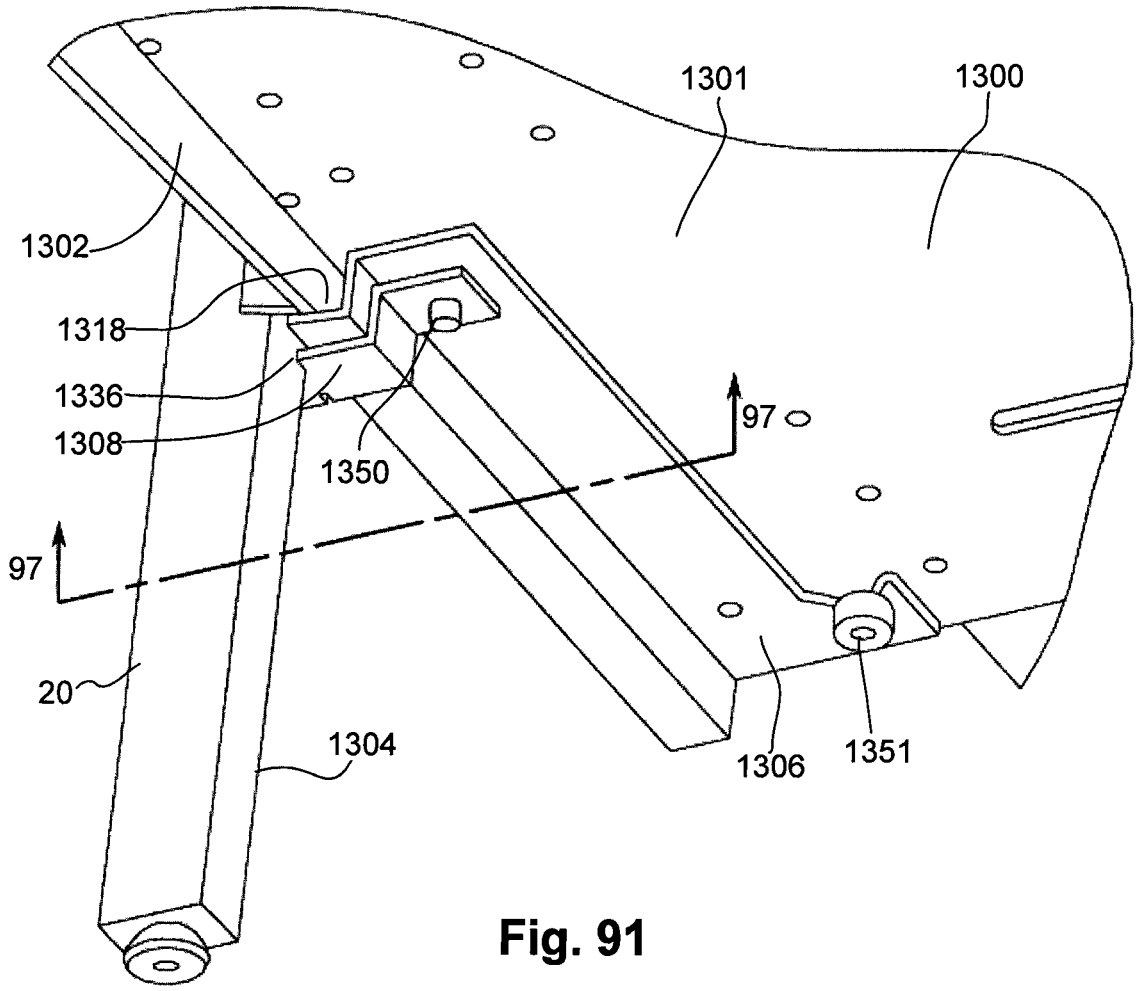
FIG. 91 is a lower perspective view of a lounge subassembly and a support leg to which the lounge subassembly is attached.
Figure 92:
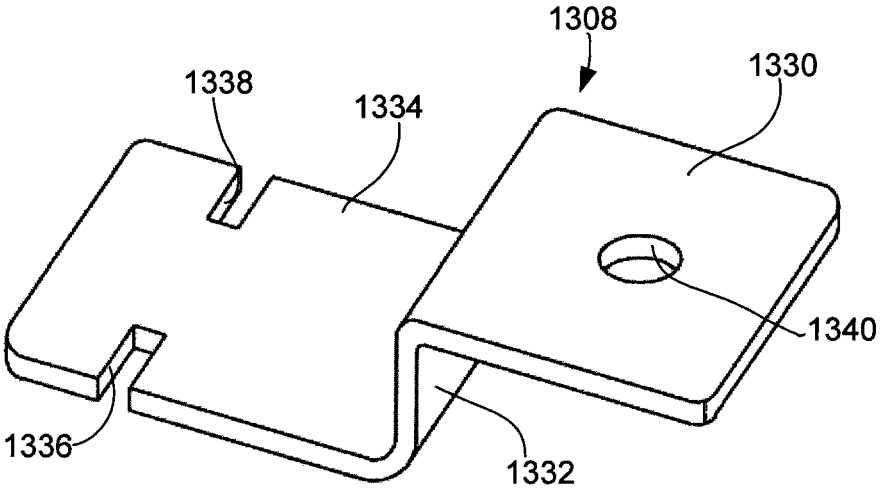
FIG. 92 is a perspective view of the stabilizing bracket shown in FIG. 91.
Figure 93:
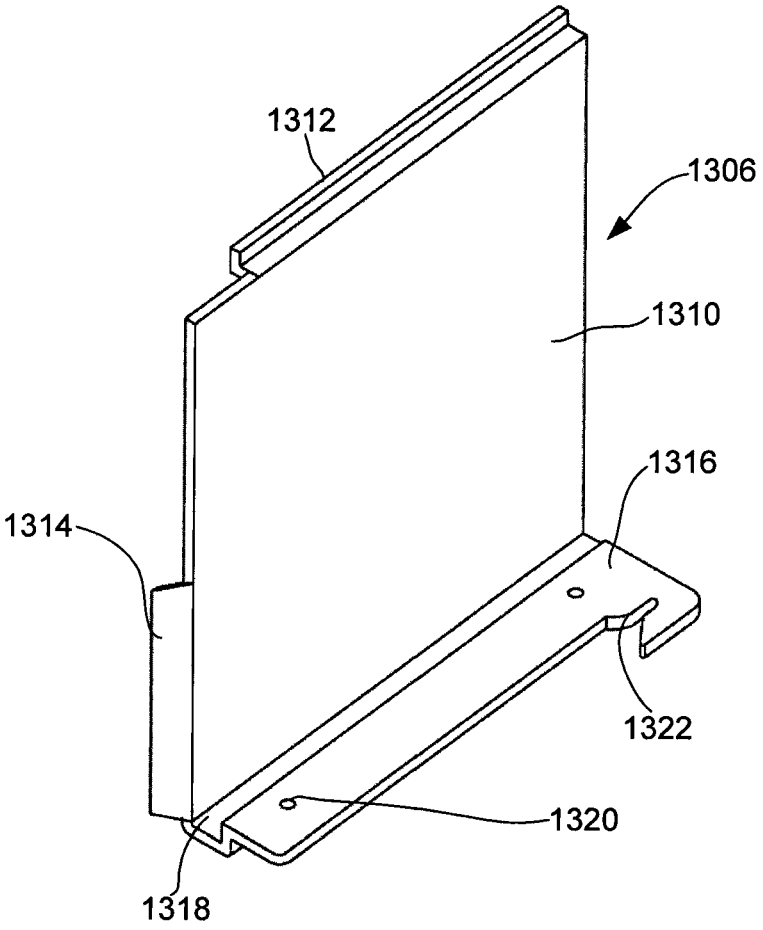
FIG. 93 is a perspective view of the lounge bracket partially shown in FIG. 91.

Referring once again to FIGS. 40 through 42, while one type of lounge mounting assembly has been described above, other mounting assemblies are contemplated that, in at least come cases, may result in a more stable configuration. To this end, one exemplary other mounting subassembly is shown in FIGS. 91 through 93. Referring specifically to FIG. 91, the undersurface 1301 of a lounge subassembly 1300 is shown mounted to a leg 20 of one of the leg assemblies 12*a*. In this embodiment, the lounge subassembly 1300 forms a rigid downwardly extending lip member 1302 along each of its lateral ends (only one lip member 1302 shown). The lip member 1302 is used, in conjunction with the rackets shown in FIGS. 92 and 93, to secure the lounge subassembly 1300 in a relatively stable fashion. To this end, referring also to FIGS. 94 and 97, each of the leg members 20 that forms a part of a leg assembly 12*a* forms inwardly extending leg lips 1304.

Referring again to FIGS. 91 through 93, the mounting subassembly components include a lounge bracket 1306 and a stabilizing bracket 1308. Lounge bracket 1306 is an integrally formed member including components bent out of rigid sheet metal. The bracket 1306 includes a substantially square rectilinear flat plate member 1310, the front flange member 1314 and a lower flange member 1316. A mounting lip member 1312 is formed along a portion of the top edge of plate member 1310 and is configured in a fashion similar to that described above with respect to FIG. 41 so that the lip member 1312 can be received within one of the rail T-slots. Front flange 1314 extends to the same side as lip member 1312 but from a front edge of plate member 1310 and serves the same function as flange 366 described above with respect to FIG. 41 and therefore will not be described again here in detail.

Referring still to FIGS. 91 and 93, the lower flange 1316 extends from a lower edge of plate member 1310 to a side opposite the side on which front flange 1314 extends. Lower flange 1316 is bent to form an upwardly opening channel 1318 dimensioned to receive the downwardly extending lounge lip member 1302 (see also FIG. 91) upon assembly. Lower flange 1316 also forms a forwardly opening edge notch 1322 at a rear end thereof as well as an opening 1320 for passing a locking bolt 1322 (see again FIG. 91).

Referring to FIGS. 91 and 92, stabilizing bracket 138 is an integral component formed of bent sheet metal or the like and includes a shoulder member 1330, an arm member 1332 and a finger member 1334. Shoulder member 1330 is a flat plate-like member that forms an opening 1340 for passing locking bolt 1350 (see FIG. 91). Arm member 1332 extends at a right angle from one edge of shoulder member 1330 and finger member 1334 extends from an edge of arm member 1332 opposite shoulder member 1330 in a direction opposite the direction in which member 1330 extends and is substantially parallel to member 1330. Along one side edge, finger member 1334 forms a first slot 1336 and along a second side edge that is opposite the first edge, finger member 1334 forms a second slot 1338. The slots 1336 and 1338 are dimensioned to be slightly larger than the thickness of one of the leg lips 1304 (see again FIG. 97) so as to be able to receive one of the leg lips 1304 therein upon assembly.

Figure 97:
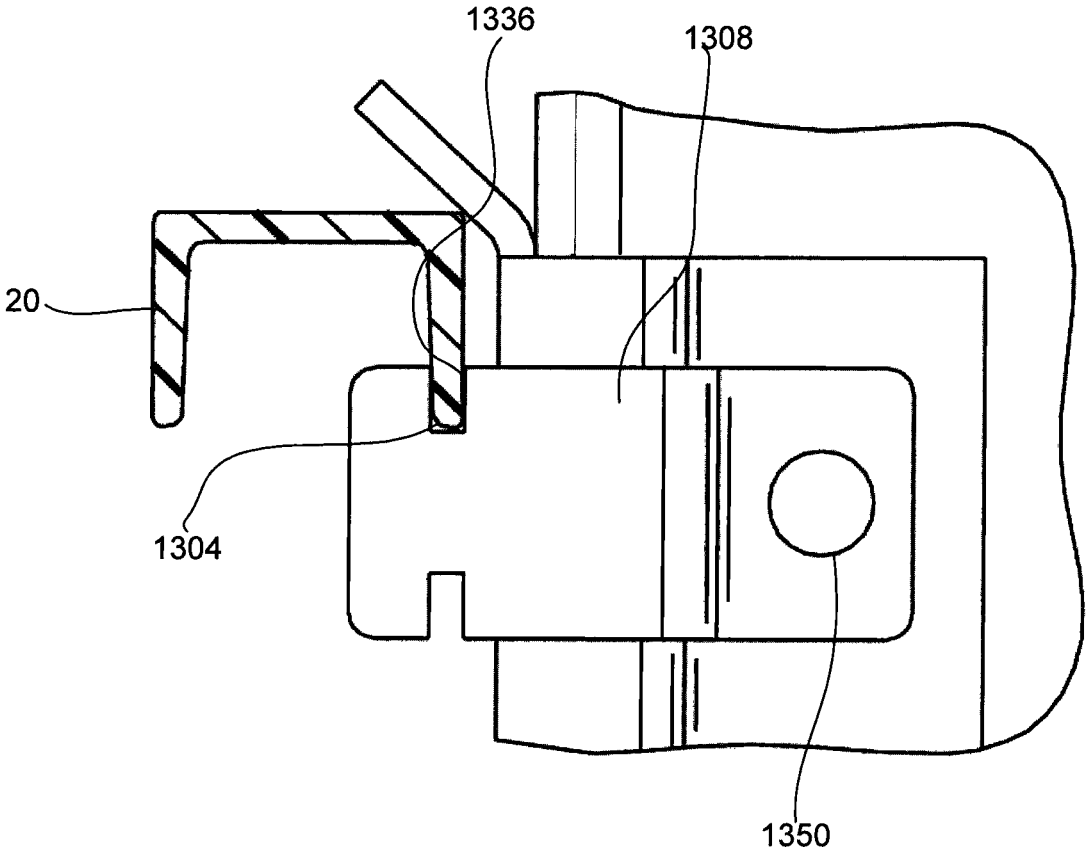
FIG. 97 is a partial cross sectional view taken along the lines 88-88 in FIG. 85.

To use the subassembly shown in FIGS. 91 through 93 to mount a lounge assembly 1300 between two leg assemblies 12*a* and 12*b*, lounge brackets 1306 are mounted to leg assemblies in the manner described above with respect to the bracket shown in FIG. 41. Next, the lounge assembly 1300 is positioned between the leg assemblies 12*a* and 12*b* above the lower flanges 1316 of the two brackets and is lowered until the lounge lip members 1302 (see again FIG. 91) are received within channels 1318. Referring to FIGS. 91 and 97, a separate stabilizing bracket 1308 is mounted to an undersurface of each of the lounge brackets 1306 via a locking bolt 1350 with an adjacent leg lip 1304 received within one of the slots 1336 or 1338 and the bolt 1350 is tightened thereby securely mounting the lounge bracket 1306 and lounge subassembly 1300 to the leg member 12*a*. Next, a thumb screw 1351 (see again FIG. 91) is placed through the edge notch 1322 and received in a threaded opening in undersurface 1301 of lounge subassembly 1300. Screw 1351 is tightened to further secure the components together.

Figure 94:
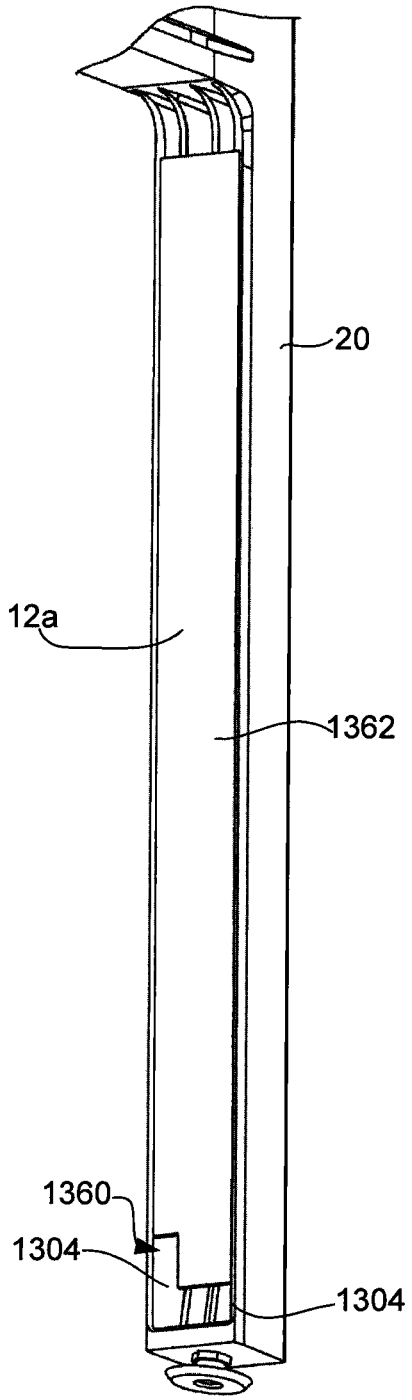
FIG. 94 is a perspective view of a wire management cover installed within a frame leg that is consistent with at least some aspects of the present invention.
Figure 95:
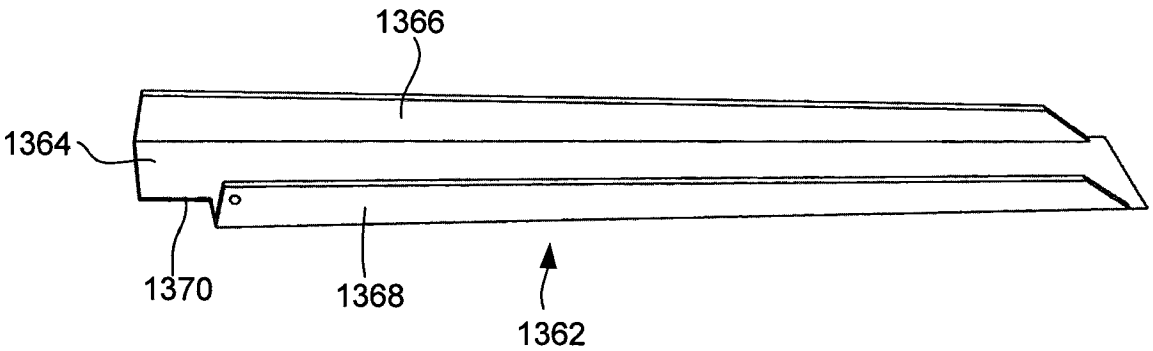
FIG. 95 is a perspective view of the cover member shown in FIG. 94.

Another accessory that may be provided for use with some of the above described configurations includes a cover member that can be used in conjunction with one of the leg members 20 to provide at least some additional wire management capability. To this end, referring now to FIGS. 94 and 95, an exemplary wire management leg cover member 1362 includes an integrally formed rigid bent sheet metal member including a substantially rectilinear fascia member 1364 and first and second flanges 1366 and 1368 that extend at essentially right angles to the same side of fascia member 1364 and that are parallel to each other. The flanges 1366 and 1368 are somewhat flexible and are resilient and their oppositely facing surfaces form a dimension that is substantially equal to a dimension between the facing surfaces of the leg lip members 1304 (see FIG. 94). Thus, cover member 1362 can be installed within a substantially vertical channel 1360 formed by leg member 20 by flexing members 1366 and 1368 slightly inward and placing the cover member 1362 within the leg channel as shown in FIG. 94. In the illustrated embodiment, the fascia member 1364 and flange member 1368 form a cutout notch 1370 to ensure that regardless of the position of cover member 1362 within the channel 1360, there will be at least some opening for passing wires or cables from the bottom end of leg member 20 upward within the channel. As shown, cover member 1362 cooperates with leg member 20 to enclose space or channel 1360 for passing wires along the length of the leg member 20 in a concealed fashion.

Figure 96:
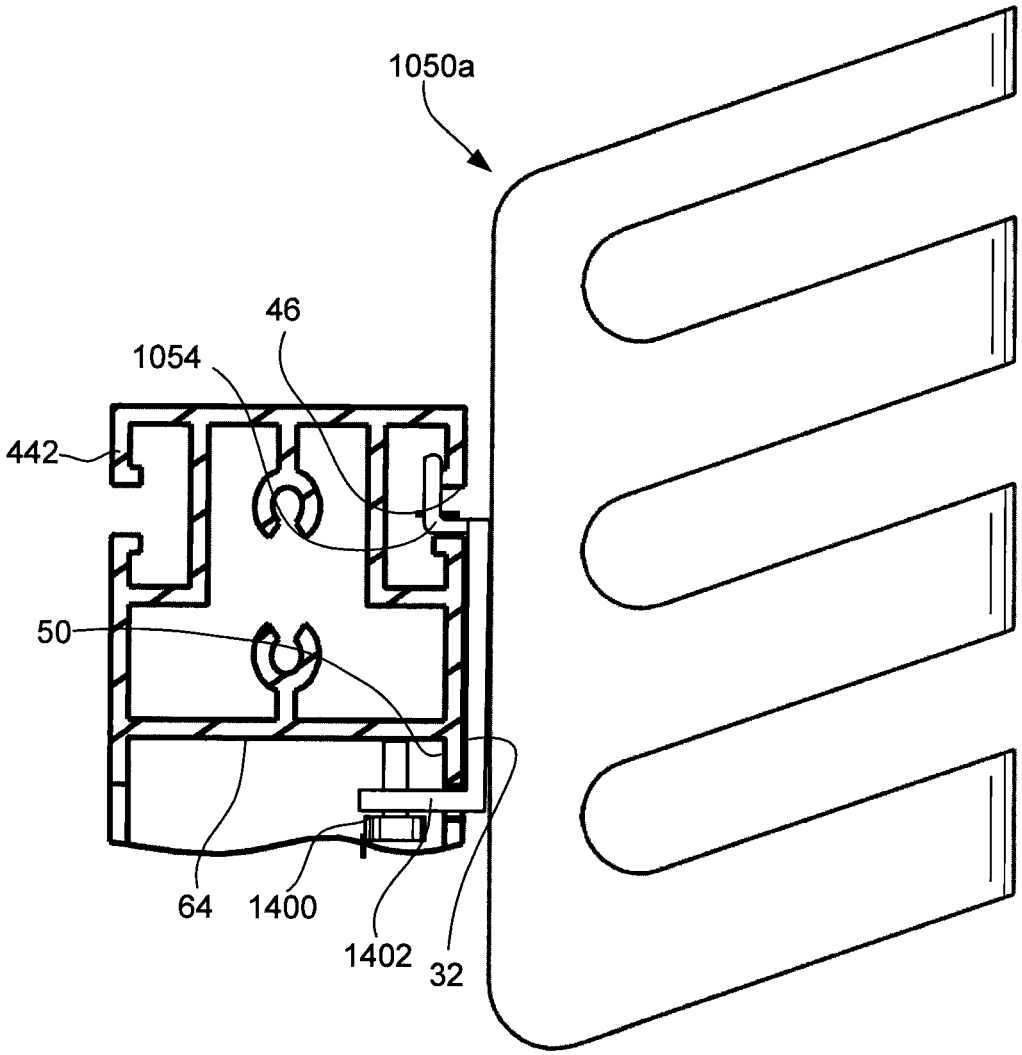
FIG. 96 is a partial cross sectional view similar to FIG. 76, albeit showing a board bracket that includes a return flange that is locked via a thumb screw to a frame rail.

While some of the rail mounting brackets have been described above as simply coupling to a rail via a lip received in a rail T-slot (e.g., 46) without more, embodiments are contemplated that include additional engaging components which result in more secure locking functionality in the case of each of the brackets. For example, referring again to FIGS. 88 through 90, in at least some embodiments return flanges akin to the monitor mounting bracket flanges 1212, 1250 may be provided along a lower edge of any one of the board bracket 1052 (see FIG. 76), planter brackets 1072*a* (see FIGS. 78 and 79), bike bracket 1100 (see FIG. 82) or rail 1122 (see FIG. 83) where the return flange forms a threaded opening for receiving a locking thumb screw or bolt member. To this end, see the exemplary board bracket 1050*a* shown in FIG. 96 which is similar to the board bracket 1050 described above with respect to FIGS. 75 and 76 except that a return flange 1402 is provided.

Figure 98:
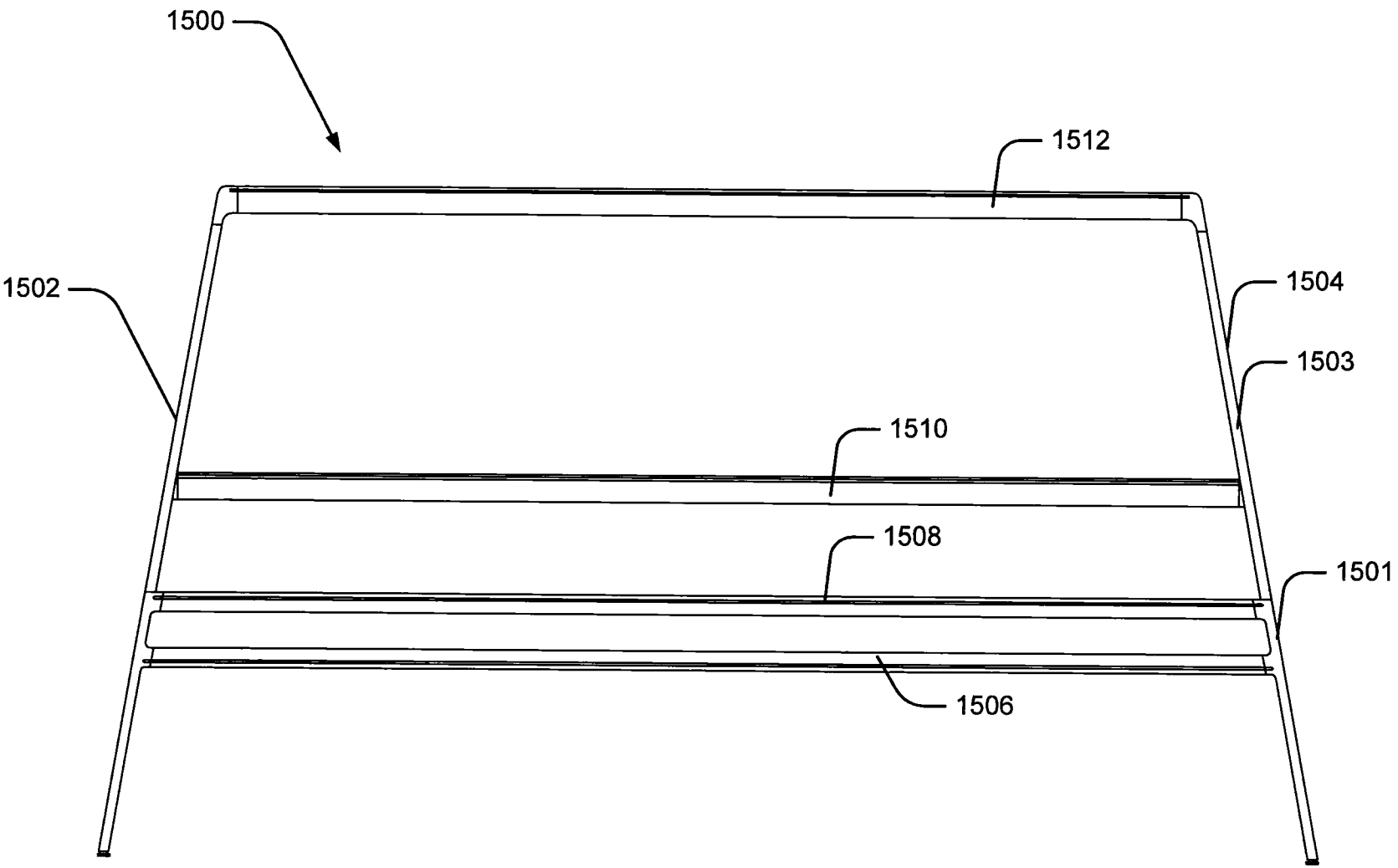
FIG. 98 is a side plan view of an exemplary long arch assembly that is consistent with at least some aspects of the present invention.

Referring now to FIG. 98, an exemplary long arch subassembly 1500 is illustrated which will be referred to hereinafter as "long arch" 1500. As the label implies, long arch 1500 includes a vertical arch assembly 1503 mounted to and extending upwardly from a leg assembly 1501 where leg assembly 1501 has a construction similar to leg assembly 12 described above and arch assembly 1503 has a construction similar to the construction of arch assembly 430*a* (see FIGS. 49 and 50) described above. The primary difference between leg assembly 1501 and leg assembly 12 is that leg assembly 1501 includes horizontal rails 1506 and 1508 that extend between substantially vertical leg members (not labeled) that are substantially longer than the horizontal rails included in assembly 12. Similarly, the primary difference between arch assembly 1503 and arch assembly 430*a* is the lengths of the horizontal rails where rails 1510 and 1512 are substantially longer than rails 442 and 444 (see again FIG. 49). In at least some embodiments the lengths of rails of assembly 1500 are between three and four times the lengths of similarly situated rails on assemblies 12 and 430*a*. Arch assembly 1503 mounts to leg assembly 1501 in a fashion similar to that described above with respect to assemblies 430*a* and 12 in FIG. 50.

Figure 99:
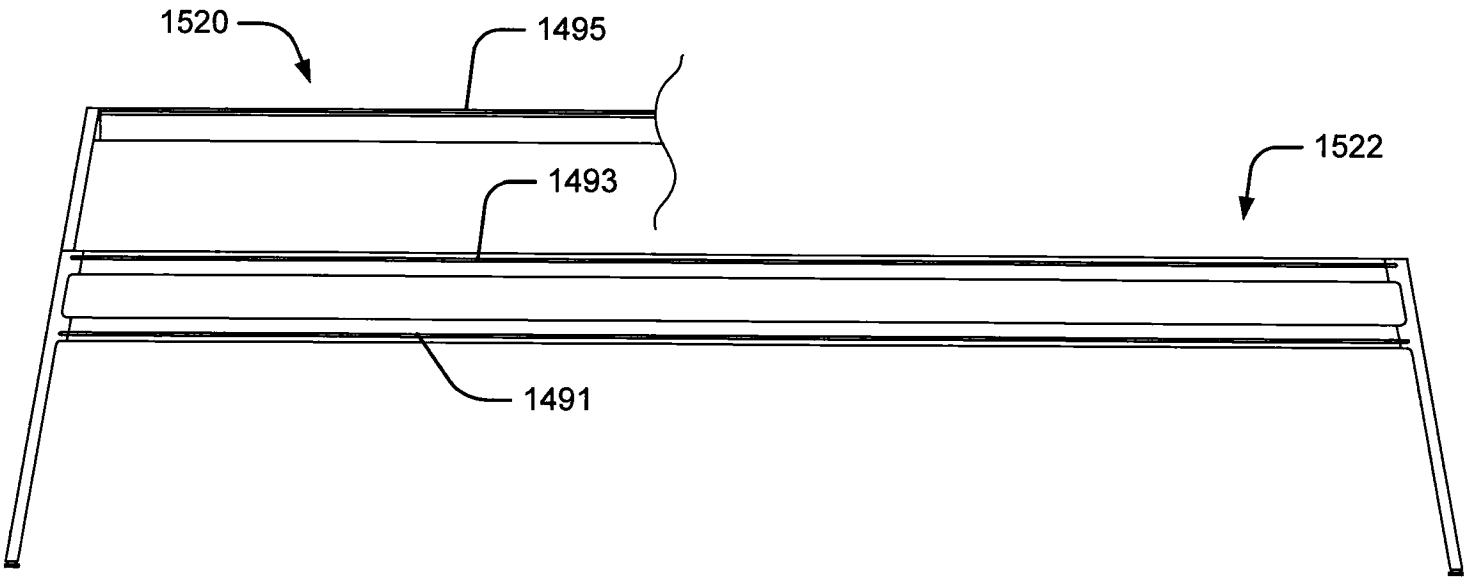
FIG. 99 is a side plan view showing partial views of each of a long support structure and a long leg that are consistent with at least some aspects of the present invention.

Referring to FIG. 99, an exemplary mid-height long support structure 1520 and an exemplary long leg 1522 are illustrated. The long support structure 1520 includes horizontal rails 1491,1492 and 1495 that have lengths similar to the lengths of rails 1506, 1508 and 1510 in FIG. 98 but has a height dimension that stops at a mid-level just above rail 1511 and therefore does not form a high arch as in FIG. 98. Long leg 1522 includes horizontal rails 1491 and 1493 that have lengths identical to the lengths of rails 1506 and 1508 but does not include other structure mounted to and extending upward above rail 1493.

Figure 100:
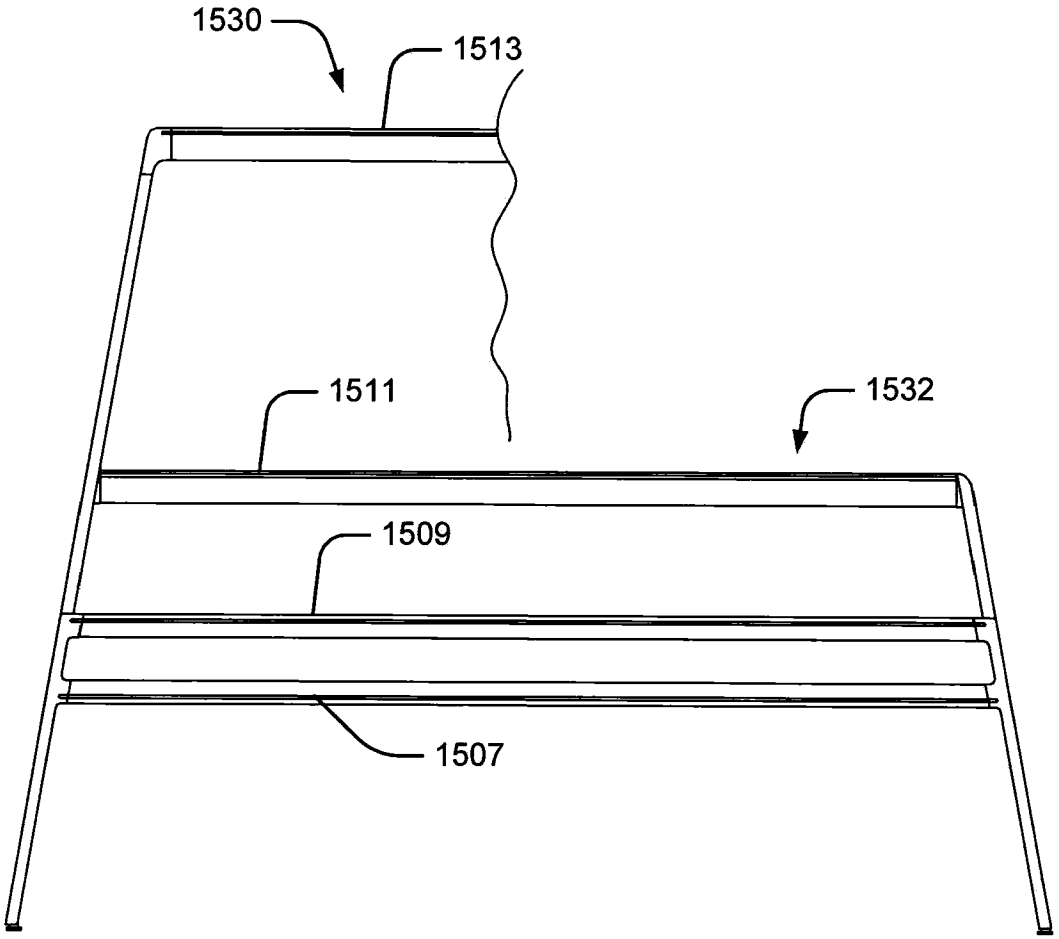
FIG. 100 is a side plan view showing partial views of an intermediate length arch assembly and an intermediate length support structure that are consistent with at least some aspects of the present invention.

Referring to FIG. 100, an exemplary mid length arch 1530 and mid-length support structure 1532 are illustrated. Mid-length arch 1530 has a height similar to the height of assembly 1500 but includes rails 1507, 1509, 1511 and 1513 that have intermediate lengths that are generally longer than the lengths of the rails that form assemblies 12 and 430*a* but shorter than the lengths of the rails that form assemblies 1501 and 1503. For instance, the lengths of rails 1507, 1509, 1511 and 1513 may be mid-way between the lengths of the similar rails that form assemblies 12 and 430*a* and assemblies 1501 and 1503. Mid-length support structure 1532 includes rails 1507, 1509 and 1511 but does not include the structure extending above rail 1511 in FIG. 100. Although not illustrated, a mid-length leg assembly is also contemplated that would only include rails 1507 and 1509 in FIG. 100 and would have a length dimension similar to assembly 1532 shown in FIG. 100.

Figure 114:
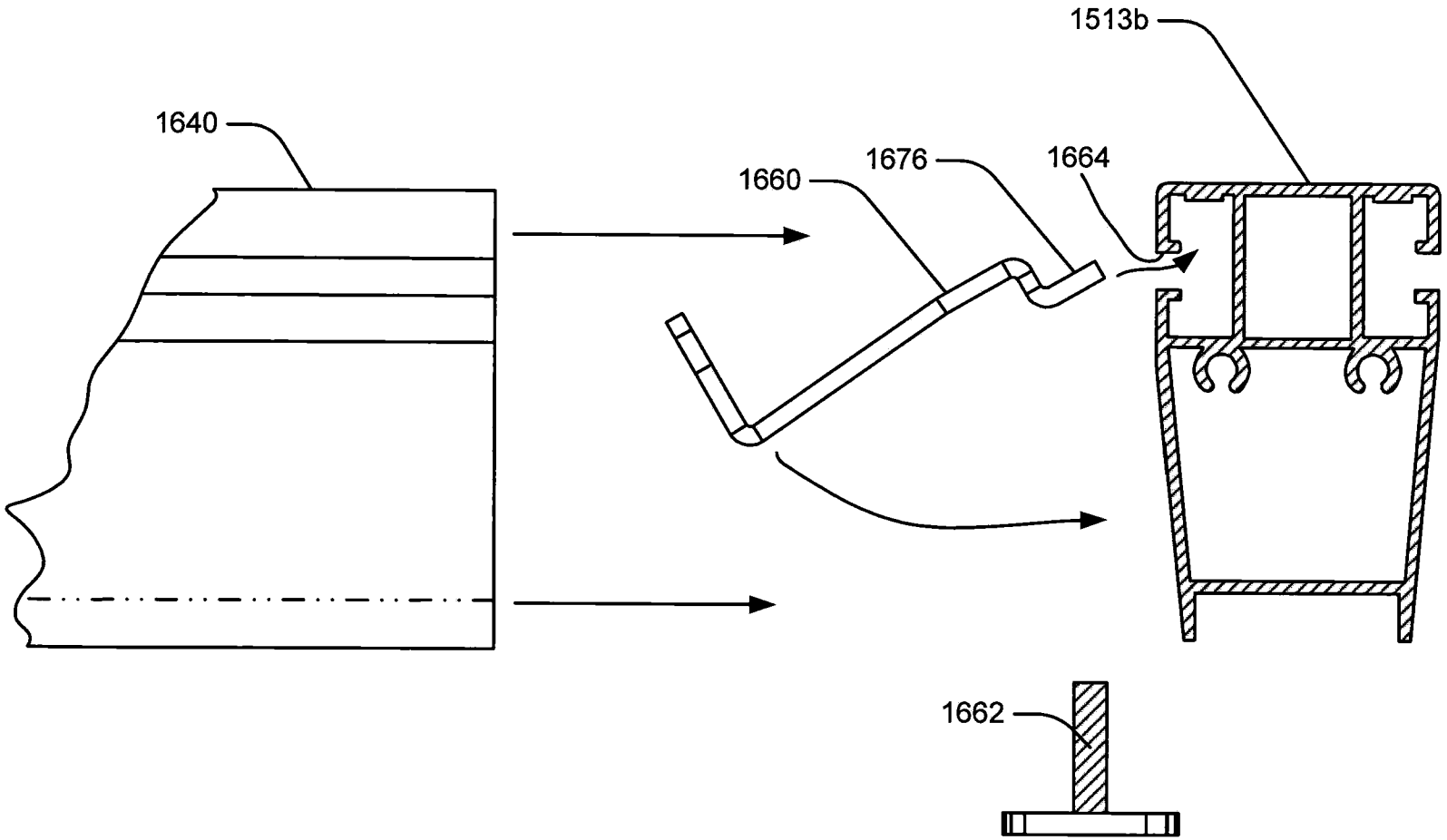
FIG. 114 is a partial cross-sectional view taken along the line 114-114 in FIG. 112, albeit showing the components in an exploded orientation.
Figure 115:
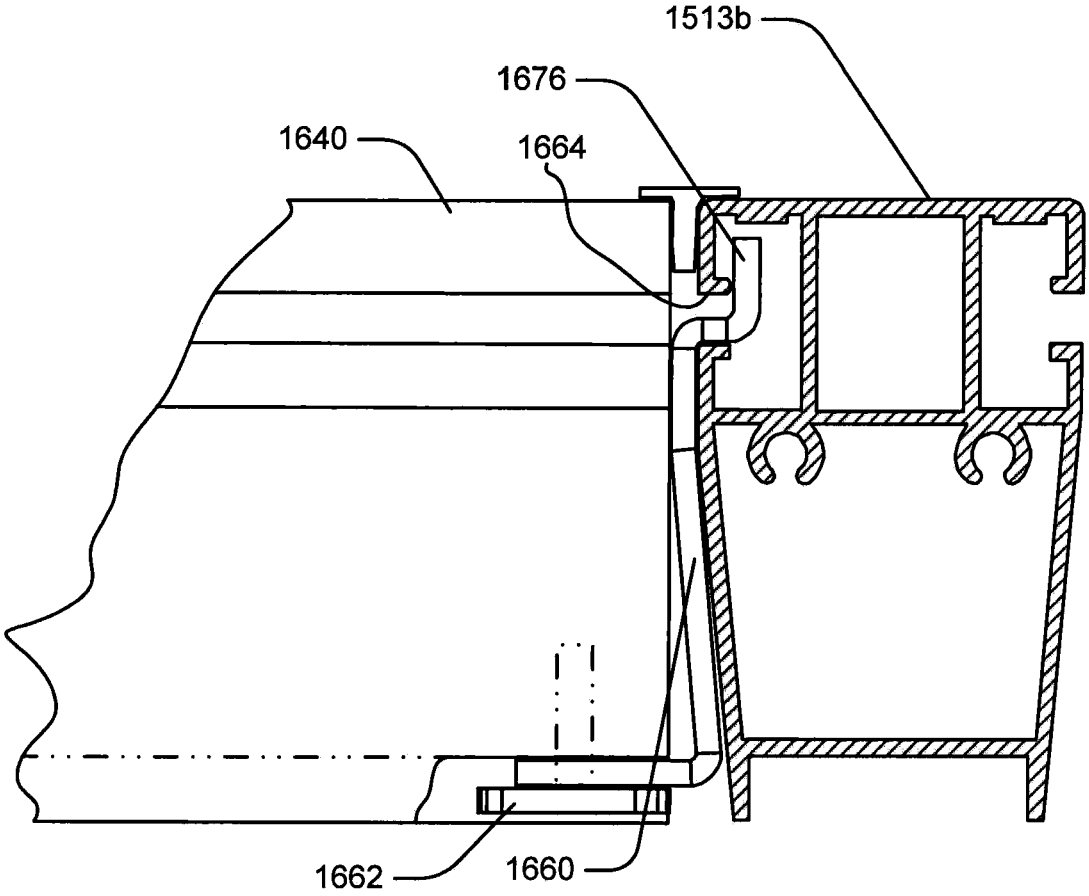
FIG. 115 is similar to FIG. 114, albeit showing the components secured together.

Referring again to FIGS. 98-100, all of the rails 1506, 1058, 1010, 1512, 1491, 1493, 1495, 1507, 1509, 1511 and 1513 have similar cross-sections and each may be similar to the cross-sections of the rails described above that form part of the leg assembly 12. Another exemplary rail cross-section is shown at 1513*b* in FIG. 114 where the rail has a shape similar to the rails described above but where the side walls of the rail taper slightly inward from top to bottom below the rail portions that form side wall slots 1664.

One or more of the long arches 1500, the long support structures 1520, the long legs 1522, the mid-length arches 1530, the mid-length support structures 1532 and the mid-length legs (not illustrated) can be cobbled together with other assembly components as described above and hereafter to configure many additional workspace configurations. For example, referring to FIGS. 101 and 103, an exemplary configuration 1538 that defines four workstations is illustrated that is configured using one long arch 1500, four short arches 1540*a*, 1540*b*, 1540*c* and 1540*d* and first through fourth table/wire management channel assemblies 1542*a*, 1542*b*, 1542*c* and 1542*d*, respectively, where each of the table/channel assemblies includes a table top subassembly 382 and channel member 18 as shown in FIG. 43.

Figure 103:
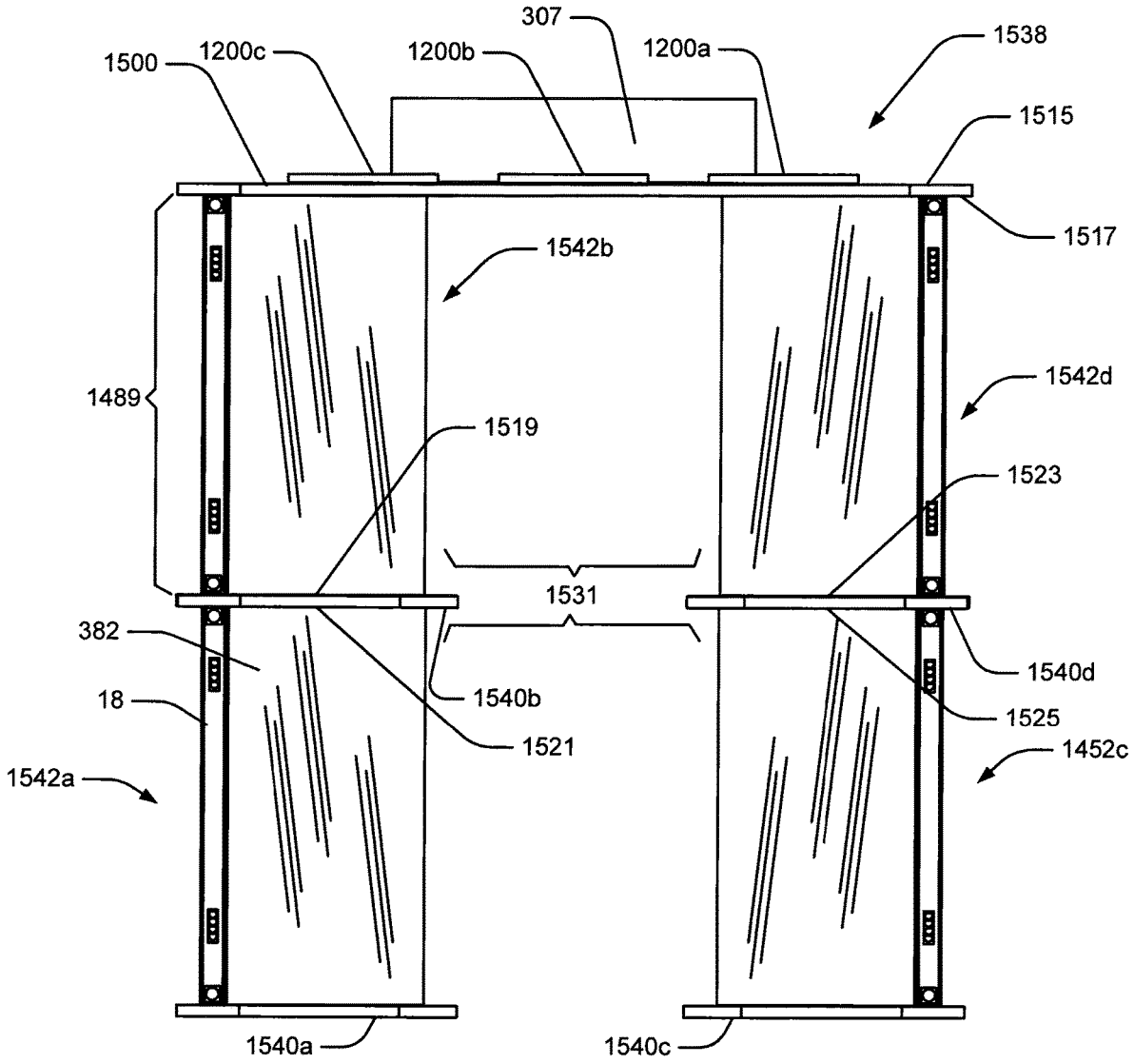
FIG. 103 is a top plan view of the configuration shown in FIG. 101.

Referring specifically to FIG. 103, long arch 1500 includes first and second oppositely facing surfaces 1515 and 1517, respectively, and short arch 1540*b* also includes first and second oppositely facing side surfaces 1519 and 1521, respectively. Short arch 1540*b* is spaced apart from long arch 1500 with the first surfaces 1515 and 1519 substantially parallel and defining first and second planes, respectively, that define an assembly space 1489 generally to the side of long arch 1500 on which arch 1540*b* resides. The space 1489 includes front and rear portions adjacent opposite ends of the long arch 1500. Short arch 1540*b* is positioned within the rear portion of space 1489 so that one end thereof is generally aligned with one end of long arch 1500 and the other end of short arch 1540*b* extends only part way across the space 1489. In the illustrated embodiment short arch 1540*b* extends about one third of the way across space 1489.

Figure 101:
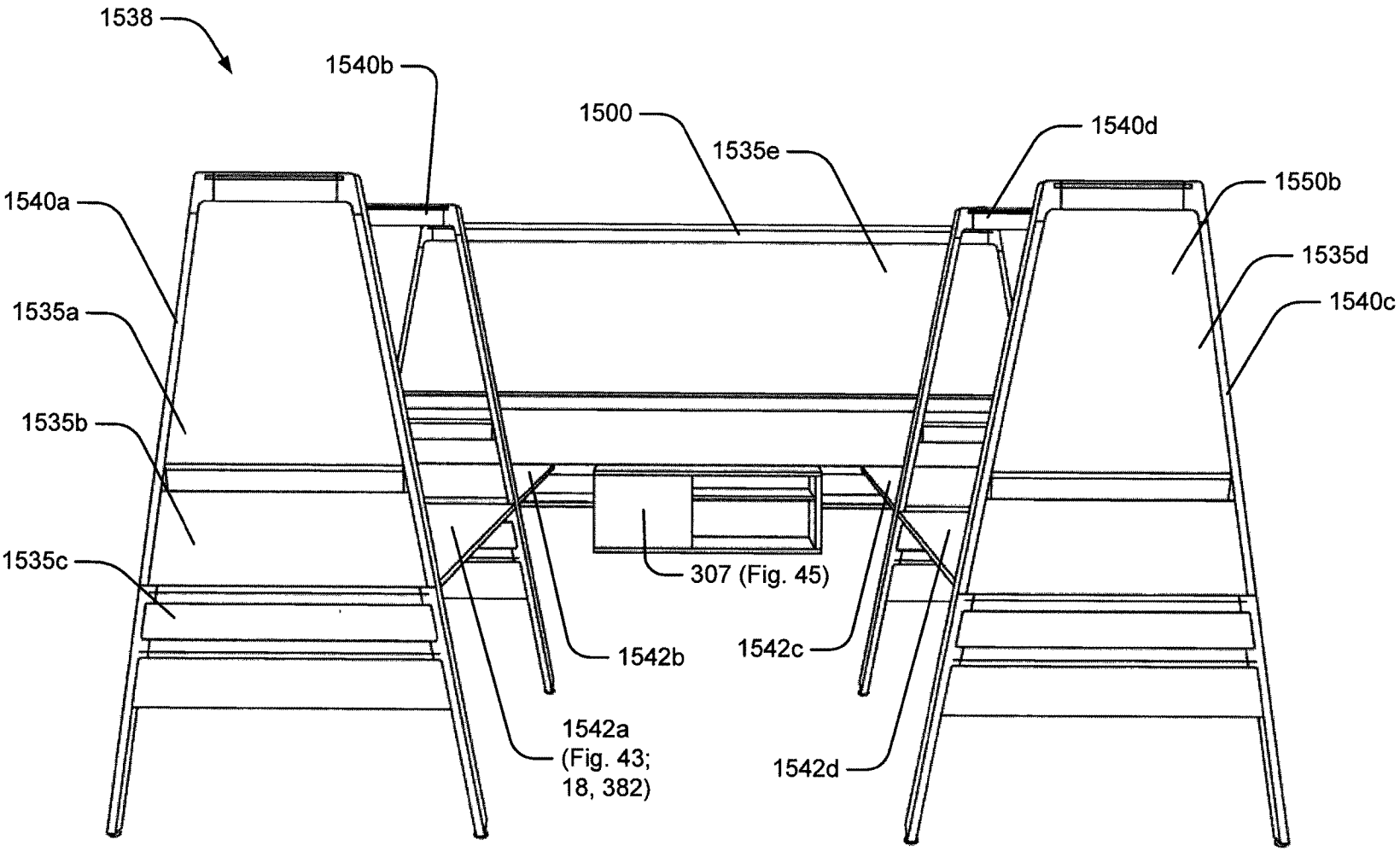
FIG. 101 is a front perspective view showing a work station configuration that is consistent with at least some aspects of the present invention.

Referring still to FIGS. 101 and 103, short arch 1540*d* includes first and second oppositely facing side surfaces 1523 and 1525, respectively. Short arch 1540*d* is spaced apart from long arch 1500 with the first surfaces 1515 and 1523 substantially parallel and defining first and second planes, respectively, with the first side 1523 generally residing in the second plane defined by surface 1519. Short arch 1540*d* is positioned within the front portion of space 1489 so that one end thereof is generally aligned with the end of long arch 1500 opposite the end that is aligned with short arch 1540*b* and the other end of short arch 1540*d* extends only part way across the space 1489 toward short arch 1540*b*. In the illustrated embodiment short arch 1540*d* extends about one third of the way across space 1489.

Referring to FIGS. 101 and 103, table/channel assembly 1542*b* is mounted between long arch 1500 and short arch 1540*b* to provide one workstation. Similarly, table/channel assembly 1542*d* is mounted between long arch 1500 and short arch 1542*d* to provide a second workstation. A space 1531 to the first side of long arch 1500 and between assemblies 1542*b* and 1542*d* is unobstructed after assembly.

Two people may be located within space 1531 with backs generally to each other to use the two resulting workstations.

Referring yet again to FIGS. 101 and 103, short arches 1540*a* and 1540*c* are spaced apart from short arches 1540*b* and 1540*d*, respectively, and are aligned with the rear and front portions of space 1489 as illustrated. Table/channel assemblies 1542*a* and 1542*c* are mounted between short arches 1540*b* and 1540*a* and between short arches 1540*d* and 1540*c*, respectively, to form third and fourth workstations, respectively. Again, the space 1531 between table/channel assemblies 1542*a* and 1542*c* is open and can be assumed by workstation users.

Referring again to FIG. 86, another accessory type subassembly that may be used with any of the embodiments described herein includes a frame in-fill panel 1535. Exemplary panel 1535 is a two sided panel that has a shape that mirrors the shape of a space defined by one of the arch or leg assemblies that is to receive the panel 1535 and has a thickness dimension that, in at least some embodiments, is generally equal to the thickness of the members that form a leg, support structure, or arch assemblies. In other embodiments panel 1535 may have a thickness dimension that is less than or greater than the thickness of the members that form a receiving space. In FIG. 86, exemplary panel 1535 has a shape and dimensions that mirror the shape and dimensions of a space 1543 defined by rails 24 and 1541 and members 1537 and 1539. Thus, when panel 1535 is received in space 1543, panel 1535 fills space 1543 and forms a visual block and increases privacy for a user of an adjacent workstation. By filling several leg or arch defined spaces, the sense of privacy afforded by a work station configuration can be increased.

In at least some embodiments panel 1535 may be very light weight and be formed by wrapping a fabric material around a foam board structure or by laminating several light weight layers of material together. In some embodiments a whiteboard material may form the outer surface of panel 1535 on one or both sides to provide a note and writing surface. In other embodiments other functional surfaces may be provided on panels such as a tack surface (e.g., cork), metal surface for use with magnets, etc. In still other embodiments one or all of the panels used with a configuration may be transparent or semi-transparent.

In at least some embodiments panel 1535 will be dimensioned so that there is a friction fit between the edges of the panel 1535 and the members that form a receiving space 1543. The panel edges may be resiliently deformable so that panel 1535 can be deformed while installing and can then assume its relaxed state after installation. In other embodiments mechanical fasteners may be provided to secure panel 1535 in a receiving space. For instance, each panel may include a manually operated panel mounted lever that can be rotated to increase the friction between a panel and the space forming members after panel insertion into a space.

In still other embodiments, referring still to FIG. 86, each panel 1535*a* may be formed by two separate panel halves 1551 and 1553 that can be brought together on either side of a receiving space where the halves have shapes and dimensions or lips 1555 that form shapes and dimensions that are slightly larger than the receiving space 1543 and where the halves connect to hold in place within the receiving space. For instance, two halves of a panel may include mating Velcro 1557 pieces that can secure the halves together where the lips 1555 sandwich the portions of the members that form a receiving space 1543. Velcro strips 1557 may be replaced by mating magnetic strips or some other type of mechanical fastener.

In still other embodiments where the arch and leg assemblies are formed of steel or are at least partially formed of steel or some other material to which a magnet may attach, magnetic attachment of panels 1535 to the members that form the receiving space is contemplated. Here, magnetic strips 1569 (see again FIG. 86) or the like may be mounted on the edges of a panel 1535 to interact with facing surfaces of the space forming members. Referring again to FIG. 101, several panels 1535*a*, 1535*b*, 1535*c*, 1535*d*, 1535*e*, etc., are shown installed in receiving spaces formed by the arches.

Figure 102:
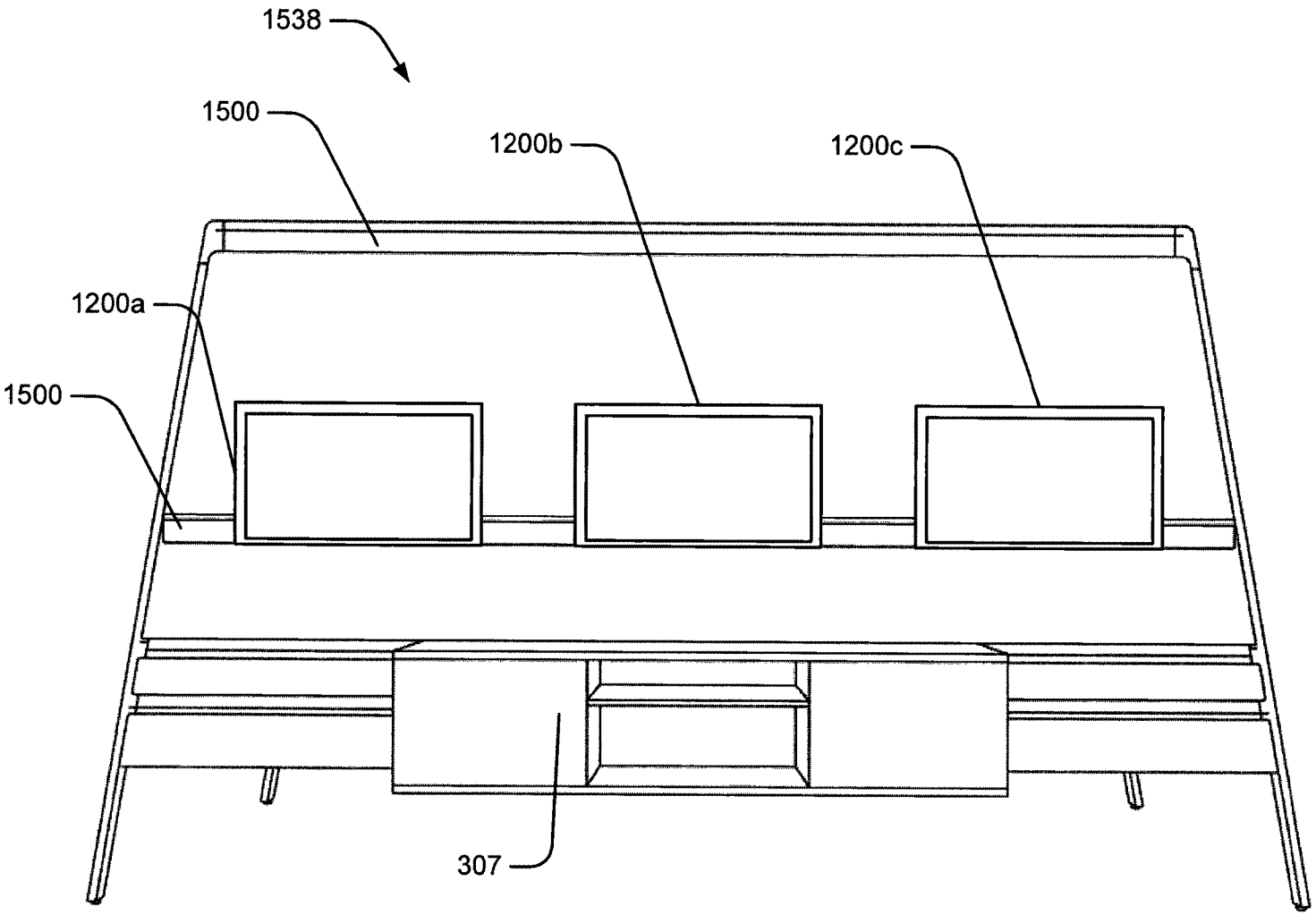
FIG. 102 is a rear perspective view of the assembly shown in FIG. 101.

It should be appreciated that other assembly components described above can be used with the basic configuration described above with respect to FIGS. 101 and 103. For instance, in FIG. 101, one of the case goods subassemblies 307 (see also FIG. 45) is shown mounted to the bottom two rails of long arch 1500. In FIG. 102, the side of long arch 1500 opposite the side shown in FIG. 101 is illustrated. Configuration 1538 also includes a case goods subassembly 307 mounted to the second side of long arch 1500 as well as three flat panel display screens 1200*a*, 1200*b* and 1200*c* mounted to the mid-length rail of long arch 1500.

Figure 104:
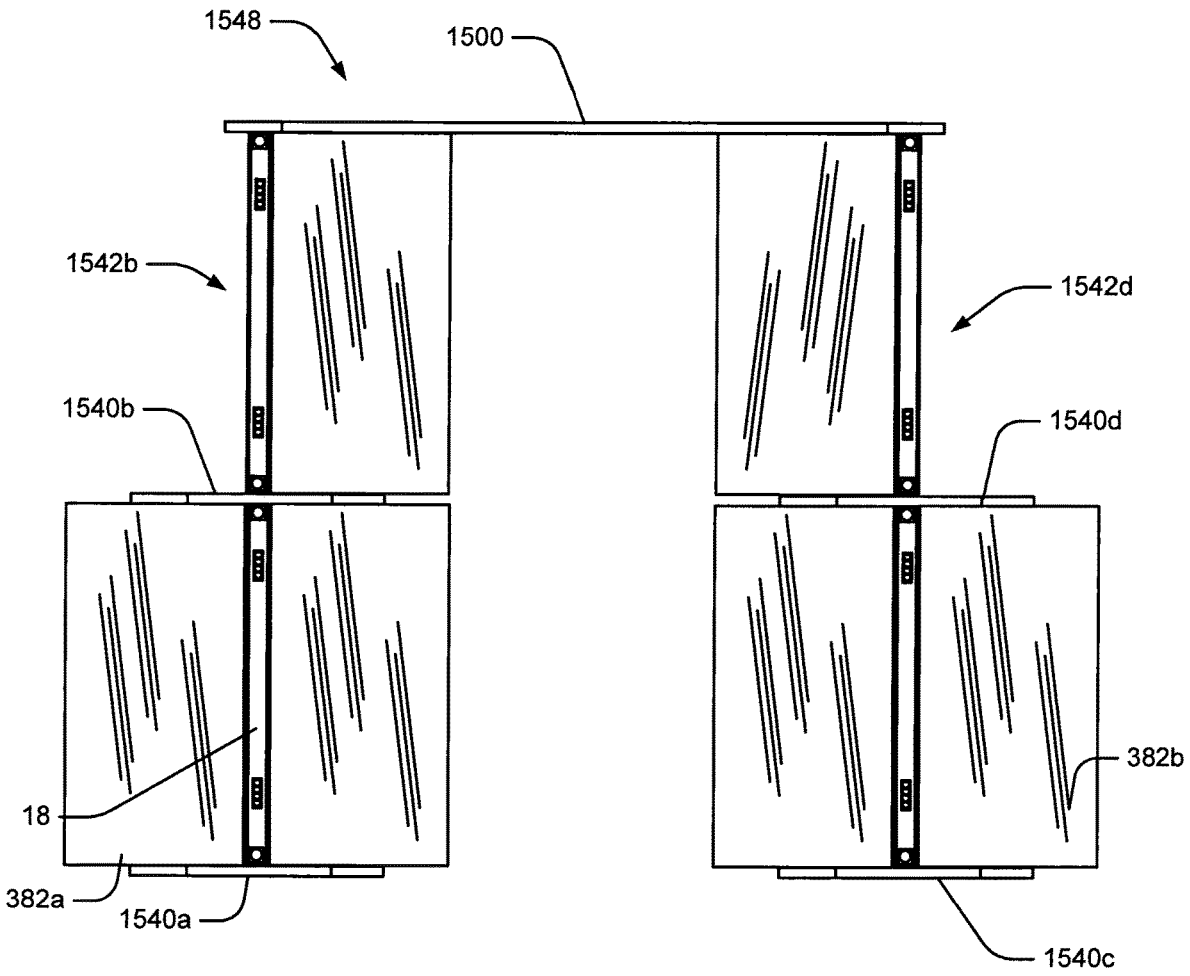
FIG. 104 is a top plan view similar to the view shown in FIG. 103, albeit showing a different work station configuration that is consistent with at least some aspects of the present invention.

Referring now to FIG. 104, the basic components of FIGS. 101 and 103 are shown rearranged slightly with some additional components added to configure a six person workstation configuration 1548. The main differences between configuration 1548 and configuration 1538 (see again FIG. 103) are that short arch assemblies 1540*b* and 1540*a* and short arch assemblies 1540*d* and 1540*c* have been moved laterally outward and fifth and sixth table top subassemblies 382*a* and 382*b* have been added which are supported at opposite ends by short arches 1540*b* and 1540*a* and by short arches 1540*d* and 1540*c*, respectively. Here, while four workstations are provided within the space to one side of large arch 1500, two additional stations are provided that extend out laterally from that space.

Thus, referring again to FIGS. 103 and 104, it should be appreciated that a kit of parts including arches having different lengths can be reconfigured in many different ways to alter the number and arrangement of workstations as well as the accessories provided at each station. In addition, the long arch 1500 in particular provides a relatively large structure that can help define common areas (see FIG. 102) for use by more than one person at a time.

Figure 105:
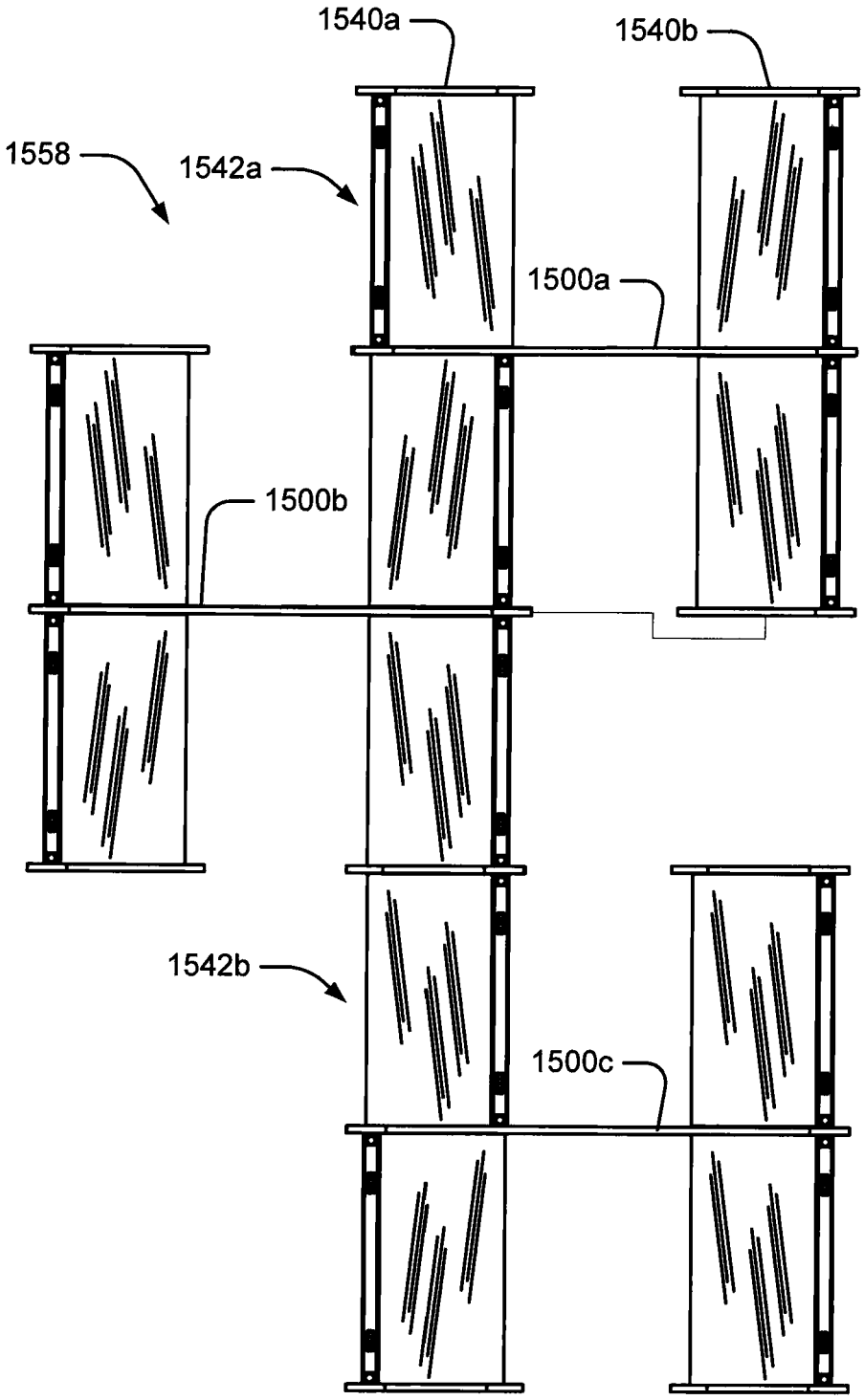
FIG. 105 is a top plan view showing another work station configuration that is consistent with at least some aspects of the present invention.

Referring to FIG. 105, another workstation configuration 1558 is illustrated that is configured using three large arches 1500*a*, 1500*b* and 1500*c*, nine short arches 1540*a*, 1540*b*, etc., and eleven table/channel subassemblies 1542*a*, etc. As shown, in at least some embodiments, workstations can be formed to either side of any one of the large arches and the system components can be cobbled together to form a virtually endless number of different and useful configurations, depending on the needs of specific system users.

Figure 106:
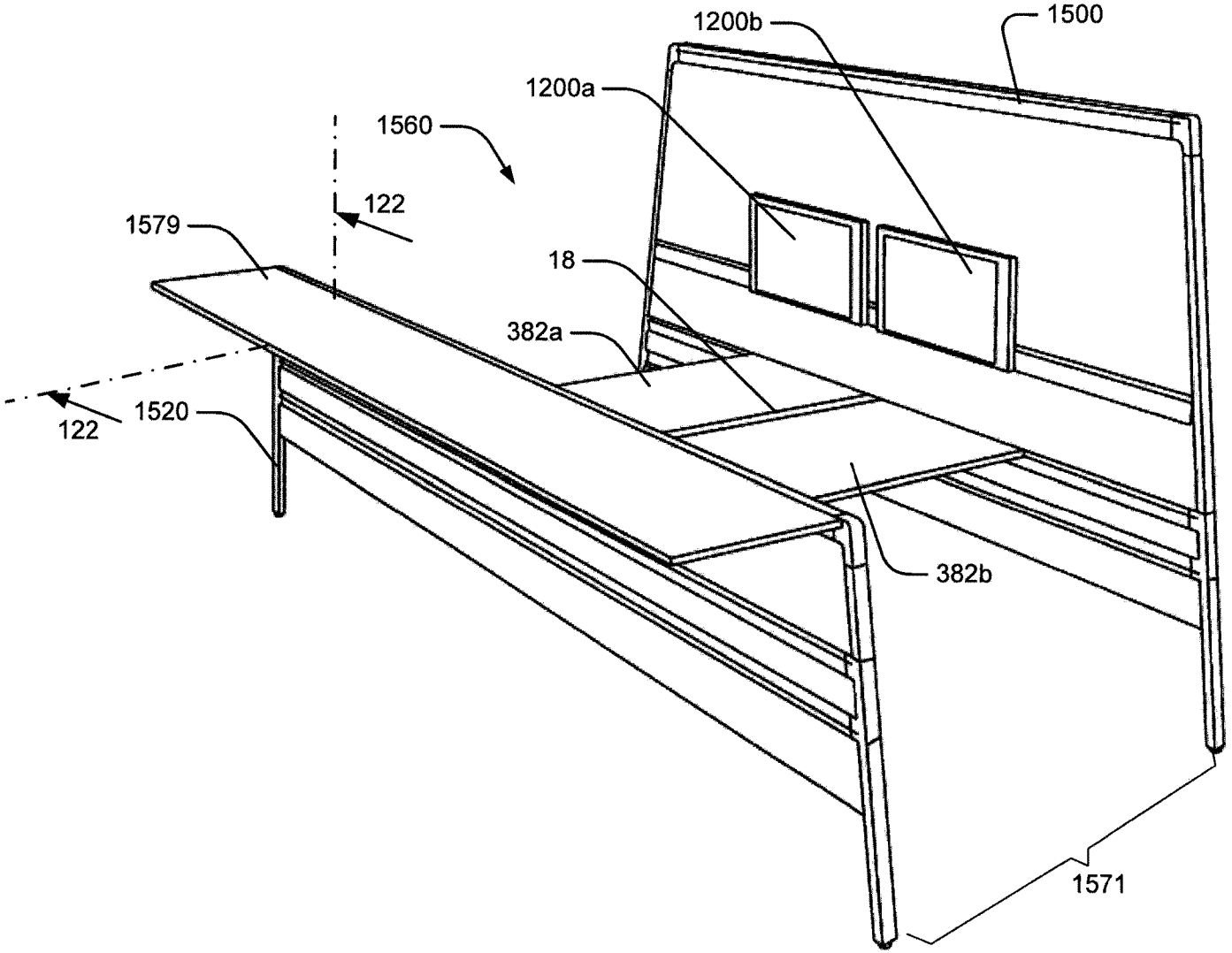
FIG. 106 is a perspective view of one other work station configuration that is consistent with at least some aspects of the present invention.

Referring now to FIG. 106, another configuration 1560 is illustrated that includes one long arch 1500, a long intermediate height support structure 1520, one channel member 18, first and second table assemblies 382*a* and 382*b* and a plurality of in-fill panels (not labeled). Long arch 1500 and intermediate height assembly 1520 are spaced apart on opposite sides of an assembly space 1571 with channel member 18 mounted at opposite ends to central locations of rails of assemblies 1500 and 1520 and with table assemblies 382*a* and 382*b* mounted on opposite sides of channel member 18 to form two facing workstations of a central table structure between arch 1500 and support structure 1520. Both the front and rear portions of space 1571 are unobstructed by member 18 and table assemblies 382*a* and 382*b*. Configuration 1560 also includes two display screens

1200*a* and 1200*b* mounted to an intermediate height rail of long arch 1500 that face space 1571.

Figure 122:
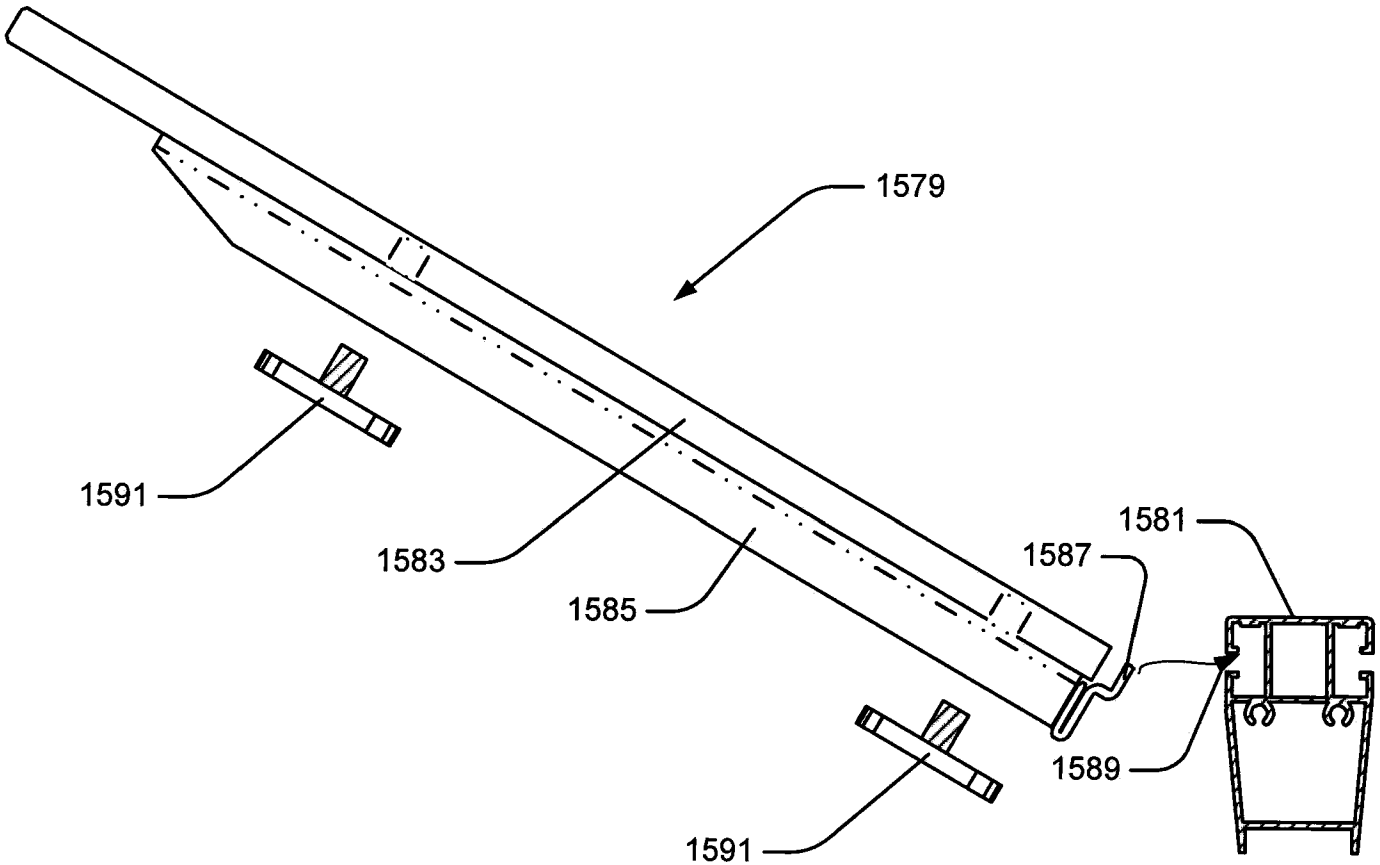
Figure 123:
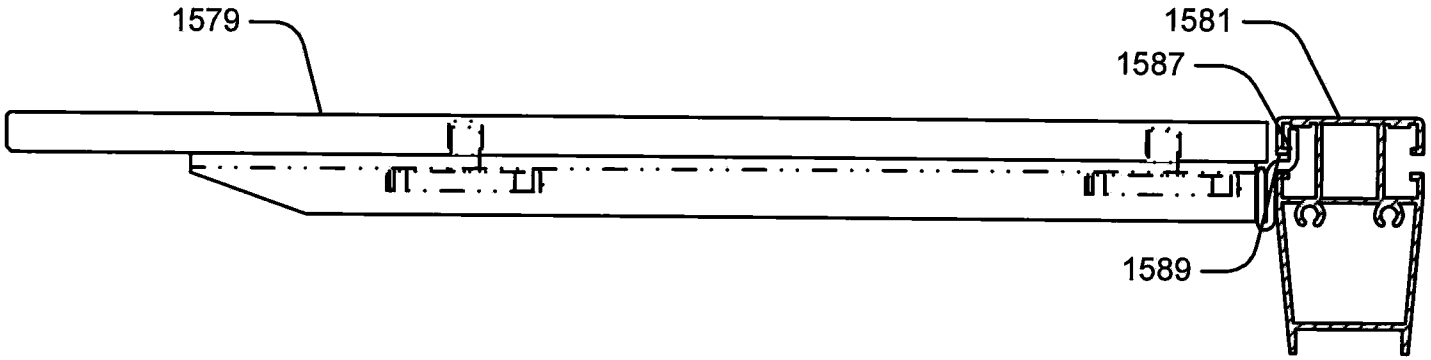
Figure 124:
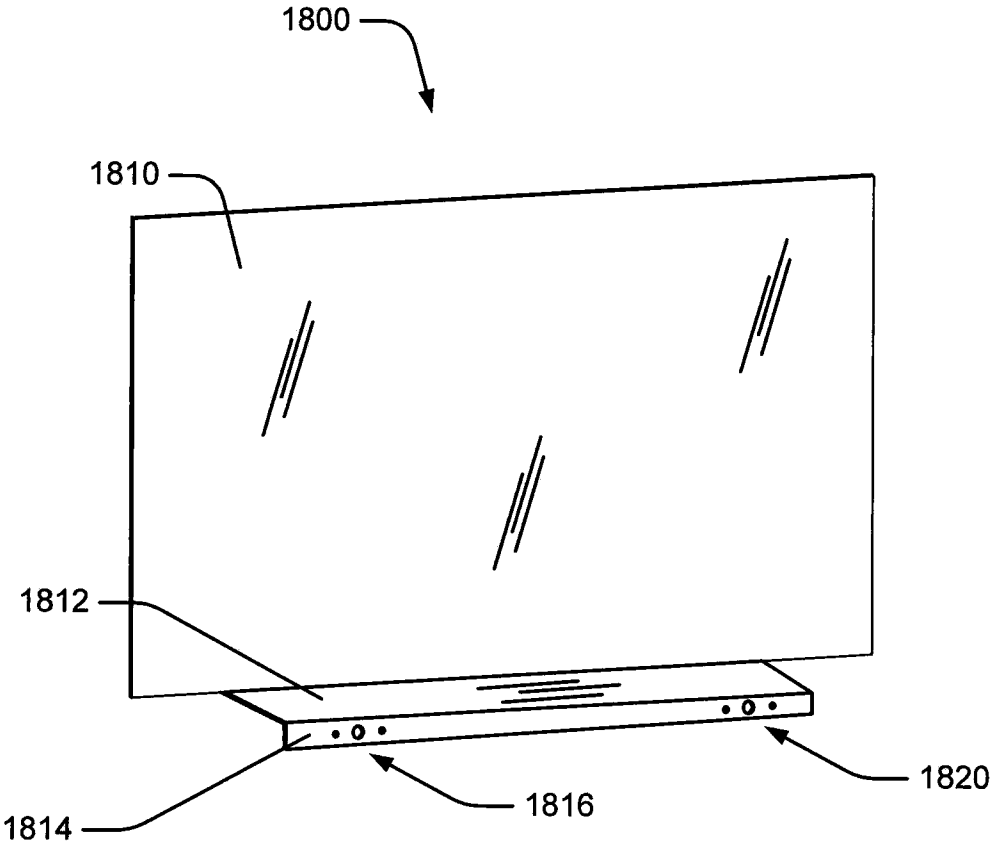

An additional assembly, a counter assembly 1579, is mounted to the top rail of intermediate height support structure 1520 on a side opposite space 1571 for use by persons standing on the side of assembly 1520 opposite space 1571. Referring also to FIGS. 122 and 123, counter assembly 1579 includes a counter top member 1583 and a plurality (only one shown) of rigid metal (e.g., steel) brackets 1585 mounted to the bottom surface of member 1583 via mechanical fasteners 1591. Bracket 1585 has an L-shape in cross section (not shown) where one member of the L-shape contacts the undersurface of member 1583 and the other member of the L-shape extends downward there from to provide strength to the supported top member 1583. Mechanical fasteners pass through the portion of the bracket that contacts the undersurface of member 1583 and are received in threaded openings. Each bracket 1585 forms an upwardly extending lip member 1587 along a rear edge of member 1583 that is shaped and dimensioned to be received in any one of the side slots (e.g., 1589) formed by any one of the leg or arch assembly rails (e.g., 1581 in FIGS. 122 and 123). Although not shown in detail, in other embodiments bracket 1585 may be replaced by a larger bracket assembly like the one shown and described in FIG. 44 where the bracket extends downward to interface with a lower rail and provide additional cantilevered support. In addition, some type of locking mechanism (see 394 in FIG. 44) may also be provided to ensure that the bracket does not become inadvertently dislodged from the support rails.

Figure 107:
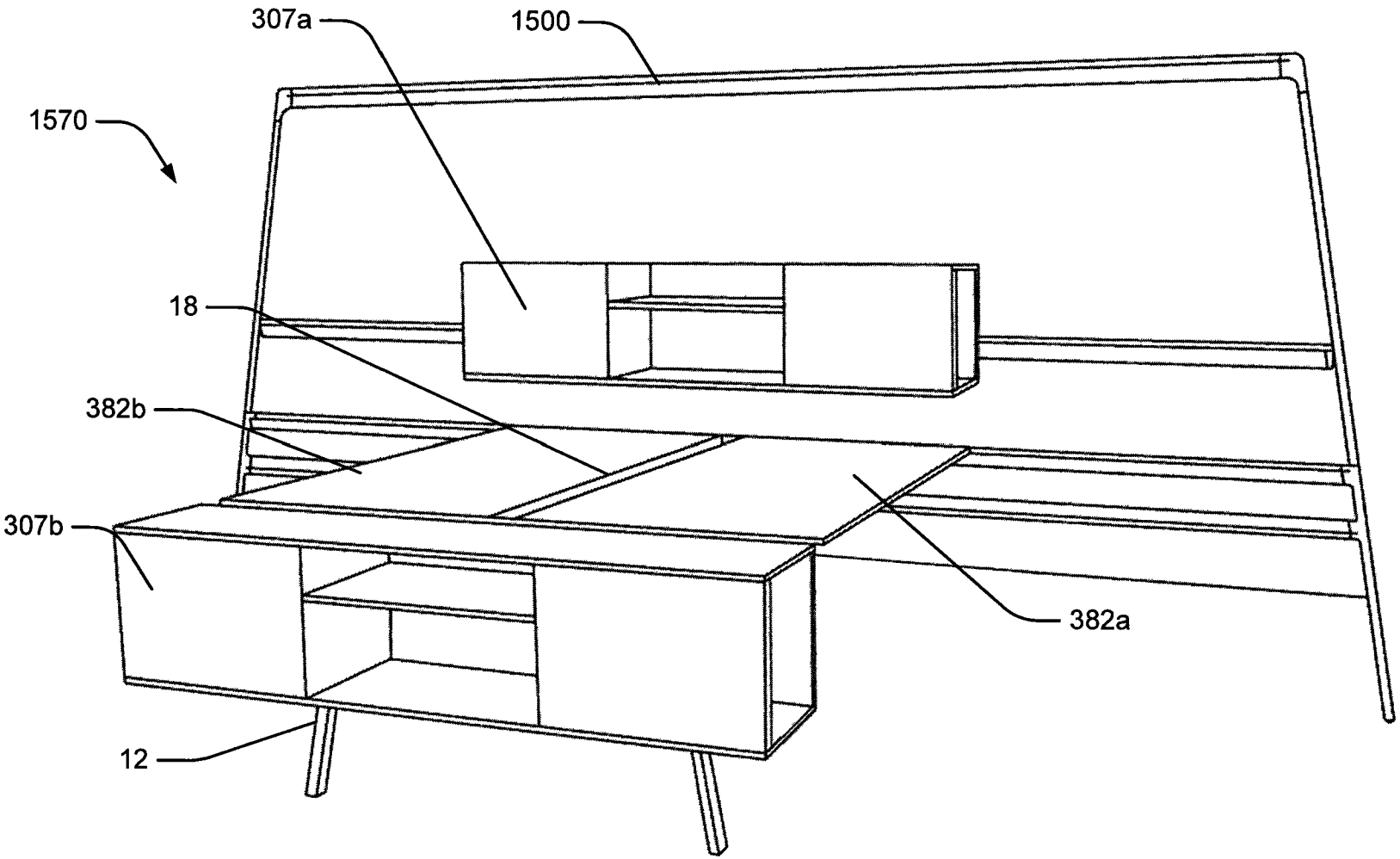
FIG. 107 is a perspective view of one other work station configuration that is consistent with at least some aspects of the present invention.

Referring to FIG. 107, another configuration 1570 is illustrated that is similar to configuration 1568 in FIG. 106, except that long support structure 1520 has been replaced by a simple short length leg assembly 12 and the accessories have been changed from displays and a counter assembly to two case goods assemblies 307*a* and 307*b*. Thus, configuration 1570 still includes long arch 1500, channel member 18 and first and second table assemblies 382*a* and 382*b*, respectively. Case goods assembly 307*a* is shown mounted to the intermediate height rail of long arch 1500 and case goods assembly 307*b* is mounted to the side of leg assembly 12*a* opposite table assemblies 382*a* and 382*b*. Configuration 1570 provides a large wall structure to one side of the table assemblies and is generally open to the other side.

Figure 39:
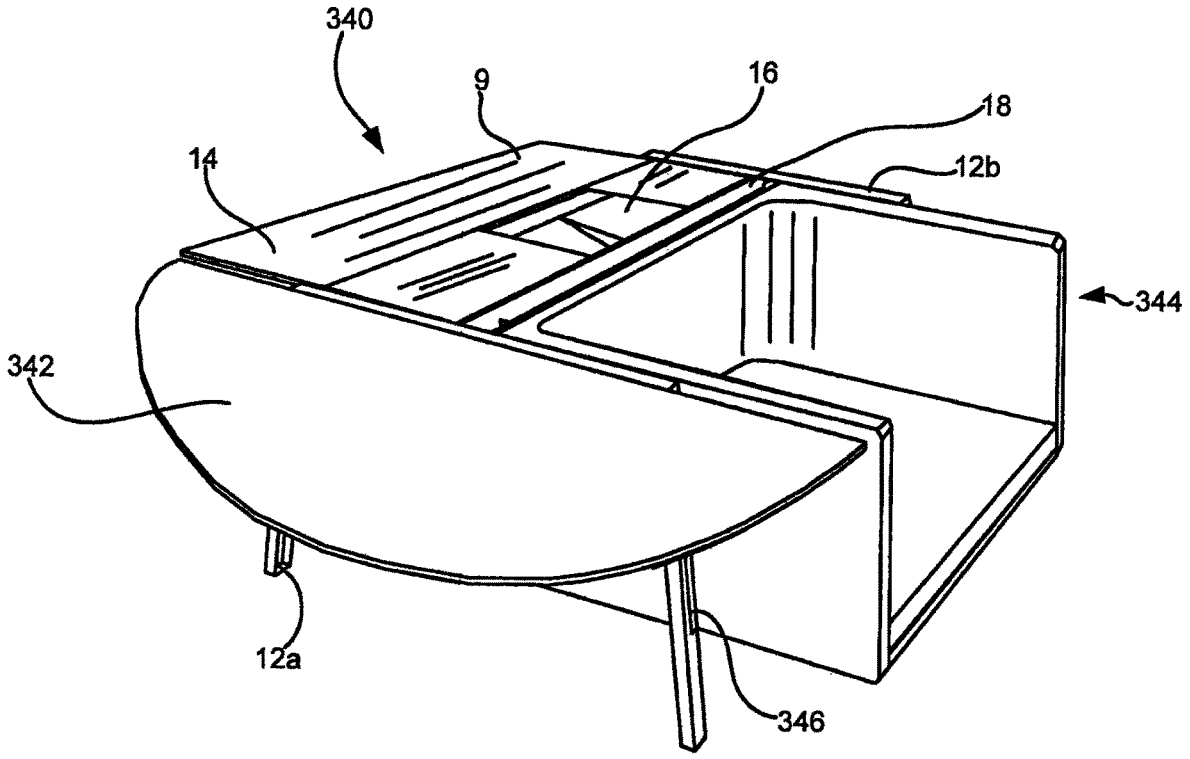
FIG. 39 is a perspective view similar to the view of FIG. 33; albeit where several components in the assembly of FIG. 33 have been replaced by a lounge sub-assembly.
Figure 108:
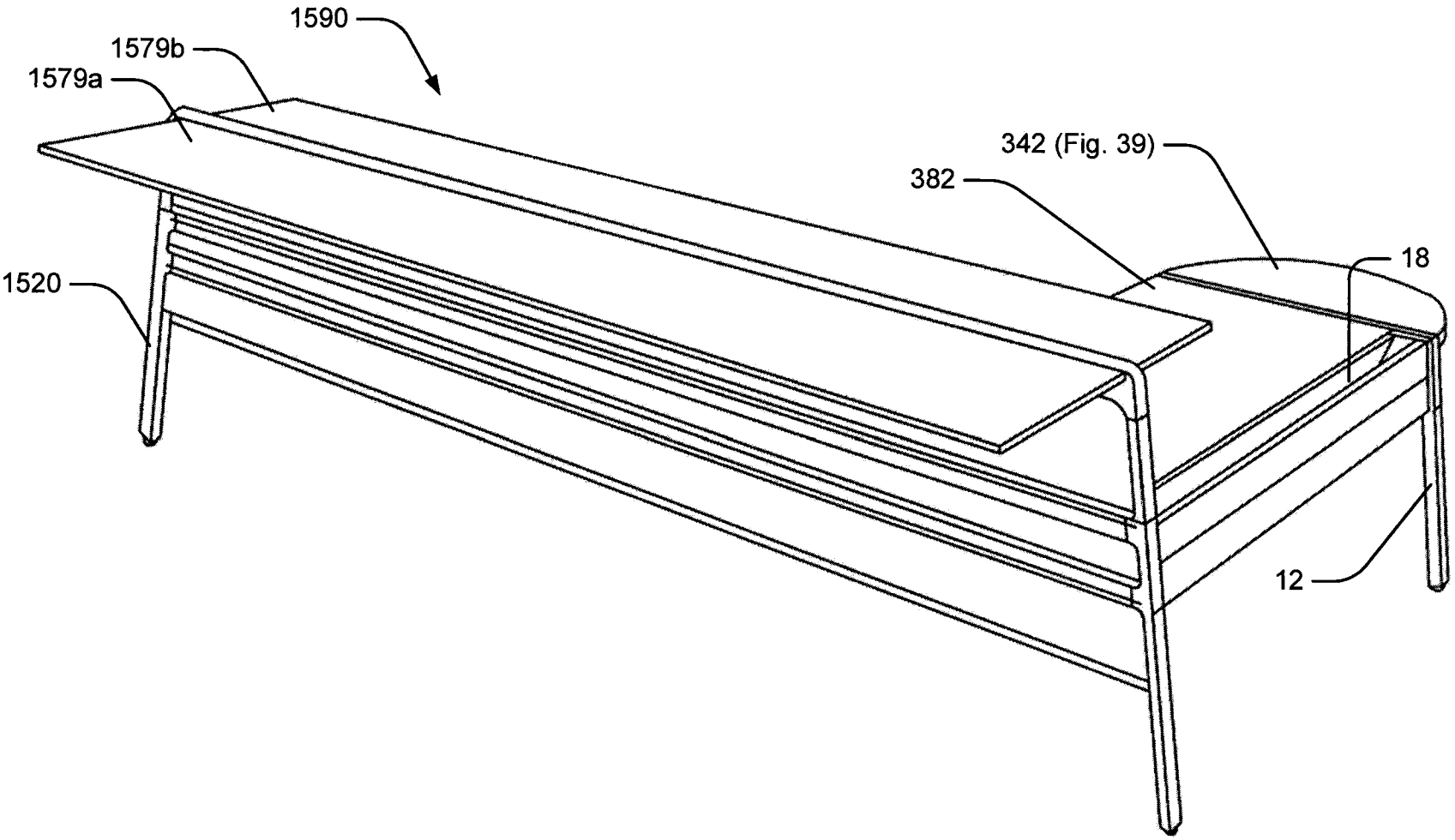
FIG. 108 is a perspective view of one other work station configuration that is consistent with at least some aspects of the present invention.

Referring to FIG. 108, another configuration 1590 is illustrated that includes one long intermediate height support assembly 1520 and one short leg assembly 12, one channel member 18 and one table assembly 382 and additional accessories including first and second counter assemblies 1579*a* and 1579*b* and a half round table assembly 342 (see again FIG. 39 for detail). Configuration 1590 may be suitable for use by a receptionist or the like where visitors may stand adjacent assembly 1579*a* while the receptionist uses the top surface of table top 382 or the top surface of half round member 342 to perform various work tasks.

Figure 109:
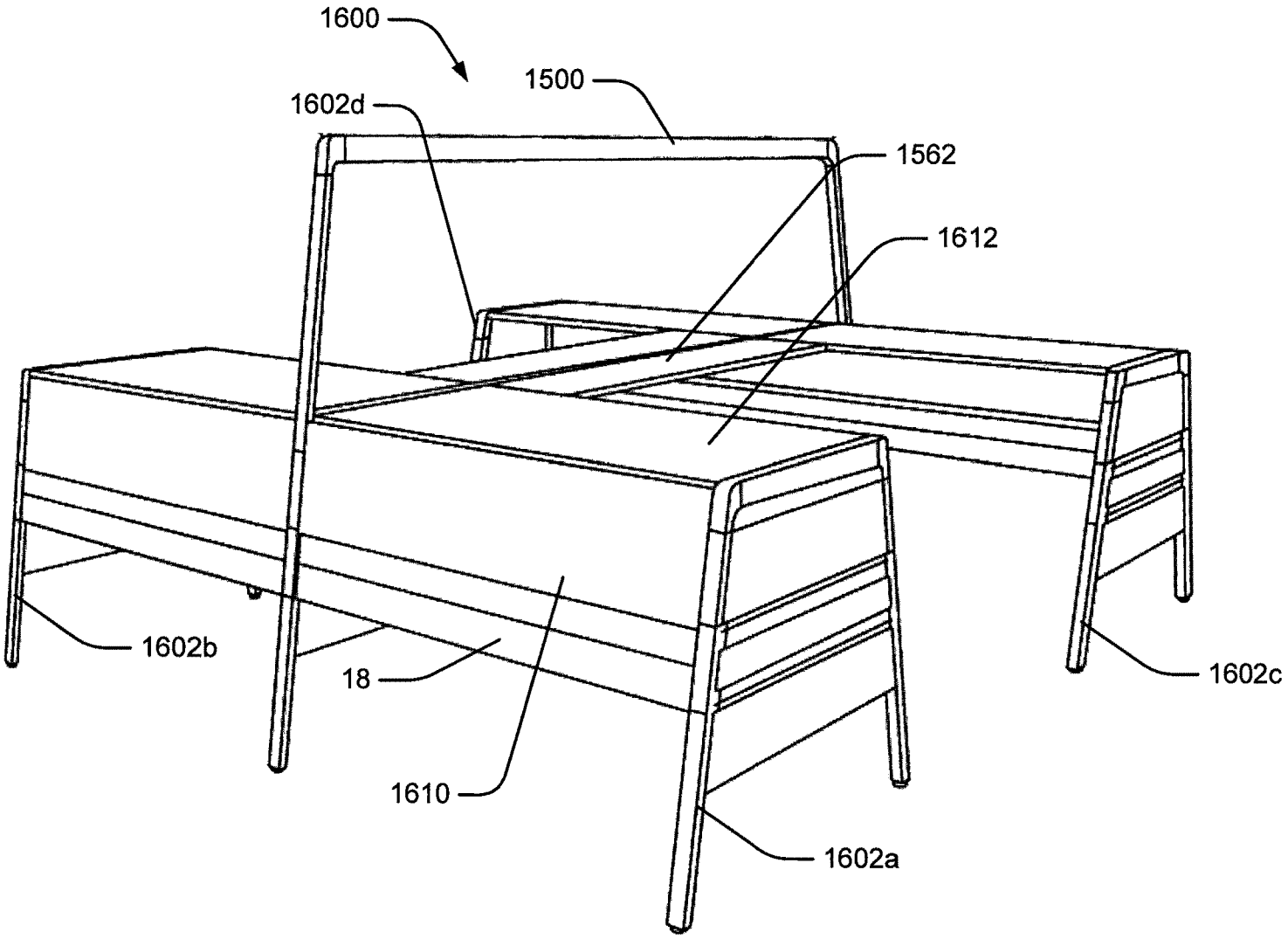
FIG. 109 is a perspective view of one other work station configuration that is consistent with at least some aspects of the present invention.

Referring to FIG. 109, another configuration 1600 is illustrated that includes one long arch 1500 and four short intermediate height support structures 1602*a*, 1602*b*, 1602*c* and 1602*d* as well as four table top assemblies, only one labeled 1612, four screen assemblies, only one labeled 1610, and four channel members, only one labeled 18. Intermediate height support structures 1602*a* and 1602*c* are spaced to one side of long arch 1500 and are separated there from so that they are aligned with front and rear portions of long arch 1500 while intermediate height support structures 1602*b* and 1602*d* are spaced to the other side of long arch 1500 and are separated there from so that they are aligned with front and rear portions of long arch 1500. Channel member 18 is mounted between long arch 1500 and support structure 1602*a*. In this embodiment, table top assembly 1612 is mounted to the top rail of intermediate height support structures 1602*a* and a rail of long arch 1500 at a similar height to provide a worksurface at a height flush with the top surfaces of the rails to which the top assembly 1612 is mounted. Screen assembly 1610 is mounted to channel member 18 and extends upward there from to a height adjacent the undersurface of table assembly 1612 to provide a modesty panel structure between channel member 18 and table top member 1612. The other three workstations that form part of configuration 1600 are constructed in a fashion similar to that described above with respect to components 1602*a*, 18, 1612 and 1610.

Referring to FIGS. 124 through 128, screen assembly 1610 includes a screen member 1800, first and second pairs (only one illustrated) of mounting blocks 1802 and 1804 and a mounting bolt 1806 and a mounting nut 1808 for each pair of mounting blocks. Screen member 1800 is a rigid member that in at least some embodiments, is formed of bent sheet metal. Member 1800 includes a rectangular main member 1810, a shelf member 1812 and a mounting flange 1814. Shelf member 1812 extends at a right angle from a lower edge of main member 1810 to one side and flange 1814 extends at a right angle from an edge of shelf member 1812 opposite main member 1810 and in a direction opposite the direction in which main member 1810 extends. Flange 1814 forms a pair of mounting hole subsets 1816 and 1818 at opposite ends where each subset includes three separate holes.

Figure 125:
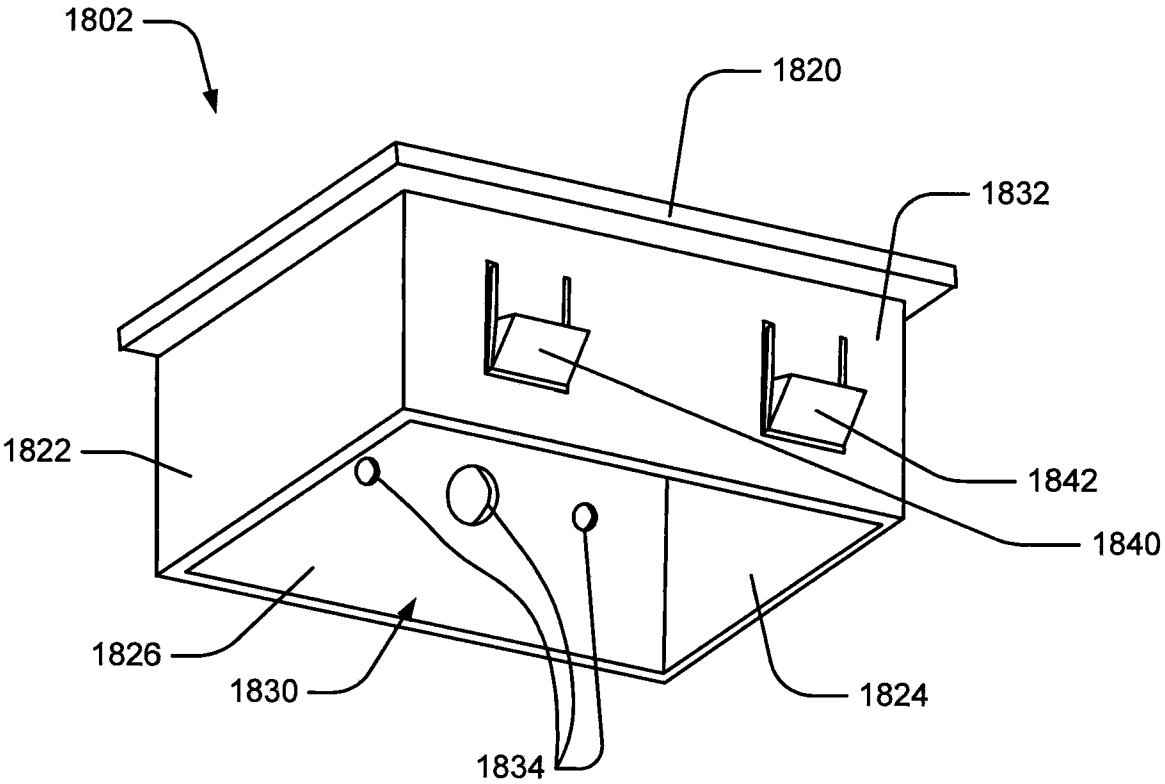
Figure 127:
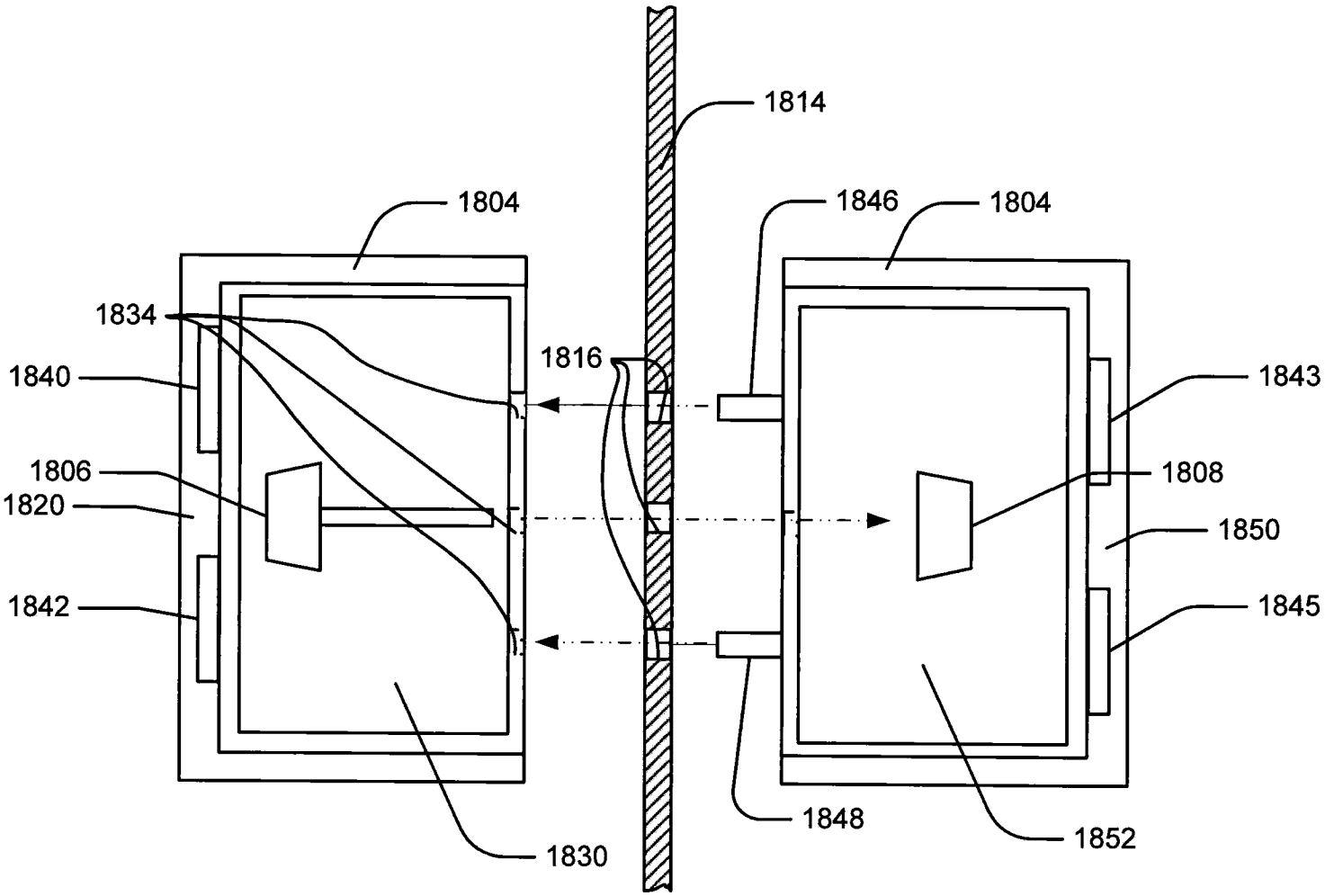

Referring to FIGS. 125 and 127, exemplary first mounting block 1802 is a rigid molded member that includes a top wall 1820, ends walls 1822 and 1824 and first and second side walls 1826 and 1828 that form a box like structure having a box shaped cavity 1830. Top wall 1820 is flush with first side wall 1826 and extends past the other side wall 1828 to form a lip 1832. First side wall 1826 forms three holes 1834 in a pattern that mirrors the pattern of one of the hole subsets (e.g., 1816) formed by flange 1814. Resilient tabs 1840 and 1842 are formed by second wall member 1828.

Figure 126:
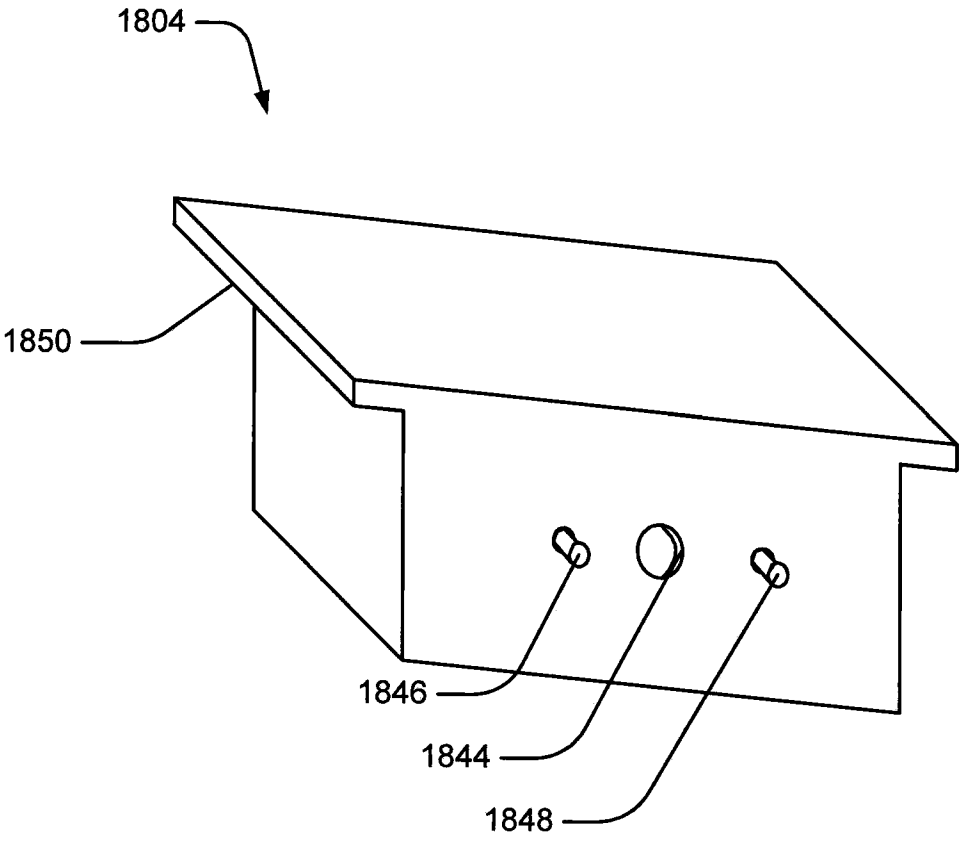

Referring to FIGS. 126 and 127, second mounting block 1804 has a shape and construction similar to block 1802 and therefore will not be described here in detail. The one main difference between blocks 1802 and 1804 is that block 1804 includes two posts 1846 and 1848 that extend on opposite sides of single hole 1844 in a pattern that mirrors the holes 1834 formed by block 1802. Block 1804 also includes a top wall that forms a lip 1850, forms a cavity 1852 and forms flanges 1843 and 1845.

To mount screen member 1800 to a channel member 18, screen member 1800 is mounted to block 1804 by aligning posts 1846 and 1848 with outer holes in hole subset 1816 and sliding block toward flange 1814 so posts 1846 and 1848 extend through the aligned holes. Block 1802 is then aligned with posts 1846 and 1848 on a side of flange 1814 opposite block 1802 and is slid toward flange 1814 until distal ends of posts 1846 and 1848 pass through block holes 1834. Bolt 1806 and nut 1808 are aligned with the central holes formed by blocks 1802 and 1804 and flange 1814 and the bolt shaft is passed through the aligned holes and nut 1808 is tightened to secure blocks 1802 and 1804 to flange 1814. The other block pair is mounted to flange 1814 at the other hole subset 1818 in a similar fashion.

Figure 128:
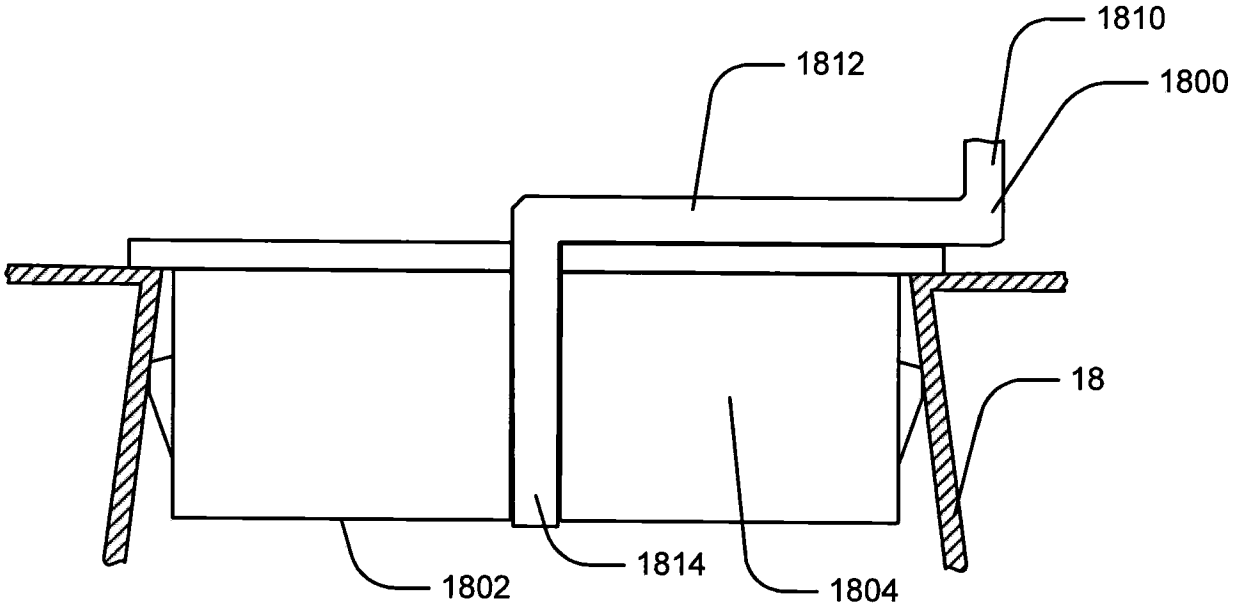

Once blocks 1802, 1804 are mounted to flange 1814, the combined width dimension of the assembly is such that tabs 1840, 1842 and 1843, 1845 that extend from opposite sides of the assembly form a friction fit with facing surfaces of channel member 18 upon being forced there into (see FIG. 128). Thus, assembly 1610 can be mounted to channel member 18.

Figure 110:
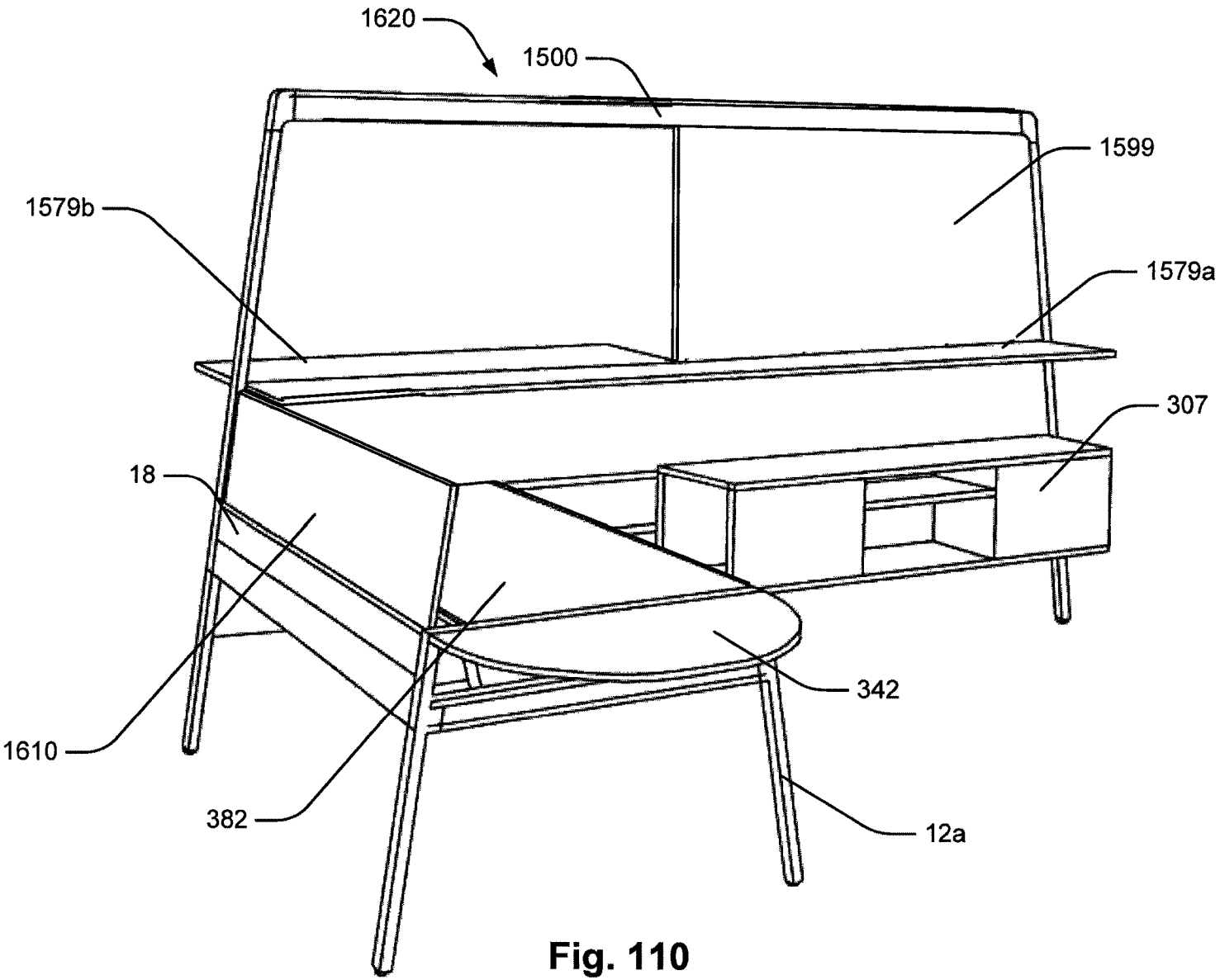
FIG. 110 is a perspective view of one other work station configuration that is consistent with at least some aspects of the present invention.

Referring now to FIG. 110, another configuration 1620 is illustrated that includes one table/channel assembly 18/382 mounted between one long arch 1500 and one short leg 12 with a half round assembly 342 mounted to the side of leg assembly 12 opposite table assembly 382. Here, assembly 1610 akin to assembly 1610 in FIG. 109 is provided which extends up from channel member 18 and provides some privacy to the area above table assembly 382. Counter assemblies 1579*a* and 1579*b* are mounted to the intermediate rail of long arch 1500 on opposite sides and one case goods assembly 307 is mounted under a portion of counter assembly 1579*a* to provide some storage for a user of configuration 1620. While configuration 1620 includes several panels (not labeled), a partial panel 1599 is provided that fills in only about half of a receiving space formed by the upper members of long arch 1500. The partial panel 1599 causes persons approaching a user of configuration 1620 to move toward the open space formed by long arch to communicate with the configuration user.

Figure 111:
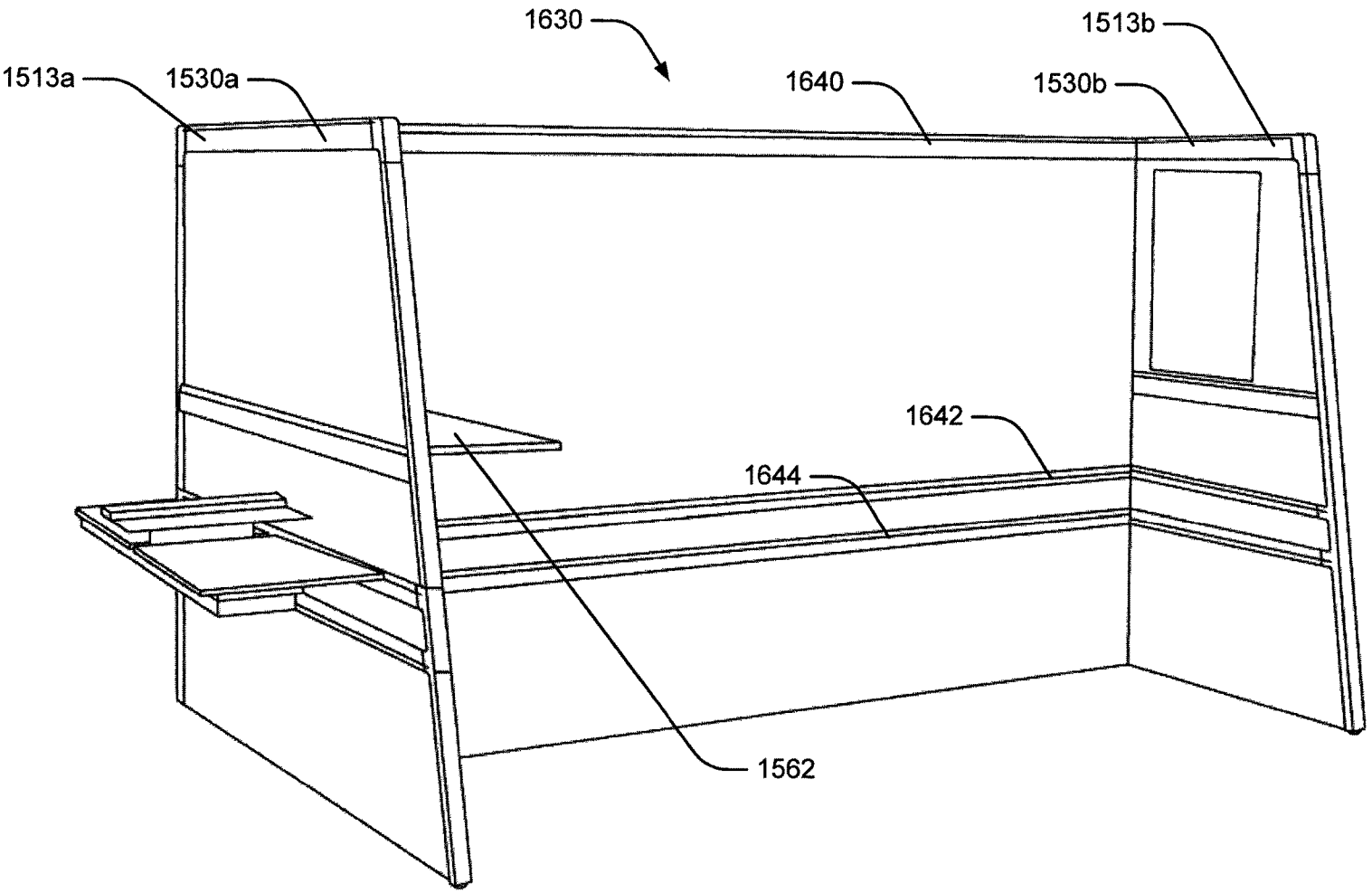
FIG. 111 is a perspective view of one other work station configuration that is consistent with at least some aspects of the present invention.
Figure 112:
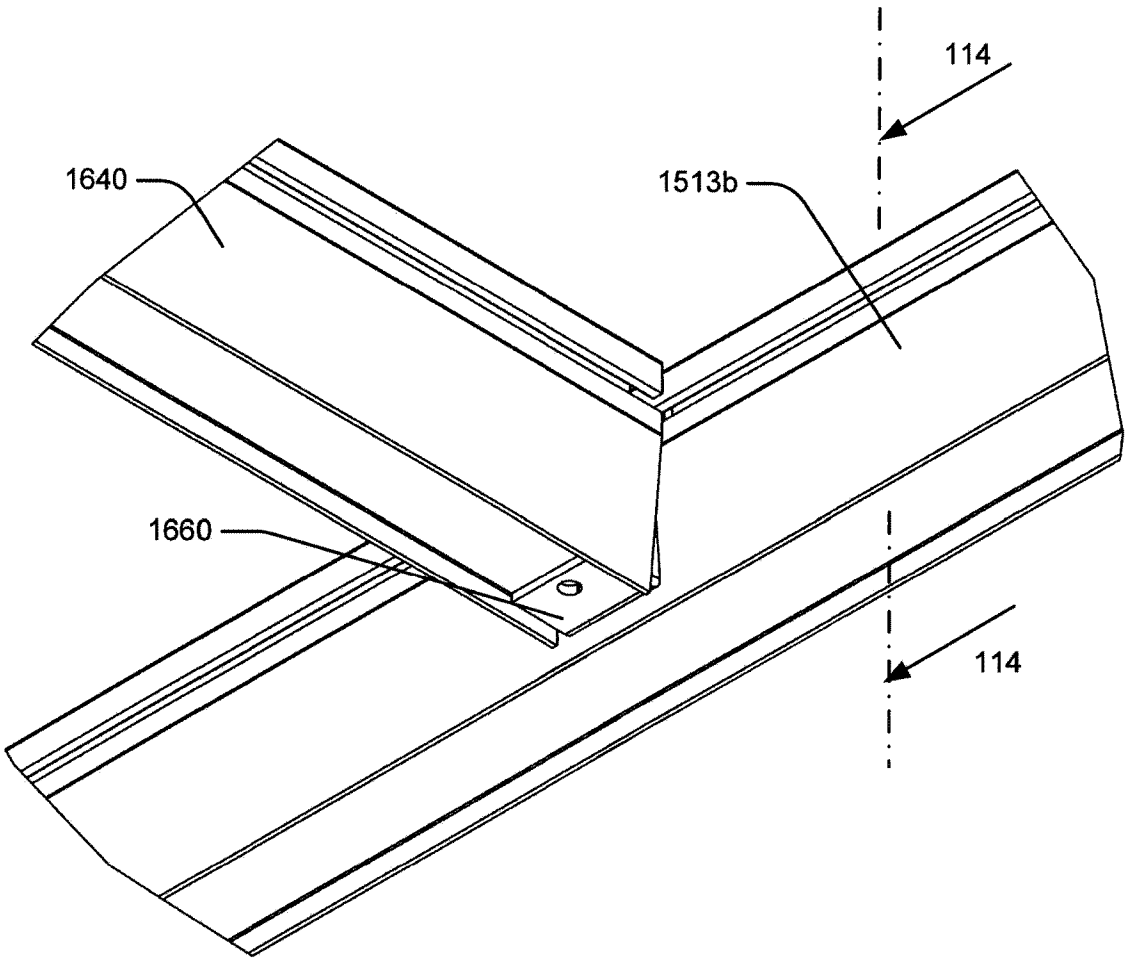
FIG. 112 is a perspective view showing one of the rail members of FIG. 111 mounted to one of the arch rail members that is consistent with at least some aspects of the present invention.
Figure 113:
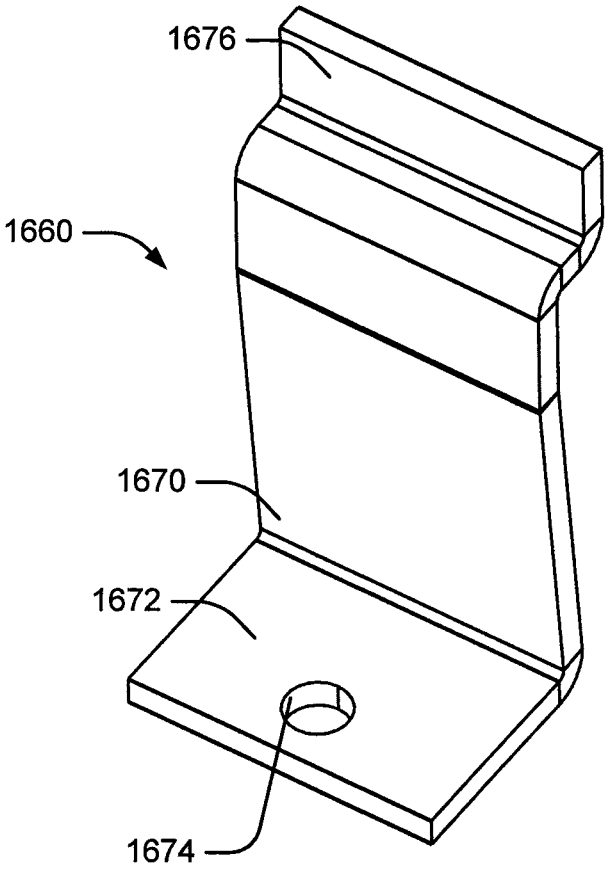
FIG. 113 is a perspective view of the bracket shown in FIG. 112.

Referring to FIG. 111, another configuration 1630 is illustrated that includes two intermediate length arches 1530*a* and 1530*b* that are connected together by spacer rails 1640, 1642 and 1644. Each of the spacer rails 1640, 1642 and 1644 is similarly constructed and operates in a similar fashion and therefore, in the interest of simplifying this explanation, only spacer rail 1640 will be described here in any detail. Referring also to FIGS. 112 through 115, rail 1640 has a cross section that is similar to the cross section of any one of the horizontal rails that form the leg assemblies or arch assemblies as described above. Spacer rail 1640 is mounted at opposite ends to top rails 1513*a* and 1513*b* of assemblies 1530*a* and 1530*b*, respectively, via brackets 1660. Exemplary bracket 1660 is a bent steel metal bracket that includes a generally flat base member 1670 (e.g., a base member shaped to follow the contour of the outer surface of adjacent rail 1650*b* and a shelf member 1672 that extends from a lower edge of base member 1670 and that forms a mounting hole 1674. Bracket 1660 forms an upwardly and rearward extending lip member 1676 that extends from the edge of base member 1670 opposite shelf member 1672. Lip member 1676 is sized and dimensioned to be received in one of the rail channels 1664 of the rail 1650*b* (see FIGS. 114 and 115) that spacer rail 1640 is to mount to. Shelf member 1672 supports rail member 1640 on a top surface (i.e., member 1672 is received in a lower channel formed by rail 1640) and a mechanical fastener 1672 (e.g., a finger tight-enable bolt) is passed through hole 1764 and is received in a threaded opening (not illustrated) formed in the undersurface of rail 1640. A similar bracket is provided at the other end of rail 1640 to secure the other end to rail 1650*a*.

After installation of the spacer rails 1640, 1642 and 1644, in-fill panels akin to those described above may be used to fill in the spaces between the rails to form a space dividing system as illustrated in FIG. 111.

Although not illustrated, in at least some embodiments the bottom two rails 1642 and 1644 may be replaced by a long channel member akin to the channel members 18 described above. Where a channel member is provided as part of a wall configuration, the channel member can provide a wire management trough as well as power and data outlets if required for an application.

Figure 116:
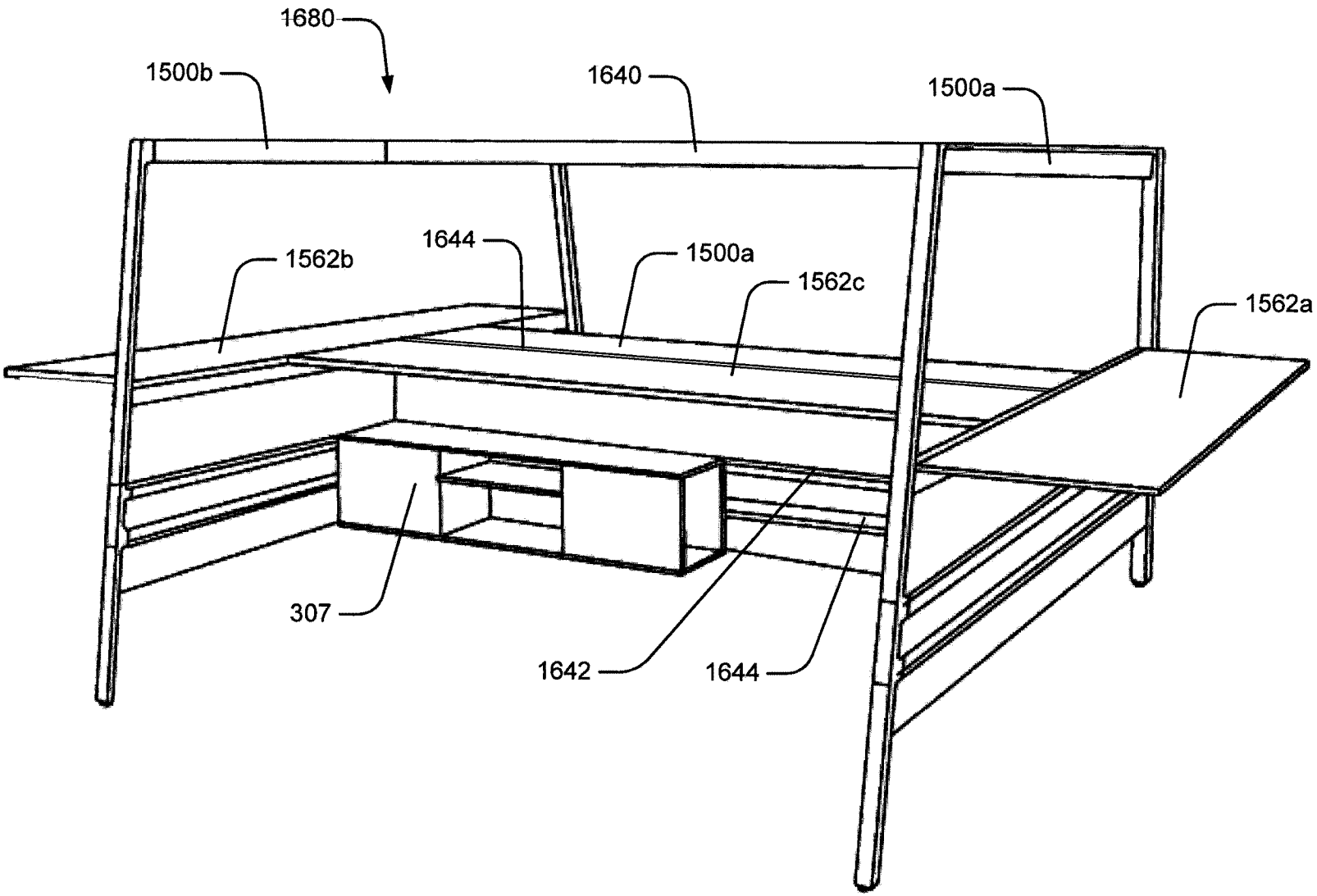
FIG. 116 is a perspective view of one other work station configuration that is consistent with at least some aspects of the present invention.

Referring to FIG. 116, another configuration 1680 is illustrated that includes two long arches 1500*a* and 1500*b* that are spaced apart by spacer rail members 1640, 1642, 1644 and 1645. Configuration 1680 also includes two separate counter assemblies 1579*a* and 1579*b*, each mounted to a different one of the intermediate rails of the long arches 1500*a* and 1500*b*, where the counter assemblies 1579*a* and 1579*b* extend in opposite directions. Configuration 1680 further includes third and fourth counter assemblies 1579*c* and 1579*d* that are mounted to opposite sides of intermediate height spacer rail 1645 so that the top surfaces of the countertop members included in assemblies 1579*c* and 1579*d* are at the same height as the top surfaces of the top members that are included in countertop assemblies 1579*a* and 1579*b*. In this manner a configuration is provided that provides worksurfaces for standing users. One case good 307 is shown mounted to the spacer rails 1642 and 1644. Thus, because the spacer rails have cross sections that are similar to the cross sections of the leg and arch rail members, any of the accessories described above can be mounted to any one of the spacer rails.

Figure 117:
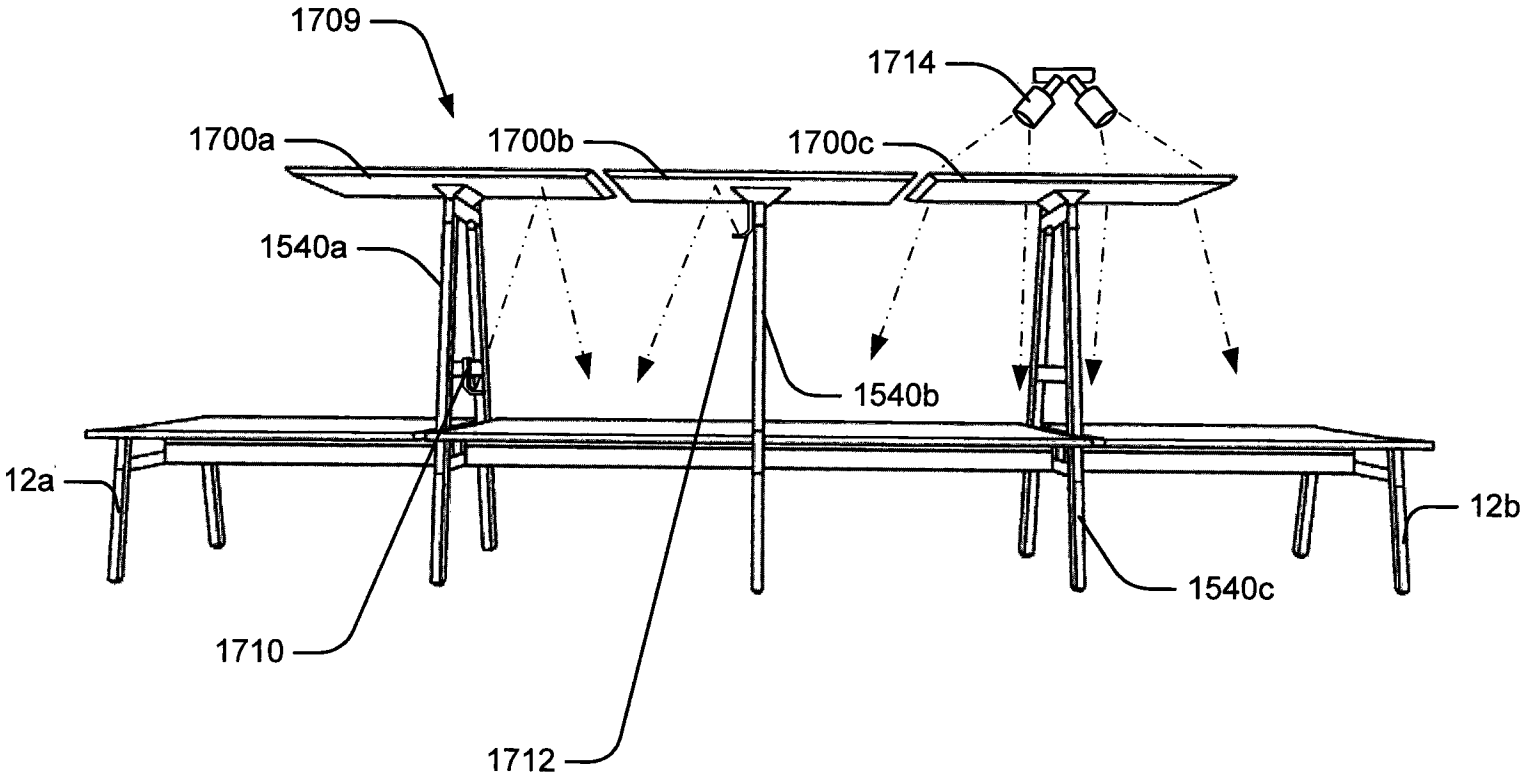
FIG. 117 is a perspective view showing another work station configuration that is consistent with at least some aspects of the present invention and that includes exemplary canopy assemblies.

Referring now to FIG. 117, another configuration 1709 is illustrated that includes three short length arches 1540*a*, 1540*b* and 1540*c*, two short leg assemblies 12*a* and 12*b*, and table and channel assemblies (not labeled) that space the leg and arch assemblies apart to form four single or double workstations, depending on the number (e.g., 1 or 2) of table assemblies mounted between adjacent arch and leg assemblies. In the illustrated embodiment, the arch assemblies are between the leg assemblies.

Configuration 1709 also includes overhead structure that can further enhance a feeling of space within an open environment and that can be used to provide additional functionality. To this end, the exemplary overhead structure shown in FIG. 117 includes three canopy subassemblies 1700*a*, 1700*b* and 1700*c* that are mounted to the top surfaces of arch assemblies 1540*a*, 1540*b* and 1540*c*. Each canopy extends to either side of the arch to which it is mounted and generally extends about half way to each adjacent arch in either direction. Each canopy has a length dimension that extends perpendicular to a supporting arch that is similar to (e.g., slightly smaller than) the length of one of the table top members that is included in one of the table assemblies therebelow. Thus, when two adjacent arches support two canopy assemblies, adjacent edges of the adjacent canopies are near each other (e.g., may form a 1-2 inch gap) so that an enclosed ceiling feeling results.

Figure 118:
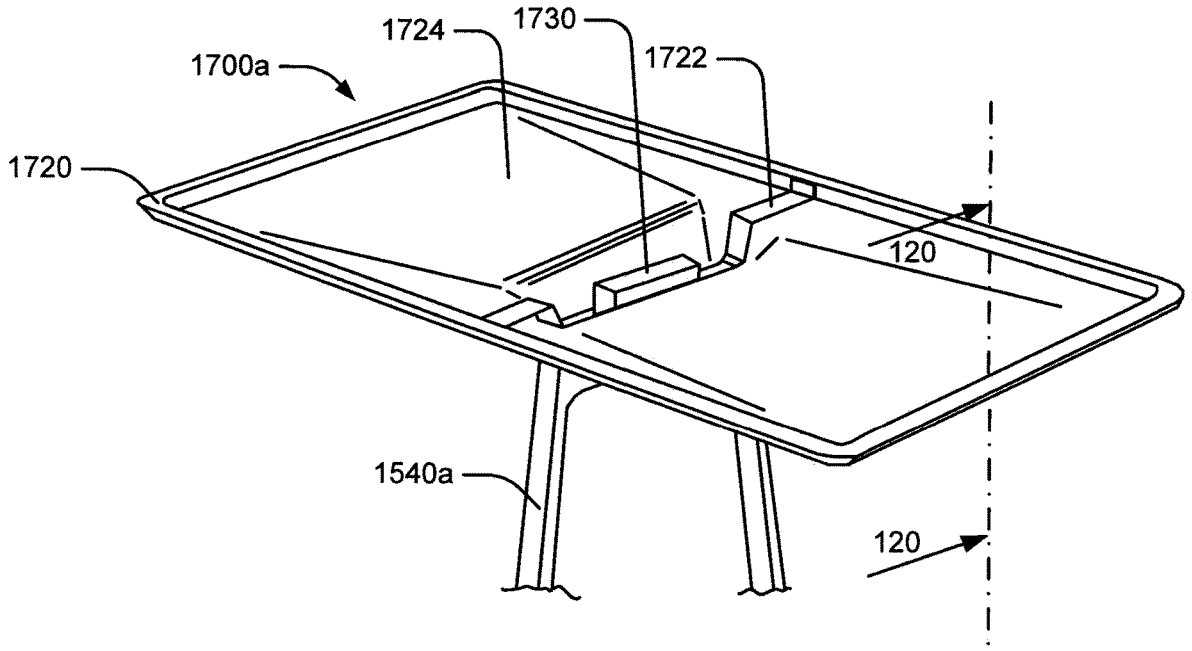
FIG. 118 is a perspective view showing one of the canopy assemblies of FIG. 117.
Figure 119:
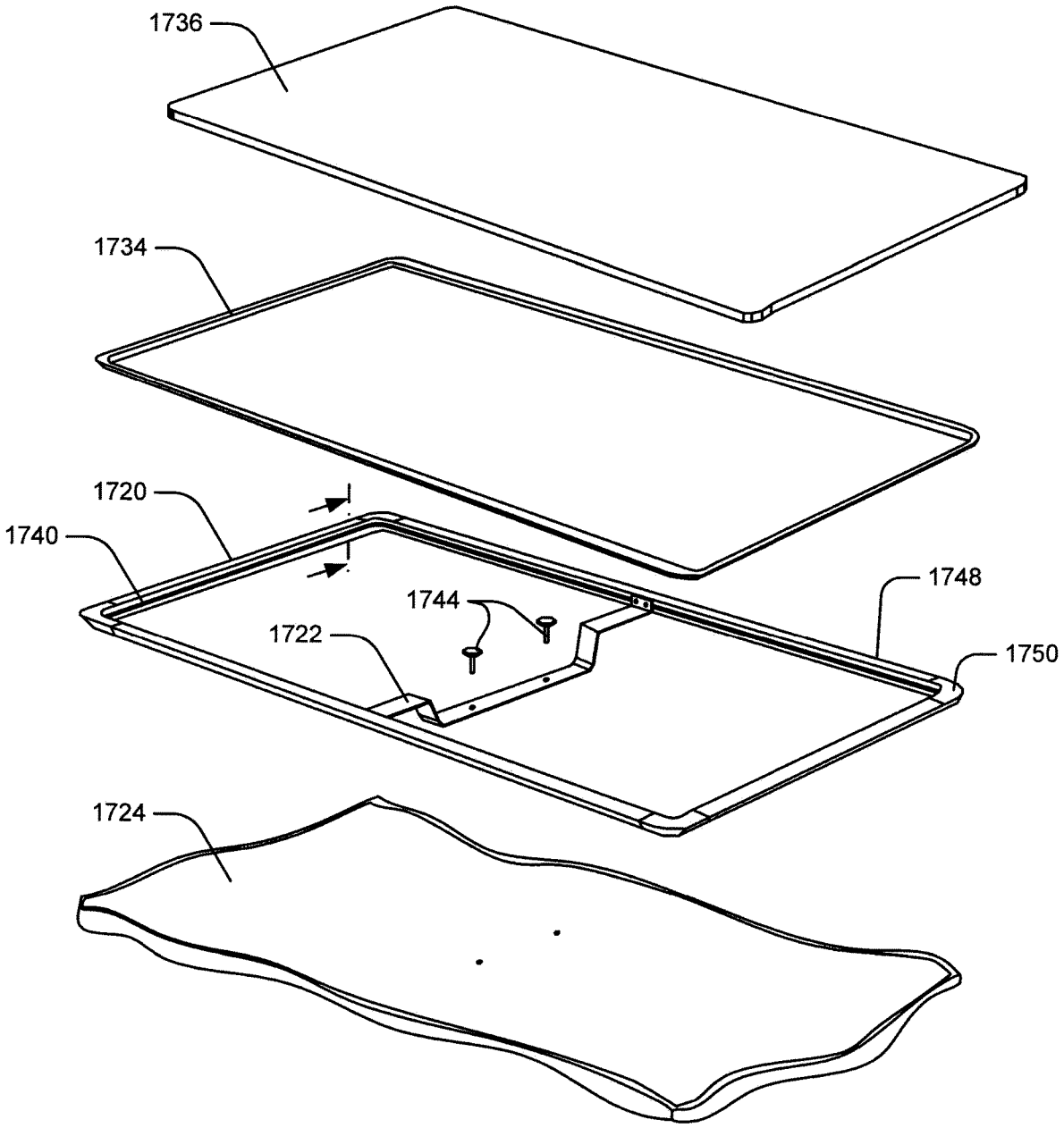
FIG. 119 is an exploded view of the canopy assembly shown in FIG. 118.

Referring also to FIGS. 118 and 119, exemplary canopy assembly 1700*a* includes a rigid and generally rectangular frame assembly 1720, a canopy cover member 1724, mechanical fasteners 1744 for fastening the assembly to the top end of one of the arches, and some features or characteristics that enable fastening of cover 1724 to frame 1720. In the illustrated embodiment, referring also to FIG. 120, frame assembly 1720 includes elongated members 1748 and four corner members 1750 formed of metal or plastic that form the rectangular shape. A central mounting member 1722 extends between central portions of the elongated members 1748 and bends downward at a central portion to form a generally flat mounting plate which in turn forms mounting holes (not labeled) for passing mechanical fasteners 1744. Edges of the frame are rounded or curved so that after cover 1724 is installed, the cover surface appears to be curved and generally smooth. Each elongated member 1748 forms a channel 1769 along its length (see again FIG. 120)

Cover 1724 is typically formed of a resilient fabric material which can deform when pulled over the frame 1720 so that the cover can conform to a shape when stretched over the frame. It the illustrated embodiment a resilient rubber gasket 1734 is provided which is formed to fit snugly within channel 1769 after an edge of the fabric cover 1724 is inserted into the channel 1769. To install cover 1724 on frame 1720, frame 1720 is placed on one side of the cover and lateral edges of the cover are pulled up and over the outer surfaces of the frame and are tucked into the channel 1769 where they are secured via insertion of the gasket 1734. During the stretching process, cover 1724 forms generally curved surfaces and the end product has an aesthetically appealing look. After cover 1724 is installed on a frame 1720, the subassembly can be mounted to a supporting arch by placing the subassembly with the bottom surface of plate 1723 facing a top surface of the arch and using fasteners 1744 to fasten the subassembly to the top of the arch (e.g., via threaded holes in the top rail of the arch assembly.

Referring again to FIG. 120, in the alternative, strips of J-hook material (e.g., plastic) 1900 may be sewn on to the edges of cover member 1724 and coupled to flanges 1902 formed by elongated members 1748 to stretch cover 1724 across structure 1720 and to secure cover 1724 to members 1748.

Referring again to FIG. 119, in some embodiments a sound deadening material 1736 such as a foam layer may be placed within the space form by canopy 1700*a* to reduce sound travel between adjacent workstations.

In addition to enhancing the sense of an enclosed space, canopies 1700*a*, 1700*b*, 1700*c*, etc., also provide an overhead space that can be used to locate audio equipment such as microphones and speakers. To this end, see component 1730 in FIG. 118 that is mounted to a top surface of member 1723 in the space defined by the stretched top surface of cover member 1724. In at least some embodiments component 1730 may include audio equipment for generating sound for various purposes (e.g., music, videoconferencing sound, etc.).

Figure 121:
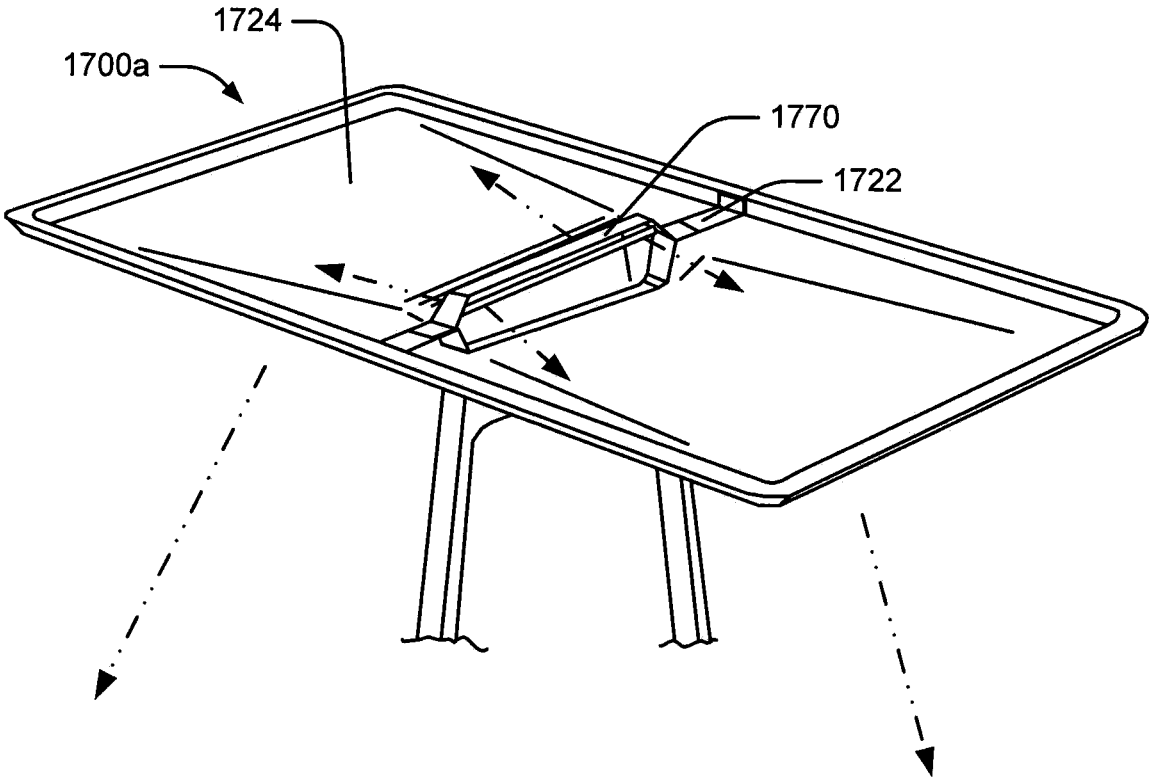

Referring to FIG. 121, in some cases a lighting device 1770 may be mounted to member 1722 that directs light down on to the top surface of cover 1724. Device 1770 may include components such as a string of LEDs or fluorescent lighting to cause the fabric of the cover to appear to glow from an underside thereof. In this case, the fabric cover may be formed of a material that is semitransparent or that is only somewhat opaque, depending on the effect sought by a designer. In some cases cover 1724 is formed of an elastomeric white material (e.g., stretch fabric) which tends to glow when viewed from a lower vantage point when light is shined on the top surface. In some embodiments the fabric used to form the cover 1724 may be a fabric that can glow when powered so that a completely uniform lighting surface (e.g., an emissive surface) on the undersurface of cover 1724 results.

In still other embodiments light may be shone onto either the top or the undersurface of cover 1724 using lighting devices located outside the space defined by the canopy assembly. For instance, referring again to FIG. 117, area lights 1714 above canopy assembly 1700*c* are shown shining light onto the top surface of assembly 1700*c* to cause the cover material to glow from below and to light the space adjacent two workstation areas. As another instance, a small light 1712 is shown mounted to the top rail of arch assembly 1540*b* where the small light directs light upward at an undersurface of the cover and the light is reflected at least in part off the undersurface and back into a workspace area. As still one other instance, a small light device 1710 is shown mounted to the intermediate height rail of arch assembly 1540*a* where the light device shines light up on the undersurface of an adjacent canopy cover. Each of the light devices 1710 and 1712 may be mounted via a lip member akin to lip member 1671 (see again FIG. 114) to one of the slots formed by any of the arch rails described above. Other lighting configurations and features are contemplated for generating light in conjunction with a canopy assembly.

While generally rectangular canopies are shown in FIGS. 117-119 and 121, other shapes are contemplated such as, for instance, round, square, rhomboids, parallelograms, etc.

Figure 129:
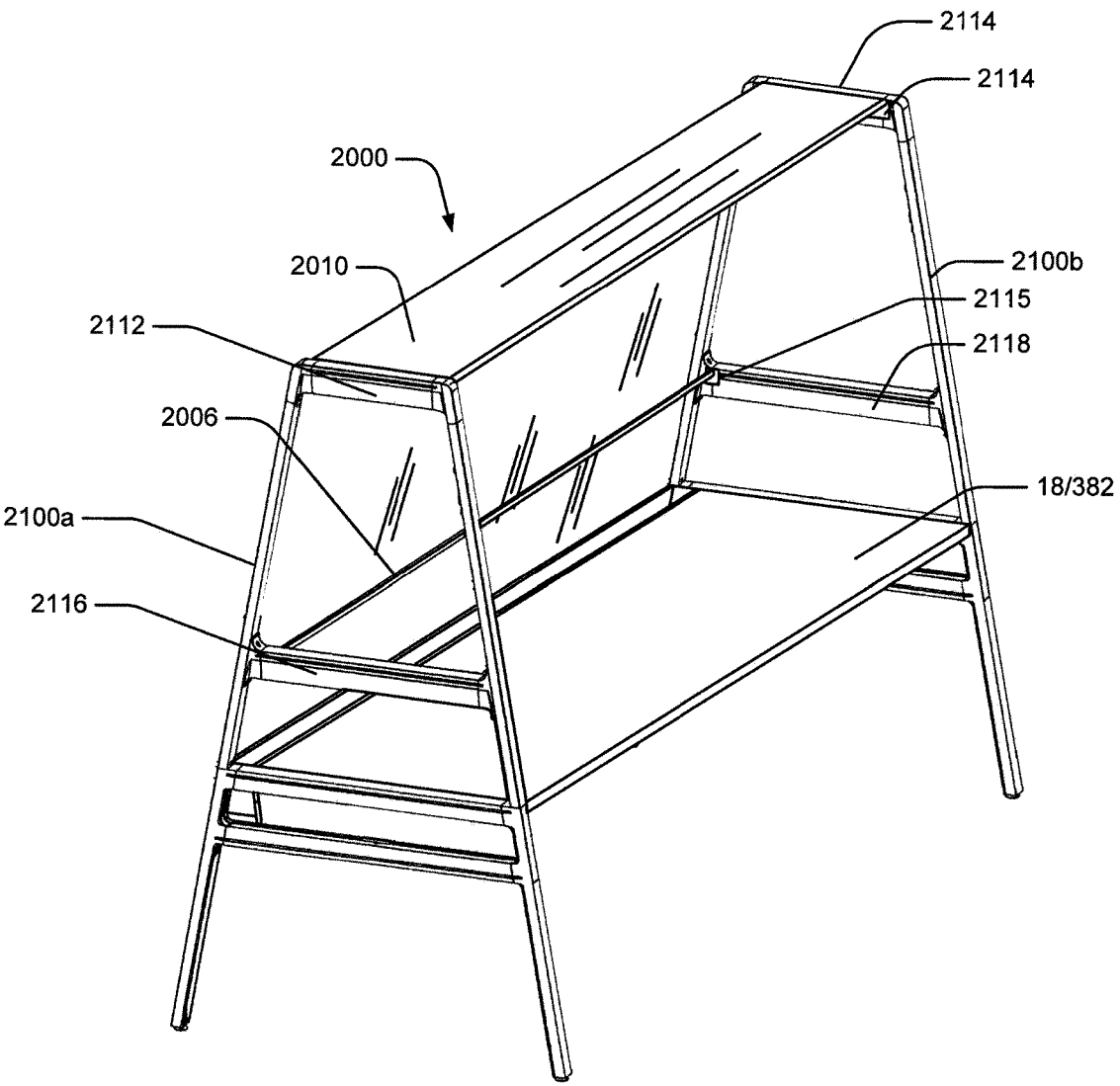
Figure 130:
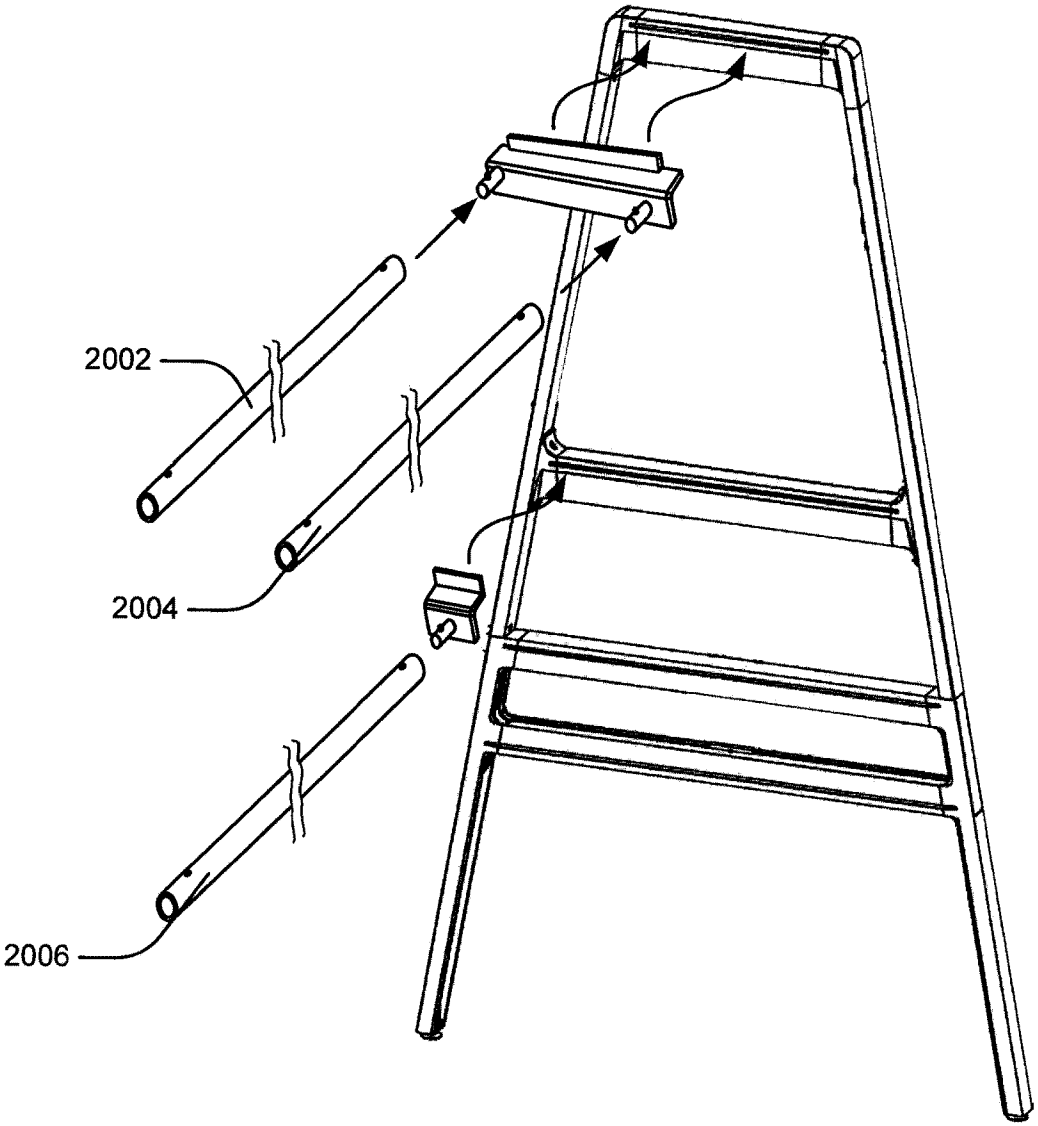

Referring now to FIG. 129, one additional accessory includes an arch shade assembly 2000 that may be mounted between two arch assemblies 2100*a* and 2100*b* on opposite sides of a channel/table subassembly 18/382 to afford additional privacy to a workstation user. Referring also to FIG. 130, exemplary shade assembly 2000 includes three rigid elongated tubes 2002, 2004 and 2006 that mount to rails of spaced apart arch assemblies 2100*a* and 2100*b* as well as a fabric shade member 2010. A pair of dual tube brackets 2014 are provided for mounting tubes 2002 and 2004 between the top rails 2112 and 2114 of assemblies 2100*a* and 2100*b* and a pair of single tube brackets 2015 are provided to mount tube 2006 between intermediate arch rails 2116 and 2118.

Figure 131:
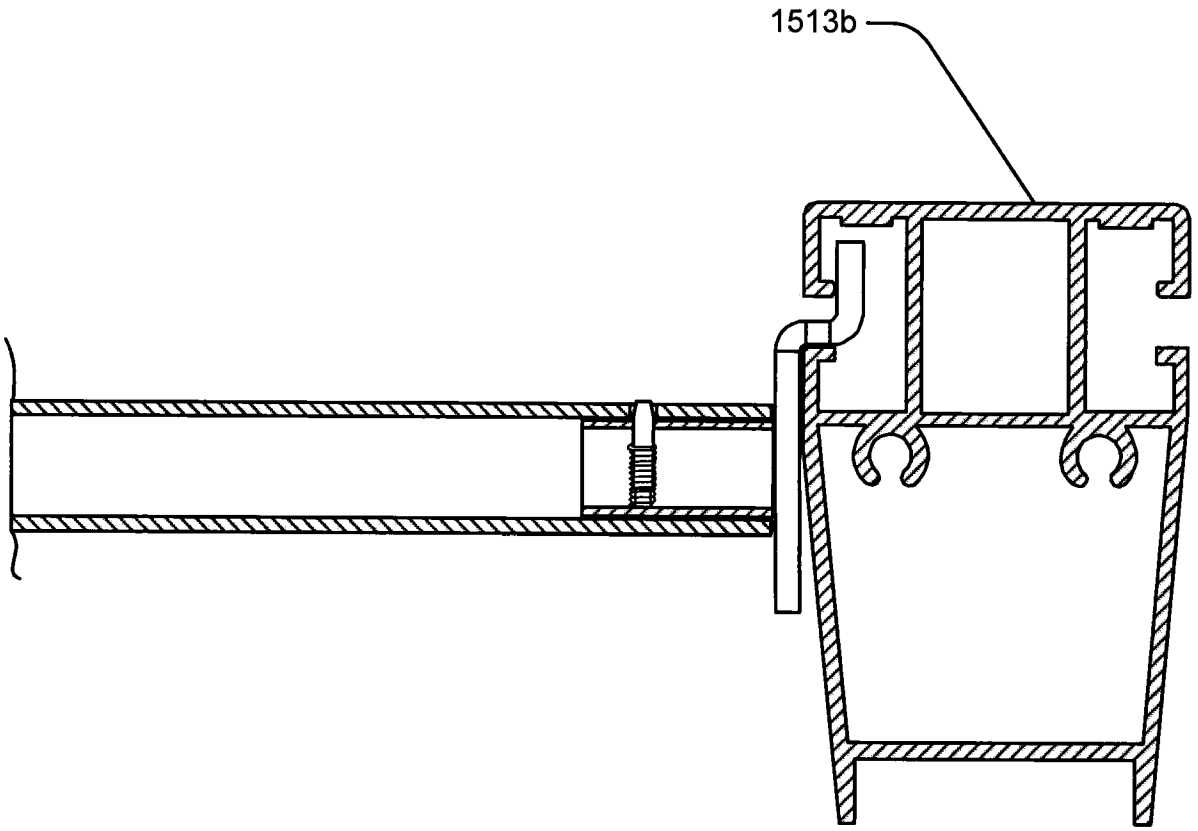

Referring to FIGS. 130 and 131, each bracket 2014 includes an upwardly extending lip 2020 that is receivable in rail slot 2022 and has a length dimension similar to the length of the slot 2022. Each bracket 2014 forms two mounting posts 2024 and 2025 that extend in the same direction adjacent opposite ends of bracket 2014. A spring loaded pin 2026 is mounted to each post and has a distal end that extends perpendicular to the post length. Each tube 2002 and 2004 is an elongated rigid tube that forms pin receiving holes 2030 adjacent each end. To mount tubes 2002 and 2004 to rail 2114, lip 2020 is placed within slot 2022 and tubes 2002 and 2004 are slid on to posts 2024 and 2026, respectively, until pins 2026 are received in holes 2030.

Referring to FIG. 130, each single tube bracket 2015 has a construction similar to the construction of bracket 2014 except that the bracket length is shorter and the bracket 2015 only includes a single post and pin subassembly. In use, brackets 2015 are mounted at rear ends of intermediate rails 2116 and 2118.

Figure 120:
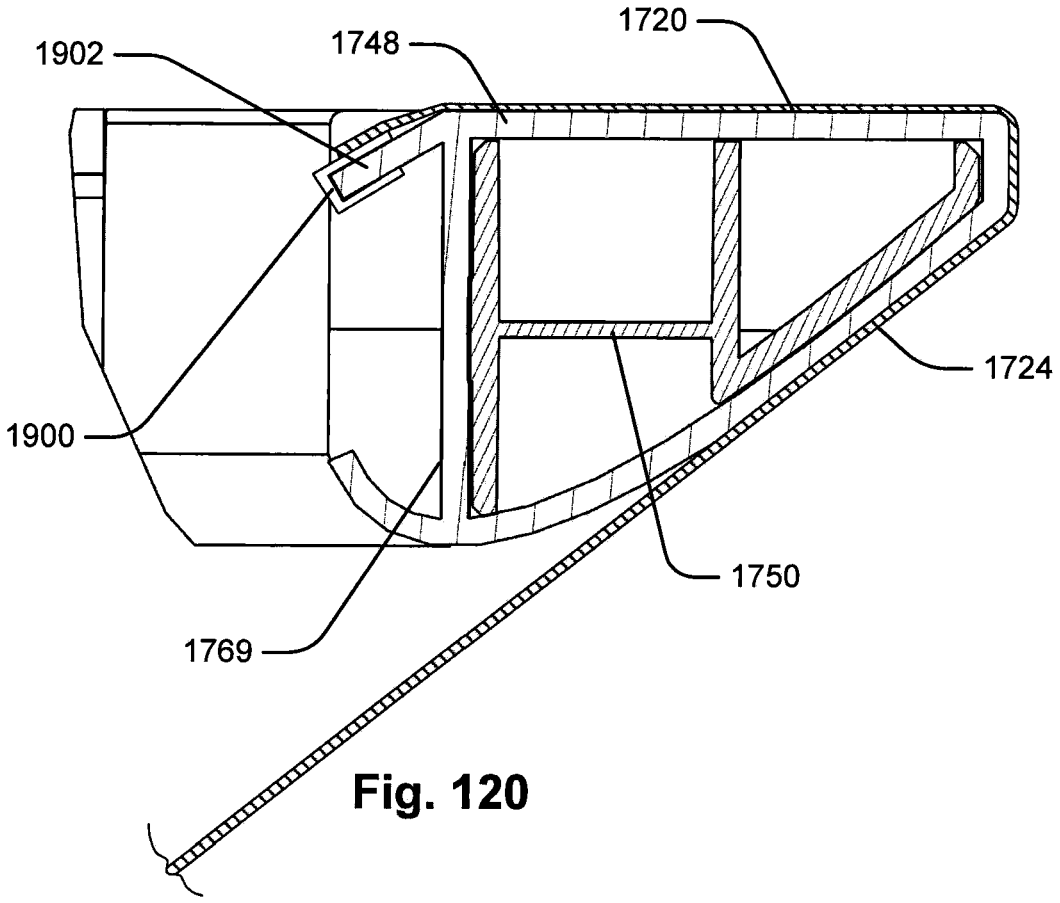
FIG. 120 is a cross-sectional view taken along the line 120-120 in FIG. 118.

Shade member 2010 is a fabric member that has a front edge secured to tube 2004, a rear edge that may be connected to channel forming member 18 (e.g., via a sewn on J-hook strip akin to strip 1900 shown in FIG. 120) and intermediate portions adjacent and supported by tubes 2002 and 2006. The fabric used to form member 2010 may be opaque or, in some cases, translucent or partially transparent. The front edge of cover 2010 may be sewn in a loop and tube 2004 may pass through the loop prior to attachment to the brackets 2014. In the alternative fasteners such as ties, Velcro® connectors, snaps, etc., may be secured to the cover edge for connection.

In at least some embodiments it is contemplated that tube 2004 may be replaced by a roll screen akin to the types of screens used to cover windows so that the cover 2010 may be optionally retracted when less privacy is required.

Thus, the invention is to cover all modifications, equivalents, and alternatives falling within the spirit and scope of the invention as defined by the following appended claims. For example, while only a small subset of the assembly accessories are shown in embodiments in FIGS. 98 through 131, any of the accessories may be used with any of the embodiments. For instance, the lounge inserts described above may be substituted for the table assemblies to configure other useful embodiments.

To apprise the public of the scope of this invention, the following claims are made:

What is claimed is:

1. A table assembly comprising:

first and second leg members that form first and second facing surfaces, respectively, a frame space located between the facing surfaces of the leg members, each leg member forming a leg member top surface;

an elongated channel member connected at opposite ends to the first and second facing surfaces and located within the frame space, the channel member forming a wire management channel along its length and a channel support surface along a first edge of the wire management channel;

a table top member forming a table top surface and supported by the leg members wherein the table top member is located substantially within the frame space and the table top surface is substantially flush with the leg member top surfaces, the table top member including a rear edge and the channel member is located rearward of the table top and is at least in part at the same height as the rear edge of the table top, and wherein the table top member has an undersurface, and a portion of the undersurface adjacent the rear edge is supported by the channel support surface.

2. The assembly of claim 1, further comprising a trough member, the trough member extending between the facing surfaces of the leg members and including a rear edge that is supported by the channel support surface, the trough member forming a front edge that forms a trough support surface, and a portion of the undersurface adjacent the rear edge is supported by the trough support surface.

3. The assembly of claim 2 wherein the trough member and the table top member are both supported by at least one support member support surface.

4. The assembly of claim 1 wherein the channel member is mounted to the leg members for substantially horizontal sliding motion along the facing surfaces of the leg members.

5. The assembly of claim 1 wherein the channel comprises an elongated rigid housing member and at least one clamping coupler assembly.

6. The assembly of claim 1 wherein the channel comprises at least one receptacle.

7. A table assembly comprising:

first and second legs forming first and second substantially horizontal elongated surfaces, respectively, and each leg member forming a leg member top surface;

a support rail comprising an elongate rigid housing member forming a support surface and extending between first and second ends, the first and second ends of the rail supported by the first and second horizontal elongated surfaces, respectively, for sliding movement between first and second different locations along each of the first and second elongated surfaces, the support rail forming a wire management channel including a power receptacle in the wire management channel, the support surface being formed along a first edge of the wire management channel; and a table top supported by the support surface between the first and second legs and positionable with the support rail at several positions adjacent the legs and wherein a top surface of the table top is substantially flush with the leg member top surfaces and wherein the table top includes a rear edge that is supported by the support surface so that the channel is located rearward of the table top.

8. The assembly of claim 7 wherein the support rail comprises an elongate rigid housing member.

9. The assembly of claim 7 wherein the wire management channel includes at least one clamping coupler assembly.

10. The assembly of claim 7 further including first and second couplers located at the first and second ends of the wire management channel for releasably securing the wire management channel at different positions along the first elongated surfaces.

11. The assembly of claim 7 wherein each first surface forms a leg lip and wherein the wire management channel includes a stationary finger member at each end that mate with the leg lips to support the wire management channel between the legs for sliding motion along the leg lips.

12. The assembly of claim 7 wherein each of the first and second elongated surfaces is an upper elongated surface and each leg member further includes a second lower elongated surface that is spaced vertically below and substantially parallel to the upper elongated surface.

13. The assembly of claim 7 wherein each upper elongated surface forms an upper leg lip, each second elongated surface forms a lower leg lip, the wire management channel including first and second couplers at first and second ends, respectively, each coupler includes a stationary finger member and a moveable finger member that engage the lower and upper leg lips on an adjacent leg member, respectively, to secure the channel member to the leg members.

14. The assembly of claim 13 wherein the upper and lower leg lips on the first leg extend toward each other and wherein the upper and lower leg lips on the second leg extend toward each other.

15. The assembly of claim 12 wherein the wire management channel forms first and second channel openings at the first and second ends and the first and second channel openings are aligned with the space between the upper and lower elongated surfaces of the first and second legs.

16. The assembly of claim 7 wherein the first and second legs include facing surfaces and wherein the rail and the table top are located between the facing surfaces of the first and second legs.

17. A table assembly comprising:

first and second legs forming first and second substantially horizontal elongated surfaces, respectively, and each leg member forming a leg member top surface;

a support rail forming a support surface and extending between first and second ends, the first and second ends of the rail supported by the first and second horizontal elongated surfaces, respectively, for sliding movement between first and second different locations along each of the first and second elongated surfaces, the support rail forming a wire management channel including a power receptacle in the wire management channel; and a table top supported by the support surface between the first and second legs and positionable with the support rail at several positions adjacent the legs and wherein a top surface of the table top is substantially flush with the leg member top surfaces, wherein the support surface is formed along a first side of the wire management channel and wherein the rail forms a second support surface along a second side of the wire management channel, the table top being a first table top, the assembly further including a second table top supported by the second support surface.

18. The assembly of claim 17 wherein the wire management channel includes at least one clamping coupler assembly.

19. The assembly of claim 17 further including first and second couplers located at the first and second ends of the wire management channel for releasably securing the wire management channel at different positions along the first elongated surfaces.

20. The assembly of claim 17 wherein each first surface forms a leg lip and wherein the wire management channel includes a stationary finger member at each end that mate with the leg lips to support the wire management channel between the legs for sliding motion along the leg lips.

* * * * *